US010086375B2

(12) United States Patent
Hwang

(10) Patent No.: US 10,086,375 B2
(45) **Date of Patent: *Oct. 2, 2018**

(54) TWO-STAGE THERMAL CONVECTION APPARATUS AND USES THEREOF

(71) Applicant: Ahram Biosystems, Inc., Seoul (KR)

(72) Inventor: Hyun Jin Hwang, Seoul (KR)

(73) Assignee: Ahram Biosystems, Inc. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/398,618

(22) Filed: Jan. 4, 2017

(65) Prior Publication Data

US 2017/0239662 A1 Aug. 24, 2017

Related U.S. Application Data

(63) Continuation of application No. 13/539,765, filed on Jul. 2, 2012, now Pat. No. 9,573,133, which is a (Continued)

(51) Int. Cl.

| | |
|---|---|
| ***B01L 3/00*** | (2006.01) |
| ***B01L 7/00*** | (2006.01) |
| ***B01L 99/00*** | (2010.01) |

(52) U.S. Cl.

CPC ..... *B01L 7/52* (2013.01); *B01L 3/50825* (2013.01); *B01L 2200/142* (2013.01); (Continued)

(58) Field of Classification Search

CPC ..... B01L 2200/142; B01L 2200/147; B01L 2300/042; B01L 2300/0861; (Continued)

(56) References Cited

U.S. PATENT DOCUMENTS 4,683,202 A 7/1987 Mullis
5,270,183 A 12/1993 Corbett et al.
(Continued)

FOREIGN PATENT DOCUMENTS

CN 1430701 4/2004
CN 1571849 1/2005
(Continued)

OTHER PUBLICATIONS

Kopp et al., "Chemical Amplification: Continuous-Flow PCR on a Chip," Science 280:1046-1048 (1998).
(Continued)

*Primary Examiner* — Nathan A Bowers
*Assistant Examiner* — Lydia Edwards
(74) *Attorney, Agent, or Firm* — JHK Law; Joseph Hyosuk Kim; Robert L. Buchanan

(57) ABSTRACT

Disclosed is a multi-stage thermal convection apparatus such as a two-stage thermal convection apparatus and uses thereof. In one embodiment, the two-stage thermal convection apparatus includes a temperature shaping element that assists a thermal convection mediated Polymerase Chain Reaction (PCR). The invention has a wide variety of applications including amplifying nucleic acid without cumbersome and expensive hardware associated with many prior devices. In a typical embodiment, the apparatus can fit in the palm of a user's hand for use as a portable, simple to operate, and low cost PCR amplification device.

24 Claims, 79 Drawing Sheets

Specification includes a Sequence Listing.

Related U.S. Application Data continuation-in-part of application No. PCT/IB2011/050104, filed on Jan. 11, 2011.

(60) Provisional application No. 61/294,446, filed on Jan. 12, 2010.

(52) U.S. Cl.
CPC ... *B01L 2200/147* (2013.01); *B01L 2300/042* (2013.01); *B01L 2300/0654* (2013.01); *B01L 2300/0861* (2013.01); *B01L 2300/1805* (2013.01); *B01L 2300/1822* (2013.01); *B01L 2300/1838* (2013.01); *B01L 2300/1883* (2013.01); *B01L 2400/0409* (2013.01)

(58) Field of Classification Search
CPC ..... B01L 2300/1805; B01L 2300/1822; B01L 2300/1844; B01L 2300/1883; B01L 3/50825; B01L 7/52
See application file for complete search history.

(56) References Cited

U.S. PATENT DOCUMENTS

| | | | |
|---|---|---|---|
| 5,455,175 | A | 10/1995 | Wittwer et al. |
| 5,589,136 | A | 12/1996 | Northrup et al. |
| 5,720,923 | A | 2/1998 | Haff et al. |
| 5,761,377 | A | 6/1998 | Wolfe et al. |
| 5,786,182 | A | 7/1998 | Catanzariti et al. |
| 5,919,622 | A | 7/1999 | Macho et al. |
| 5,985,651 | A | 11/1999 | Hunicke-Smith |
| 6,132,996 | A | 10/2000 | Hunicke-Smith |
| 6,168,948 | B1 | 1/2001 | Anderson et al. |
| 6,472,186 | B1 | 10/2002 | Quintanar et al. |
| 6,586,233 | B2 | 7/2003 | Benett et al. |
| 6,734,401 | B2 | 5/2004 | Bedingham et al. |
| 6,787,338 | B2 | 9/2004 | Wittwer et al. |
| 7,238,321 | B2 | 7/2007 | Wittwer et al. |
| 7,488,595 | B2 | 2/2009 | Hwang et al. |
| 7,628,961 | B2 | 12/2009 | Hwang et al. |
| 8,053,215 | B2 | 11/2011 | Hwang et al. |
| 9,346,055 | B2 | 5/2016 | Hwang et al. |
| 9,573,133 | B2 * | 2/2017 | Hwang ..... B01L 7/52 |
| 9,573,134 | B2 | 2/2017 | Hwang |
| 2002/0127152 | A1 | 9/2002 | Benett et al. |
| 2003/0160114 | A1 | 8/2003 | Caley et al. |
| 2004/0058395 | A1 | 3/2004 | Hara |
| 2004/0152122 | A1 | 8/2004 | Hwang et al. |
| 2004/0179974 | A1 | 9/2004 | Bedingham et al. |
| 2004/0209331 | A1 | 10/2004 | Kirk |
| 2005/0032198 | A1 | 2/2005 | Wittwer et al. |
| 2005/0074782 | A1 | 4/2005 | Krishnan et al. |
| 2006/0269641 | A1 | 11/2006 | Atwood |
| 2007/0202531 | A1 | 8/2007 | Grover |
| 2008/0038813 | A1 | 2/2008 | Chen |
| 2008/0038818 | A1 | 2/2008 | Natan |
| 2008/0131956 | A1 | 6/2008 | Chung |
| 2009/0203084 | A1 | 8/2009 | Chen et al. |
| 2010/0086975 | A1 | 4/2010 | Hwang et al. |
| 2011/0008881 | A1 | 1/2011 | Corbett |
| 2012/0021463 | A1 | 1/2012 | Hwang et al. |

FOREIGN PATENT DOCUMENTS

| | | |
|---|---|---|
| CN | 2767454 | 3/2006 |
| CN | 1995319 | 7/2007 |
| EP | 504435 | 9/1992 |
| EP | 0997530 | 6/1998 |
| EP | 2 095 877 A1 | 9/2009 |
| JP | 07287019 | 10/1995 |
| JP | 09094086 | 4/1997 |
| JP | 11509136 | 8/1999 |
| WO | WO 9700726 | 1/1997 |
| WO | WO 9748818 | 12/1997 |
| WO | WO 9825701 | 6/1998 |
| WO | WO 9900506 | 1/1999 |
| WO | WO 0058013 | 10/2000 |
| WO | WO 0131038 | 5/2001 |
| WO | WO 2002057798 | 7/2002 |
| WO | WO 02072267 | 9/2002 |

OTHER PUBLICATIONS

Krishnan, M., et al., "PCR in a Rayleigh-Renard Convection Cell," Science, 298:798, 2002.
Braun, D., et al., "Exponential DNA Replication by Laminar Convection," Physical Review Letters, 91 (15):158103-1-158103-4, 2003.
Braun, D., "PCR by Thermal Convection," Modern Physics Letters B, 18(16):775-784, 2004.
Wheeler, E.K., et al., "Convectively Driven Polymerase Chain Reaction Thermal Cycler," Analytical Chemistry, 76 (14):4011-4016, 2004.
Hennig, M., and Braun, D., "Convective polymerase chain reaction around micro immersion heater," Applied Physics Letters, 87:183901-1-183901-3, 2005.
Nakano et al., "High Speed Polymerase Chain Reaction in Constant Flow," Biosci. Biotech. Biochem., 58(2): pp. 349-352, 1994.
Daniel et al., "Silicon microchambers for DNA amplification," Sensors and Actuators, A. Physical, 71, pp. 81-88, 1998.
Chen, Zongyuan et al., "Thermosiphon-Based PCR Reactor: Experiment and Modeling", Anal. Chem., 2004, vol. 76, pp. 3707-3715.
European Search Report for European Patent Application No. 11732725.4-1371/2524026 for "Three-Stage Thermal Convection Apparatus and Uses Thereof," dated Sep. 18, 2017.
European Search Report for European Patent Application No. 11732726.2-1371/2524027 for "Two-Stage Thermal Convection Apparatus and Uses Thereof," dated Sep. 21, 2017.

* cited by examiner

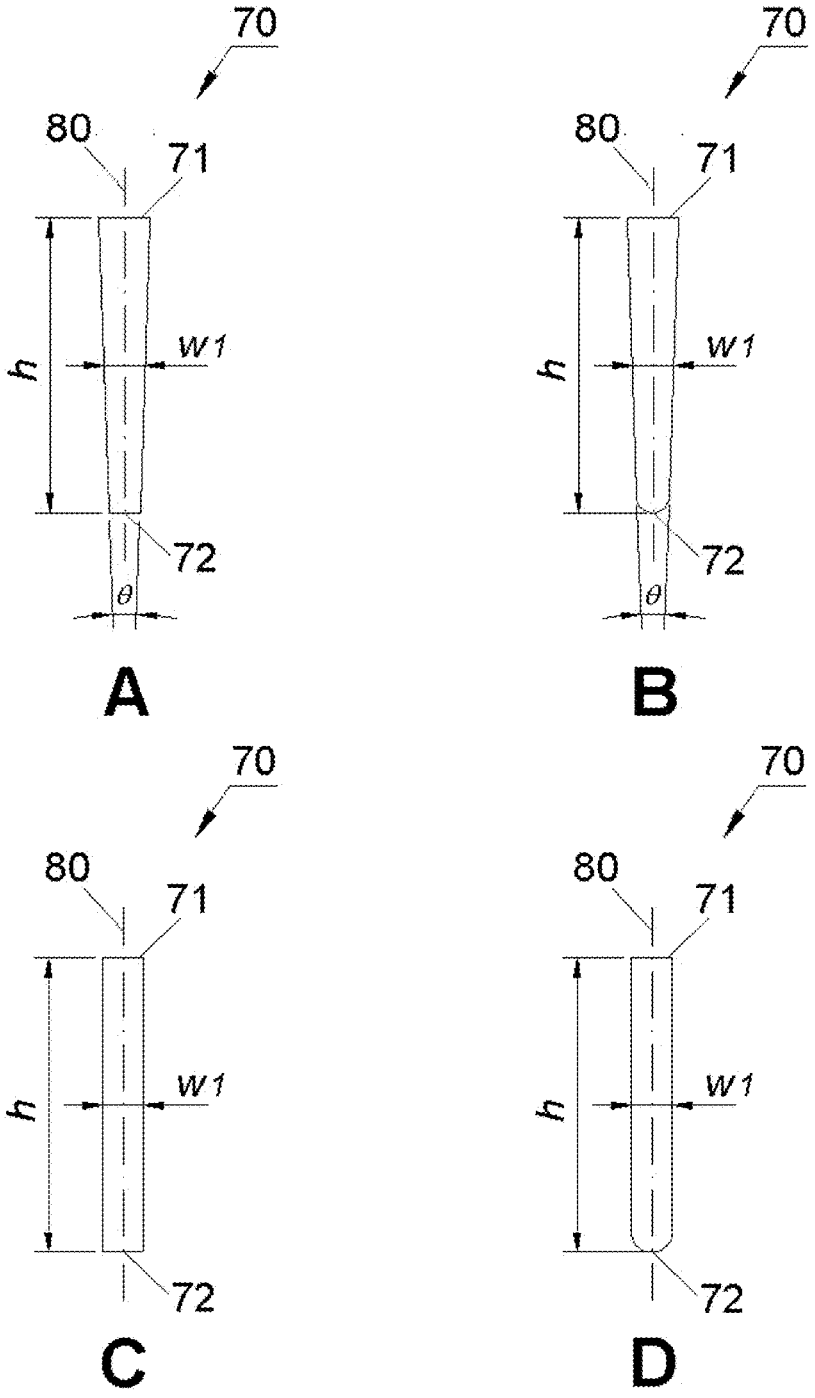
FIG. 7A-D

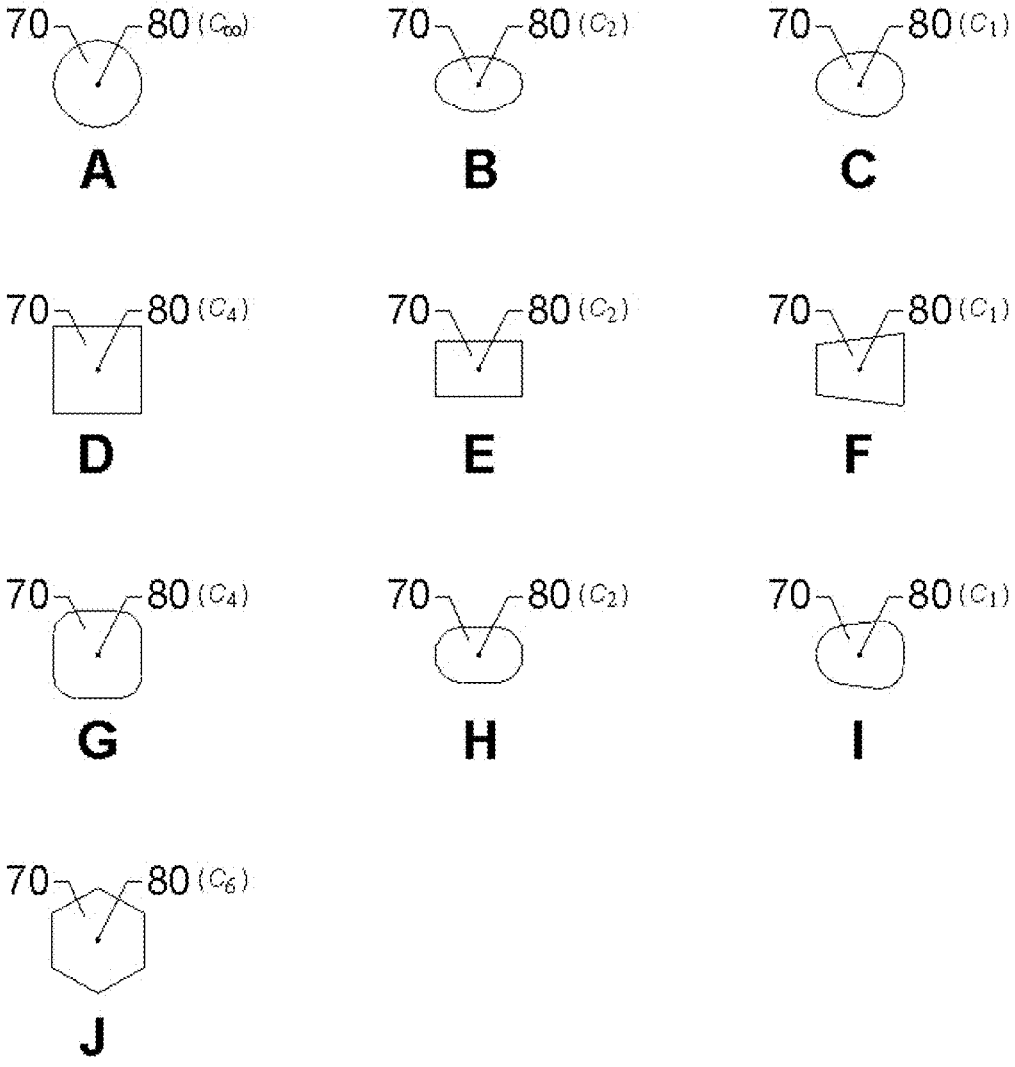
FIG. 8A-J

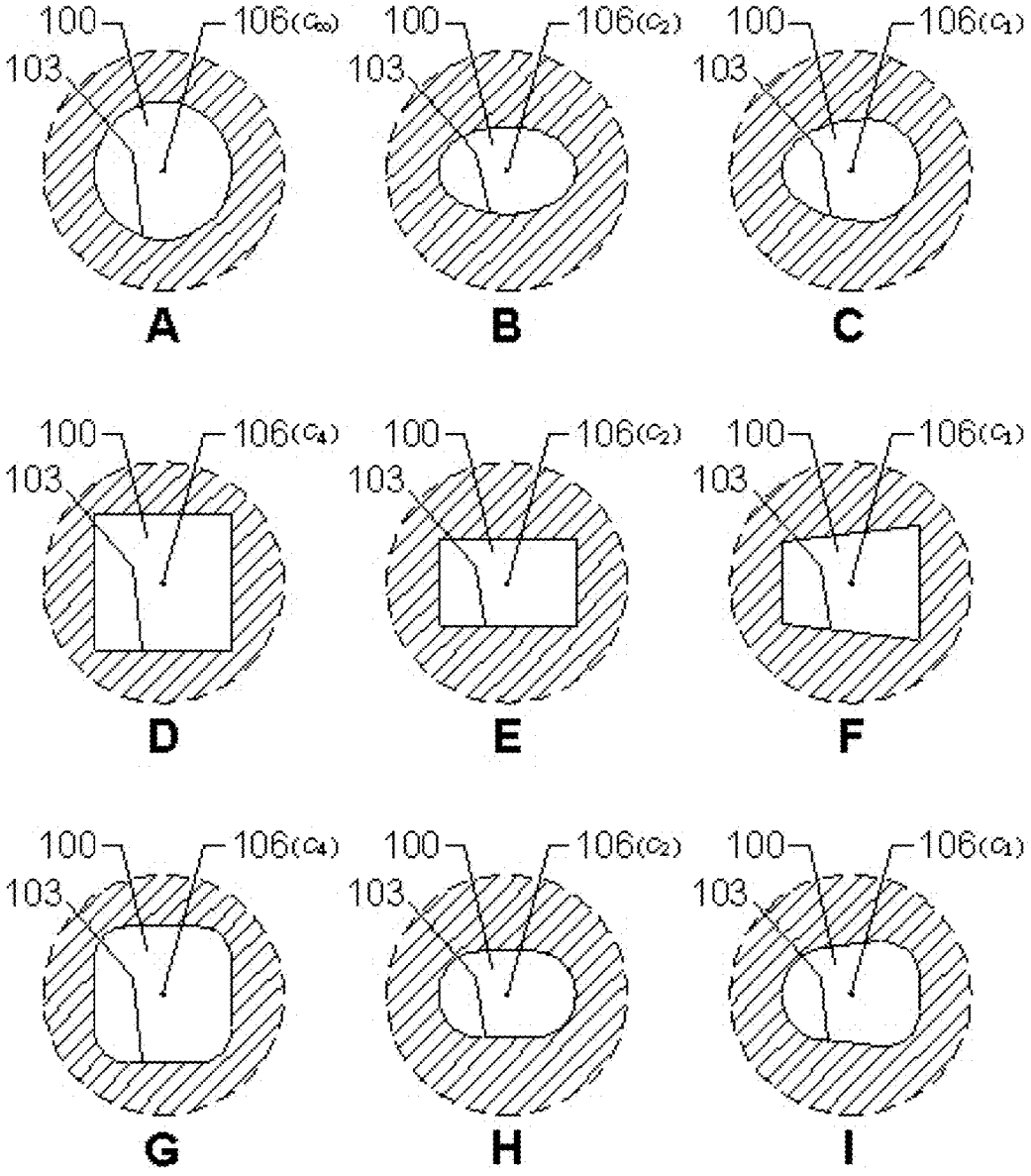
FIG. 9A-I

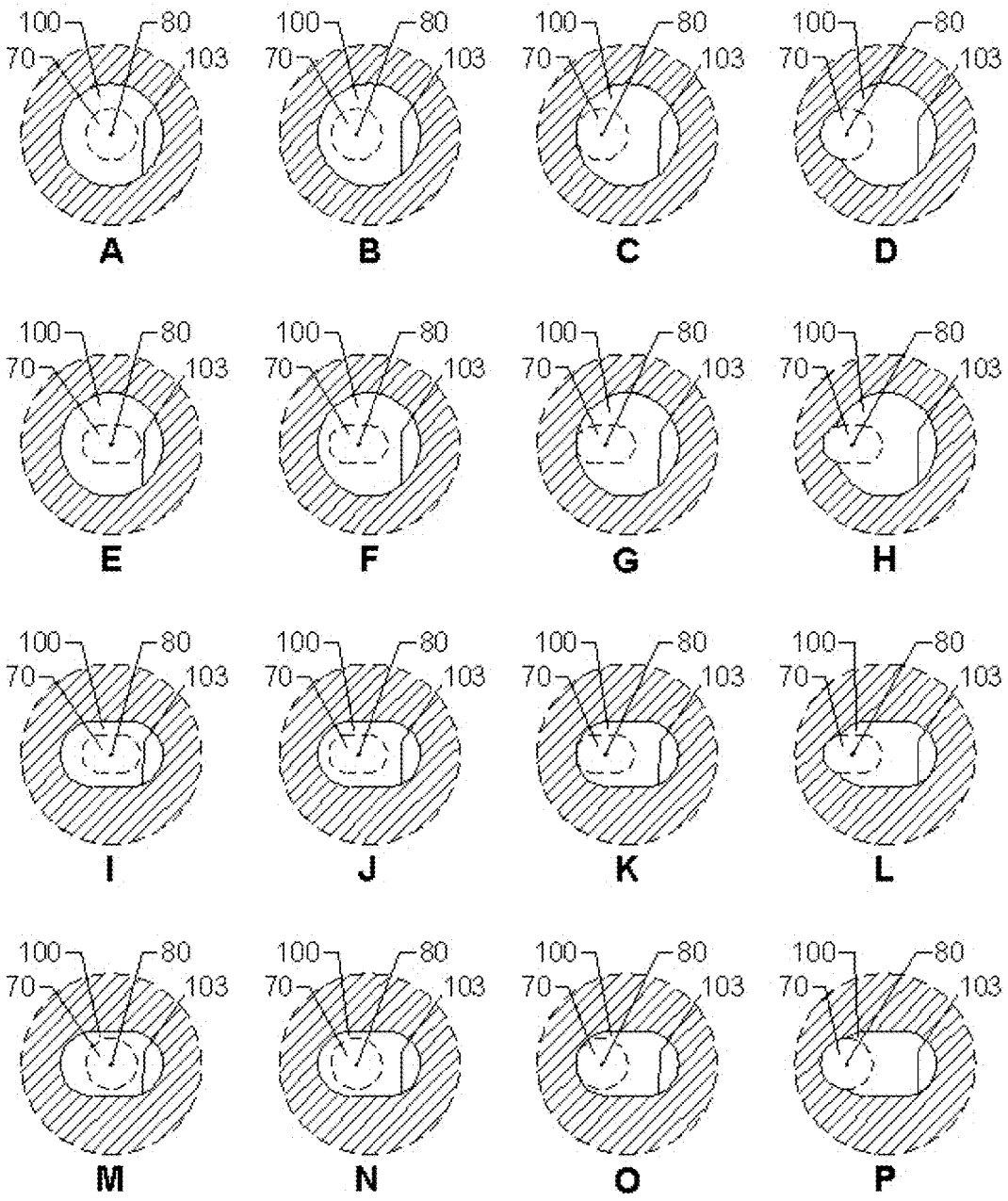
FIG. 10A-P

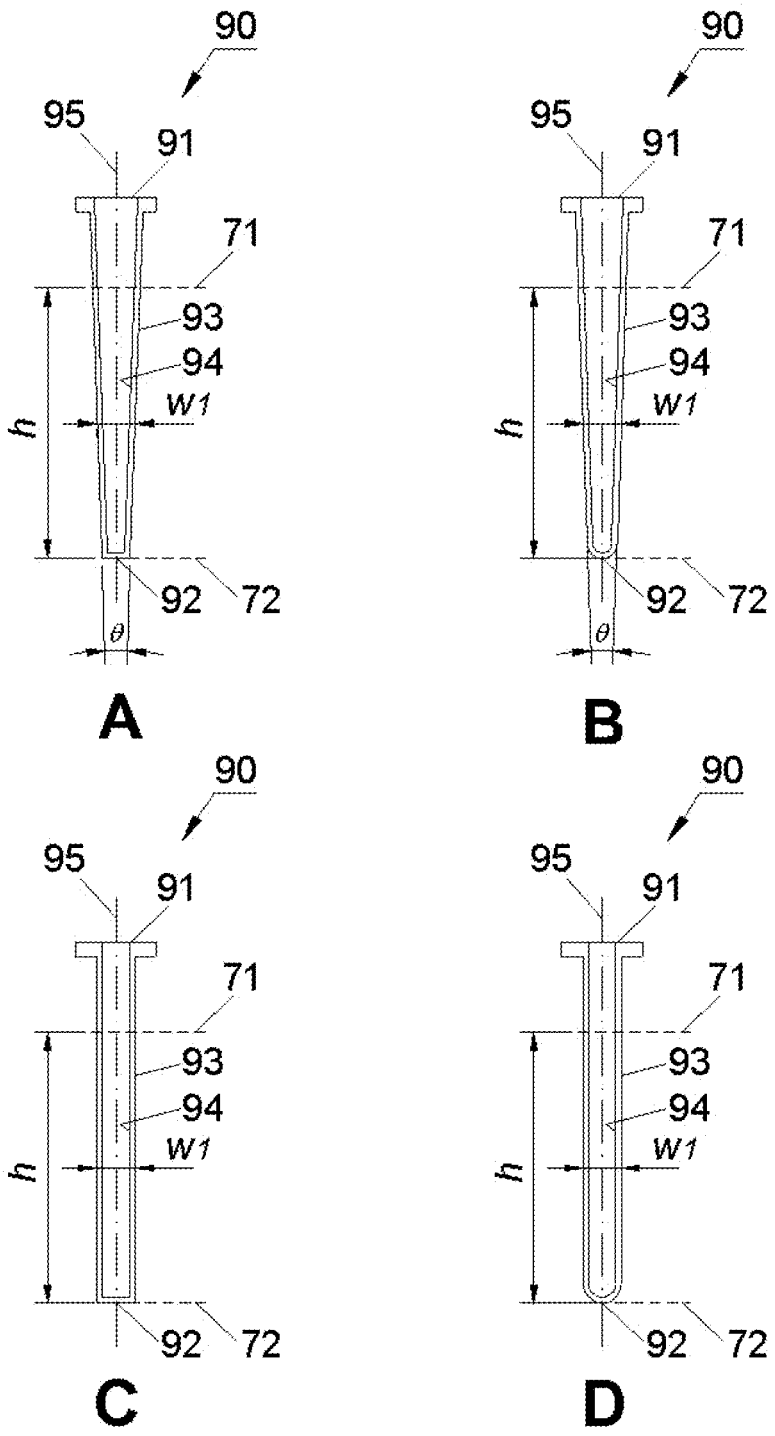
FIG. 40A-D

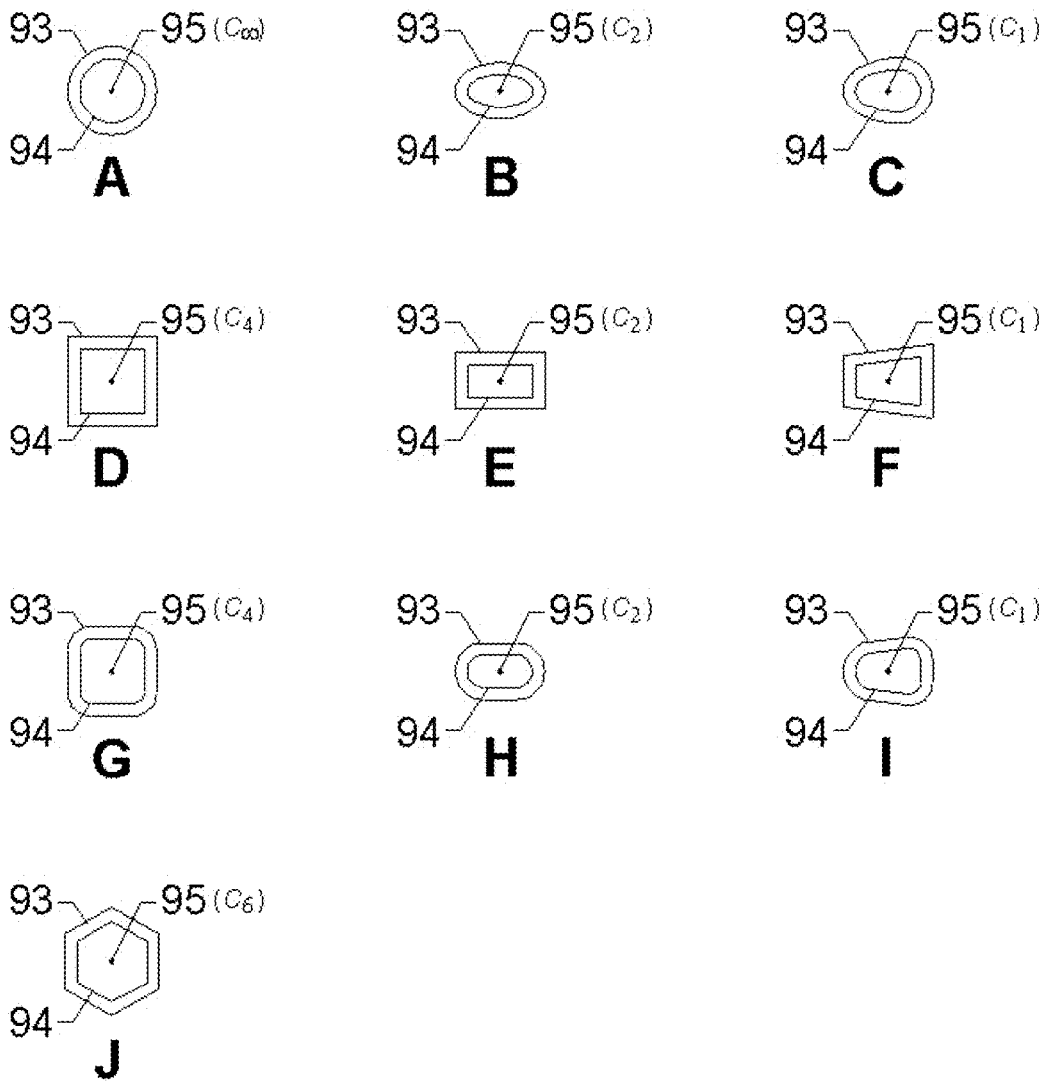
FIG. 41A-J

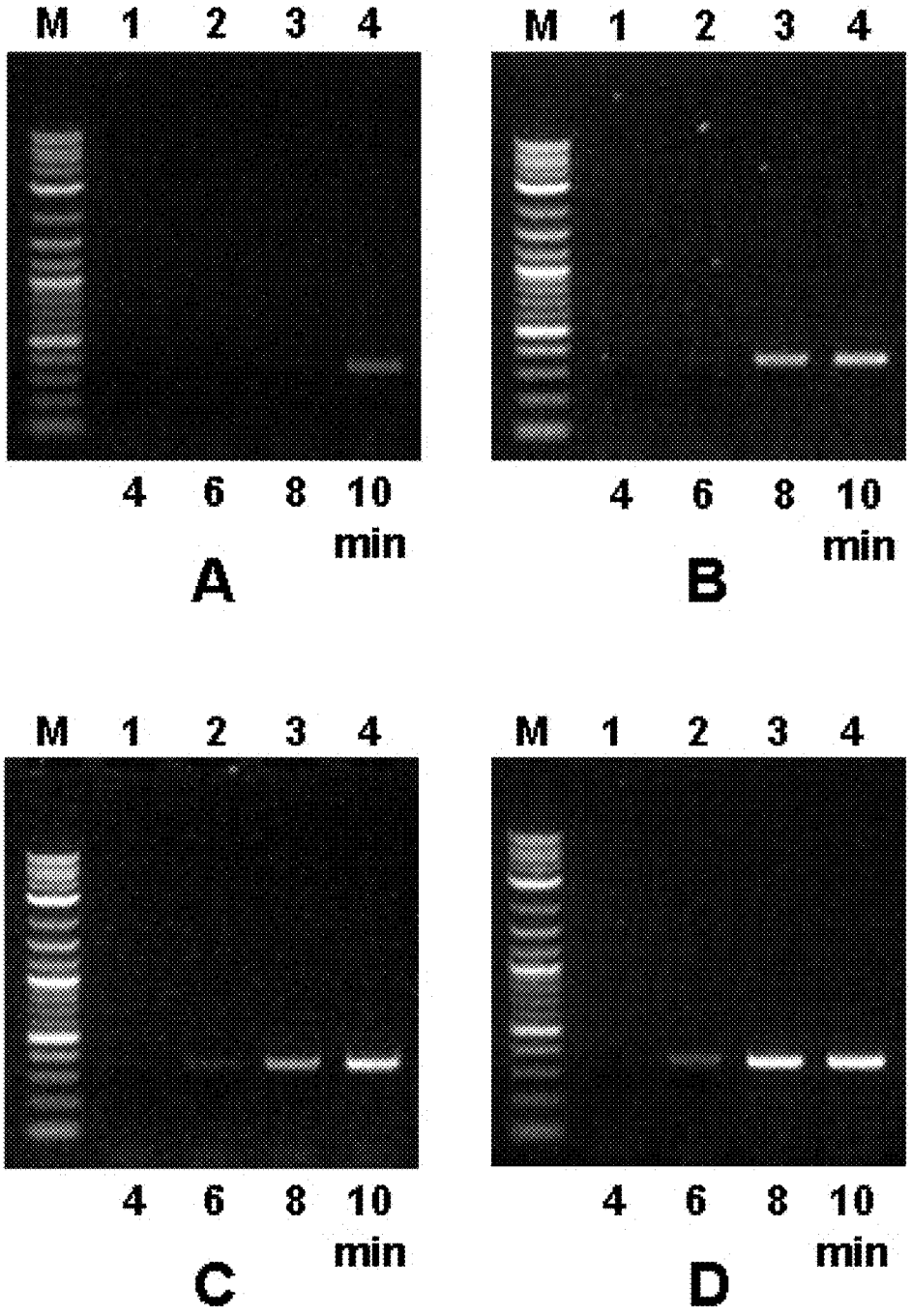
FIG. 44A-D

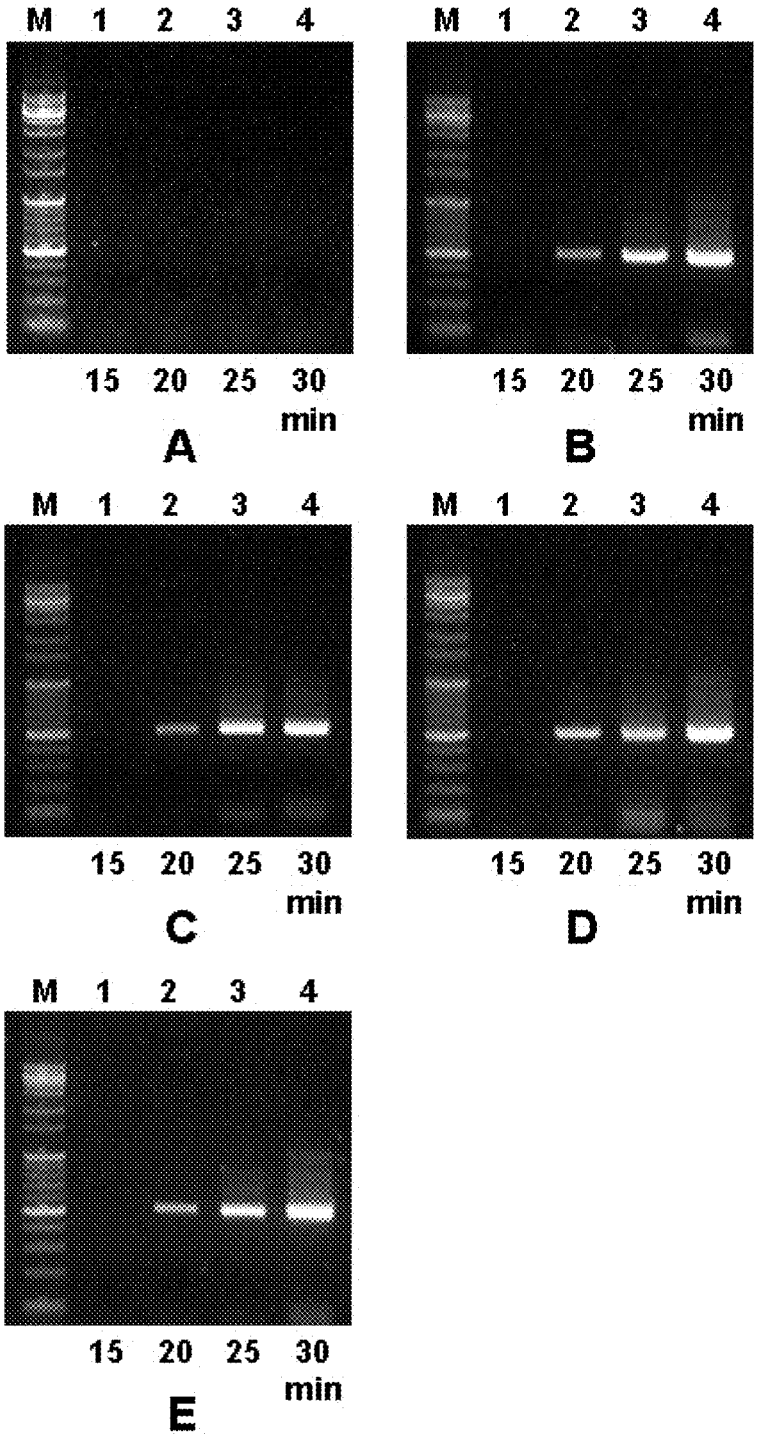
FIG. 52A-E

TWO-STAGE THERMAL CONVECTION APPARATUS AND USES THEREOF

CROSS-REFERENCE TO RELATED APPLICATION

The present application is a continuation-in-part application of PCT/IB2011/050104, filed on Jan. 11, 2011 which claims priority to U.S. Provisional Application No. 61/294,446 as filed on Jan. 12, 2010, the disclosure of which is incorporated herein by reference.

FIELD OF THE INVENTION

The present invention features a multi-stage thermal convection apparatus, particularly a two-stage thermal convection apparatus and uses thereof. The apparatus includes at least one temperature shaping element that assists a polymerase chain reaction (PCR). The invention has a wide variety of applications including amplifying a DNA template without the cumbersome and often expensive hardware associated with prior devices. In one embodiment, the apparatus can fit in the palm of a user's hand for use as a portable PCR amplification device.

BACKGROUND

The polymerase chain reaction (PCR) is a technique that amplifies a polynucleotide sequence each time a temperature changing cycle is completed. See for example, *PCR: A Practical Approach*, by M. J. McPherson, et al., IRL Press (1991), *PCR Protocols: A Guide to Methods and Applications*, by Innis, et al., Academic Press (1990), and *PCR Technology: Principals and Applications for DNA Amplification*, H. A. Erlich, Stockton Press (1989). PCR is also described in many patents, including U.S. Pat. Nos. 4,683,195; 4,683,202; 4,800,159; 4,965,188; 4,889,818; 5,075,216; 5,079,352; 5,104,792; 5,023,171; 5,091,310; and 5,066,584.

In many applications, PCR involves denaturing a polynucleotide of interest ("template"), followed by annealing a desired primer oligonucleotide ("primer") to the denatured template. After annealing, a polymerase catalyzes synthesis of a new polynucleotide strand that incorporates and extends the primer. This series of steps: denaturation, primer annealing, and primer extension, constitutes a single PCR cycle. These steps are repeated many times during PCR amplification.

As cycles are repeated, the amount of newly synthesized polynucleotide increases geometrically. In many embodiments, primers are selected in pairs that can anneal to opposite strands of a given double-stranded polynucleotide. In this case, the region between the two annealing sites can be amplified.

There is a need to vary the temperature of the reaction mixture during a multi-cycle PCR experiment. For example, denaturation of DNA typically takes place at about 90° C. to about 98° C. or a higher temperature, annealing a primer to the denatured DNA is typically performed at about 45° C. to about 65° C., and the step of extending the annealed primers with a polymerase is typically performed at about 65° C. to about 75° C. These temperature steps must be repeated, sequentially, for PCR to progress optimally.

To satisfy this need, a variety of commercially available devices has been developed for performing PCR. A significant component of many devices is a thermal "cycler" in which one or more temperature controlled elements (sometimes called "heat blocks") hold the PCR sample. The temperature of the heat block is varied over a time period to support the thermal cycling. Unfortunately, these devices suffer from significant shortcomings.

For example, most of the devices are large, cumbersome, and typically expensive. Large amounts of electric power are usually required to heat and cool the heat block to support the thermal cycling. Users often need extensive training. Accordingly, these devices are generally not suitable for field use.

Attempts to overcome these problems have not been entirely successful. For instance, one attempt involved use of multiple temperature controlled heat blocks in which each block is kept at a desired temperature and sample is moved between heat blocks. However, these devices suffer from other drawbacks such as the need for complicated machinery to move the sample between different heat blocks and the need to heat or cool one or a few heat blocks at a time.

There have been some efforts to use thermal convection in some PCR processes. See Krishnan, M. et al. (2002) *Science* 298: 793; Wheeler, E. K. (2004) *Anal. Chem.* 76: 4011-4016; Braun, D. (2004) *Modern Physics Letters* 18: 775-784; and WO02/072267. However, none of these attempts has produced a thermal convection PCR device that is compact, portable, more affordable and with a less significant need for electric power. Moreover, such thermal convection devices often suffer from low PCR amplification efficiency and limitation in the size of amplicon.

SUMMARY

The present invention provides a multi-stage thermal convection apparatus, particularly a two-stage thermal convection apparatus and uses thereof. The apparatus generally includes at least one temperature shaping element to assist a polymerase chain reaction (PCR). As described below, a typical temperature-shaping element is a structural and/or positional feature of the apparatus that supports thermal convection PCR. Presence of the temperature shaping element enhances the efficiency and speed of the PCR amplification, supports miniaturization, and reduces need for significant power. In one embodiment, the apparatus readily fits in the palm of a user's hand and has low power requirements sufficient for battery operation. In this embodiment, the apparatus is smaller, less expensive and more portable than many prior PCR devices.

Accordingly, and in one aspect, the present invention features a two-stage thermal convection apparatus adapted to perform thermal convection PCR amplification ("apparatus"). Preferably, the apparatus has at least one of and preferably all of the following elements as operably linked components:

(a) a first heat source for heating or cooling a channel and comprising a top surface and a bottom surface, the channel being adapted to receive a reaction vessel for performing PCR, (b) a second heat source for heating or cooling the channel and comprising a top surface and a bottom surface, the bottom surface facing the top surface of the first heat source, wherein the channel is defined by a bottom end contacting the first heat source and a through hole contiguous with the top surface of the second heat source, and further wherein center points between the bottom end and the through hole form a channel axis about which the channel is disposed, (c) at least one temperature shaping element adapted to assist thermal convection PCR; and (d) a receptor hole adapted to receive the channel within the first heat source.

Also provided is a method of making the forgoing apparatus which method includes assembling each of (a)-(d) in an operable combination sufficient to perform thermal convection PCR as described herein.

In another aspect of the present invention, there is provided a thermal convection PCR centrifuge ("PCR centrifuge") adapted to perform PCR using at least one of the apparatus as described herein.

Further provided by the present invention is a method for performing a polymerase chain reaction (PCR) by thermal convection. In one embodiment, the method includes at least one of and preferably all of the following steps:

(a) maintaining a first heat source comprising a receptor hole at a temperature range suitable for denaturing a double-stranded nucleic acid molecule and forming a single-stranded template, (b) maintaining a second heat source at a temperature range suitable for annealing at least one oligonucleotide primer to the single-stranded template, and (c) producing thermal convection between the receptor hole and the second heat source under conditions sufficient to produce the primer extension product.

In another aspect, the invention provides reaction vessels adapted to be received by an apparatus of the invention.

BRIEF DESCRIPTION OF THE DRAWINGS

FIGS. 2A-C are cross-sectional views taken along the A-A (FIGS. 2A, 2B) and B-B planes (FIG. 2C).

FIG. 4B shows an expanded view of the region (identified by the dotted circle in FIG. 4A). The apparatus has a first 100 and a second 110 chamber. A region between the first and second chambers includes a first thermal brake 130.

FIGS. 5A-C are cross-sectional views taken along the A-A (FIGS. 5A-B) and B-B planes (FIG. 5C). The second heat source 30 comprises a first chamber 100 and a first protrusion 33 disposed symmetrically about the channel axis 80 that extend the length of the first chamber 100. The first heat source 20 comprises a first protrusion 23.

FIGS. 7A-D are schematic drawings showing channel embodiments of the apparatus (A-A plane).

FIGS. 8A-J are schematic drawings showing channel embodiments of the apparatus. The plane of section is perpendicular to the channel axis 80.

FIGS. 9A-I are drawings showing various chamber embodiments of the apparatus. The plane of section is perpendicular to the channel axis 80. Hatched parts represent the second or first heat source.

FIGS. 10A-P are drawings showing various chamber and channel embodiments of the apparatus. The plane of section is perpendicular to the channel axis 80. Hatched parts represent the second or first heat source.

FIG. 11A shows a positioning embodiment of the apparatus shown in FIG. 5A. The apparatus is tilted (by an angle defined by $\theta_g$) with respect to the direction of gravity. FIG. 11B shows an apparatus embodiment in which the channel 70 and the first chamber 100 are tilted with respect to the direction of gravity within the second heat source 30. The direction of gravity remains perpendicular with respect to the heat sources.

FIG. 13B shows an expanded view of the region identified by the dotted circle shown in FIG. 13A to illustrate structural details of the first thermal brake 130.

FIGS. 14B and D show expanded views of the region identified by the dotted circle shown in FIGS. 14A and D, respectively, to illustrate structural details of the first thermal brake 130. The first chamber 100 has a straight wall in FIGS. 14A-B and a tapered wall in FIGS. 14C-D.

In FIG. 17A, the protrusion 23 next to the receptor hole 73 has multiple top surfaces one of which has a greater height and is closer to the first chamber 100. In FIG. 17B, the protrusion 23 has one top surface that is inclined with respect to the channel axis 80 so that one side has a greater height and is closer to the first chamber 100 than another side opposite to the receptor hole 73.

In FIGS. 18A and 18B, the first chamber 100 features a bottom end 102 in which a portion is closer to one side of the protrusion 23 than another portion opposite to the channel axis 80. In FIGS. 18C and 18D, the bottom end 102 of the first chamber 100 is located essentially at a constant distance from the top surface of the protrusion 23.

In FIG. 19A, the bottom end 102 of the first chamber 100 features multiple surfaces so that a portion of the bottom end 102 that is closer to one side of the protrusion 23 than another portion opposite to the channel axis 80. In FIG. 19B, the bottom end 102 of the first chamber 100 is inclined with respect to the channel axis 80 so that a portion of the bottom end 102 is closer to the protrusion 23 than another portion opposite to the channel axis 80.

FIG. 20A shows a sectional view of an apparatus embodiment in which the first chamber 100 is within the second heat source 30 and is disposed asymmetrically (off-centered) about the channel 70.

FIGS. 20B-C show sectional views of an apparatus embodiment along the A-A plane. The first chamber 100 is disposed asymmetrically about the channel 70. As shown in FIG. 20C, the thermal brake 130 is shown disposed asymmetrically about the channel 70 with the wall 133 contacting the channel 70 on one side.

As shown in FIG. 23B, the apparatus features a first thermal brake 130 asymmetrically disposed about the channel 70 and between the first 100 and second 110 chambers with the wall 133 contacting the channel 70 on one side.

As shown in FIG. 26B, the first thermal brake 130 is also disposed asymmetrically about the channel 70 with the wall 133 contacting the channel 70 on one side.

As shown in FIG. 26D, the first thermal brake 130 is also asymmetrically disposed about the channel 70 with the wall 133 contacting the channel 70 on one side.

Figure 1:
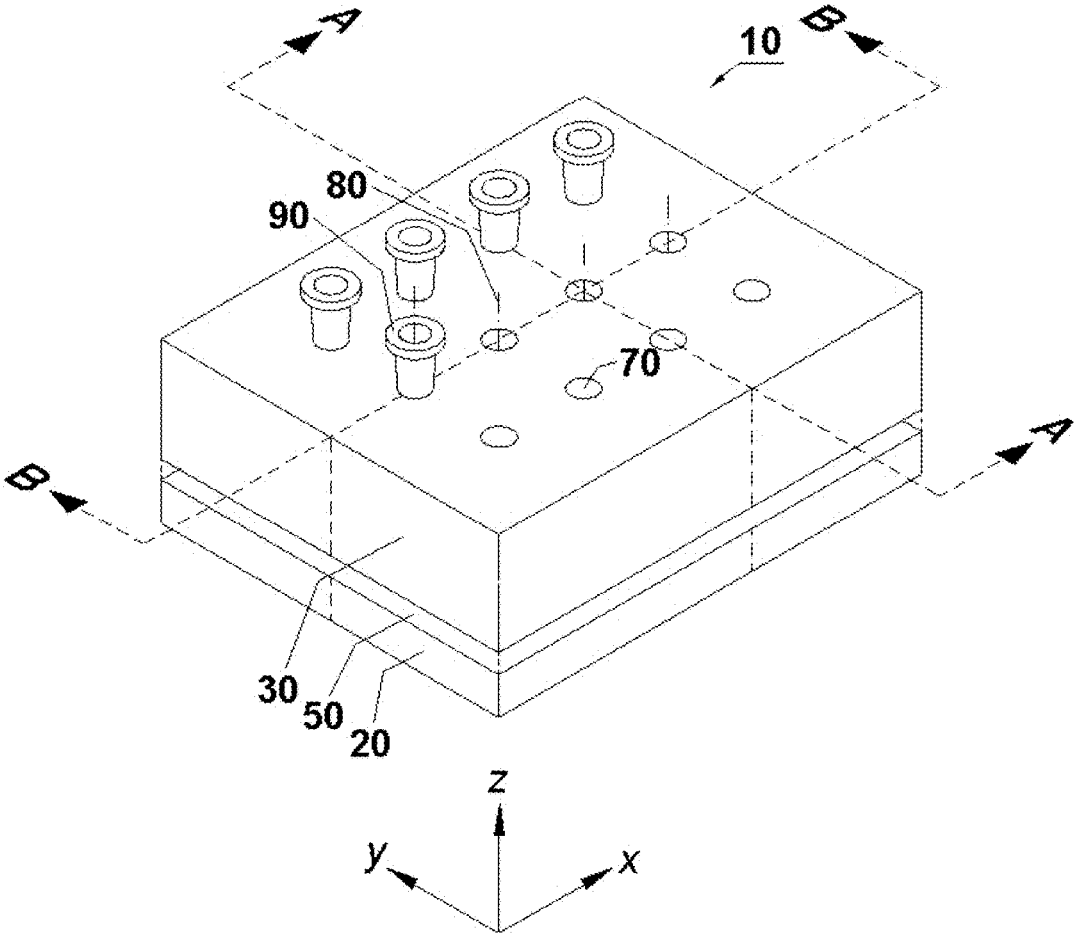
FIG. 1 is a schematic drawing showing an overhead view of an embodiment of the apparatus. Sectional planes through the apparatus (A-A and B-B) are depicted.

The wall 103 of the first chamber 100, the wall 113 of the second chamber 110 are each essentially parallel to the channel axis 80. In an expanded view shown in FIG. 28B, the first thermal brake 130 is shown inclined (tilted) with respect to the channel axis 80 and the wall 133 contacts the channel 70.

FIGS. 29A-D are schematic drawings showing sectional views of apparatus embodiments along the A-A plane in which the first 100 and second 110 chambers are within the second heat source 30 and are disposed asymmetrically about the channel axis 80. In FIGS. 29A-D, the wall 103 of the first chamber 100 and the wall 113 of the second chamber 110 are shown inclined (tilted) with respect to the channel axis 80. In an expanded view shown in FIG. 29B, the thermal brake 130 is shown symmetrically disposed about the channel 70 with the wall 133 contacting the channel 70. In an expanded view shown in FIG. 29D, the first thermal brake 130 is shown inclined (tilted) with respect to the channel axis 80 with the wall 133 contacting the channel 70.

Figure 30:
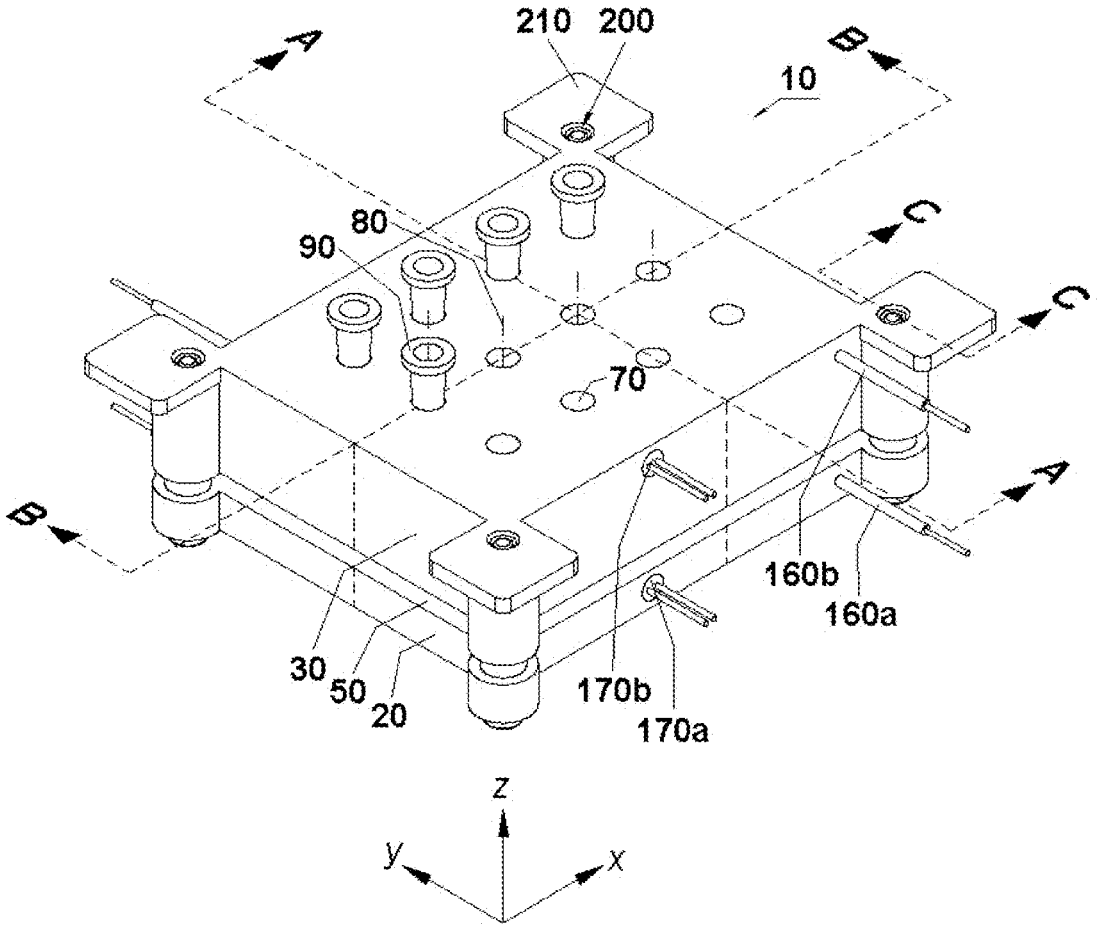

FIG. 30 is a schematic drawing showing an overhead view of an embodiment of the apparatus 10 showing first securing element 200, second securing element 210, heating/cooling elements (160*a-b*), and temperature sensors (170*a-b*). Various sectional planes are indicated (A-A, B-B, and C-C).

Figure 31A:
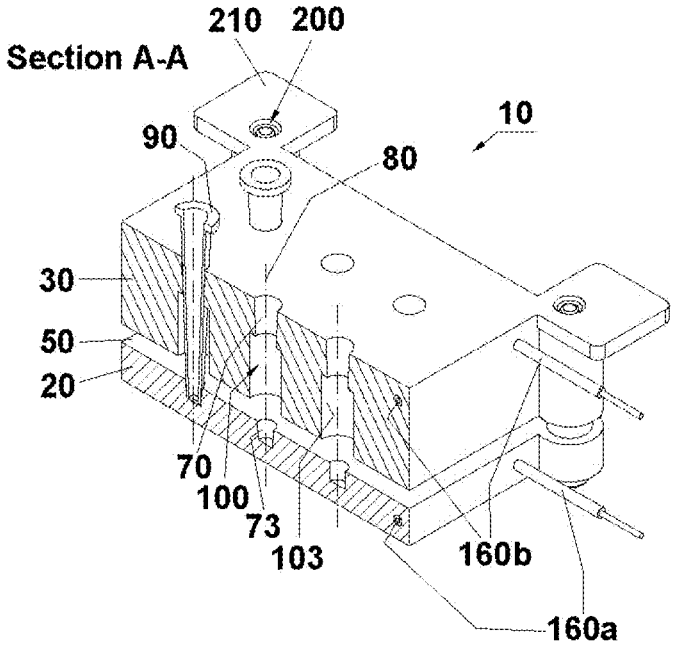
Figure 31B:
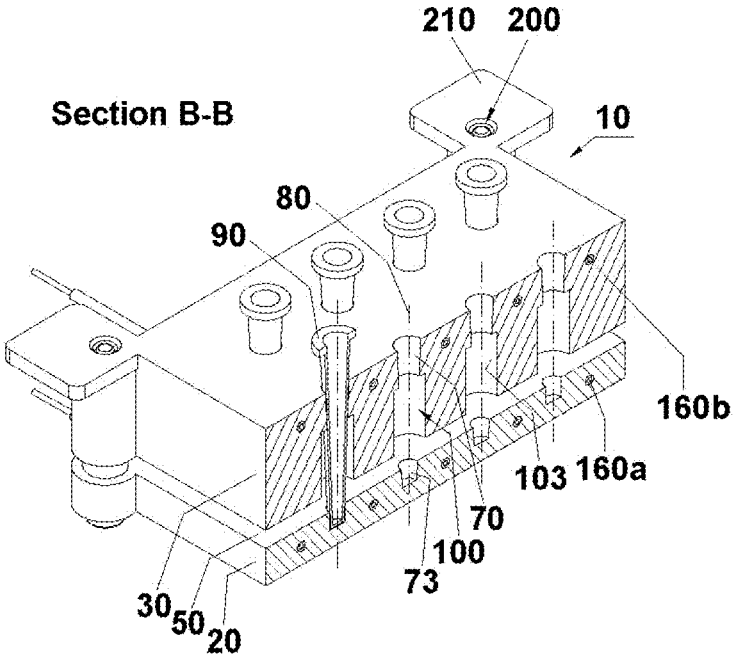

FIGS. 31A-B are schematic drawings of cross-sectional views of the apparatus embodiment shown in FIG. 30 taken along the A-A (FIG. 31A) and B-B (FIG. 31B) planes.

Figure 32:
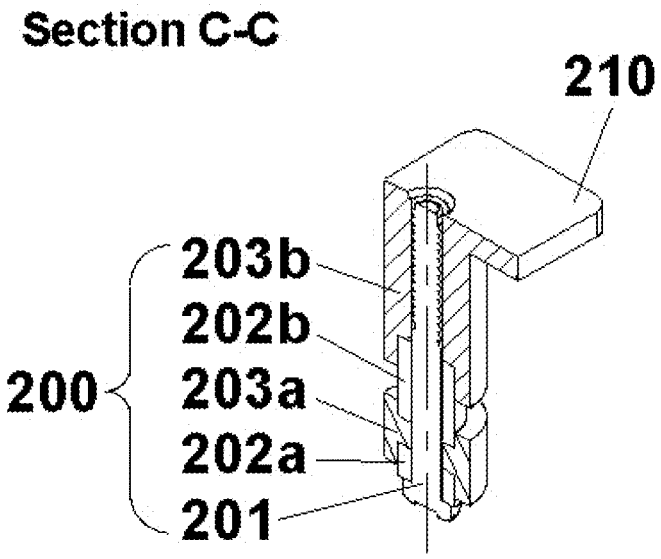

FIG. 32 is a schematic drawing of a cross-sectional view of the first securing element 200 taken along the C-C plane.

Figure 33:
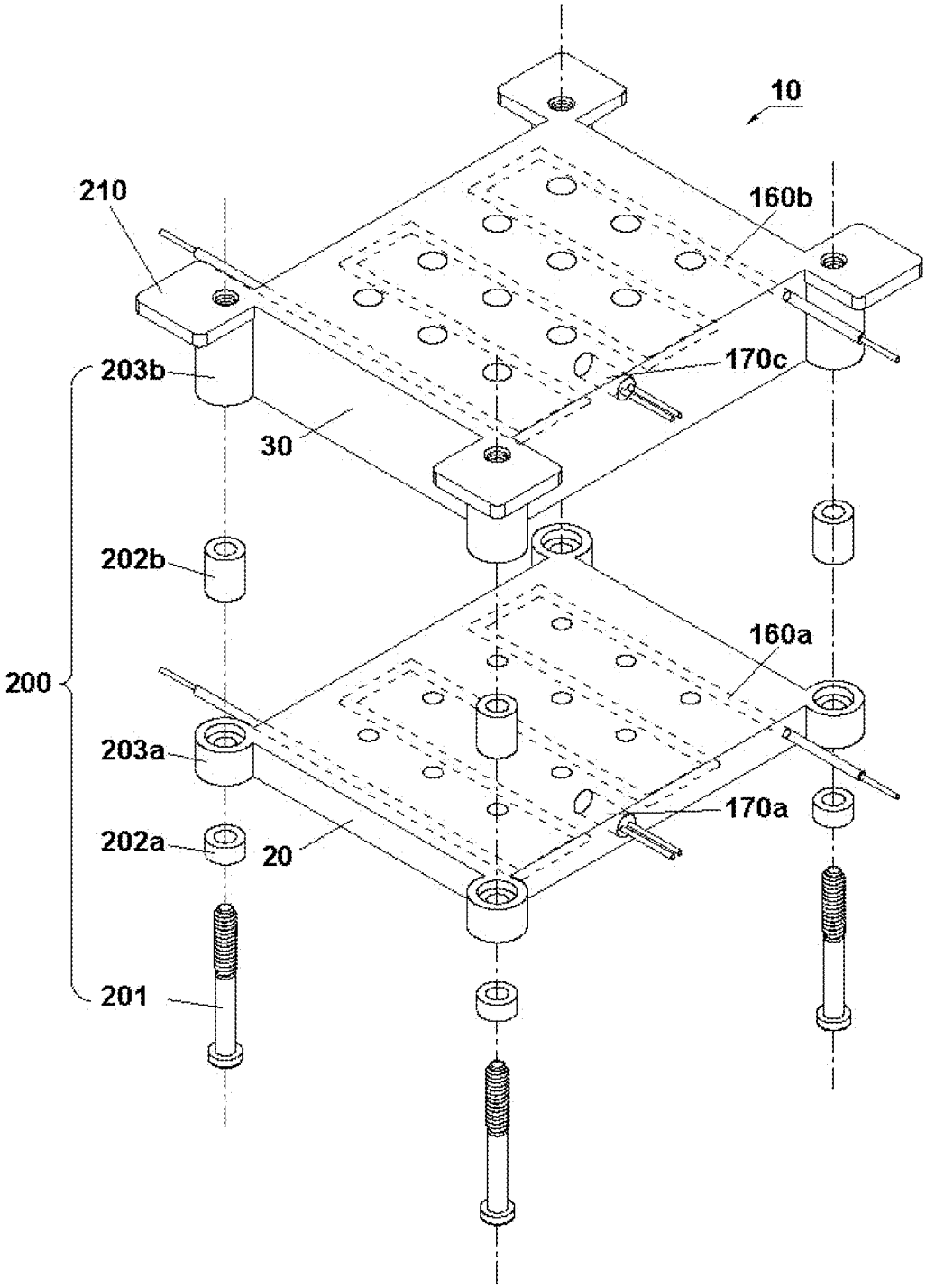

FIG. 33 is a schematic drawing of an overhead view of an apparatus embodiment showing various securing elements, heat source structures, heating/cooling elements, and temperature sensors.

Figure 34A:
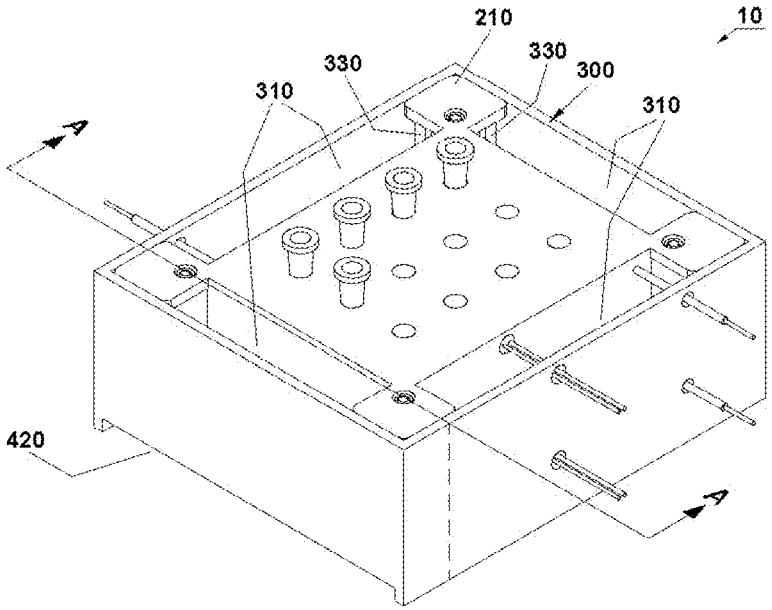
Figure 34B:
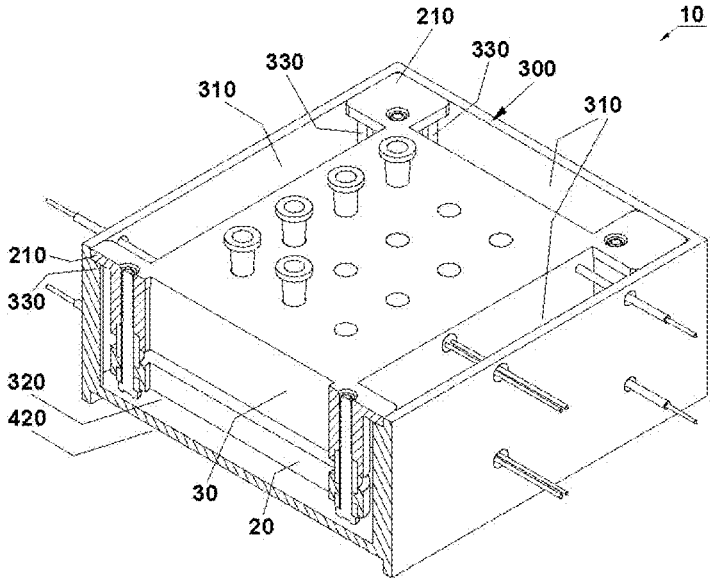

FIGS. 34A-B are schematic drawings of an overhead view (FIG. 34A) and a cross-sectional view (FIG. 34B) of an apparatus embodiment showing a first housing element 300 defining a second 310 and third 320 insulator.

Figure 35A:
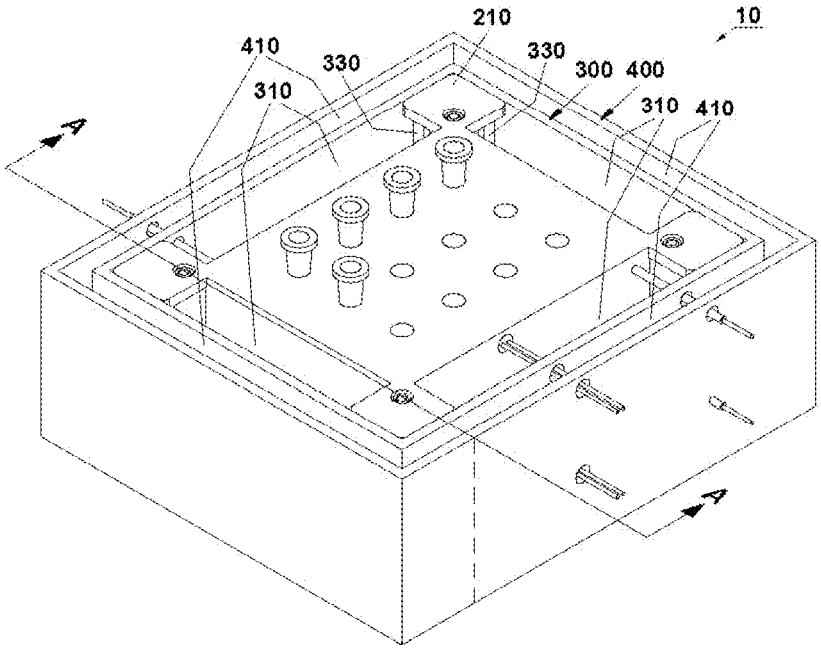
Figure 35B:
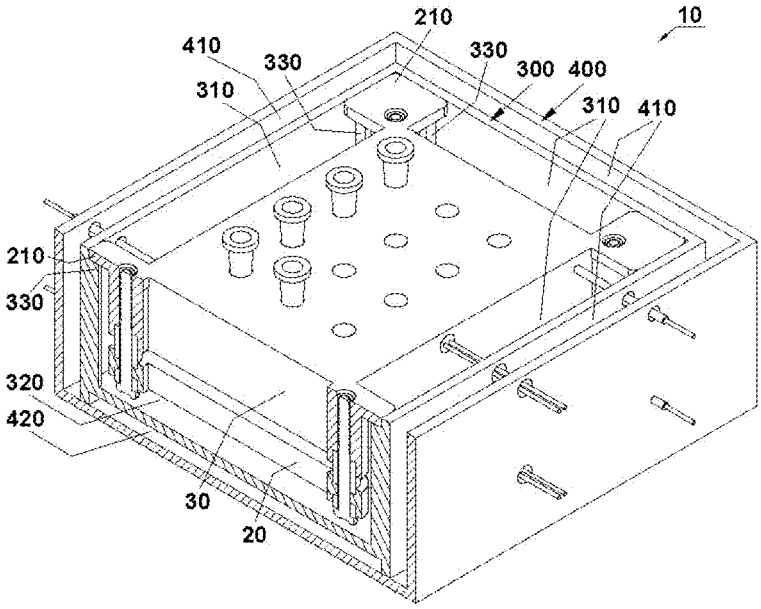

FIGS. 35A-B are schematic drawings of an overhead view (FIG. 35A) and a cross-sectional view (FIG. 35B) of an apparatus embodiment comprising a second housing element 400 and a fourth 410 and fifth 420 insulator.

Figure 36A:
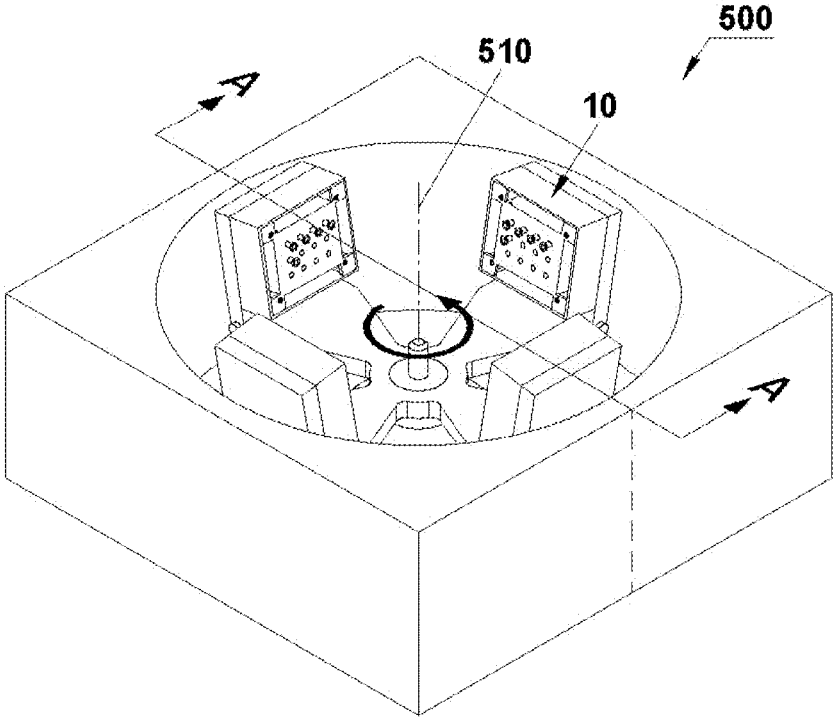
Figure 36B:
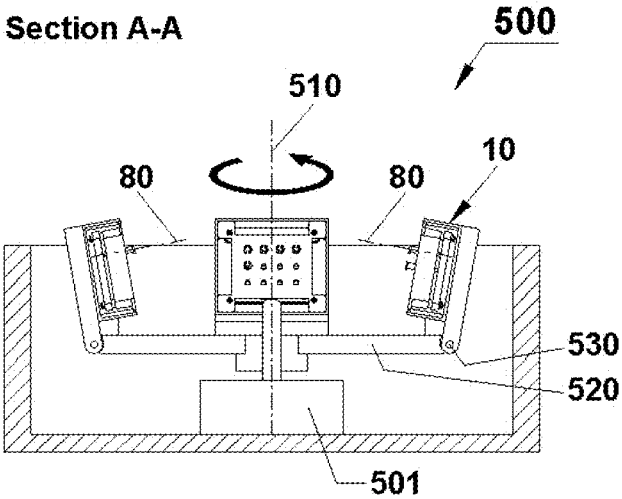

FIGS. 36A-B are schematic drawings of an embodiment of a PCR centrifuge. FIG. 36A shows an overhead view and FIG. 36B shows a cross-sectional view taken along the A-A plane.

Figure 37:
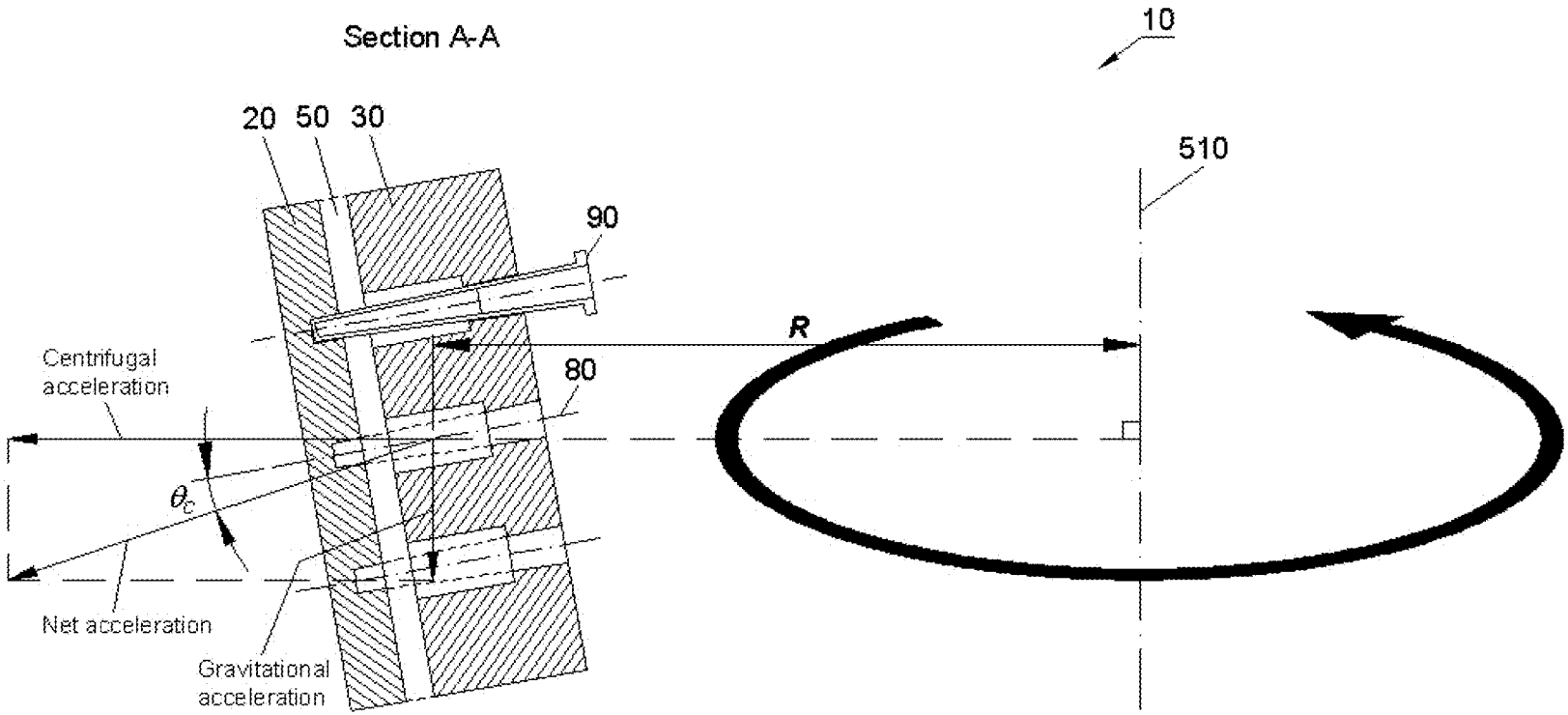

FIG. 37 is a schematic drawing showing a cross-sectional view of an apparatus embodiment of the PCR centrifuge taken along the A-A plane.

Figure 38A:
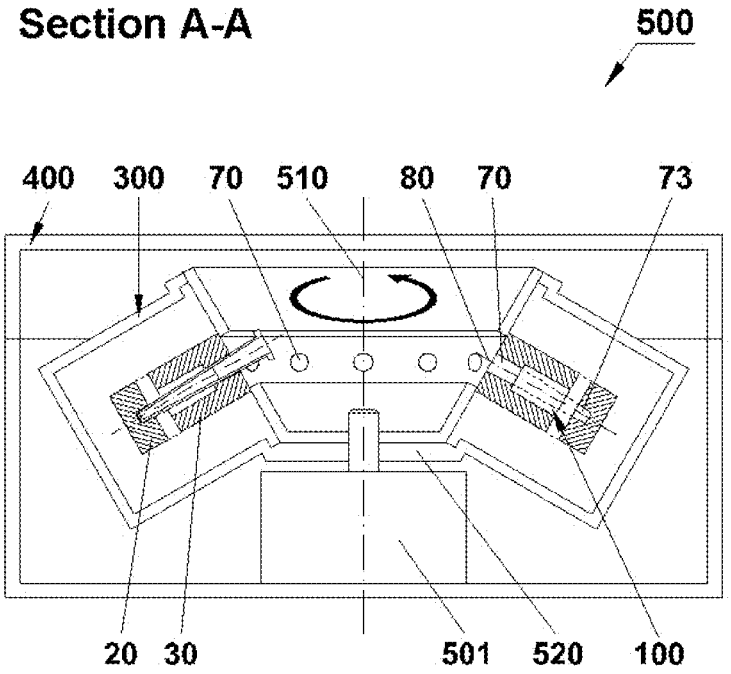
Figure 38B:
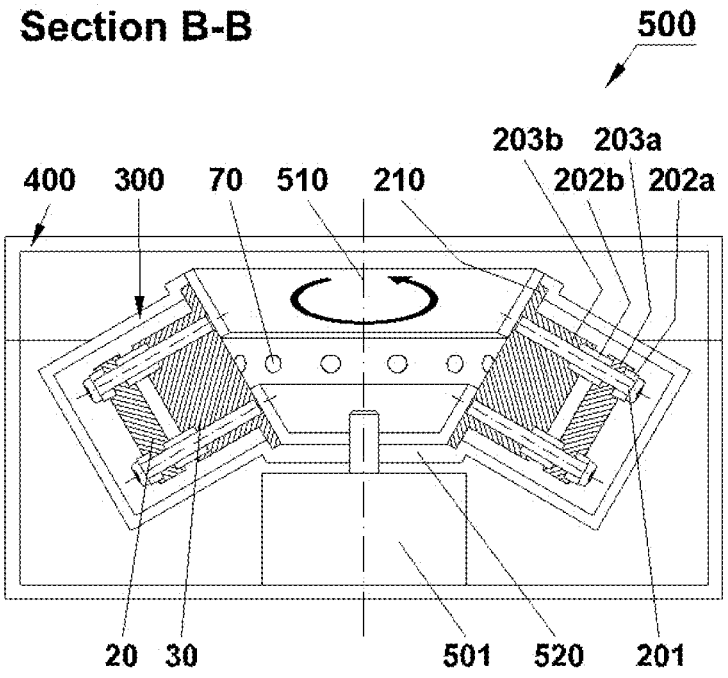

FIGS. 38A-B are schematic drawings showing an embodiment of a PCR centrifuge comprising a first chamber. In FIG. 38A, the plane of section along A-A is through the channel 70. In FIG. 38B, the plane of section along B-B is through the first 200 and second 210 securing means.

Figure 39A:
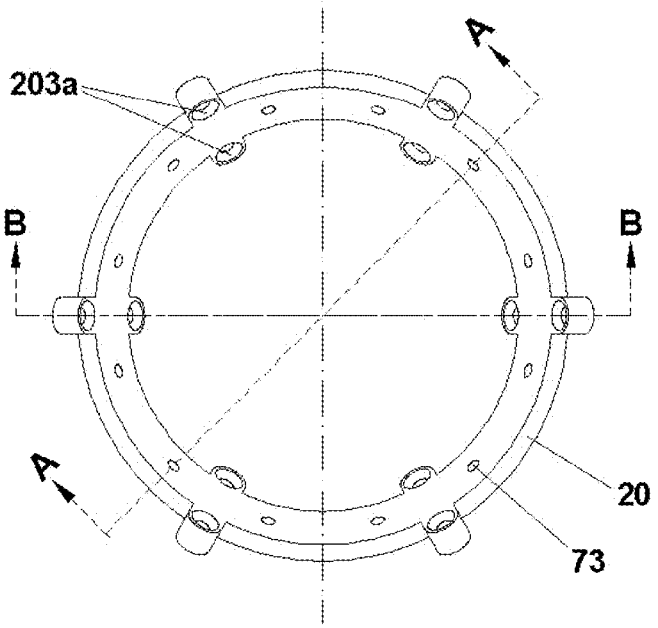
Figure 39B:
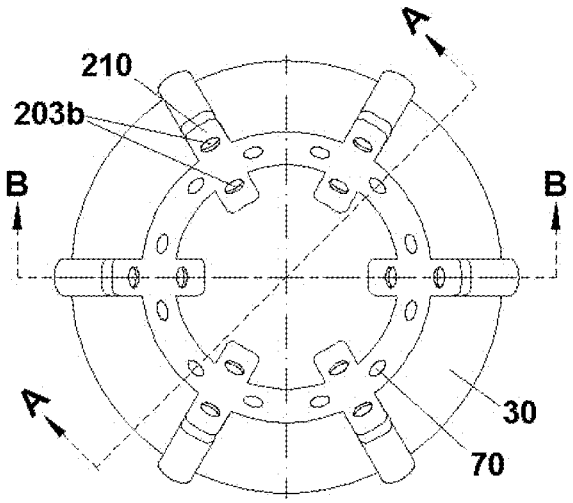

FIGS. 39A-B are schematic drawings showing embodiments of a first (FIG. 39A) and second (FIG. 39B) heat source for use in the PCR centrifuge shown in FIGS. 38A-B. Sectional planes through the apparatus (A-A and B-B) are indicated.

FIGS. 40A-D are schematic drawings showing a cross-sectional view of various reaction vessel embodiments.

FIGS. 41A-J are schematic drawings showing cross-sectional views of various reaction vessel embodiments taken perpendicular to the reaction vessel axis 95.

Figure 5A:
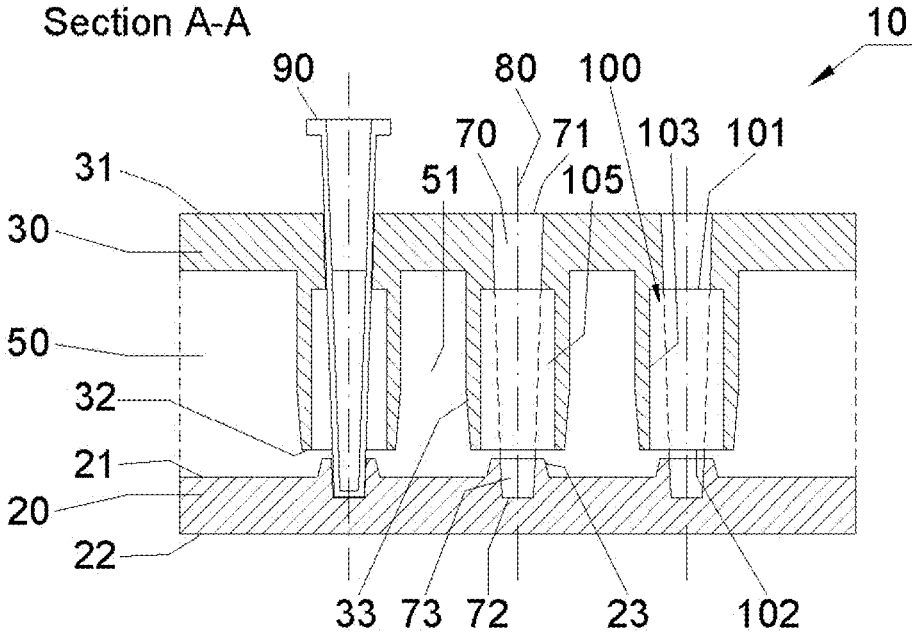
FIGS. 5A-C are schematic drawings showing sectional views of an apparatus embodiment.
Figure 42A:
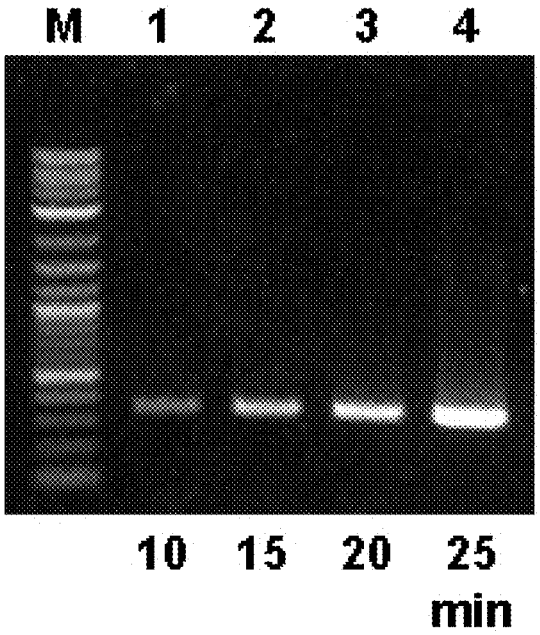
Figure 42B:
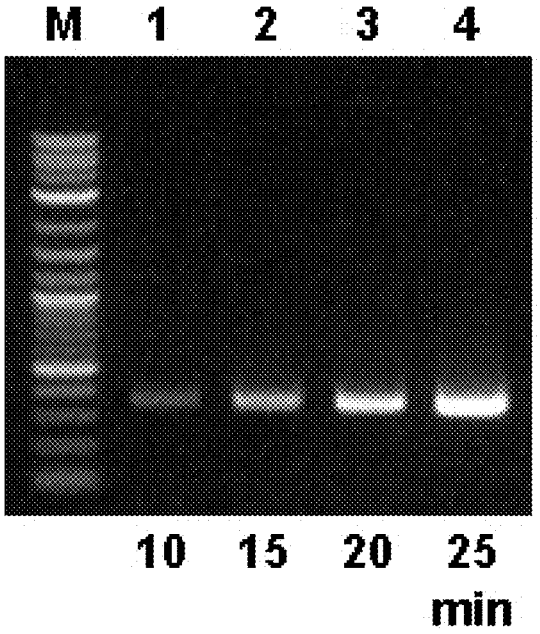
Figure 42C:
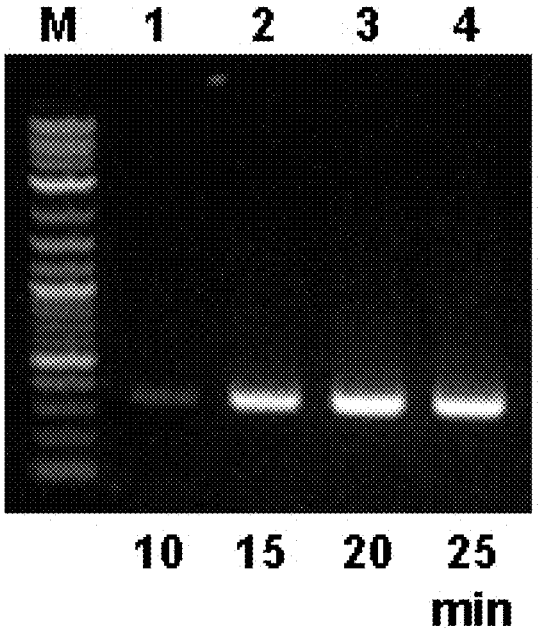

FIGS. 42A-C are results of thermal convection PCR using the apparatus of FIG. 5A showing amplification of a 349 bp sequence from a 1 ng plasmid sample with three different DNA polymerases from Takara Bio, Finnzymes, and Kapa Biosystems, respectively.

Figure 43:
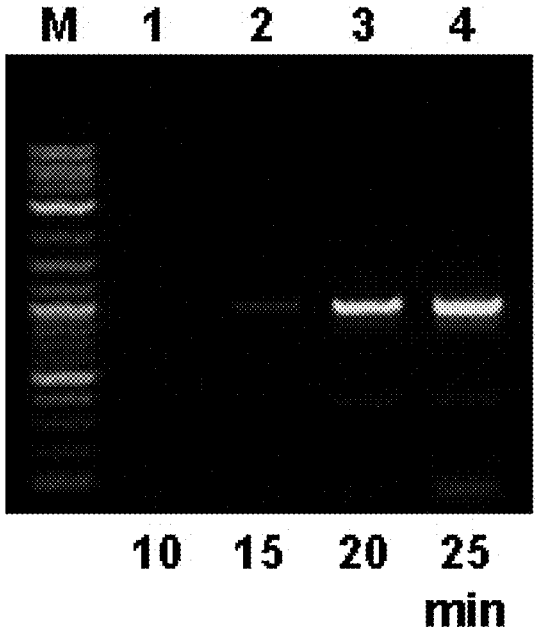

FIG. 43 shows results of thermal convection PCR using the apparatus of FIG. 5A showing amplification of a 936 bp sequence from a 1 ng plasmid sample.

FIGS. 44A-D are results of thermal convection PCR using the apparatus of FIG. 5A showing acceleration of PCR amplification at elevated denaturation temperatures (98° C., 100° C., 102° C., and 104° C., respectively).

Figure 45A:
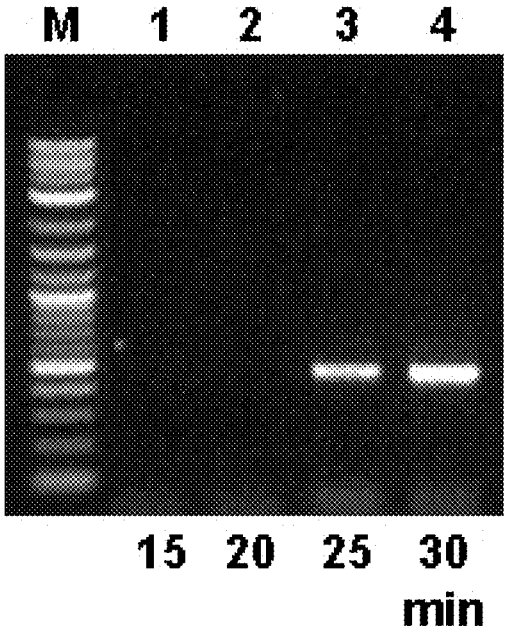
Figure 45B:
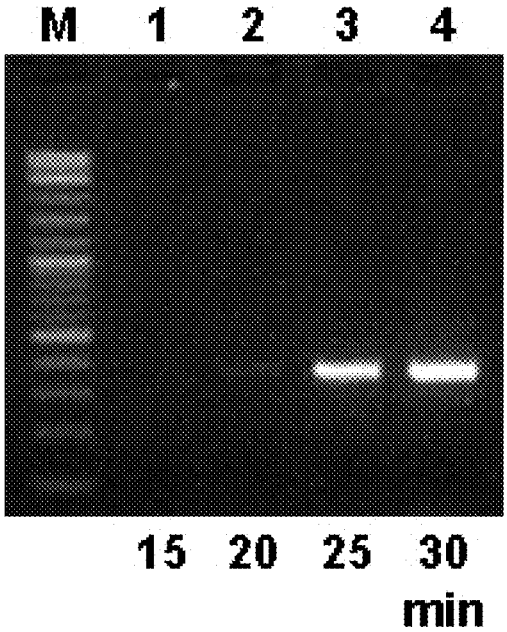

FIGS. 45A-B are results of thermal convection PCR using the apparatus of FIG. 5A showing amplification of 479 bp GAPDH (FIG. 45A) and 363 bp β-globin (FIG. 45B) sequences from 10 ng human genome samples.

Figure 46:
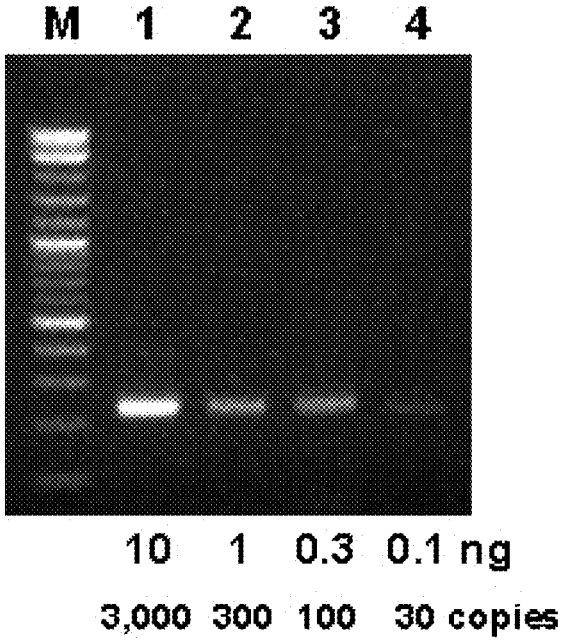

FIG. 46 shows results of thermal convection PCR using the apparatus of FIG. 5A showing amplification of a 241 bp β-actin sequence from very low copy human genome samples.

Figure 47:
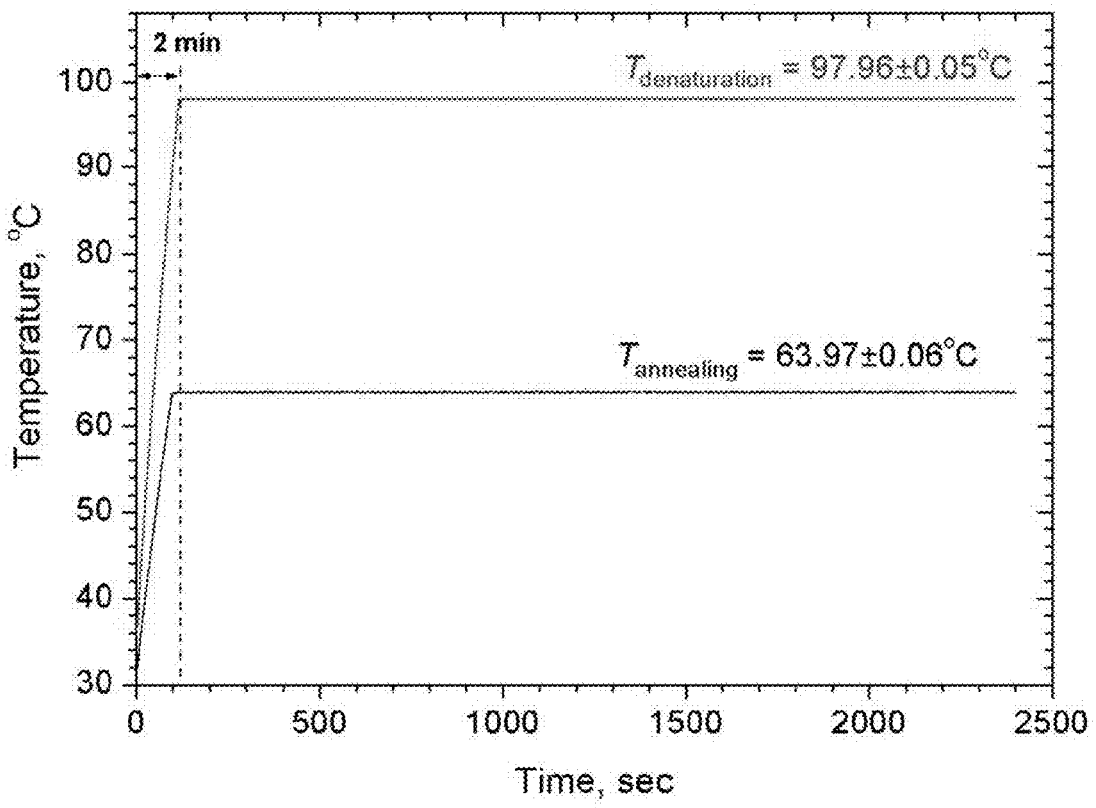

FIG. 47 shows temperature variations of the first and second heat sources of the apparatus of FIG. 5A as a function of time when target temperatures were set to 98° C. and 64° C., respectively.

Figure 48:
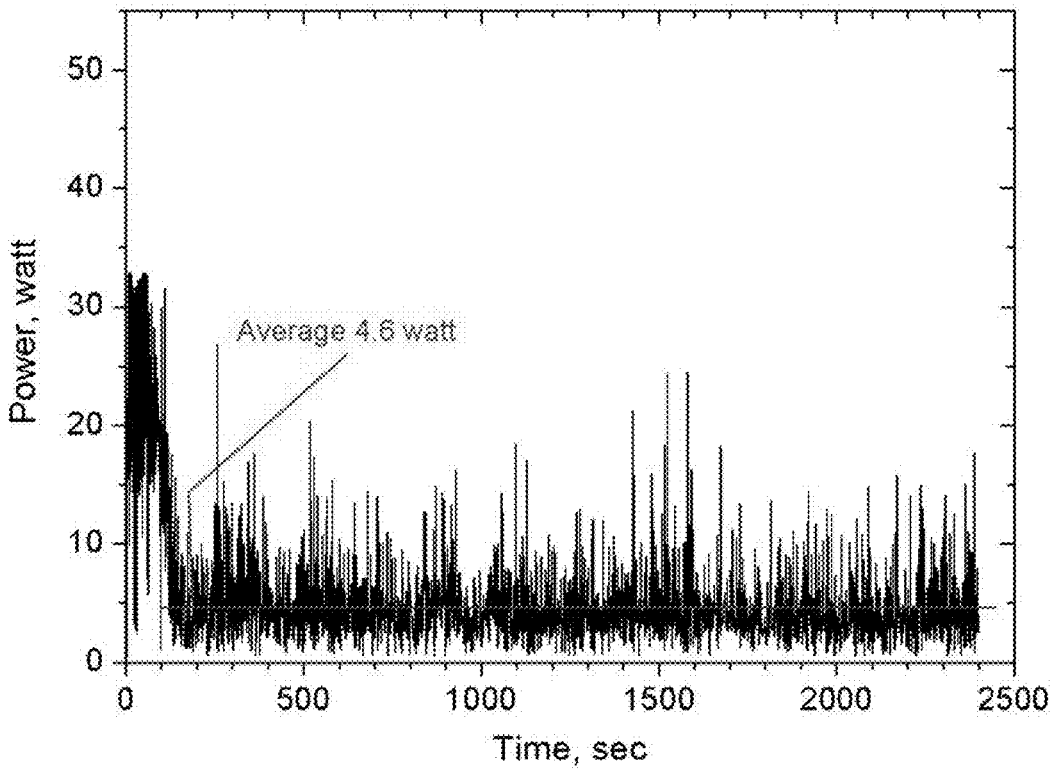

FIG. 48 shows power consumption of the apparatus of FIG. 5A having 12 channels as a function of time.

Figure 11A:
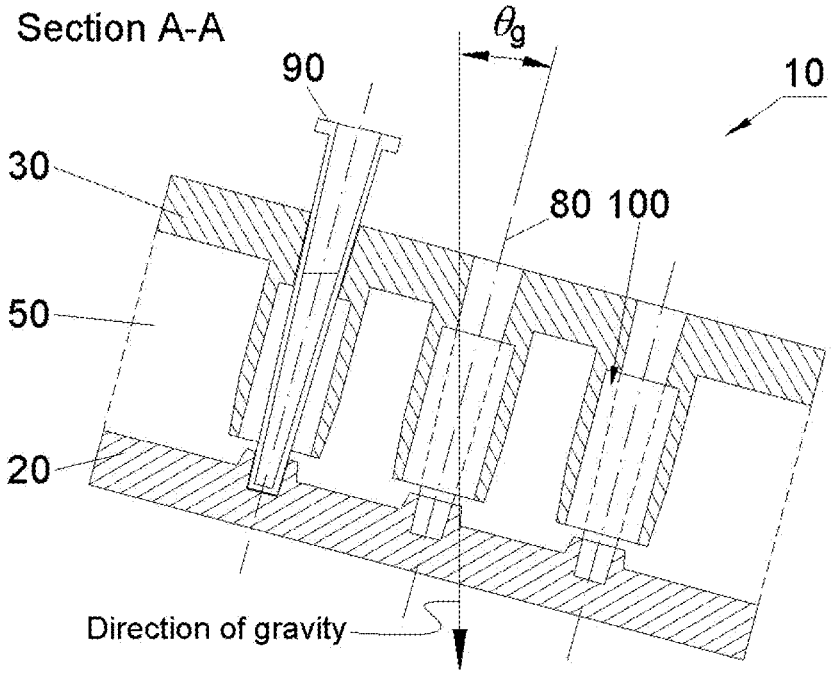
FIGS. 11A-B are schematic drawings showing various positioning embodiments.

FIGS. 49A-E are results of thermal convection PCR using the apparatus of FIG. 11A showing acceleration of PCR amplification for a 349 bp plasmid target as a function of the gravity tilting angle. The gravity tilting angle was 0°, 10°, 20°, 30°, and 45° for FIGS. 49A-E, respectively.

FIGS. 50A-E are results of thermal convection PCR using the apparatus of FIG. 11A showing acceleration of PCR amplification for a 936 bp plasmid target as a function of the gravity tilting angle. The gravity tilting angle was 0°, 10°, 20°, 30°, and 45° for FIGS. 50A-E, respectively.

Figure 51:
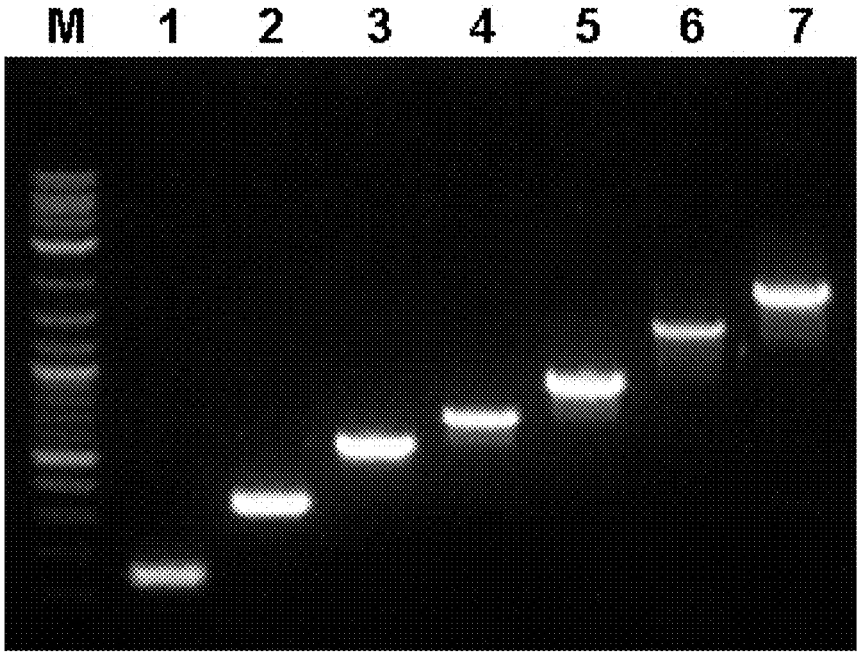

FIG. 51 shows results of thermal convection PCR using the apparatus of FIG. 11A showing amplification of various target sequences (with size between about 150 bp to about 2 kbp) from 1 ng plasmid samples. The gravity tilting angle was 10°.

FIGS. 52A-E are results of thermal convection PCR using the apparatus of FIG. 11A showing acceleration of PCR amplification for a 521 bp human genome target as a function of the gravity tilting angle. The gravity tilting angle was 0°, 10°, 20°, 30°, and 45° for FIGS. 52A-E, respectively.

Figure 53A:
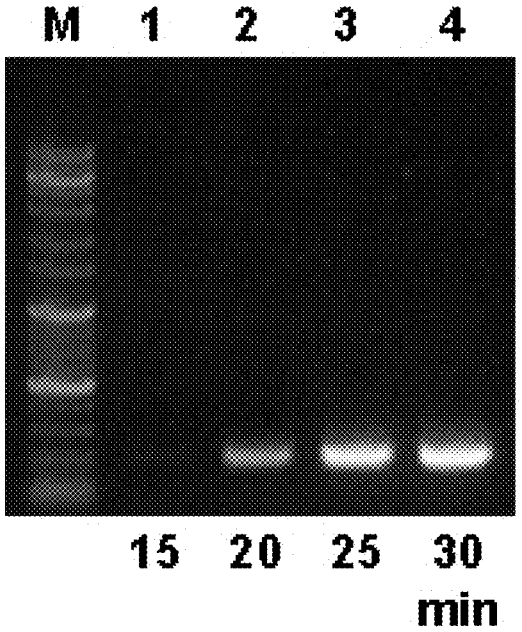
Figure 53B:
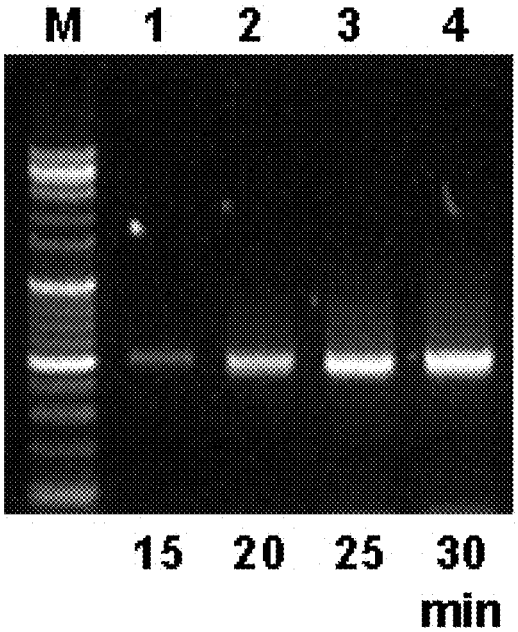

FIGS. 53A-B are results of thermal convection PCR using the apparatus of FIG. 11A showing amplification of 200 bp β-globin (FIG. 53A) and 514 bp β-actin (FIG. 53B) sequences from 10 ng human genome samples. The gravity tilting angle was 10°.

Figure 54:
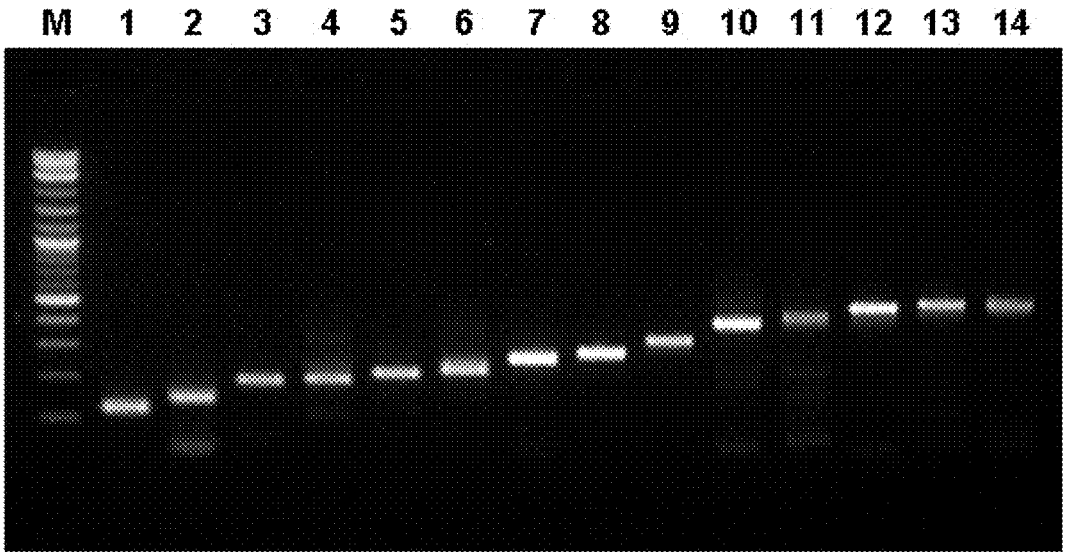

FIG. 54 shows results of thermal convection PCR using the apparatus of FIG. 11A showing amplification of various target sequences (with size between about 100 bp to about 500 bp) from 10 ng human genome and cDNA samples. The gravity tilting angle was 10°.

Figure 55:
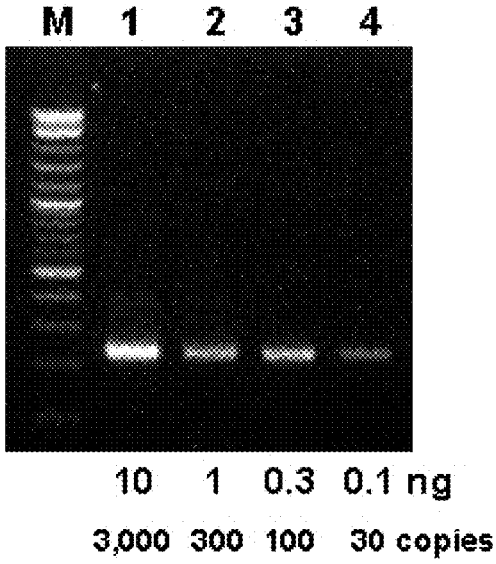

FIG. 55 shows results of thermal convection PCR using the apparatus of FIG. 11A showing amplification of a 241 bp β-actin sequence from very low copy human genome samples when the gravity tilting angle of 10° was introduced.

Figure 20A:
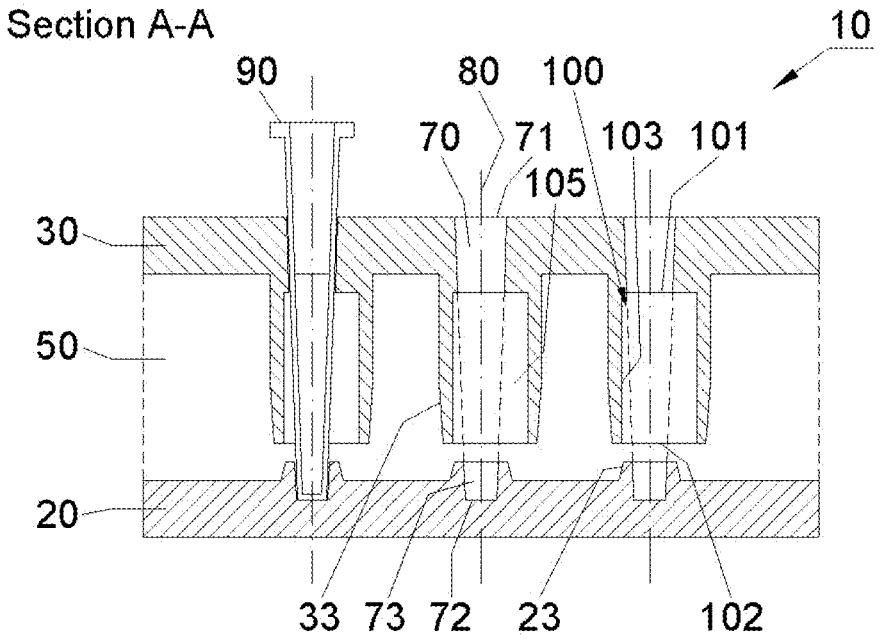
FIGS. 20A-C are schematic drawings showing various apparatus embodiments.
Figure 56A:
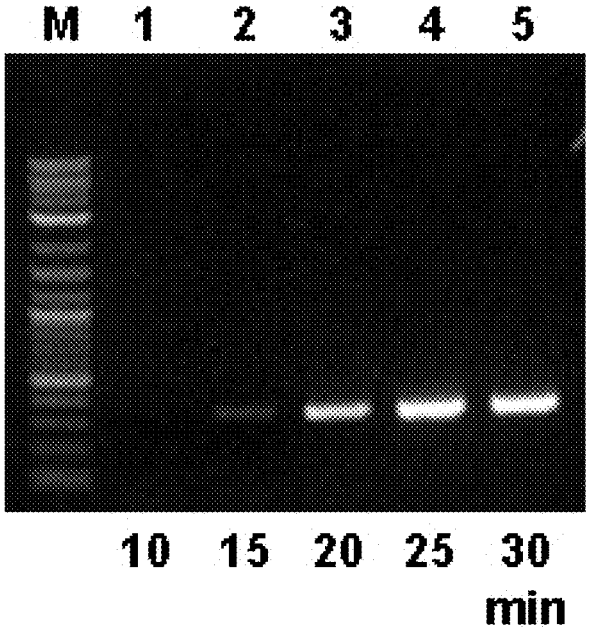
Figure 56B:
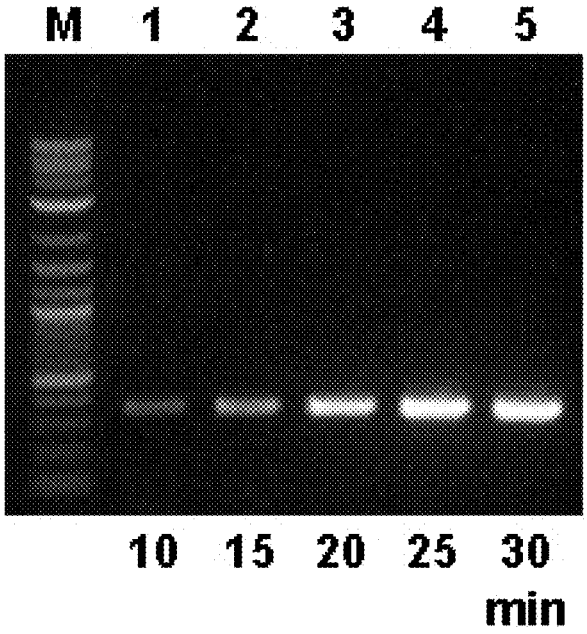

FIGS. 56A-B are results of thermal convection PCR using the apparatuses of FIGS. 5A and 20A, respectively, for amplification of a 349 bp plasmid target. The apparatus of FIG. 5A has a symmetric heating structure and that of FIG. 20A has an asymmetric heating structure comprising an off-centered first chamber.

Figure 57A:
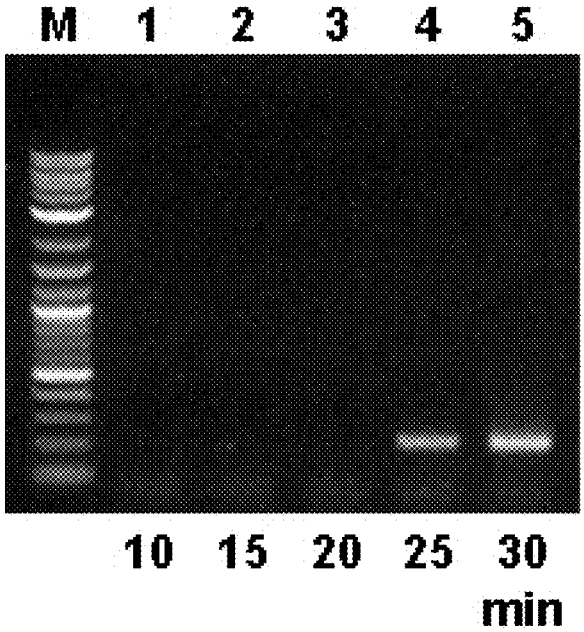
Figure 57B:
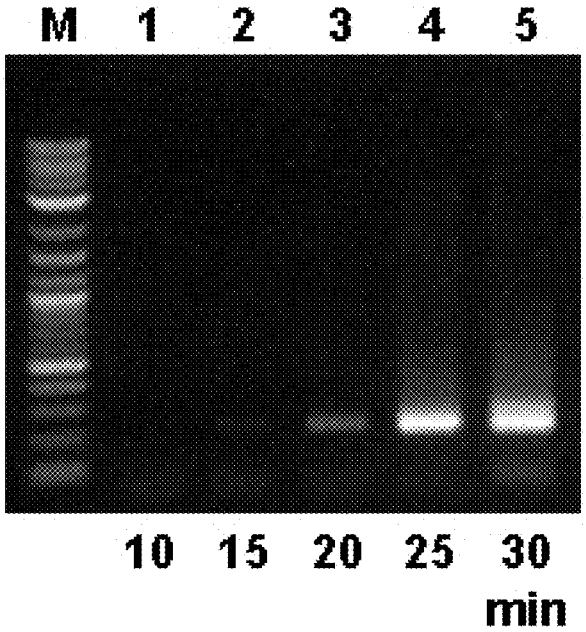

FIGS. 57A-B are results of thermal convection PCR using the apparatuses of FIGS. 5A and 20A, respectively, for amplification of a 241 bp human genome target. The apparatus of FIG. 5A has a symmetric heating structure and that of FIG. 20A has an asymmetric heating structure comprising an off-centered first chamber.

Figure 58A:
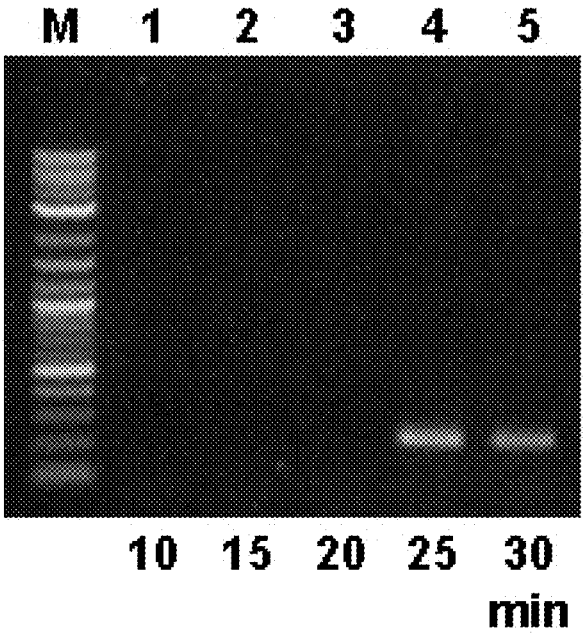
Figure 58B:
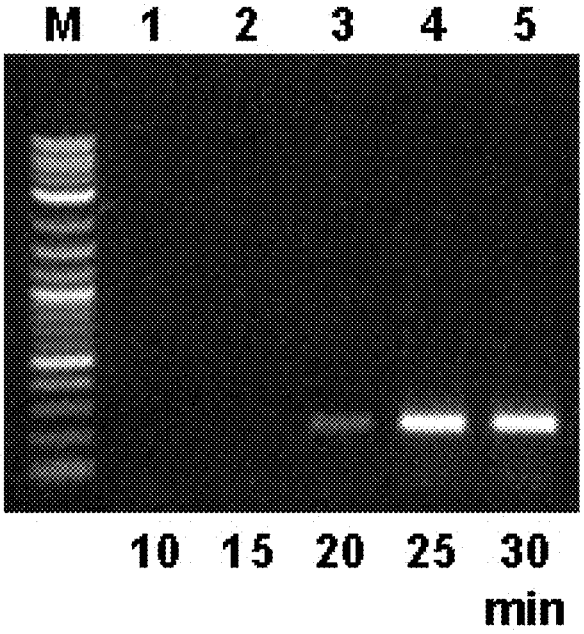

FIGS. 58A-B are results of thermal convection PCR using the apparatuses of FIGS. 5A and 20A, respectively, for amplification of a 216 bp human genome target. The apparatus of FIG. 5A has a symmetric heating structure and that of FIG. 20A has an asymmetric heating structure comprising an off-centered first chamber.

Figure 59A:
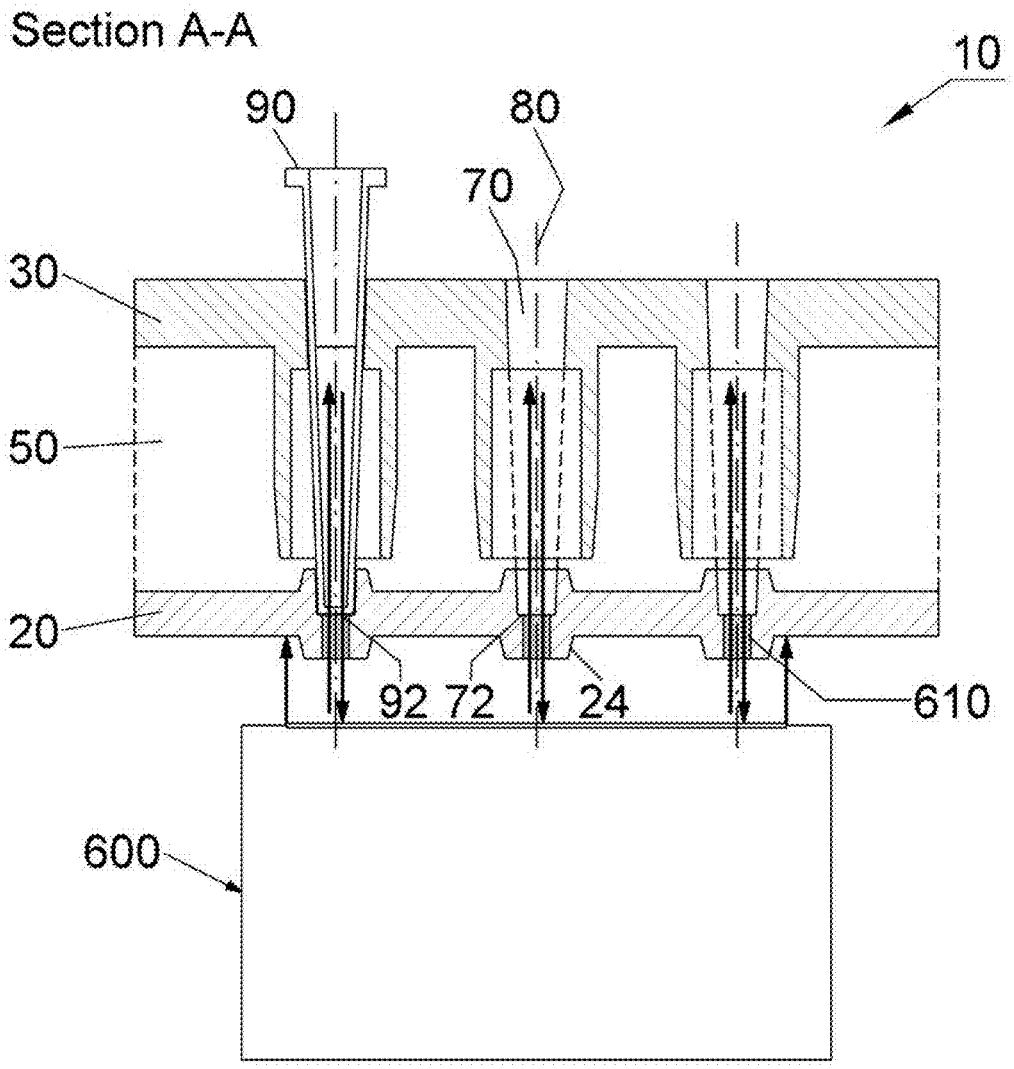
Figure 59B:
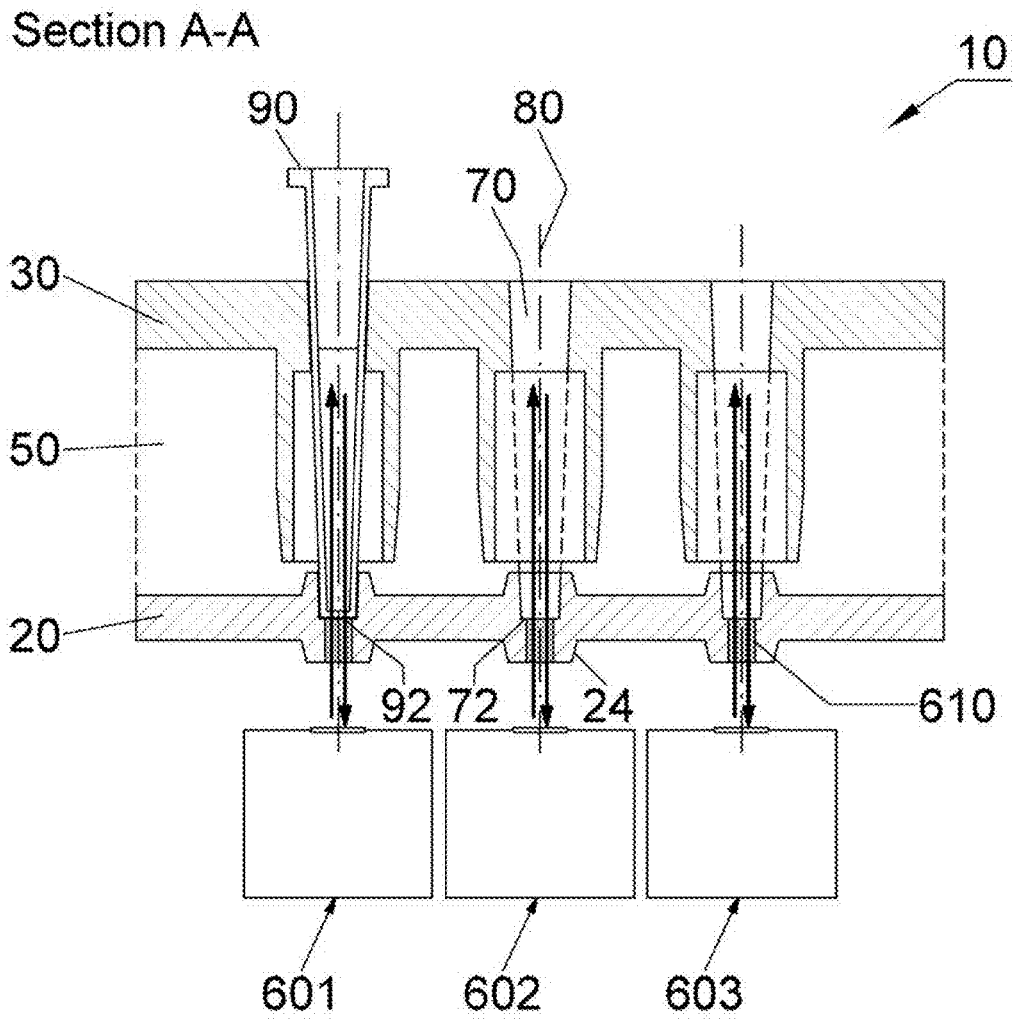

FIG. 59A-B are schematic drawings showing sectional views of apparatus embodiments having one or more optical detection units 600-603 spaced from the first heat source 20 along the channel axis 80 and sufficient to detect a fluorescence signal from the samples in the reaction vessels 90. The apparatus includes a single optical detection unit 600 to detect the fluorescence signal from multiple reaction vessels (FIG. 59A) or multiple optical detection units 601-603 (FIG. 59B) to detect the fluorescence signal from each reaction vessel. In the embodiments shown in FIGS. 59A-B, the optical detection unit detects the fluorescence signal from the bottom end 92 of the reaction vessel 90. The first heat source 20 comprises an optical port 610 positioned about the channel axis 80 between the bottom end 72 of the channel 70 and the first heat source protrusion 24 that provides a path for the excitation and emission of light parallel to the channel axis 80 (shown as upward and downward arrows, respectively).

Figure 60A:
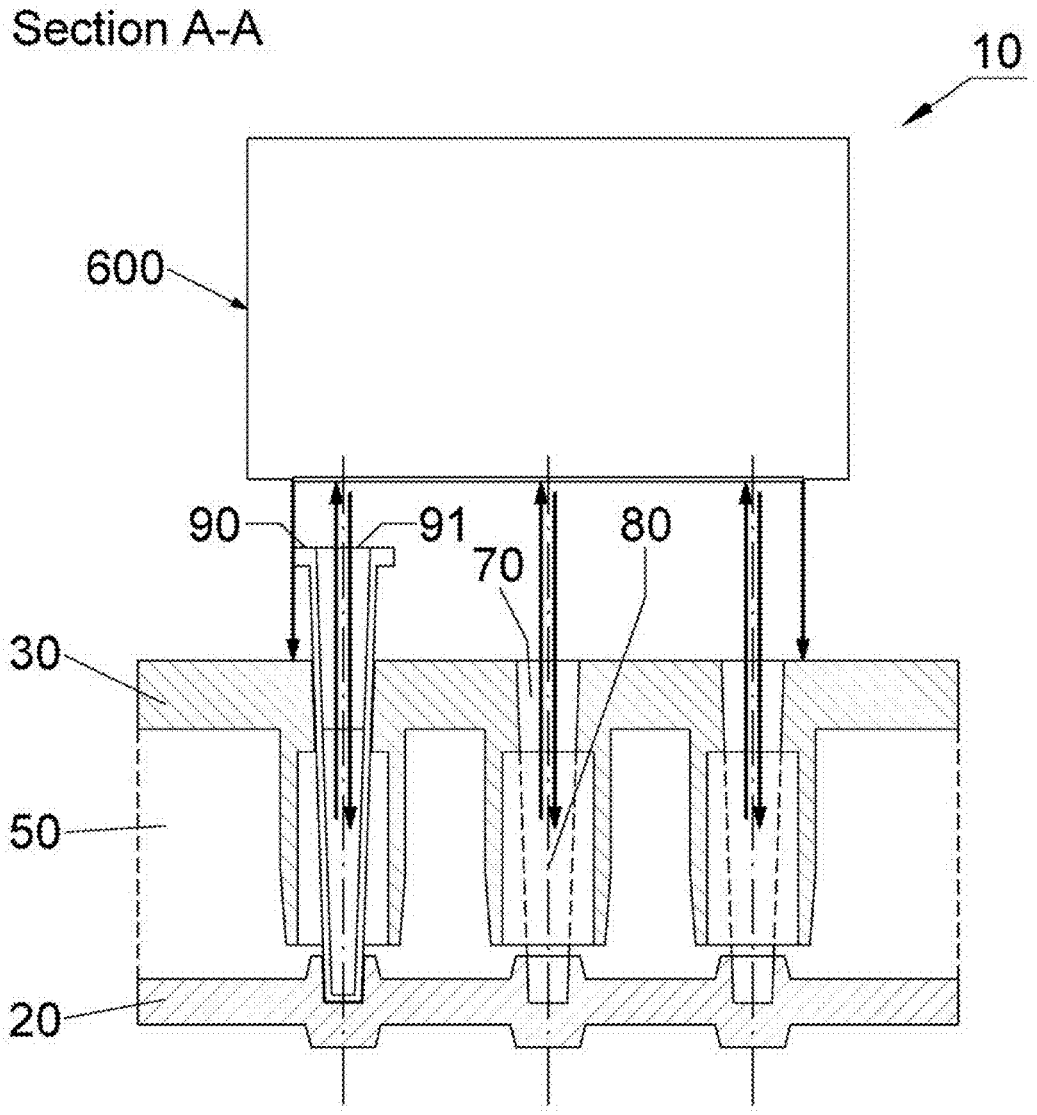
Figure 60B:
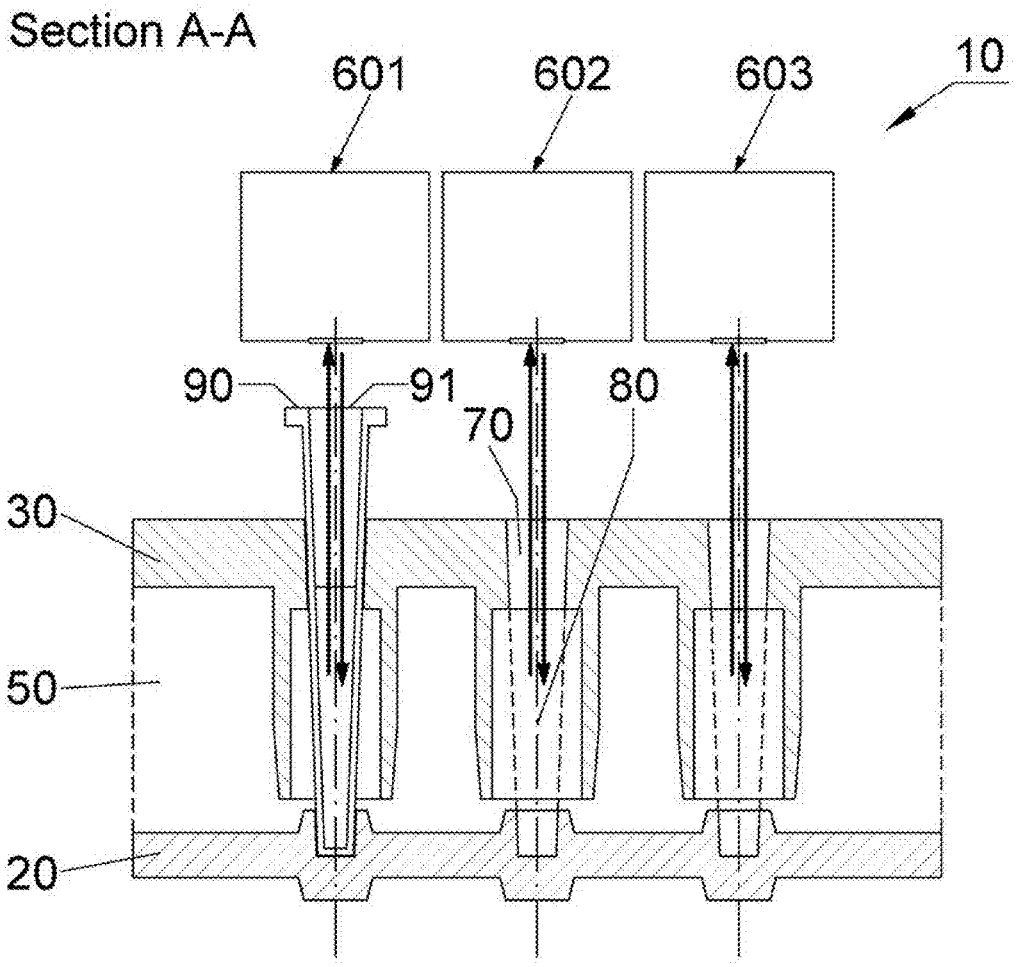

FIGS. 60A-B are schematic drawings showing sectional views of apparatus embodiments having one optical detection unit 600 (FIG. 60A) or more than one optical detection units 601-603 (FIG. 60B). Each of optical detection units 600-603 is spaced from the second heat source 30 along the channel axis 80 sufficient to detect a fluorescence signal from the samples located in the reaction vessels 90. In these embodiments, a center part of a reaction vessel cap (not shown) that typically fits to the top opening of the reaction vessel 90 functions as an optical port for the excitation and emission light parallel to the channel axis 80 (shown in FIGS. 60A-B as downward and upward arrows, respectively).

Figure 61:
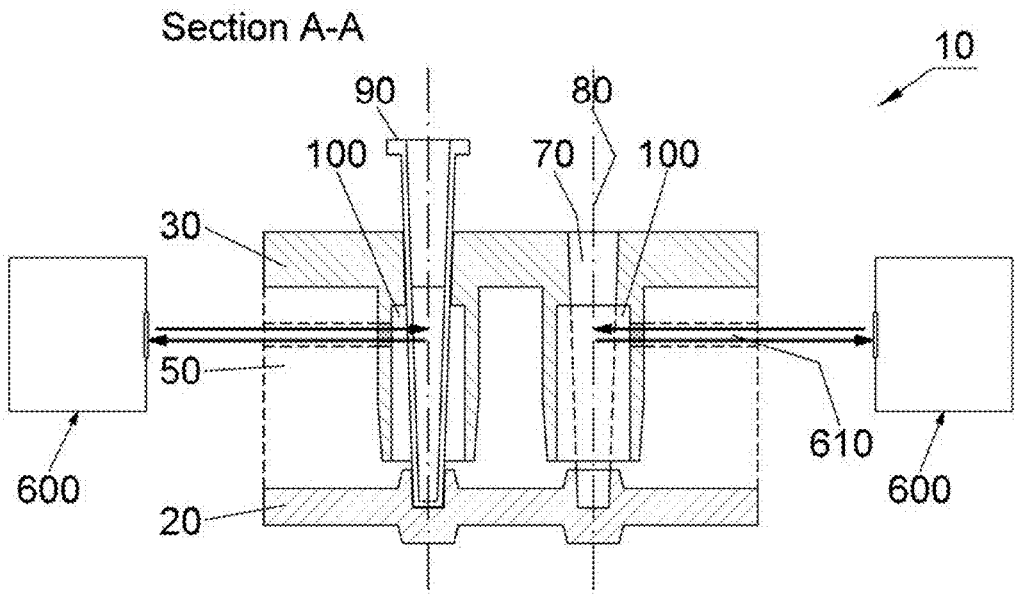

FIG. 61 is a schematic drawing showing a sectional view of an apparatus embodiment having an optical detection unit 600 spaced from the second heat source 30. In this embodiment, the optical port 610 is positioned in the second heat source 30 (shown as gray rectangular boxes) and the first insulator 50 (shown as dashed lines) along a path perpendicular to the channel axis 80 toward the optical detection unit 600 sufficient to detect a fluorescence signal from the side of the samples in the reaction vessels 90. The optical port 610 provides a path for the excitation and emission light between the reaction vessel 90 and the optical detection unit 600 (shown as left and right pointing arrows or vice versa). A side part of the reaction vessel 90 and a portion of the first chamber 100 along the light path also function as optical port in this embodiment.

Figure 62:
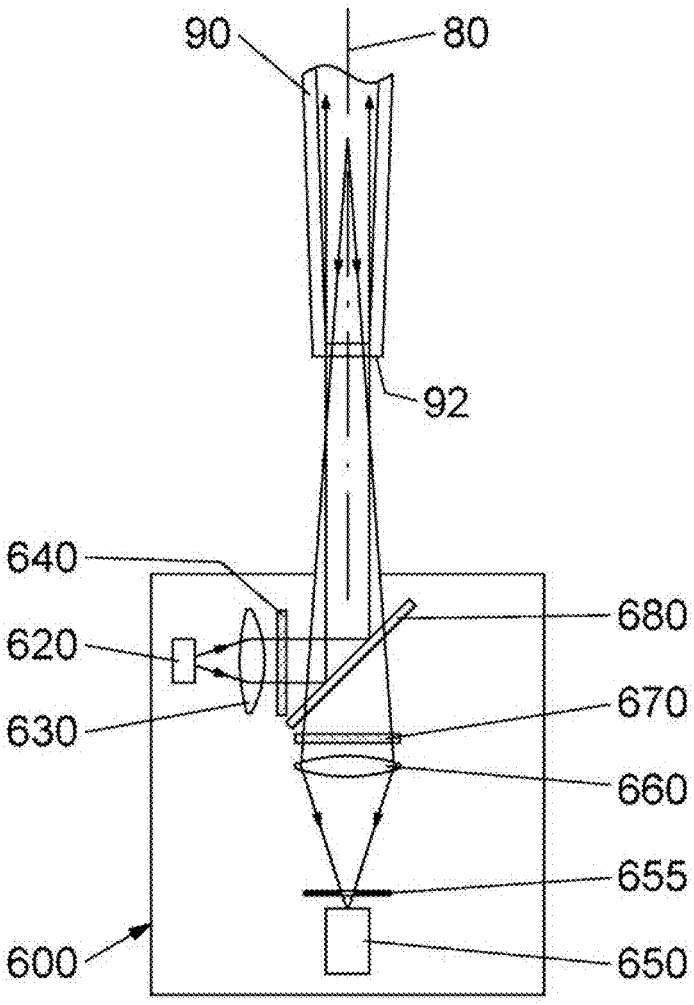

FIG. 62 is a schematic drawing showing a sectional view of an optical detection unit 600 positioned to detect a fluorescence signal from the bottom end 92 of the reaction vessel 90. In this embodiment, a light source 620, an excitation lens 630, and an excitation filter 640 that are configured to generate an excitation light are located along a direction at a right angle with respect to the channel axis 80, and a detector 650, an aperture or slit 655, an emission lens 660, and an emission filter 670 that are operable to detect an emission light are located along the channel axis 80. A dichrocic beam-splitter 680 that transmits the fluorescence emission and reflects the excitation light is also shown.

Figure 63:
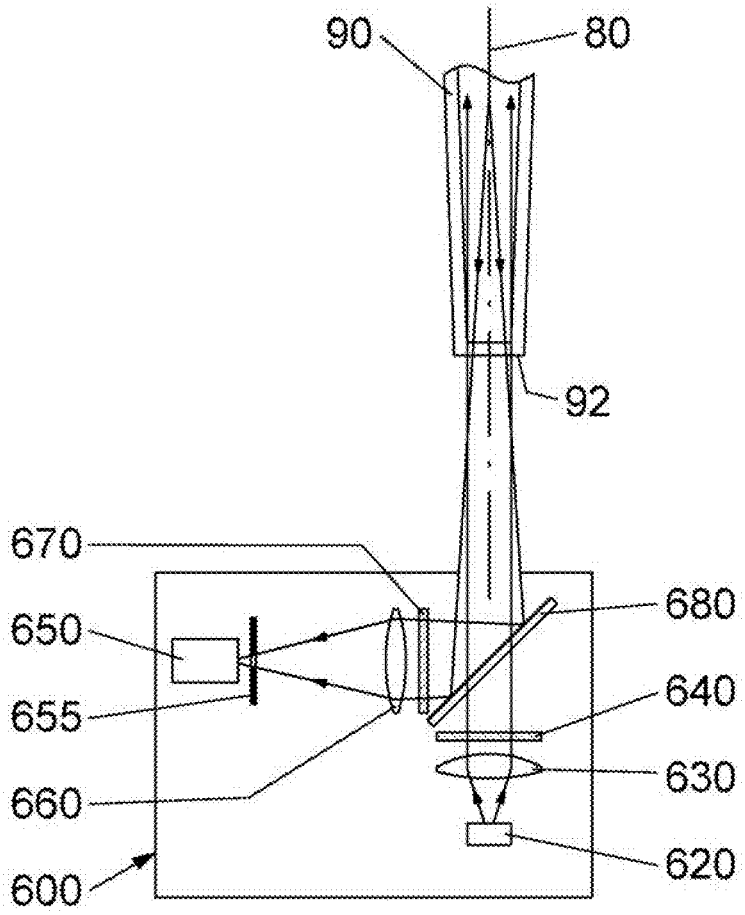

FIG. 63 is a schematic drawing showing a sectional view of an optical detection unit 600 positioned to detect a fluorescence signal from the bottom end 92 of the reaction vessel 90. In this embodiment, a light source 620, an excitation lens 630, and an excitation filter 640 are positioned to generate an excitation light along the channel axis 80. A detector 650, an aperture or slit 655, an emission lens 660, and an emission filter 670 are positioned to detect an emission light as located along a direction at a right angle with respect to the channel axis 80. A dichrocic beam-splitter 680 that transmits the excitation light and reflects the fluorescence emission is shown.

Figure 64A:
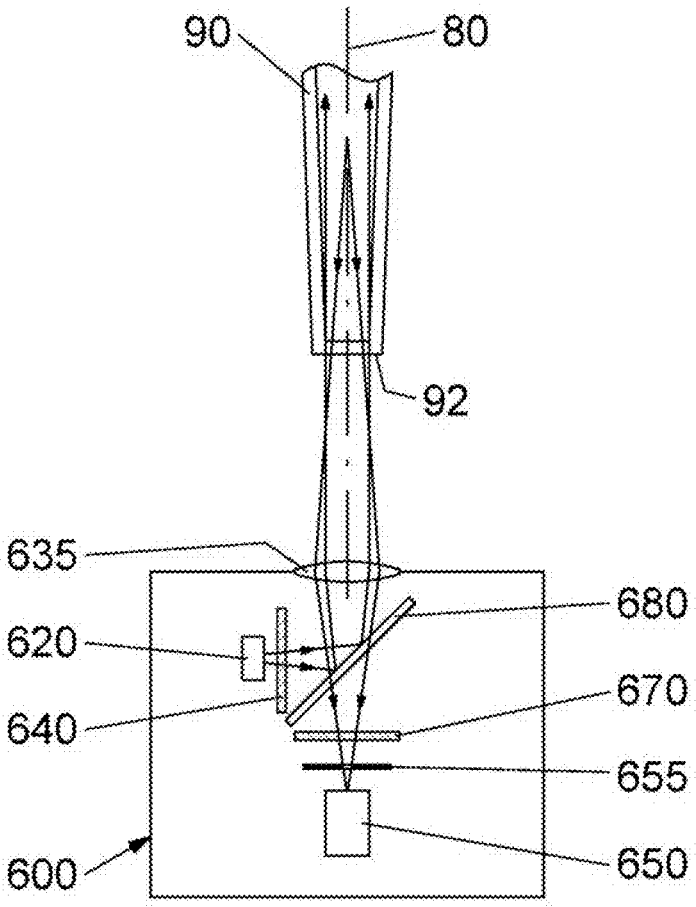
Figure 64B:
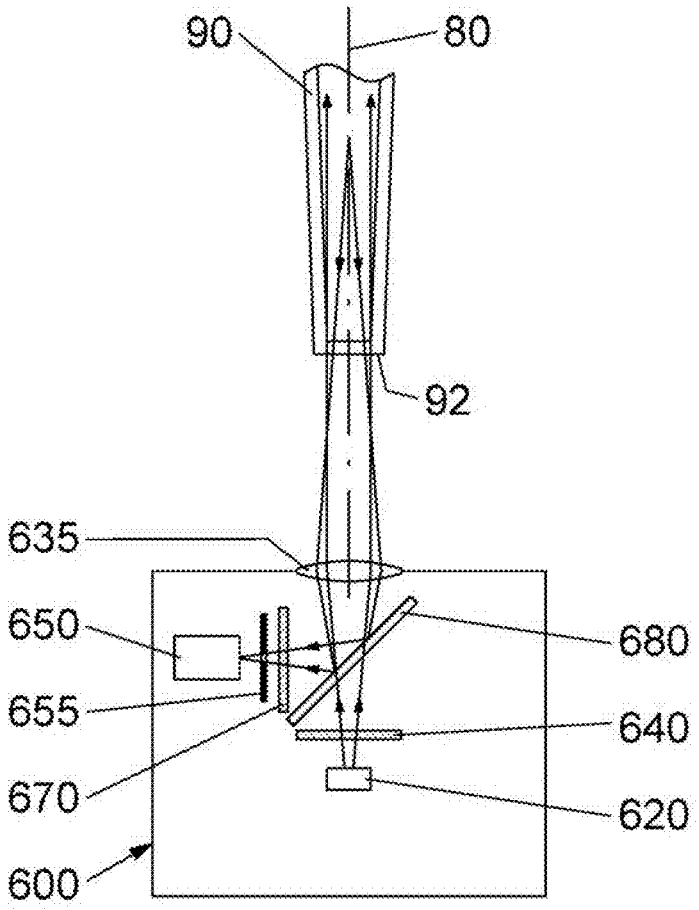

FIGS. 64A-B are schematic drawings showing sectional views of an optical detection unit 600 positioned to detect a fluorescence signal from the bottom end 92 of the reaction vessel 90. In these embodiments, a single lens 635 is used to shape the excitation light and also to detect the fluorescence emission. In the embodiment shown in FIG. 64A, the light source 620 and the excitation filter 640 are located along a direction at a right angle to the channel axis 80. In the embodiment shown in FIG. 64B, the optical elements for detecting the fluorescence emission (650, 655, and 670) are located along a direction at a right angle to the channel axis 80.

Figure 65:
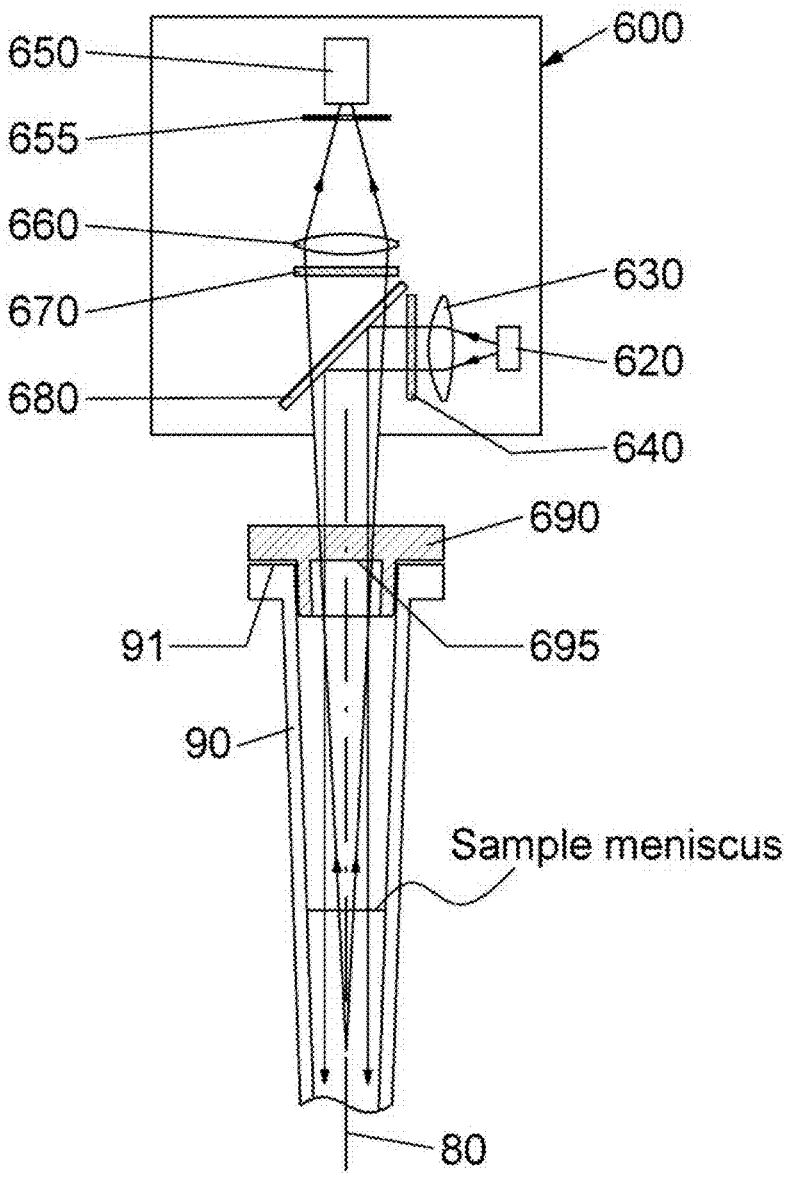

FIG. 65 is a schematic drawing showing a sectional view of an optical detection unit 600 positioned to detect a fluorescence signal from the top end 91 of the reaction vessel 90. As in FIG. 62, the light source 620, the excitation lens 630, and the excitation filter 640 are located along a direction at a right angle to the channel axis 80, and the detector 650, the aperture or slit 655, the emission lens 660, and the emission filter 670 are located along the channel axis 80. Also shown in this embodiment is a reaction vessel cap 690 sealably attached to the top end 91 of the reaction vessel 90 and including an optical port 695 disposed around a center point of the top end 91 of the reaction vessel 90 and for transmission of the excitation and emission light. The optical port 695 is further defined by the upper part of the reaction vessel cap 690 and the upper part of the reaction vessel 90 in this embodiment.

Figure 66A:
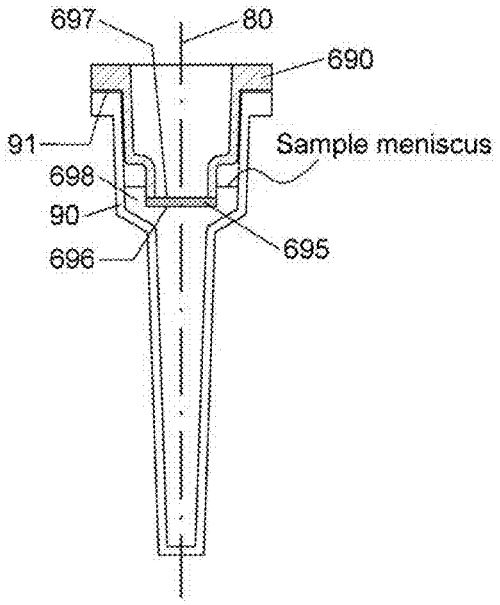
Figure 66B:
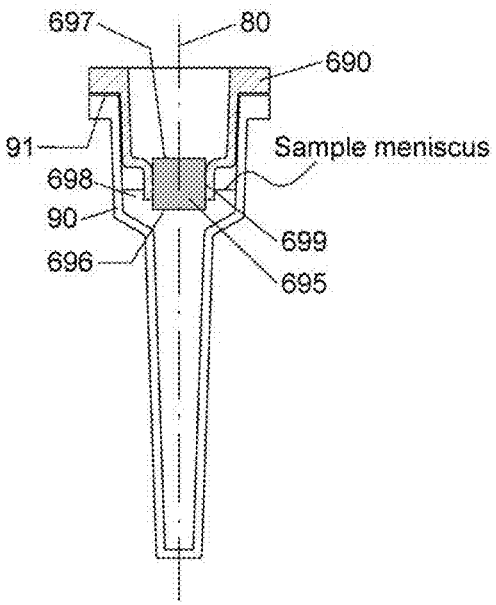

FIGS. 66A-B are schematic drawings showing sectional views of reaction vessels 90 with reaction vessel caps 690 and optical ports 695. The reaction vessel cap 690 is sealably attached to the upper part of the reaction vessel 90 and the optical port 695. In these embodiments, the bottom end 696 of the optical port 695 is made to contact the sample when the reaction vessel 90 is sealed with the reaction vessel cap 690. An open space 698 is provided on the side of the bottom end 696 of the optical port 695 and the reaction vessel cap 690 so that the sample can fill up the open space when the reaction vessel 90 is sealed with the reaction vessel cap 690. The sample meniscus is located higher than the bottom end 696 of the optical port 695. In FIGS. 66A-B, the optical port 695 is disposed around a center point of the lower part of the reaction vessel cap 690 and is further defined by the lower part of the reaction vessel cap 690 and the upper part of the reaction vessel 90.

Figure 67:
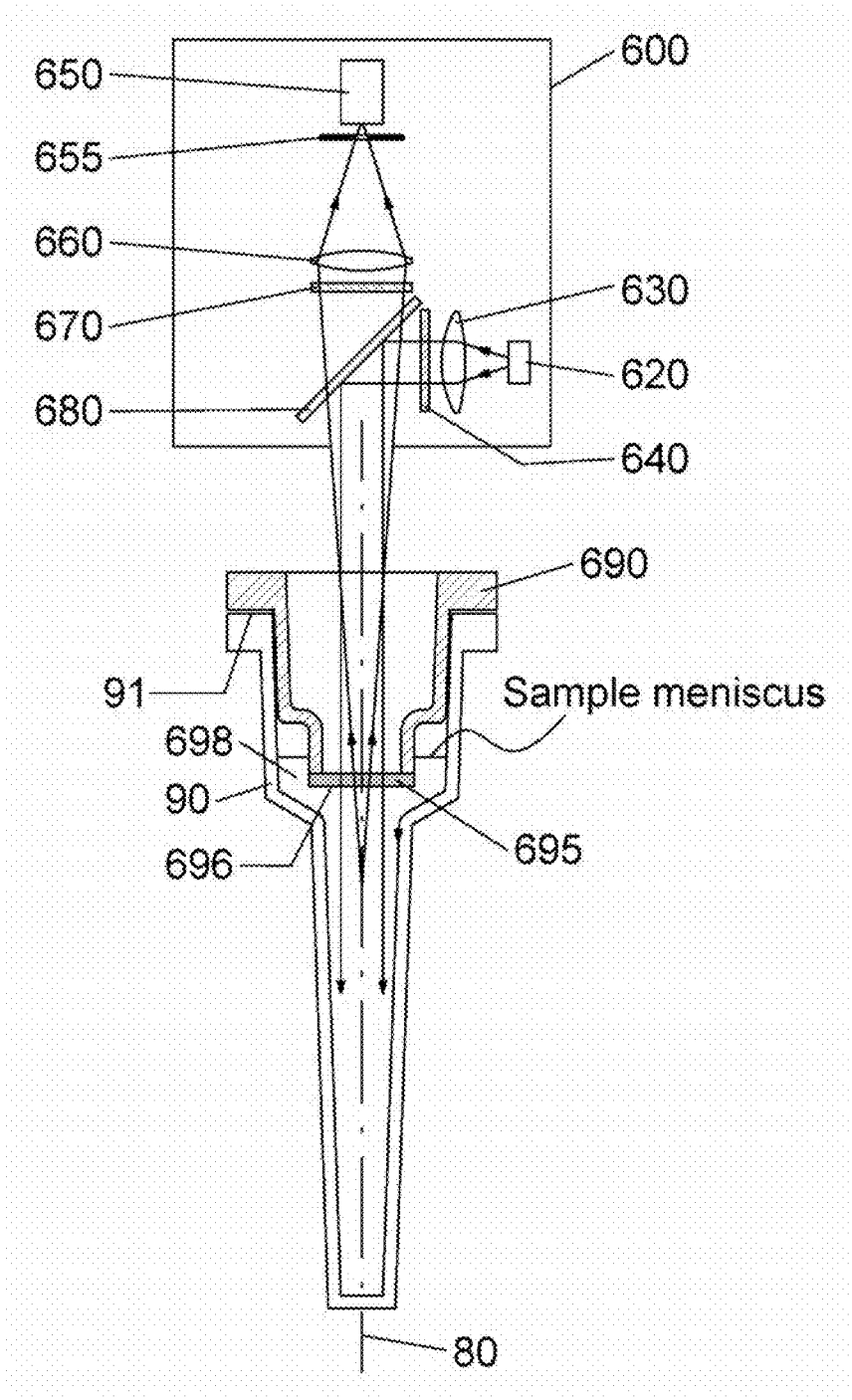

FIG. 67 is a schematic drawing showing a sectional view of a reaction vessel 90 with an optical detection unit 600 disposed above the reaction vessel 90. The reaction vessel 90 is sealed with the reaction vessel cap 690 having an optical port 695 disposed around a center point of the upper part of the reaction vessel 90 sufficient to make contact with sample. In this embodiment, the excitation light and the fluorescence emission pass through the optical port 695 and reach the sample or vice versa without passing air contained inside the reaction vessel 90.

DETAILED DESCRIPTION

The following figure key may help the reader better appreciate the invention including the Drawings and claims:

10: Apparatus embodiment
20: First heat source (bottom stage)
21: Top surface of the first heat source
22: Bottom surface of the first heat source
23: First heat source protrusion (pointing toward the second heat source)
24: First heat source protrusion (pointing toward table)
30: Second heat source (intermediate stage)
31: Top surface of the second heat source
32: Bottom surface of the second heat source
33: Second heat source protrusion (pointing toward the first heat source)
34: Second heat source protrusion (pointing away from the top of the second heat source)
50: First insulator (or first insulating gap)
51: First insulator chamber
70: Channel
71: Top end of the channel/through hole
72: Bottom end of the channel
73: receptor hole
74: receptor hole gap
80: (Center) axis of the channel
90: Reaction vessel
91: Top end of the reaction vessel
92: Bottom end of the reaction vessel
93: Outer wall of the reaction vessel
94: Inner wall of the reaction vessel
95: (Center) axis of the reaction vessel
100: First Chamber
101: Top end of the first chamber, defining an upper limit of the chamber
102: Bottom end of the first chamber, defining a lower limit of the chamber
103: First wall of the first chamber, defining a horizontal limit of the chamber
105: Gap of the first chamber
106: (Center) axis of the first chamber
110: Second Chamber
111: Top end of the second chamber
112: Bottom end of the second chamber
113: First wall of the second chamber
115: Gap of the second chamber
120: Third Chamber
121: Top end of the third chamber
122: Bottom end of the third chamber
123: First wall of the third chamber
125: Gap of the third chamber
130: First thermal brake
131: Top end of the first thermal brake
132: Bottom end of the first thermal brake
133: First wall of the first thermal brake, essentially contacting at least part of the channel
140: Second thermal brake
141: Top end of the second thermal brake
142: Bottom end of the second thermal brake
143: First wall of the second thermal brake, essentially contacting at least part of the channel
160: Heating/cooling elements
**160*a***: Heating (and/or cooling) element of the first heat source
**160*b***: Heating (and/or cooling) element of the second heat source
170: Temperature Sensors
**170*a***: Temperature sensor of the first heat source
**170*b***: Temperature sensor of the second heat source
200: First securing element comprising at least one of following elements
201: Screw or fastener (typically made of a thermal insulator)
**202*a***: Washer or positioning standoff (typically made of a thermal insulator)
**202*b***: Spacer or positioning standoff (typically made of a thermal insulator)
**203*a***: Securing element of the first heat source
**203*b***: Securing element of the second heat source
210: Second securing element (typically made as a wing structure)
Used to assemble the heat source assembly to the first housing element 300
300: First housing element
310: Second insulator (or second insulating gap)
Located between the sides of the heat sources and the side walls of the first housing element; and
Filled with a thermal insulator such as air, a gas, or a solid insulator
320: Third insulator (or third insulating gap)
Located between the bottom of the first heat source and the bottom wall of the first housing element; and
Filled with a thermal insulator such as air, a gas, or a solid insulator
330: Support
400: Second housing element
410: Fourth insulator (or Fourth insulating gap)
Located between the side walls of the first housing element and those of the second housing element; and
Filled with a thermal insulator such as air, a gas, or a solid insulator
420: Fifth insulator (or fifth insulating gap)
Located between the bottom wall of the first housing element and that of the second housing element; and
Filled with a thermal insulator such as air, a gas, or a solid insulator.
500: Centrifuge unit
501: Motor
510: Axis of centrifugal rotation
520: Rotation arm
530: Tilt shaft
600-603: Optical detection units
610: Optical port
620: Light source
630: Excitation lens
635: Lens
640: Excitation filter
650: Detector
655: Aperture or slit
660: Emission lens
670: Emission filter
680: Dichroic beam-splitter
690: Reaction vessel cap
695: Optical port
696: Bottom end of optical port
697: Top end of optical port
698: Open space between inner wall of reaction vessel and side wall of optical port
699: Side wall of optical port As discussed, and in one embodiment, the present invention features a two-stage thermal convection apparatus adapted to perform thermal convection PCR amplification.

In one embodiment, the apparatus includes as operably linked components the following elements:

(a) a first heat source for heating or cooling a channel and comprising a top surface and a bottom surface, the channel being adapted to receive a reaction vessel for performing PCR, (b) a second heat source for heating or cooling the channel and comprising a top surface and a bottom surface, the bottom surface facing the top surface of the first heat source, wherein the channel is defined by a bottom end contacting the first heat source and a through hole contiguous with the top surface of the second heat source, and further wherein center points between the bottom end and the through hole form a channel axis about which the channel is disposed, (c) at least one temperature shaping element such as at least one gap or space (e.g., a chamber) disposed around the channel and within at least part of the second or first heat source, the chamber gap being sufficient to reduce heat transfer between the second or first heat source and the channel; and (e) a receptor hole adapted to receive the channel within the first heat source.

In operation, the apparatus uses multiple heat sources such as two, three, four or more heat sources, preferably two heat sources positioned within the apparatus so that each is essentially parallel to the other heat source in typical embodiments. In this embodiment, the apparatus will generate a temperature distribution suitable for a convection-based PCR process that is fast and efficient. A typical apparatus includes a plurality of channels disposed within the first and second heat sources so that a user can perform multiple PCR reactions at the same time. For instance, the apparatus can include at least one or two, three, four, five, six, seven, eight, nine channels up to about ten, eleven, or twelve channels, twenty, thirty, forty, fifty, or up to several hundred channels extending through the first and second heat sources, with between about eight to about one hundred channels being generally preferred for many invention applications. A preferred channel function is to receive a reaction vessel holding the user's PCR reaction and to provide direct or indirect thermal communication between the reaction vessel and at least one of and preferably all of a) the heat sources, b) the temperature shaping element(s), and c) the receptor hole.

The relative position of each of the two heat sources to the other is an important feature of the invention. The first heat source of the apparatus is typically located on the bottom and maintained at a temperature suitable for nucleic acid denaturation, and the second heat source is typically located on the top and maintained at a temperature suitable for annealing of denatured nucleic acid template with one or more oligonucleotide primers. In some embodiments, the second heat source is maintained at a temperature suitable for both annealing and polymerization. Thus in one embodiment, the bottom part of the channel in the first heat source and the top part of the channel in the second heat source are subject to a temperature distribution suitable for the denaturation and annealing steps of the PCR reaction, respectively. In between the top and bottom part of the channel is the transition region in which temperature change from the denaturation temperature of the first heat source (the high temperature) to the annealing temperature of the second heat source (the low temperature) takes place. Thus, in typical embodiments, at least part of the transition region is subject to a temperature distribution suitable for polymerization of the primer along the denaturated template. When the second heat source is maintained at a temperature suitable for both annealing and polymerization, the top part of the channel in the second heat source also provides a temperature distribution suitable for the polymerization step in addition to an upper part of the transition region. Therefore, temperature distribution in the transition region is important for achieving efficient PCR amplification, particularly regarding the primer extension. Thermal convection inside the reaction vessel typically depends on the magnitude and direction of the temperature gradient generated in the transition region, and thus temperature distribution in the transition region is also important for generating suitable thermal convection inside the reaction vessel that is conducive to PCR amplification. Various temperature shaping elements can be used with the apparatus to generate a suitable temperature distribution in the transition region to support fast and efficient PCR amplification.

Typically, each individual heat source is maintained at a temperature suitable for inducing each step of thermal convection PCR. Moreover, and in embodiments in which the apparatus features two heat sources, temperatures of the two heat sources are suitably arranged to induce thermal convection across a sample inside a reaction vessel. One general condition for inducing suitable thermal convection according to the invention is, a heat source maintained at a higher temperature is located at a lower position within the apparatus than a heat source maintained at a lower temperature. Thus in a preferred embodiment comprising two heat sources, the first heat source is positioned lower in the apparatus than the second heat source.

As discussed, it is an object of the invention to provide an apparatus with at least one temperature shaping element. In most embodiments, each channel of the apparatus will include less than about ten of such elements, for example, one, two, three, four, five, six, seven, eight, nine or ten of the temperature shaping elements for each channel. One function of the temperature shaping element is to provide for efficient thermal convection mediated PCR by providing a structural or positional feature that supports PCR. As will be more apparent from the examples and discussion which follows, such features include, but are not limited to, at least one gap or space such as a chamber; at least one insulator or insulating gap located between the heat sources; at least one thermal brake; at least one protrusion structure in at least one of the first and second heat sources; at least one asymmetrically disposed structure within the apparatus, particularly in at least one of the channels, first heat source, second heat source, gap such as a chamber, thermal brake, protrusion, first insulator, or the receptor hole; or at least one structural or positional asymmetry. Structural asymmetry is typically defined in reference to the channel and/or channel axis. An example of positional asymmetry is tilting or otherwise displacing the apparatus with respect to the direction of gravity.

The words "gap" and "space" will often be used herein interchangeably. A gap is a small enclosed or semi-enclosed space within the apparatus that is intended to assist thermal convection PCR. A large gap or large space with a defined structure will be referred to herein as a "chamber". In many embodiments, the chamber will include a gap and be referred to herein as a "chamber gap". A gap may be empty, filled or partially filled with an insulating material as described herein. For many applications, a gap or chamber filled with air will be generally useful.

One or a combination of temperature shaping elements (the same or different) can be used with the invention apparatus. Illustrative temperature shaping elements will now be discussed in more detail.

Illustrative Temperature Shaping Elements

A. Gap or Chamber

In one embodiment of the present apparatus, each channel will include at least one gap or chamber as the temperature shaping element. In a typical embodiment, the apparatus will include one, two or even three chambers disposed around each channel and within at least the second heat source. Alternatively, or in addition, the apparatus may feature at least one chamber that is disposed around the channel within the first heat source. However for many embodiments, it is preferred to have at least one chamber disposed around the channel within the second heat source, but no chamber structure disposed within the first heat source. In this example of the invention, the chamber creates a space between the channel and the second (or sometimes first) heat source that allows the user to precisely control temperature distribution within the apparatus. That is, the chamber assists in shaping the temperature distribution of the channel in the transition region. By "transition region" is meant the region of the channel roughly in between an upper part of the channel that contacts the second heat source and a lower part of the channel that contacts the first heat source. The chamber can be positioned nearly anywhere around the channel provided intended results are achieved. For instance, positioning the chamber (or more than one chamber) within or near the second heat source will be useful in many invention applications. Although less preferred, the chamber may also reside in the first heat source or both the first and second heat sources. In embodiments in which a channel in the apparatus has multiple chambers, each chamber may be separated from the other and may in some instances contact one or more other chambers within the apparatus.

One or a combination of different gap or chamber structures is compatible with the invention. As general requirements, the chamber should generate a temperature distribution in the transition region that fulfills at least one and preferably all of the following conditions: (1) the temperature gradient generated (particularly across the vertical profile of the channel) must be large enough so as to generate a thermal convection across the sample inside the reaction vessel; and (2) the thermal convection thus generated by the temperature gradient must be sufficiently slow (or appropriately fast) so that sufficient time periods can be provided for each step of the PCR process. In particular, it is especially important to make the time period of the polymerization step sufficiently long since the polymerization step typically takes more time than the denaturation and annealing steps. Examples of particular gap or chamber configurations are disclosed below.

If desired, the channel within an invention apparatus may have at least one chamber disposed essentially symmetrically or asymmetrically about the channel axis. In many embodiments, an apparatus with one, two or three chambers will be preferred. The chambers may be disposed in one or a combination of the heat sources, for example, the second heat source, the first heat source, or both the second and first heat sources. For many apparatuses, having one, two, or three chambers within the second heat source will be especially useful. Examples of such chamber embodiments are provided below.

In one embodiment, the chamber will be further defined by what is referred to herein as a "protrusion" from at least one of the first heat source and the second heat source. In a particular embodiment, the protrusion will extend from the second heat source toward the first heat source in a direction generally parallel to the channel axis. Other embodiments are possible such as including a second protrusion extending away from the top surface of the second heat source generally parallel to the channel axis. Additional embodiments include an apparatus with a protrusion extending from the first heat source toward the second heat source generally parallel to the channel axis. Still further embodiments include an apparatus with a second protrusion extending away from the bottom surface of the first heat source also generally parallel to the channel axis. In some embodiments, the apparatus may comprise at least one protrusion that is tilted with respect to the channel axis. In these examples of the invention, it is possible to substantially reduce the volume of the first and/or second heat sources as well as the heat transfer between the two heat sources while lengthening chamber dimensions along the channel axis. These features have been found to enhance thermal convection PCR efficiency while reducing power consumption.

FIGS. 2A, 3A, 4A, 5A, 11A, 11B, 12A, 14A, 18A, and 20A provide a few examples of acceptable chambers for use with the invention. Other suitable chamber structures are disclosed below.

B. Thermal Brake

Each channel within an invention apparatus may include one, two, three or more thermal brakes, typically one or two thermal brakes to control the temperature distribution within the apparatus. In many embodiments, the thermal brake will be defined by a top and bottom end and a wall that will be in optional thermal contact with the channel. The thermal brake is typically disposed adjacent or near a wall of the gap or chamber (if present). An undesirable intrusion of a temperature profile from one heat source to another (typically from the first heat source to the second heat source) can be controlled and usually reduced by including the thermal brake as a temperature shaping element. As will be described in more detail below, it was found that thermal convection PCR amplification efficiency is sensitive to the position and thickness of the thermal brake. An acceptable thermal brake may be disposed with respect to the channel either symmetrically or asymmetrically.

One or more thermal brakes as described herein may be placed in nearly any position around each channel of the apparatus provided intended results are achieved. Thus in one embodiment, a thermal brake can be positioned adjacent or near a chamber within the second heat source to block or reduce undesired heat flow from the first heat source and achieve suitable PCR amplification.

FIGS. 4B, 13B, 14B, 20C, 23B, 24B, 26B, and 27B provide a few examples of suitable thermal brakes for use with the invention. Other suitable thermal brakes are disclosed below.

C. Positional or Structural Asymmetry

It was found that thermal convection PCR was faster and more efficient when an invention apparatus included at least one positional or structural asymmetric element, for example, one, two, three, four, five, or six of such elements for each channel. Such elements can be placed around one or more channels up to the entire apparatus. Without wishing to be bound by theory, it is believed that presence of an asymmetric element within the apparatus increases the buoyancy force in ways that make the amplification process faster and more efficient. It has been found that by introducing at least one positional or structural asymmetry within the apparatus that can cause "horizontally asymmetric heating or cooling" with respect to the channel axis or the direction of gravity, it is possible to assist thermal convection PCR. Without wishing to be bound by theory, it is believed that an apparatus with at least one asymmetric element therein breaks apparatus symmetry with regard to heating or cooling the channel and helps or enhances generation of the buoyancy force so as to make the amplification process faster and more efficient. By a "positional asymmetric element" is meant that a structural element that makes the channel axis or the apparatus tilted with respect to the direction of gravity. By a "structural asymmetric element" is meant that a structural element that is not symmetrically disposed within the apparatus with respect to the channel and/or channel axis.

As discussed, it is necessary to generate a vertical temperature gradient inside a sample fluid in order to generate thermal convection (and also to fulfill the temperature requirements for the PCR process). However, even in the presence of a vertical temperature gradient, the buoyancy force that induces the thermal convection may not be generated if isothermal contours of the temperature distribution are flat (i.e., horizontal) with respect to the direction of gravity (i.e., the vertical direction). Within such a flat temperature distribution, the fluid does not experience any buoyancy force since each part of the fluid has the same temperature (and thus the same density) as other parts of the fluid at the same height. In symmetric embodiments, all the structural elements are symmetric with respect to the channel or channel axis and the direction of gravity is aligned essentially parallel to the channel or channel axis. In such symmetric embodiments, isothermal contours of the temperature distribution inside the channel or the reaction vessel often become nearly or perfectly flat with respect to the gravitational field, and thus it is often difficult to generate the thermal convection that is sufficiently fast. Without wishing to be bound by theory, it is believed that presence of certain perturbations that can induce a fluctuation or instability in the temperature distribution often helps or enhances generation of the buoyancy force and makes the PCR amplification faster and more efficient. For instance, a small vibration that typically exists in usual environment may disturb the near or perfectly flat temperature distribution, or a small structural defect in the apparatus may break the symmetry of the channel/chamber structure or the reaction vessel structure so as to disturb the near or perfectly flat temperature distribution. In such a perturbed temperature distribution, the fluid can have different temperature for at least part of the fluid as compared to other part of the fluid at the same height, and thus the buoyancy force can be readily generated due to such temperature fluctuation or instability. Such natural or incidental perturbations are usually important in generating the thermal convection in the symmetric embodiments. When a positional or structural asymmetry is present within the apparatus, the temperature distribution within the channel or the reaction vessel can be controllably made uneven at the same height (i.e., horizontally uneven or asymmetric). In the presence of such horizontally asymmetric temperature distribution, the buoyancy force can be readily and usually more strongly generated so as to make the thermal convection PCR faster and more efficient. Useful positional or structural asymmetric elements cause "horizontally asymmetric heating or cooling" of the channel with respect to the channel axis or the direction of gravity.

Asymmetry can be introduced into an invention apparatus by one or a combination of strategies. In one embodiment, it is possible to make an invention apparatus with a positional asymmetry imposed on the apparatus, for example, by tilting the apparatus or the channel with respect to the direction of gravity. Nearly any of the apparatus embodiments disclosed herein can be tilted by incorporating a structure capable of offsetting the channel axis with respect to the direction of gravity. An example of an acceptable structure is a wedge or related inclined shape, or an inclined or tilted channel. See FIGS. 11A-B for examples of this invention embodiment.

In other embodiments, at least one of the following elements can be asymmetrically disposed within the apparatus with respect to the channel axis: a) the channel, b) a gap such as a chamber, c) the receptor hole d) the first heat source, e) the second heat source, f) the thermal brake; and g) the insulator. Thus in one invention embodiment, the apparatus features a chamber as the structural asymmetric element. In this invention example, the apparatus may include one or more other structural asymmetric elements such as the channel, receptor hole, thermal brake, insulator, or one or more of the heat sources. In another embodiment, the structural asymmetric element is the receptor hole. In yet another embodiment, the structural asymmetric element is the thermal brake or more than one thermal brake. The apparatus may include one or more other asymmetric or symmetric structural elements such as the first heat source, the second heat source, the chamber, the channel, the insulator etc.

In embodiments in which the first heat source and/or the second heat source feature a structural asymmetric element, the asymmetry may reside particularly in a protrusion (or more than one protrusion) that extends generally parallel to the channel axis.

Further examples are provided below. In particular, see FIGS. 17A-B, 18A-D, 19A-B, 21, and 22.

As discussed, one or both of the channel and chamber can be symmetrically or asymmetrically disposed in the apparatus with respect to the channel axis. See also FIGS. 8A-J, 9A-I, and 10A-P for examples in which the channel and/or chamber are the symmetric or asymmetric structural element.

It will often be desirable to have an apparatus in which the receptor hole is the structural asymmetric element. Without wishing to be bound to any theory, it is believed that the region between the receptor hole and the bottom end of the chamber or the second heat source is a location in the apparatus where a major driving force for thermal convection flow is generated. As will be readily apparent, this region is where initial heating to the highest temperature (i.e., the denaturation temperature) and transition toward a lower temperature (i.e., the polymerization temperature) take place, and thus the largest driving force should originate from this region.

Figure 15:
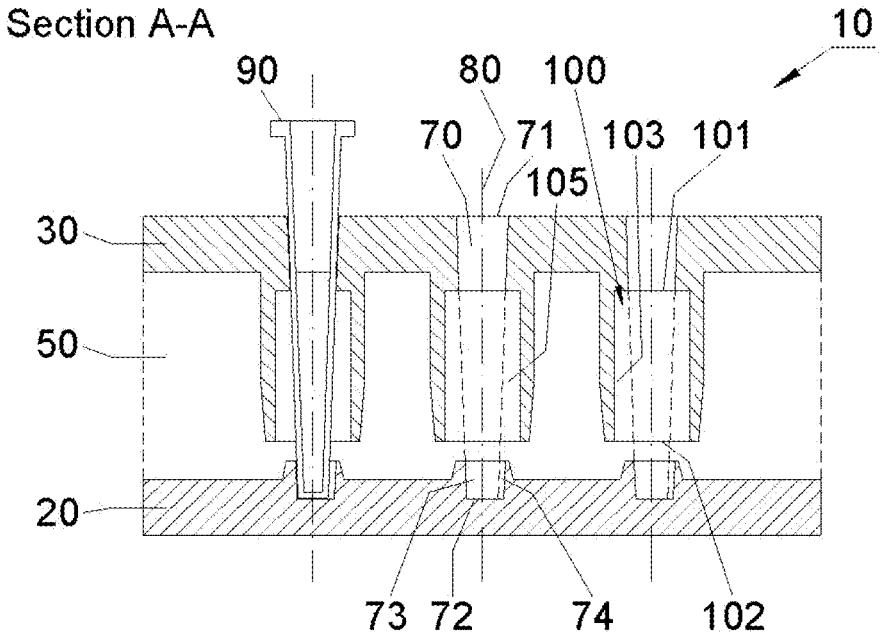
FIG. 15 is a schematic drawing showing a sectional view (A-A) of one embodiment of the apparatus. The receptor hole 73 is asymmetrically disposed around the channel axis 80 and forms a receptor hole gap 74.
Figure 17A:
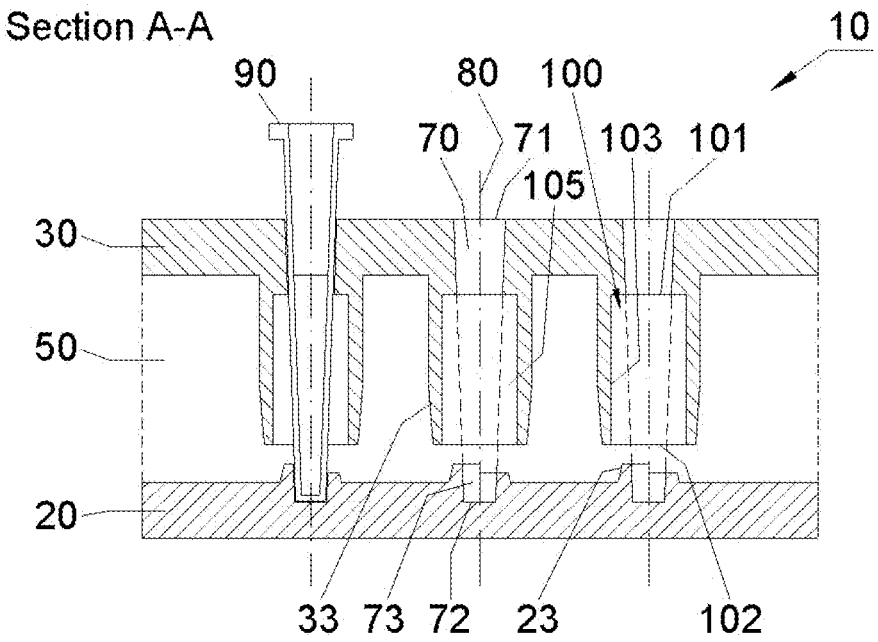
FIGS. 17A-B are schematic drawings showing sectional views of apparatus embodiments taken along the A-A plane. The first heat source 20 features a protrusion 23 disposed asymmetrically around the receptor hole 73.
Figure 17B:
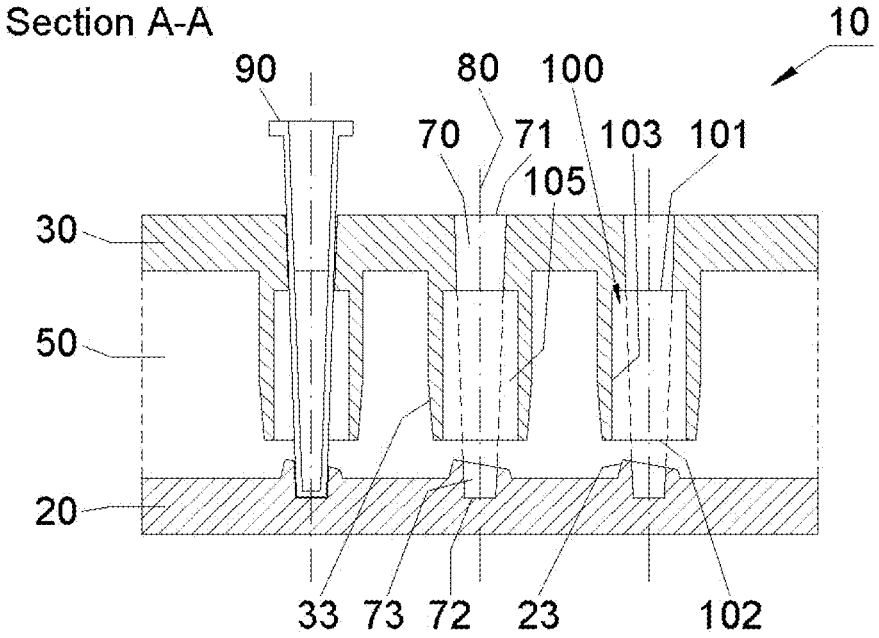

See, for example, FIGS. 15 and 17A-B showing asymmetric receptor hole structures.

D. Insulator and Insulating Gap

It will often be useful to insulate each of the heat sources from the other to achieve the objects of this invention. As will be apparent from the following discussion, the apparatus can be used with a wide variety of insulators placed in the insulating gap between the heat sources. Thus in one embodiment, a first insulator is placed in the first insulating gap between the first and second heat sources. One or a combination of gas or solid insulators having low thermal conductivity can be used. A generally useful insulator for many purposes of the invention is air (having low thermal conductivity of about 0.024 $W \cdot m^{-1} \cdot K^{-1}$ at room temperature for static air, with a gradual increase with increasing temperature). Although materials that have a thermal conductivity larger than that of static air can be used without significantly reducing the performance of the apparatus other than the power consumption, it is generally preferred to use gas or solid insulators that have a thermal conductivity similar to or smaller than air. Examples of good thermal insulators include, but not limited to, wood, cork, fabrics, plastics, ceramics, rubber, silicon, silica, carbon, etc. Rigid foams made of such materials are particularly useful since they represent very low thermal conductivity. Examples of rigid foams includes, but not limited to, Styrofoam, polyurethane foam, silica aerosol, carbon aerosol, SEAgel, silicone or rubber foam, wood, cork, etc. In addition to air, polyurethane foam, silica aerosol and carbon aerosol are particularly useful thermal insulators to use at elevated temperatures.

In embodiments in which an invention apparatus has the insulating gap, advantages will be apparent. For instance, a user of the apparatus will have the ability to 1) reduce the power consumption by substantially reducing heat transfer from one heat source to next heat source; and 2) control the temperature gradient for generating the driving force (and therefore control the thermal convection) since large temperature change from one heat source to next heat source occurs in the insulating gap region. It has been found that a larger insulating gap with a low thermal conductivity insulator generally helps reducing the power consumption. Use of the protrusion structures is particularly useful for substantially reducing the power consumption since a larger average gap can be provided while independently controlling different regions of the insulating gap (i.e., regions near and distant from the channel, separately). It has been also found that by changing the insulating gap, particularly in the region near the channel, it is possible to control the speed of the thermal convection and thus the speed of the PCR amplification. Other advantages of having the insulating gap will be apparent from the discussion and Examples that follow.

It will be apparent from the following discussion and examples that an invention apparatus may include one or a combination of the foregoing temperature shaping elements. Thus in one embodiment, the apparatus features at least one chamber (e.g., one, two or three chambers) disposed symmetrically about the channel and typically parallel to the channel axis along with the first insulator separating the first and second heat sources from each other. In this embodiment, the apparatus may further include one or two thermal brakes to further assist thermal convection PCR. In an embodiment in which the apparatus includes two chambers, for instance within the second heat source, each chamber may have the same or different horizontal position with respect to the channel axis. In another embodiment, the second heat source features a first protrusion extending toward the first heat source; and optionally a second protrusion extending away from the top surface of the second heat source generally parallel to the channel axis, in which the first protrusion typically defines the chamber. In this embodiment, the apparatus may further include a first protrusion extending from the first heat source to the second heat source; and optionally a second protrusion extending away from the bottom surface of the first heat source generally parallel to the channel axis. In these embodiments, the second heat source typically includes at least one chamber (e.g., one, two or three chambers) disposed symmetrically with respect to the channel axis, and the first heat source typically includes no chamber, but sometimes may include one chamber or two chambers disposed symmetrically with respect to the channel axis.

As discussed, it will often be useful to include asymmetric structural element within the apparatus. Thus it is an object of the invention to include within the apparatus a receptor hole that is disposed asymmetrically with respect to the channel axis. In this embodiment, the apparatus may include one or more chambers disposed symmetrically or asymmetrically with respect to the channel axis. Alternatively, or in addition, the apparatus may feature at least one thermal brake that is disposed asymmetrically with respect to the channel axis. In this embodiment, the apparatus may include one or more chambers disposed symmetrically or asymmetrically with respect to the channel axis. Alternatively, or in addition, the apparatus may feature at least one of the protrusions disposed asymmetrically with respect to the channel axis. In one embodiment, the protrusion extending from the first heat source is disposed asymmetrically about the channel axis while one or both protrusions (and chamber) extending from the second heat source is disposed symmetrically or asymmetrically about the channel axis. Alternatively, or in addition, the one or more protrusions (and chamber) of the second heat source can be disposed asymmetrically about the channel axis while one or both protrusions extending from the first heat source is disposed symmetrically or asymmetrically about the channel axis.

However, in another embodiment, one or more of the channels up to all of the channels within the apparatus need not include any chamber or gap structure. In this example, the apparatus will preferably include one or more other temperature shaping elements such as tilting the angle of the channel with respect to gravity (an example of positional asymmetry). Alternatively, or in addition, the channel can include a structural asymmetry or be subjected to centrifugal acceleration as provided herein.

As will be appreciated, it is possible to have an invention apparatus in which other or further asymmetric elements are present. For example, the apparatus can include two or three chambers in which one or more of the chambers are disposed asymmetrically with respect to the channel axis. In embodiments in which the apparatus includes a single chamber, that chamber may be disposed asymmetrically with respect to the channel axis. Embodiments include an apparatus in which protrusions extending from the second heat source toward the first heat source are disposed asymmetrically with respect to the channel axis.

If desired, any of the foregoing invention embodiments can include a positional asymmetry by tilting the device or the channel with respect to the direction of gravity or placing it on a wedge or other inclined shape.

As will be appreciated, nearly any temperature shaping element of an apparatus embodiment (whether symmetrically or asymmetrically disposed within the apparatus with respect to the channel axis) can be combined with one or more other temperature shaping elements including other structural or positional features of the apparatus so long as intended results are achieved.

As will also be appreciated, the invention is flexible and includes an apparatus in which each channel includes the same or different temperature shaping elements. For example, one channel of the apparatus can have no chamber or gap structures while another channel of the apparatus includes one, two, or three of such chamber or gap structures. The invention is not limited to any channel configuration (or group of channel configurations) so long as intended results are achieved. However, it will often be preferred to have all the channels of an invention apparatus have the same number and type of temperature shaping element to simplify use and manufacturing considerations.

Reference to the following figures and examples is intended to provide greater understanding of the thermal convection PCR apparatus. It is not intended and should not be read as limiting the scope of the present invention.

Turning now to FIGS. 1 and 2A-C, the apparatus 10 features the following elements as operably linked components:

(a) a first heat source 20 for heating or cooling a channel 70 and comprising a top surface 21 and a bottom surface 22 in which the channel 70 is adapted to receive a reaction vessel 90 for performing PCR;

(b) a second heat source 30 for heating or cooling the channel 70 and comprising a top surface 31 and a bottom surface 32 in which the bottom surface 32 faces the top surface of the first heat source 21, wherein the channel 70 is defined by a bottom end 72 contacting the first heat source 20 and a through hole 71 contiguous with the top surface of the second heat source 41. In this embodiment, center points between the bottom end 72 and the through hole 71 form a channel axis 80 about which the channel 70 is disposed;

(c) at least one chamber disposed around the channel 70 and within at least part of the second heat source 30. In this embodiment, the first chamber 100 includes a chamber gap 105 between the second heat source 30 and the channel 70 sufficient to reduce heat transfer between the second heat source 30 and the channel 70; and (d) a receptor hole 73 adapted to receive the channel 70 within the first heat source 20.

By the phrase "operably linked", "operably associated" or like phrase is meant one or more elements of the apparatus that are operationally linked to one or more other elements. More specifically, such an association can be direct or indirect (e.g., thermal), physical and/or functional.

An apparatus in which some elements are directly linked and others indirectly (e.g., thermally) linked is within the scope of the present invention.

Figure 2A:
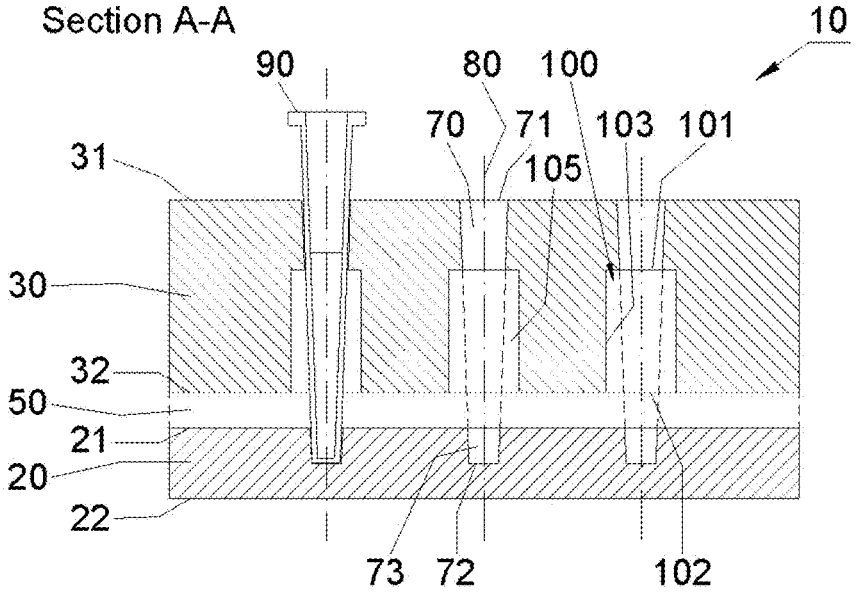
FIGS. 2A-C are schematic drawings showing sectional views of an apparatus embodiment having a first chamber 100.

In the embodiment shown in FIG. 2A, the apparatus further includes a first insulator 50 positioned between the top surface 21 of the first heat source 20 and the bottom surface 32 of the second heat source 30. As will be appreciated, practice of the invention is not limited to having only one insulator present provided the number of insulators is sufficient for intended results to be achieved. That is, the invention may include multiple insulators (e.g. 2, 3 or 4 insulators). In most embodiments, it is preferred to have the length of the second heat source 30 that is greater than the length of the first heat source 20 along the channel axis 80. Although in other embodiments the length of the second heat source 30 can be smaller or essentially the same as that of the first heat source 20, it is advantageous to have a greater length for the second heat source 30 to achieve a longer path length for the polymerization step.

In one embodiment shown in FIG. 2A, the first insulator 50 is filled with a thermal insulator having a low thermal conductivity. Preferred thermal insulators have a thermal conductivity between about a few tenths of $W \cdot m^{-1} \cdot K^{-1}$ to about 0.01 $W \cdot m^{-1} \cdot K^{-1}$ or smaller. In this embodiment, the length of the first insulator 50 along the channel axis 80 is made to be small, for instance, between about 0.1 mm to about 5 mm, preferably between about 0.2 mm to about 4 mm. In this example of the invention, heat loss from one heat source to an adjacent heat source can be substantially large, resulting in large power consumption in operating the apparatus. For many applications, it will often be preferred to have the two heat sources (e.g., 20 and 30) isolated from each other and also preferably isolated from other elements of the apparatus if exist. Use of one or more thermal insulators will often be helpful. For instance, use of a thermal insulator in the first insulating gap 50 can often lower power consumption.

Figure 2B:
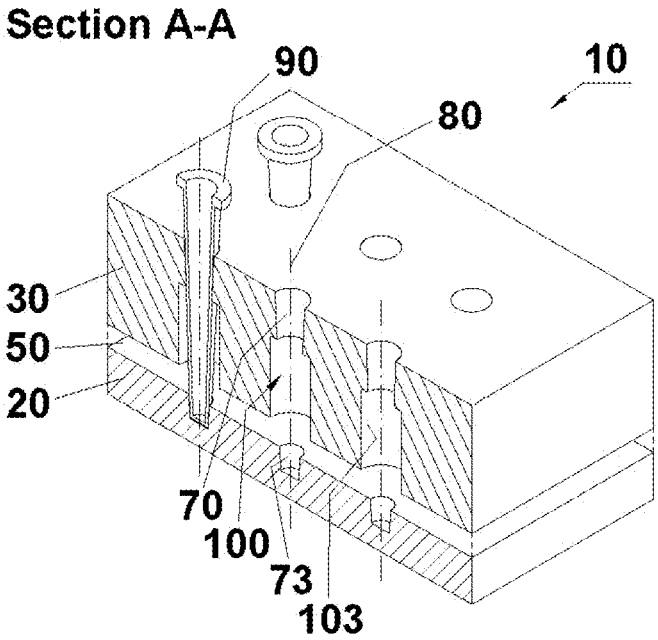
Figure 2C:
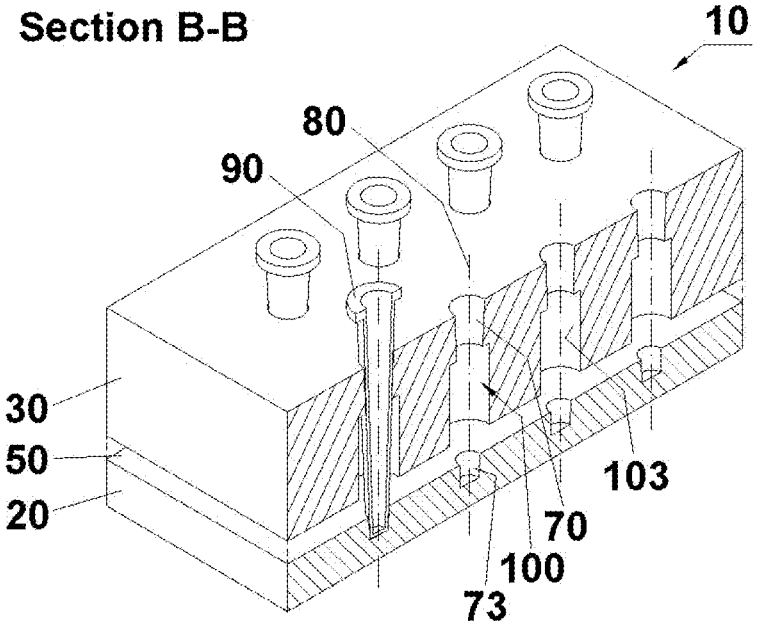

Thus in the invention embodiment of the invention shown in FIGS. 2A-C, the first insulator 50 comprises or consists of a solid or a gas as a thermal insulator.

Turning again to the apparatus shown in FIGS. 2A-C, the chamber gap 105 between the chamber wall 103 and the channel 70 inside the second heat source may be partially or totally filled with a thermal insulator such as a gas, solid, or gas-solid combination. Typically useful insulators include air, and gas or solid insulators that have a thermal conductivity similar to or smaller than air. Since one important function of the chamber gap 105 is to control (typically to reduce) heat transfer from the second heat source to the channel inside the second heat source, materials that have a thermal conductivity larger than that of air such as plastics or ceramics can also be used. However, when such higher thermal conductivity materials are used, the chamber gap 105 should be adjusted to be larger compared to the embodiment of using air as an insulator. Similarly, if a material having a lower thermal conductivity than air is used, the chamber gap 105 should be adjusted to be smaller than that of the air insulator embodiment.

In particular, FIGS. 2A-C show an apparatus embodiment in which air or a gas is used as an insulator in the first insulator 50 and the chamber gap 105. The channel structures inside these gaps are depicted with dashed lines to represent invisibility of these structures when air (or a gas) is used as an insulator. If desired to achieve a particular invention objective, the apparatus can be adapted so that a solid insulator is used in the chamber gap 105. Alternatively, or in addition, the apparatus may include a solid insulator in the first insulator 50.

FIGS. 2B and 2C show perspective views of section A-A and B-B of the apparatus as marked in FIG. 1. An embodiment in which air or a gas is used as an insulator is shown.

As shown in the embodiment of FIGS. 1 and 2A-C, the apparatus features twelve channels (sometimes referred herein to as reaction vessel channels). However, more or less channels are possible depending on intended use, for instance, from about one or two to about twelve channels, or between about twelve to several hundred channels, preferably about eight to about one hundred channels. Preferably, each channel is independently adapted to receive a reaction vessel 90 that is typically defined by a bottom end 92 within the first heat source 20 and a top end 91 on the top of the second heat source 31. The channel 70 in the first 20 and second 30 heat sources typically passes through the first insulator 50. Center points between the top 71 and bottom 72 ends of the channel 70 form an axis of the channel 80 (sometimes referred herein to as channel axis) about which the heat sources and insulators are disposed.

Referring again to the embodiment shown in FIGS. 1 and 2A-C, the channel 70 is adapted so that the reaction vessel 90 can fit snugly therein i.e., it has a dimensional profile that is essentially the same as that of a lower part of the reaction vessel as depicted in FIG. 2A. In the operation, the channel functions as a receptor for receiving a reaction vessel. However as will be explained in more detail below, the structure of the channel 70 can be adjusted and/or moved in relation to the channel axis 80 to provide different thermal contact possibilities between the reaction vessel 90 and one or more of the heat sources 20 and 30.

As an example, the through hole 71 formed in the second heat source 30 can function as a top part of the channel 70. In this embodiment, the channel 70 inside the second heat source 30 is in physical contact with the second heat source 30. That is, a wall of the through hole 71 extending into the second heat source 30 is in physical contact with the reaction vessel 90. In this embodiment, the apparatus can provide efficient heat transfer from the second heat source 30 to the channel 70 and reaction vessel 90.

For many invention applications, it will be generally preferred to have the size of the through hole in the second heat source essentially the same as that of the channel or reaction vessel. However, other through hole embodiments are within the scope of the present invention and are disclosed herein. For example, and referring again to FIGS. 2A-C, the through hole 71 in the second heat source 30 may be made larger than the size of the reaction vessel 90. However, in such case, heat transfer from the second heat source 30 to the reaction vessel 90 may become less efficient. In this embodiment, it may be useful to lower the temperature of the second heat source 30 for optimal practice of the invention. For most invention applications, it will be generally useful to have the size of the through hole 71 in the second heat source 30 essentially the same size as that of the reaction vessel 90.

In invention embodiments in which the receptor hole 73 has a closed bottom end 72 formed in the first heat source 20, it will often function as a bottom portion of the channel 70. See FIG. 2A, for instance. In such an embodiment, the receptor hole 73 of the first heat source 20 has a size essentially the same as that of the bottom part of the reaction vessel 92 which in most embodiments will provide physical contact and efficient heat transfer to the reaction vessel 90. In some invention embodiments, the receptor hole 73 in the first heat source 20 may have a partial chamber structure or a size slightly larger than that of the bottom part of the reaction vessel as will be discussed.

Chamber Structure and Function

Turning again to the apparatus shown in FIGS. 2A-C, the first chamber 100 is symmetrically disposed about the channel 70 and within the second heat source 30. Presence of such a physically non-contacting (but thermally contacting) space within the apparatus 10 provides many benefits and advantages. For example, and without wishing to be bound to any theory, presence of the first chamber 100 provides heat transfer from the second heat source 30 to the channel 70 or the reaction vessel 90 that is desirably less efficient. That is, the chamber 100 reduces heat transfer substantially between the second heat source 30 and the channel 70 or the reaction vessel 90. As will become more apparent from the discussion that follows, this invention feature supports robust and faster thermal convection PCR within the apparatus 10.

While it will often be useful to include a physically non-contacting space within the second heat source 30, it is within the scope of the present invention to include such a space within the first heat source 20. For example, the first heat source 20 may include one or more chambers intended to reduce heat transfer between the first heat source 20 and the channel 70 or the reaction vessel 90.

The invention embodiment shown in FIGS. 2A-C includes a first chamber 100 in the second heat source 20 as a key structural element. In this example of the invention, the first chamber 100 is independently adapted to receive the channel 70 from the top of the second heat source 31 toward the bottom of the second heat source 32 and the top of the first heat source 21. The first chamber 100 is defined by a top end 101 within the second heat source 30, a bottom end 102 on the bottom of the second heat source 30, and the first chamber wall 103 that is disposed around the channel axis 80 and spaced from the channel 70 inside the second heat source 30. The chamber wall 103 surrounds the channel 70 inside the second heat source 20 at a distance, forming a chamber gap 105. The chamber gap 105 between the chamber wall 103 and the channel 70 is preferably in the range between from about 0.1 mm to about 6 mm, more preferably from about 0.2 mm to about 4 mm. The length of the first chamber 100 is between about 1 mm to about 25 mm, preferably between about 2 mm to about 15 mm.

The invention is compatible with a wide variety of heat source and insulator configurations. For instance, the first heat source 20 can have a length larger than about 1 mm along the channel axis 80, preferably from about 2 mm to about 10 mm; and the second heat source 30 can have a length between from about 2 mm to about 25 mm along the channel axis 80, preferably from about 3 mm to about 15 mm. As discussed, it will be generally useful to have an apparatus with a first insulator 50. For example, in embodiments without the protrusions, the first insulator 50 can have a length along the channel axis 80 between about 0.2 mm to about 8 mm along the channel axis 80, preferably between about 0.5 mm to 5 mm. In other embodiments in which the protrusion structure is present, the first insulator 50 can have different lengths along the channel axis 80 depending on the position with respect to the channel 70. For instance, in the region near or around the channel (i.e., within the protrusions), the first insulator 50 can have a length along the channel axis between about 0.2 mm to about 8 mm, preferably between about 0.5 mm to 5 mm. In the region distant from the channel (i.e., outside the protrusion structures), the first insulator 50 can have a length along the channel axis between about 0.5 mm to about 20 mm, preferably between about 1 mm to 10 mm.

As discussed, an invention apparatus may include multiple chambers (for example, two, three, four or more chambers) within at least one of the heat sources such as the second heat source.

Figure 3A:
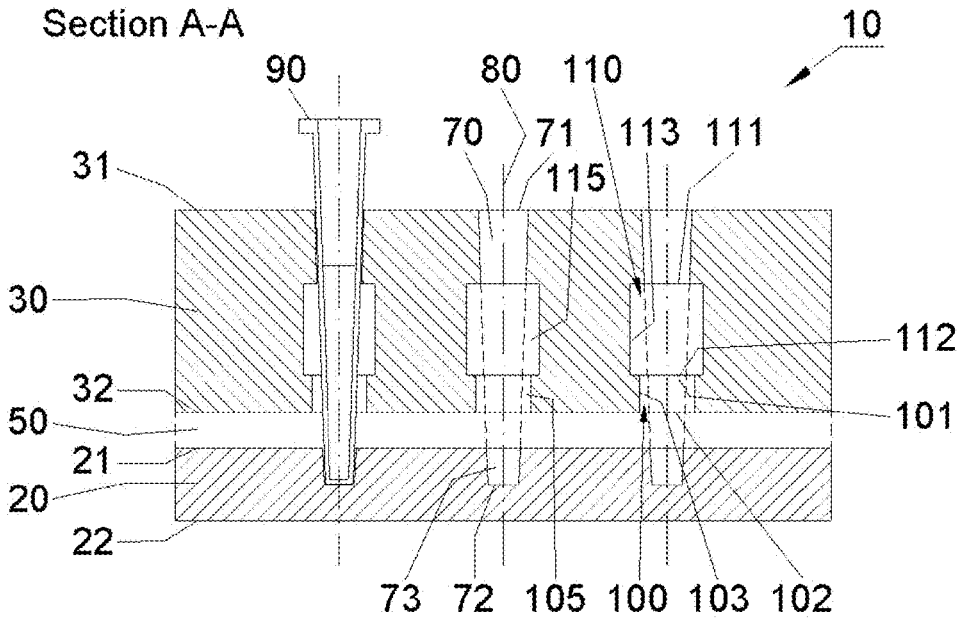
FIGS. 3A-B are schematic drawings showing sectional views of apparatus embodiments taken along the A-A plane. Each apparatus has a first 100 and a second 110 chamber of unequal widths with respect to the channel axis 80.
Figure 3B:
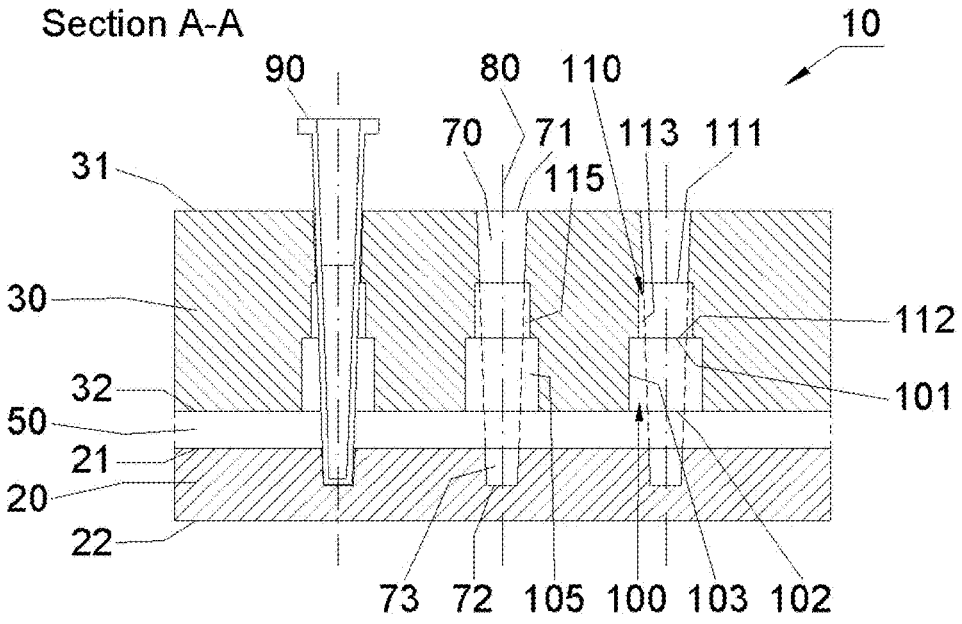

In the embodiment shown in FIGS. 3A-B, the apparatus includes a first chamber 100 positioned entirely within the second heat source 30. In this embodiment, the first chamber 100 includes the chamber top end 101 facing a first chamber bottom end 102 along the channel axis 80. The apparatus further includes a second chamber 110 positioned entirely within the second heat source 30 and in contact with the top end 101 of the first chamber 100. The wall 103 of the first chamber 100 is aligned essentially parallel to the channel axis 80. The second chamber 110 is further defined by the wall 113 positioned essentially parallel to the channel axis 80. The second chamber 110 is further defined by a top end 111 within the second heat source 30 and a bottom end 112 in contact with the top end 101 of the first chamber 100. As shown, the first chamber 100 and the second chamber 110 include gaps 105 and 115, respectively. In the embodiment shown, each of the top end 111 and bottom end 112 of the second chamber 110 are perpendicular to the channel axis 80. As shown in FIG. 3A, the width or radius of the first chamber 100 from the channel axis 80 is smaller (about 0.9 to 0.3 times smaller) than the width or radius of the second chamber 110 from the channel axis 80. However as shown in the embodiment of FIG. 3B, the width or radius of the first chamber 100 from the channel axis 80 is greater (about 1.1 to about 3 times greater) than the width of the second chamber 110 from the channel axis 80.

Turning again to FIGS. 3A-B, the first chamber 100 and the second chamber 110 provide a useful temperature controlling or shaping effect. In these embodiments, the first chamber 100 (FIG. 3A) or the second chamber 110 (FIG. 3B) has a smaller diameter or width compared to the other chamber. The narrower portion of the second chamber 110 (FIG. 3B) or first chamber 100 (FIG. 3A) provides more efficient heat transfer from the second heat source 30 compared to the other chamber. In addition, the chamber configuration shown in these embodiments blocks or reduces heat transfer from the first heat source.

Unless otherwise mentioned, embodiments with multiple chambers will be described by numbering the chambers from the first heat source (typically located nearest the bottom of the apparatus). Thus the chamber closest to the first heat source will be designated "first chamber", the next closest chamber to the first heat source will be designated "second chamber", etc.

Thermal Brake Structure and Function

Figure 4A:
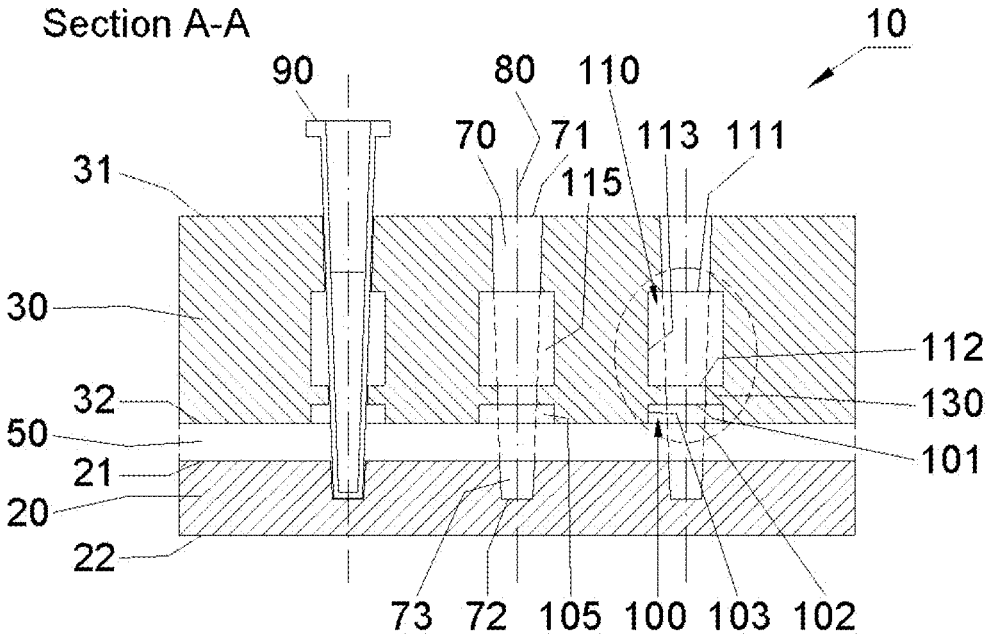
FIGS. 4A-B are schematic drawings showing a sectional view (A-A) of an embodiment of the apparatus.

FIG. 4A shows an invention embodiment with two chambers positioned in the second heat source. In particular, the apparatus 10 has the first chamber 100 and the second chamber 110 positioned in the second heat source 30.

Figure 4B:
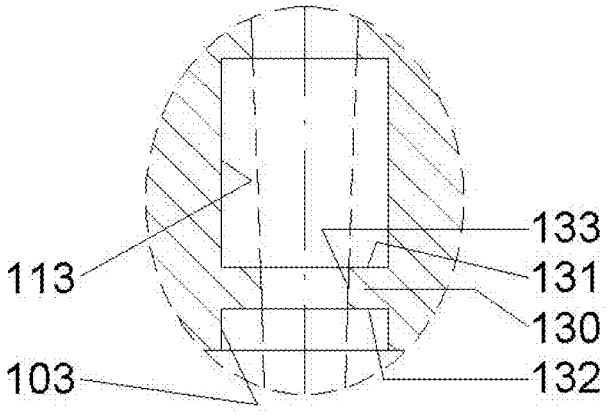

FIG. 4B is an expanded view of the dotted circle shown in FIG. 4A. In particular, the region between the first chamber 100 and the second chamber 110 defines a first thermal brake 130. As mentioned above, the first thermal brake 130 is intended to control the temperature distribution within the apparatus 10. In the embodiment shown, the first thermal brake 130 is defined by a top end 131 and a bottom end 132 and a wall 133 that essentially contacts the channel 70. In this embodiment, a function of the first thermal brake 130 is to reduce or block an undesirable intrusion of a temperature profile from the first heat source 20 to the second heat source 30. Another function of the first thermal brake 130 is to provide an efficient heat transfer between the second heat source 30 and the channel 70 so as to make the channel in that region quickly approach the temperature of the second heat source 30. The first thermal brake 130 is disposed symmetrically about the channel 70.

If desired, at least one of the first chamber 100 and the second chamber 110 (or a portion thereof) may include a suitable solid or a gas insulator. Alternatively, or in addition, the first insulator 50 shown may include or consist of a suitable solid or a gas. An example of suitable insulating gas is air.

Protrusion Structure and Function

In many invention embodiments, the apparatus 10 features at least one protrusion extending from the top or bottom surface of the first or second heat source. In one embodiment, the second heat source 30 features a first protrusion 33 extending from the bottom surface 32 of the second heat source 30 toward the first heat source 20 in a direction generally parallel to the channel axis; and optionally a second protrusion 34 extending away from the top surface 31 of the second heat source 30 generally parallel to the channel axis. Alternatively, or in addition, the first heat source 20 may include a first protrusion 23 extending from the top surface 21 of the first heat source 20 toward the second heat source 30 generally parallel to the channel axis; and optionally a second protrusion 24 extending away from the bottom surface 22 of the first heat source 20 generally parallel to the channel axis. In some embodiments, the apparatus may comprise at least one protrusion that is tilted with respect to the channel axis.

Figure 5B:
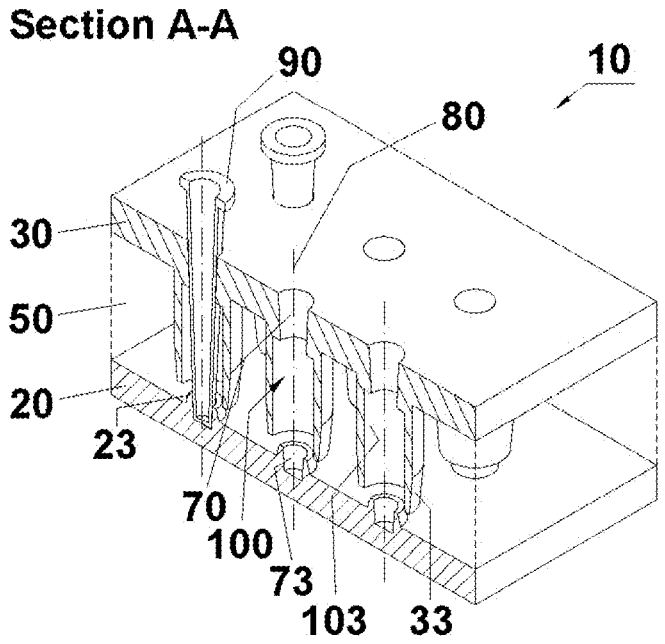
Figure 5C:
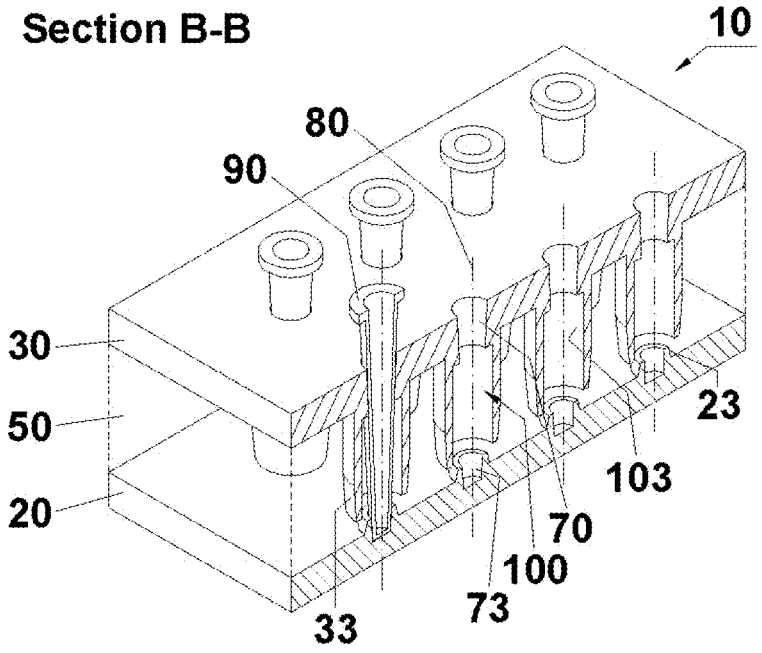

FIGS. 5A-C show an invention embodiment comprising a first protrusion 33 of the second heat source 30 extending toward the first heat source 20 and a first protrusion 23 of the first heat source 20 extending toward the second heat source 30. In this example of the invention, each of the protrusions (23, 33) is disposed symmetrically about the first chamber 100 and/or the channel axis 80. In this embodiment, the first protrusion 33 of the second heat source 30 helps define the first chamber 100 or the channel 70, the first insulator 50, and the second heat source 30, and separate the first insulator 50 from the first chamber 100 or the channel 70. The first protrusion 23 of the first heat source 20 helps define the channel 80 and the first heat source 20, and separate the first insulator 50 from the channel 70. The protrusions 23, 33 also define a portion 51 of the first insulator 50 (called a first insulator chamber). In this embodiment, the first insulator chamber 51 is defined by at least the first heat source 20, the first protrusion of the first heat source 23, the second heat source 30, and the first protrusion of the second heat source 33.

In the embodiment shown in FIGS. 5A-C, the top 101 and bottom 102 ends of the first chamber 100 are essentially perpendicular to the channel axis 80. The length of the first chamber 100 is between about 1 mm to about 25 mm, preferably between about 2 mm to about 15 mm. Additionally, the receptor hole 73 is symmetrically disposed about the channel 70 and channel axis 80.

In this embodiment, the function of the protrusions 23 and 33 is to reduce the heat transfer between the first 20 and second 30 heat sources as well as the volume of the first 20 and second 30 heat sources while lengthening the chamber dimension along the channel axis to assist the thermal convection PCR. By use of the protrusion structures, the first insulating gap can be made small near the channel region (i.e., within the protrusions structures) so that a longer chamber length along the channel axis can be provided to enhance the efficiency of the thermal convection PCR, while providing a larger gap outside the protrusion structures to help reduce the heat transfer between the two heat sources so as to reduce the power consumption of the apparatus. The volume of the two heat sources can also be reduced substantially by use of the protrusion structures 23, 33 so that the heat capacity of the two heat sources is reduced to further assist reduction of the power consumption.

Figure 6A:
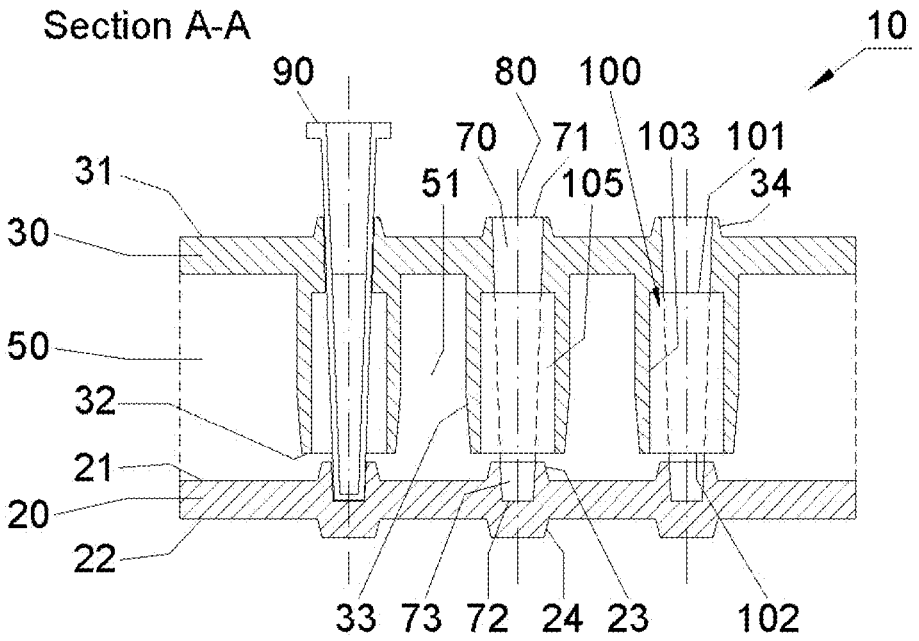
FIGS. 6A-C are schematic drawings of an apparatus embodiment taken along the A-A (FIGS. 6A-B) and B-B planes (FIG. 6C). The first 20 and second 30 heat sources include protrusions (23, 24, 33, 34) that are each positioned symmetrically about the channel axis 80. The second heat source 30 comprises a first chamber 100.
Figure 6B:
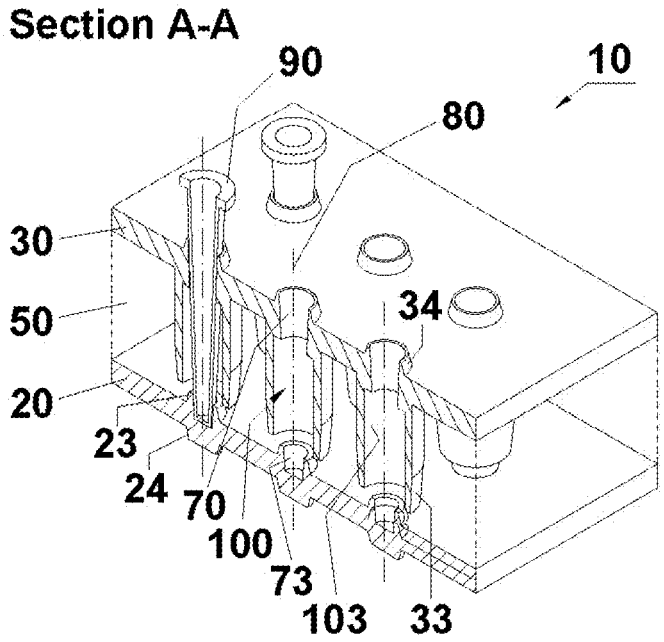
Figure 6C:
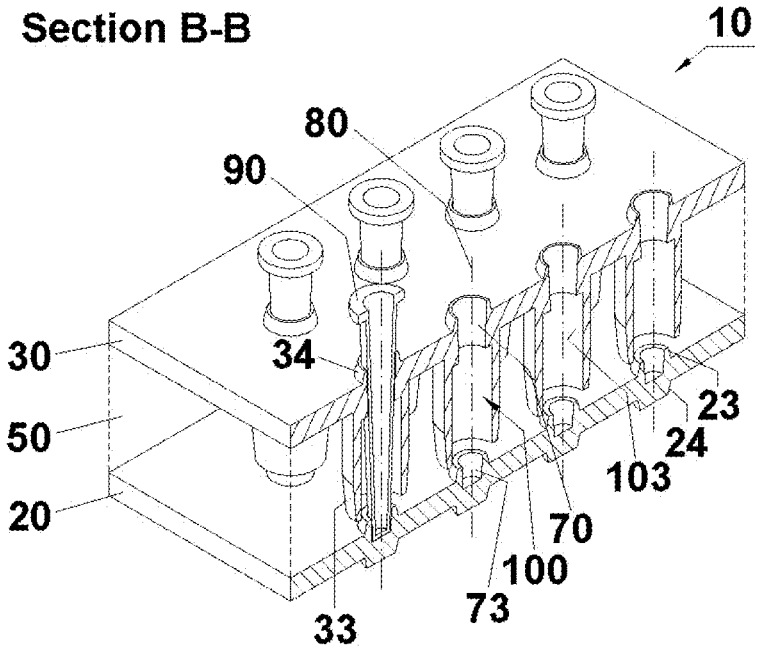

Referring to the embodiment shown in FIGS. 6A-C, the first heat source 20 further includes a second protrusion 24 extending away from the bottom surface 22 of the first heat source 20 in addition to the first protrusion 23. The second heat source 30 also further includes a second protrusion 34 extending away from the top surface 31 of the second heat source in addition to the first protrusion 33. Other features of this embodiment are the same as the embodiment shown in FIGS. 5A-C. In this embodiment, the function of the second protrusions 24 and 34 is to further reduce the volume of the first and second heat sources so as to further reduce the power consumption of the apparatus. The second protrusions 24, 34 of the first and second heat sources are also useful in this embodiment to assist fast cooling of the two heat sources after completion of the thermal convection PCR using a cooling element such as a fan.

Channel Structure

A. Vertical Profiles

The invention is fully compatible with several channel configurations. For example, FIGS. 7A-D show vertical sections of suitable channel configurations. As shown, the vertical profile of the channel may be shaped as a linear (FIGS. 7C-D) or tapered (FIG. 7A-B) channel. In a tapered embodiment, the channel may be tapered either from the top to the bottom or from the bottom to the top. Although various modifications are possible regarding the vertical profile of the channel (e.g., a channel having a side wall that is curved, or tapered with two or more different angles, etc.), it is generally preferred to use a channel that is (linearly) tapered from the top to the bottom because such structure facilitates not only the fabrication process but also introduction of the reaction vessel to the channel. A generally useful taper angle (θ) is in the range between from about 0° to about 15°, preferably from about 2° to about 10°.

In the embodiments shown in FIGS. 7A-B, the channel 70 is further defined by an open top 71 and a closed bottom end 72 which ends may be perpendicular to the channel axis 80 (FIG. 7A) or curved (FIG. 7B). The bottom end 72 may be curved with a convex or concave shape having a radius of curvature equal to or larger than the radius or half width of the horizontal profile of the bottom end. Flat or near flat bottom end with its radius of curvature at least two times larger than the radius or half width of the horizontal profile of the bottom end is more preferred over other shapes since it can provide an enhanced heat transfer for the denaturation process. The channel 70 is further defined by a height (h) along the channel axis 80 and a width (w1) perpendicular to the channel axis 80.

For many invention applications, it will be useful to have a channel 70 that is essentially straight (i.e., not bent or tapered). In the embodiments shown in FIGS. 7C-D, the channel 70 has the open top end 71 and the closed bottom end 72 which may be perpendicular to the channel axis 80 (FIG. 7C) or curved (FIG. 7D). As in the tapered channel embodiments, the bottom end 72 may be curved with a convex or concave shape and flat or near flat bottom end having a large curvature is typically more preferred. The channel 70 is further defined in these embodiments by a height (h) along the channel axis 80 and a width (w1) perpendicular to the channel axis 80.

In the channel embodiments shown in FIGS. 7A-D, the height (h) is at least about 5 mm to about 25 mm, preferably 8 mm to about 16 mm for a sample volume of about 20 microliters. Each channel embodiment is further defined by the average of the width (w1) along the channel axis 80 which is typically at least about 1 mm to about 5 mm. Each of the channel embodiments shown in FIGS. 7A-D can be further defined by a vertical aspect ratio which is the ratio of the height (h) to the width (w1), and a horizontal aspect ratio which is the ratio of the first width (w1) to the second width (w2) along first and second directions, respectively, that are mutually perpendicular to each other and aligned perpendicular to the channel axis. A generally suitable vertical aspect ratio is between about 4 to about 15, preferably from about 5 to about 10. The horizontal aspect ratio is typically between about 1 to about 4. In embodiments in which the channel 70 is tapered (FIGS. 7A-B), the width or diameter of the channel changes across the vertical profile of the channel. By way of general guidance, for sample volumes larger or smaller than 20 microliters, the height and width (or diameter) may be scaled by a factor of cubic root or sometimes square root of the volume ratio.

As discussed, the bottom end 72 of the channel may be flat, rounded, or curved as depicted in FIG. 7A-D. When the bottom end is rounded or curved, it typically has a convex or concave shape. As discussed, a flat or near flat bottom end is more preferred over other shapes for many invention embodiments. While not wishing to be bound to any theory, it is believed that such a bottom design can enhance heat transfer from the first heat source 20 to the bottom end 71 of the channel 70 so as to facilitate the denaturation process.

None of the foregoing vertical channel profiles are mutually exclusive. That is, a channel that has a first portion that is straight and second portion that is tapered (with respect to the channel axis 80) is within the scope of the present invention.

B. Horizontal Profiles

The invention is also compatible with a variety of horizontal channel profiles. An essentially symmetrical channel shape is generally preferred where ease of manufacture is a concern. FIGS. 8A-J show a few examples of acceptable horizontal channel profiles, each with a designated symmetry. For instance, the channel 70 may have its horizontal shape that is circular (FIG. 8A), square (FIG. 8D), rounded square (FIG. 8G) or hexagonal (FIG. 8J) with respect to the channel axis 80. In other embodiments, the channel 70 may have a horizontal shape that has its width larger than its length (or vice versa). For instance, and as depicted in the middle column of FIGS. 8B, E and H, the horizontal profile of the channel 70 may be shaped as an ellipsoid (FIG. 8B), rectangular (FIG. 8E), or rounded rectangular (FIG. 8H). This type of horizontal shape is useful when incorporating a convection flow pattern going upward on one side (e.g., on the left hand side) and going downward on the opposite side (e.g., on the right hand side). Due to the relatively larger width profile incorporated compared to the length, interference between the upward and downward convection flows can be reduced, leading to more smooth circulative flow. The channel may have a horizontal shape that has its one side narrower than the opposite side. A few examples are shown on the right column of FIGS. 8C, F and I. The left side of the channel is depicted to be narrower than the right side for instance. This type of horizontal shape is also useful when incorporating a convection flow pattern going upward on one side (e.g., on the left hand side) and going downward on the opposite side (e.g., on the right hand side). Moreover, when this type of shape is incorporated, speed of the downward flow (e.g., on the right hand side) can be controlled (typically reduced) with respect to the upward flow. Since the convective flow must be continuous within the continuous medium of the sample, the flow speed should be reduced when cross-sectional area becomes larger (or vice versa). This feature is particularly important with regard to enhancing the polymerization efficiency. The polymerization step typically takes place during the downward flow (i.e., after the annealing step), and therefore time period for the polymerization step can be lengthened by making the downward flow slower as compared to that of the upward flow, leading to more efficient PCR amplification.

Thus in one invention embodiment, at least part of the channel 70 (including the entire channel) has a horizontal shape along a plane essentially perpendicular to the channel axis 80. In one invention example, the horizontal shape has at least one reflection (σ) or rotation symmetry element ($C_x$) in which X is 1, 2, 3, 4, up to ∞ (infinity). Nearly any horizontal shape is acceptable provided it satisfies intended invention objectives. Further acceptable horizontal shapes include a circular, rhombus, square, rounded square, ellipsoid, rhomboid, rectangular, rounded rectangular, oval, semi-circular, trapezoid, or rounded trapezoid shape along the plane. If desired, the plane perpendicular to the channel axis 80 can be within the first 20 or second 30 heat source.

None of the foregoing horizontal channel profiles are mutually exclusive. That is, a channel that has a first portion that is circular, for instance, and a second portion that is semi-circular (with respect to the channel axis 80) is within the scope of the present invention.

Horizontal Chamber Shape and Position

As discussed, an apparatus of the invention can include at least one chamber, preferably one, two or three chambers to help control the temperature distribution within the apparatus, for instance, within the transition region of the channel. The channel can have one or a combination of suitable shapes provided intended invention results are achieved.

For instance, FIGS. 9A-I show suitable horizontal profiles of a chamber (the first chamber 100 is used as an illustration only). In this invention embodiment, the horizontal profile of the chamber 100 may be made into various different shapes although shapes that are essentially symmetric will often be useful to facilitate the fabrication process. For instance, the first chamber 100 may have a horizontal shape that is circular, square, or rounded square as depicted in the left column. See FIGS. 9A, D, and G. The first chamber 100 may have a horizontal shape that has its width larger than its length (or vice versa), for instance, an ellipsoid, rectangular, or rounded rectangular as depicted in the middle column. The first chamber 100 may have a horizontal shape that has its one side narrower than the opposite side as depicted in the right column. See FIGS. 9C, F, and I.

As discussed, chamber structure is useful in controlling (typically reducing) the heat transfer from the heat source (typically the second heat source) to the channel or the reaction vessel. Therefore, it is important to change the position of the first chamber 100 relative to that of the channel 70 depending on the invention embodiment of interest. In one embodiment, the first chamber 100 is disposed symmetrically with respect to the position of the channel 70, i.e., the chamber axis (an axis formed by the center points of the top and bottom end of the chamber, 106) coincides with the channel axis 80. In this embodiment, the heat transfer from the heat source 20 or 30 to the channel is intended to be constant in all directions across the horizontal profile of the channel (at certain vertical location). Therefore, it is preferred to use a horizontal shape of the first chamber 100 that is the same as that of the channel in such embodiments. See FIGS. 9A-I.

However other embodiments of the chamber structure are within the scope of the present invention. For instance, one or more of the chambers within the apparatus may be disposed asymmetrically with respect to the position of the channel 70. That is the chamber axis 106 formed between the top end and bottom end of a particular chamber may be off-centered, tilted or both off-centered and tilted with respect to the channel axis 80. In this embodiment, one or more of the chamber gaps between the channel 70 and a wall of the chamber will be larger on one side and smaller on the opposite side of that chamber. Heat transfer in such embodiments will be higher in one side of the channel 70 and lower in the opposite side (while it is same or similar in the two opposite sides located along the direction perpendicular to the positions of above two sides). In a particular embodiment, it is preferred to use a horizontal shape of the first chamber 100 that is circular or rounded rectangular. A circular shape is generally more preferred.

Thus in one embodiment of the apparatus, at least part of the first chamber 100 (including the entire chamber) has a horizontal shape along a plane essentially perpendicular to the channel axis 80. See FIG. 9A and FIG. 2A-C, for instance. Typically, the horizontal shape has at least one reflection or rotation symmetry element. Preferred horizontal shapes for use with the invention include those that are circular, rhombus, square, rounded square, ellipsoid, rhomboid, rectangular, rounded rectangular, oval, semi-circular, trapezoid, or rounded trapezoid shape along a plane perpendicular to the channel axis 80. In one embodiment, the plane perpendicular to the channel axis 80 is within the second 30 or first 20 heat source.

It will be appreciated that the foregoing discussion about chamber structure and position will be applicable to more chamber embodiments than the first chamber 100. That is, in an invention embodiment with multiple chambers (e.g., one with the second chamber 110 and/or third chamber 120), these considerations may also apply.

Asymmetric and Symmetric Channel/Chamber Configurations

As mentioned, the invention is compatible with a wide variety of channel and chamber configurations. In one embodiment, a suitable channel is disposed asymmetrically with respect to the chamber. FIGS. 10A-P show some examples of this concept.

In particular, FIGS. 10A-P show horizontal sections of suitable channel and chamber structures with reference to location of the channel 70 within the chamber 100 (the first chamber 100 is used only for illustrative purposes). Horizontal shapes of the first chamber 100 and channel 70 are shown to be circular or rounded rectangular for instance. The first column (FIGS. 10A, E, I and M) shows examples of symmetrically positioned structures. In these embodiments, the chamber axis coincides with the channel axis 70. Therefore, the gap between the first chamber wall (103, solid line) and the channel 70 (dotted line) is the same for the left and right sides, and also for the upper and lower sides, providing a heat transfer from the heat source to the channel that is symmetric in both directions. The second column (FIGS. 10B, F, J and N) shows examples of asymmetrically positioned structures. The channel axis 80 is positioned off-centered (to the left hand side) from the chamber axis and the gap between the first chamber wall 103 and the channel 70 is smaller on the left side (while it is the same on the upper and lower sides), providing higher heat transfer from the left side. The third (FIGS. 10C, G, K and O) and fourth (FIGS. 8D, H, L, and P) columns show other examples of asymmetrically positioned structures that provide more asymmetric heat transfer. The third column (FIGS. 10C, G, K and O) shows examples in which the chamber wall is in contact with the channel on one side (the left side). The fourth column (FIGS. 10D, H, L, and P) shows examples in which one side (the right side) forms the first chamber 100 while the opposite side (the left side) forms the channel 70. In both examples, heat transfer from the left side is much higher than from the right side. The physically contacting side shown in the third and fourth columns is intended to function as a thermal brake, particularly as an asymmetric thermal brake that provides thermal braking on one side only.

It is thus an object of the invention to provide an apparatus in which at least one of the chambers therein (e.g., one or more of the first chamber 100, second chamber 110, or the third chamber 120) is disposed essentially symmetrically about the channel along a plane that is essentially perpendicular to the channel axis. It is also an object to provide an apparatus in which at least one of the chambers is disposed asymmetrically about the channel and along the plane that is essentially perpendicular to the channel axis. All or part of a particular chamber(s) can be disposed about the channel axis either symmetrically or asymmetrically as needed. In embodiments in which at least one chamber is disposed asymmetrically about the channel axis, the chamber axis and the channel axis can be off-centered while essentially parallel to each other, tilted or both off-centered and tilted. In a more specific embodiment of the foregoing, at least part of a chamber including the entire chamber is disposed asymmetrically about the channel along a plane perpendicular to the channel axis. In other embodiments, at least part of the channel is located inside the chamber along the plane perpendicular to the channel axis. In one example of this embodiment, at least part of the channel is in contact with the chamber wall along the plane perpendicular to the channel axis. In another embodiment, at least part of the channel is located outside of the chamber along the plane perpendicular to the channel axis and contacting the second or first heat source. For some invention embodiments, the plane perpendicular to the channel axis contacts the second or first heat source.

Vertical Chamber Shape

It is also an object of the invention to provide an apparatus in which the second heat source includes at least one chamber, typically one, two or three of same to help control temperature distribution. Preferably, the chamber helps control the temperature gradient of the transition region from one heat source (e.g., the first heat source 20) within the apparatus to another heat source (e.g., the second heat source 30) therein. Various adaptations of the chamber are within the scope of the invention so long as it generates a temperature distribution suitable for the convection-based PCR process of the present invention.

It is an object of the invention to provide an apparatus in which at least part of a chamber (up to and including the entire chamber) is tapered along the channel axis. For instance, and in one embodiment, one or more of the chambers including all of the chambers therein are tapered along the channel axis. In one embodiment, at least part of one or all of the chambers is positioned within the second heat source and has a width (w) perpendicular to the channel axis that is greater towards the first heat source than the other side. In some embodiments, at least part of the chamber is positioned within the second heat source and has a width (w) perpendicular to the channel axis that is smaller towards the first heat source than the other side. In one embodiment, the apparatus includes the first chamber and the second chamber positioned within the second heat source, the first chamber having a width (w) perpendicular to the channel axis that is larger (or smaller) than the width (w) of the second chamber. For some embodiments, the first chamber is facing the first heat source.

Further Illustrative Apparatus Embodiments

Suitable heat source, insulator, channel, gap, chamber, receptor hole configurations and PCR conditions are described throughout the present application and may be used as needed with the following invention examples.

A. One Chamber, First and Second Heat Sources, Protrusion

In some invention embodiments, it will be useful to manipulate the structure of one or more of the chambers by changing the structure of at least one of the heat sources. For instance, at least one of the first and second heat sources can be adapted to include one or more protrusions that defines the gap or chamber and generally extends essentially parallel to the channel or chamber axis. A protrusion may be disposed symmetrically or asymmetrically about the channel or chamber axis. Significant protrusions extend away from one heat source to another heat source within the apparatus. For example, the first protrusion of the second heat source extends away from the second heat source in the direction toward the first heat source and the first protrusion of the first heat source extends away from the first heat source toward the second heat source. In these embodiments, the protrusion contacts the chamber and defines a chamber gap or chamber wall. In a particular embodiment, the width or diameter of the second heat source protrusion along the channel axis is decreased as going away from the second heat source while the width of the first insulator adjacent to the protrusion along the channel axis is increased. Each chamber may have the same or different protrusion (including no protrusion). An important advantage of the protrusions is to help reduce the size of the heat sources and lengthen chamber dimensions and insulator or insulating gap dimensions along the channel axis. These and other benefits were found to assist thermal convection PCR in the apparatus while substantially reducing the power consumption of the apparatus.

A particular embodiment of an invention apparatus with protrusions is shown in FIG. 5A. The apparatus includes a first protrusion 33 of the second heat source 30 disposed essentially symmetrically about the channel axis 80 and extending toward the first heat source 20. The first chamber 100 is disposed within the second heat source 30 and comprises a chamber wall 103 that is essentially parallel to the channel axis 80. Importantly, there is a gap between the bottom of the second heat source 32 and the top of the first heat source 21. In this embodiment, the first heat source 20 also includes a first protrusion 23 that are disposed symmetrically about the channel 70 and extending toward the second heat source 30. Also in this embodiment, the width or diameter of the first heat source protrusions 23, 24 along the channel axis 80 is reduced as going away from the first heat source 20.

As is also shown in FIG. 5A, the receptor hole 73 is disposed symmetrically about the channel axis 80. In this embodiment, the receptor hole 73 has a width or diameter perpendicular to the channel axis 80 that is about the same as the width or diameter of the channel 70. Alternatively, the receptor hole 73 may have a width or diameter perpendicular to the channel axis 80 that is somewhat larger (for example, about 0.01 mm to about 0.2 mm larger) than the width or diameter of the channel 70.

Figure 11B:
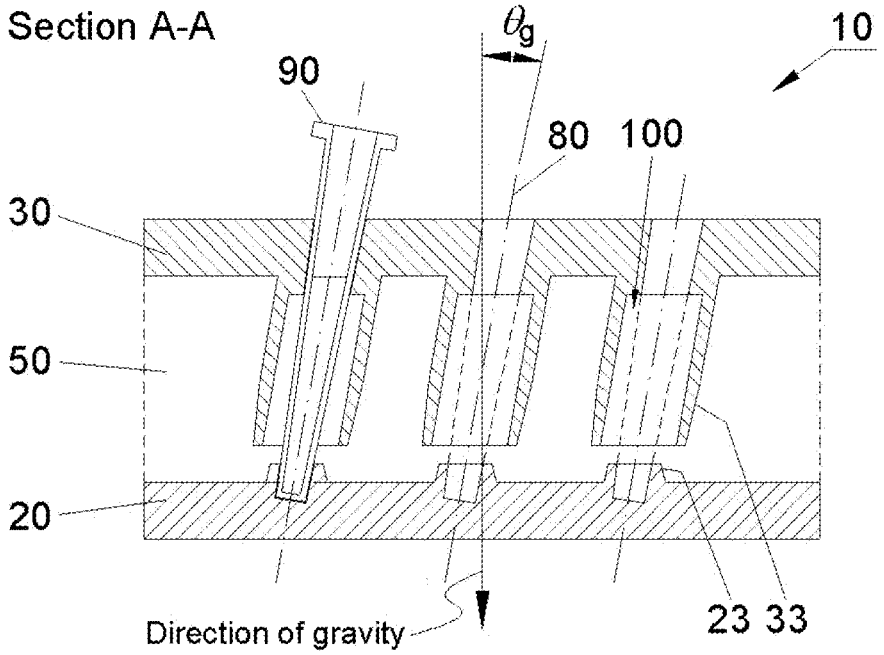

As discussed, it is an object of the invention to provide an apparatus for performing thermal convection PCR which includes at least one temperature shaping element which in one embodiment can be a positional asymmetry imposed on the apparatus. FIG. 11A shows one important example of this embodiment. As shown, the apparatus is tilted at an angle θg (tilting angle) with respect to the direction of gravity. This type of embodiments is particularly useful in controlling (typically increasing) speed of the thermal convection PCR. Alternatively, the apparatus can be made to include one or more of the channel and chambers that is tilted with respect to the direction of gravity. FIG. 11B shows one example of such embodiments in which both the channel and the first chamber are tilted with respect to the direction of gravity. As will be discussed below, increase of the tilting angle typically leads to faster and more robust thermal convection PCR. Other embodiments that include one or more positional asymmetries will be described in more detail below.

The embodiments shown in FIGS. 5A and 11A will be particularly suitable for many invention applications including amplification of "difficult" samples such as genomic or chromosomal target sequences or long-sequence target templates (e.g., longer than about 1.5 or 2 kbp). In particular, FIG. 5A shows heat sources with a symmetric chamber and channel configuration. The first chamber 100 and the first protrusion 33 of the second heat source 30 effectively block protrusion of the high temperature of the first heat source 20 toward inside the first chamber 100 as they are located on the bottom of the second heat source 32. In use, the temperature drops down rapidly in the first insulator region 50 from the high denaturation temperature (about 92° C. to about 106° C.) of the first heat source 20 to the polymerization temperature (about 80° C. to about 60° C.) on the bottom part of the first chamber 100. Hence, the temperature inside the first chamber 100 becomes more narrowly distributed around the polymerization temperature (due to the early cut off of the high denaturation temperature by the first thermal brake) so that a large volume (and time) inside the second heat source 30 becomes available for the polymerization step.

A major difference between the embodiments shown in FIGS. 5A and 11A is that the apparatus of FIG. 11A has a tilting angle θg. The apparatus without the tilting angle (FIG. 5A) works well and takes about 15 to 25 min to amplify from a 1 ng plasmid sample and about 25 to 30 min to amplify from a 10 ng human genome sample (3,000 copies) when the structure of the apparatus is optimized. PCR amplification efficiency of the apparatus can be further enhanced if a tilting angle of about 2° to about 60° (more preferably about 5° to about 30°) is introduced as depicted in FIG. 11A. With the gravity tilting angle introduced with this structure (FIG. 11A), PCR amplification from a 10 ng human genome sample can be completed in about 20 to 25 min. See Examples 1 and 2 below.

B. Tapered Chamber

Figure 12A:
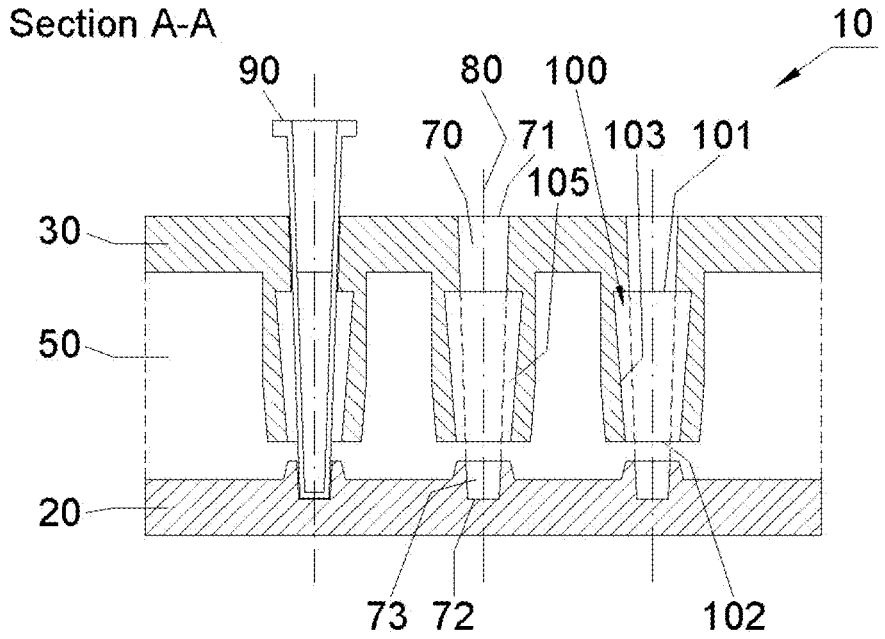
FIGS. 12A-B are schematic drawings showing sectional views (A-A plane) of apparatus embodiments. The first chamber 100 is tapered.
Figure 12B:
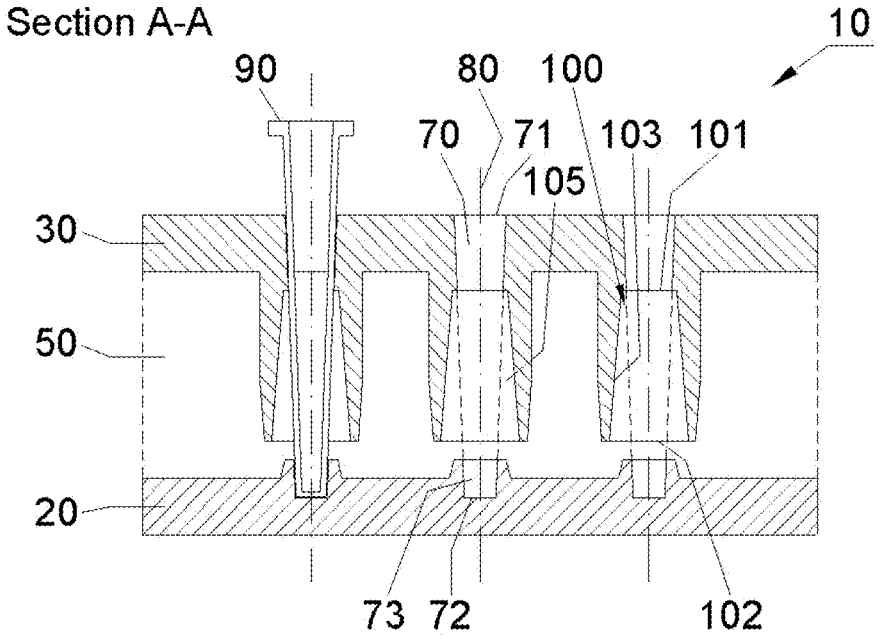

Referring now to FIGS. 12A-B, the apparatus embodiment features a first chamber 100 that is concentric with the channel. In this example of the invention, the chamber axis (i.e., an axis formed by the centers of the top and bottom end of the chamber) coincides with the channel axis 80. The chamber wall 103 of the first chamber 100 has an angle with respect to the channel axis 80. That is, the chamber wall 103 is tapered from the top end 101 to the bottom end 102 of the first chamber 100 (FIG. 12A). In FIG. 12B, the chamber wall 103 is tapered from the bottom end 102 to the top end 101 of the first chamber 100. Such a structure provides a narrow hole on the bottom and a wide hole on the top, or vice versa. For instance, if the bottom part is made narrower, as in FIG. 12A, heat transfer from the bottom part 32 of the second heat source 30 to the channel 70 becomes larger than that from the top part 31 of the second heat source 30. Moreover, the high denaturation temperature typical of the first heat source 20 is more preferentially blocked in this embodiment as compared to the embodiment with the top part of the second heat source 31 that is made narrower, as in FIG. 12B.

In the examples shown in FIGS. 12A-B, the temperature distribution of the channel 70 inside the second heat source 30 can be controlled with the tapered chamber structure. Depending on the temperature property of DNA polymerase used, the temperature conditions inside the second heat source 30 may need to be adjusted using such structure because the polymerization efficiency is sensitive to the temperature conditions inside the second heat source 30. For most widely used Taq DNA polymerase or its derivatives, a first chamber wall 103 that is tapered from the top to the bottom is more preferred since optimum temperature of Taq DNA polymerase (around 70° C.) is closer to the annealing temperature compared to the denaturation temperature in typical operation conditions.

C. One or Two Chambers, One Thermal Brake

Referring now to FIG. 4A, the apparatus 10 features the first chamber 100 and the second chamber 110 disposed in the second heat source 30 essentially symmetrically about the channel axis 80. In this embodiment, the first chamber 100 is located on the bottom part of the second heat source 30 and the second chamber 110 is located on the upper part of the second heat source 30.

The apparatus 10 includes the first thermal brake 130 to help provide more active control of the temperature distribution. In this embodiment, the width of the first chamber 100 and the second chamber 110 are about the same. However, the heights of the first chamber 100 and the second chamber 110 can be varied between about 0.2 mm to about 80% or 90% of the length of the second heat source 30 along the channel axis 80, depending on the temperature property of DNA polymerase used as discussed below. FIG. 4B provides an expanded view of the first thermal brake 130 defined by the top end 131, bottom end 132, and wall 133 contacting the channel 70. In this embodiment, the location and thickness of the first thermal brake 130 along the channel axis 80 will be defined by the heights of the first 100 and second 110 chambers along the channel axis 80. The thickness of the thermal brake 130 along the channel axis 80 is between about 0.1 mm to about 60% of the height of the second heat source 30 along the channel axis 80, preferably between about 0.5 mm to about 40% of the height of the second heat source 30. The first thermal brake 130 can be located nearly anywhere inside the second heat source in between the first 100 and second 110 chambers, depending on temperature property of DNA polymerase used. It is preferred to locate the first thermal brake 130 closer to the bottom surface 32 of the second heat source 30 if optimum temperature of DNA polymerase used is closer to the annealing temperature of the second heat source 30 than the denaturation temperature of the first heat source 20, or vice versa.

Figure 13A:
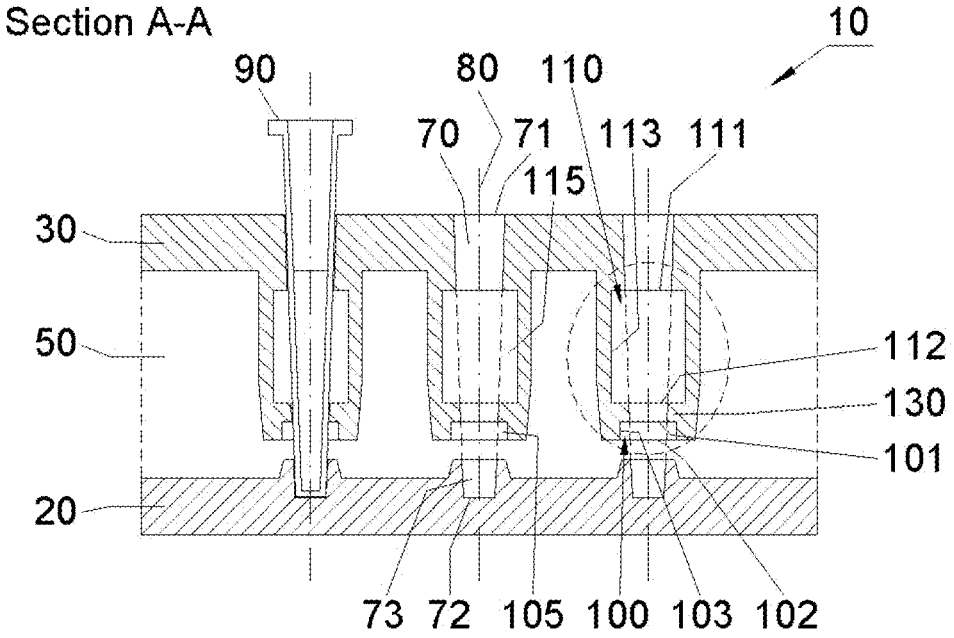
FIGS. 13A-B are schematic drawings showing sectional views (A-A plane) of an apparatus embodiment having a first thermal brake 130 located in between the first 100 and second 110 chambers within the second heat source 30. The widths of the first and second chambers are shown to be different.
Figure 13B:
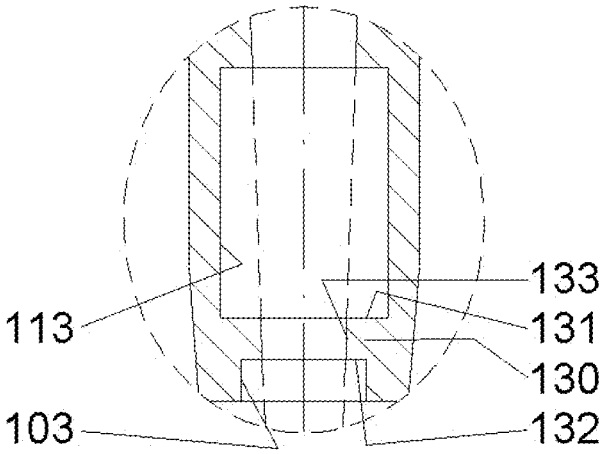

FIG. 13A is an example in which the first chamber 100 has a smaller width than the second chamber 110, for instance, about 0.9 to about 0.3 times smaller, preferably about 0.8 to about 0.4 times smaller. An opposite arrangement with the first chamber 100 having a larger width than the second chamber 110 can also be used depending on the temperature property of DNA polymerase used. An expanded view of the first thermal brake 130 is shown in FIG. 13B.

In the embodiments shown in FIGS. 4A-B and 13A-B, the apparatus features the first chamber and the second chamber that are not tapered. In these embodiments, the first chamber is spaced from the second chamber by a length (l) along the channel axis 80. In one embodiment, the first chamber, the second chamber, and the second heat source define a first thermal brake contacting the channel between the first and second chambers with an area and a thickness (or a volume) sufficient to reduce heat transfer from the first heat source.

Figure 14A:
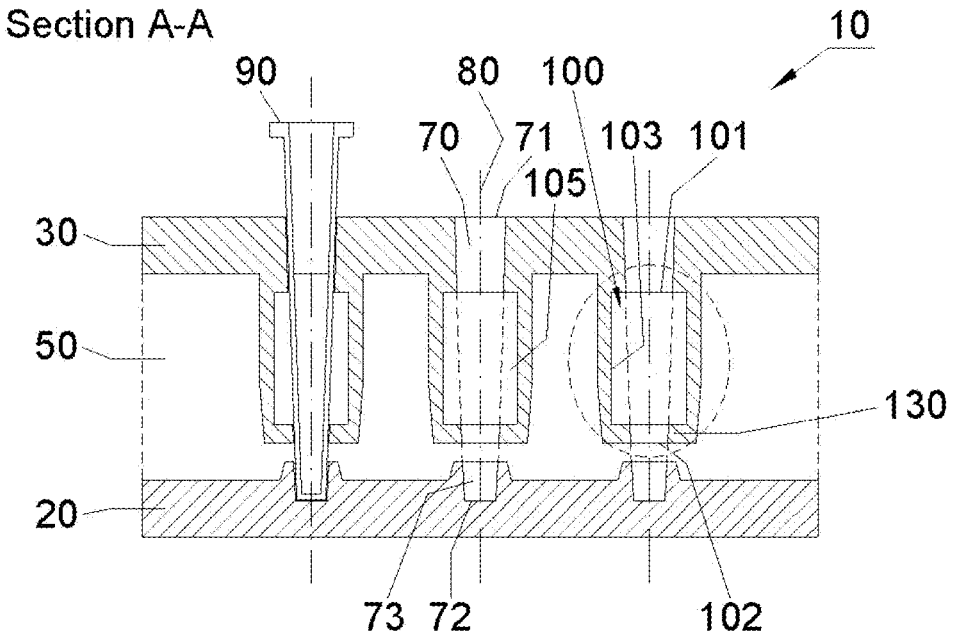
FIGS. 14A-D are schematic drawings showing sectional views (A-A plane) of apparatus embodiments having a first thermal brake 130 located on the bottom of the first chamber 100 (i.e., on the bottom of the second heat source 30).
Figure 14B:
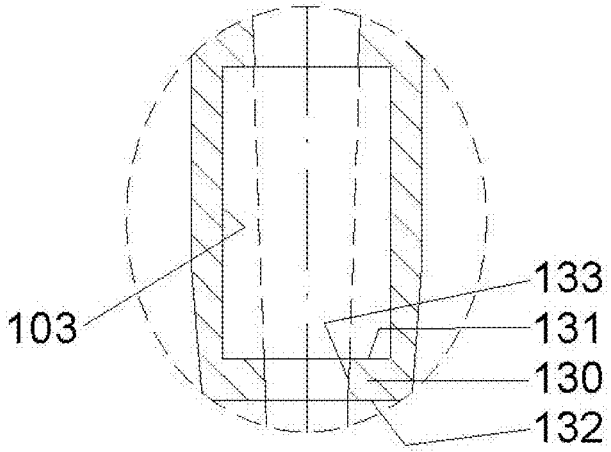

Referring to FIGS. 14A-B, the apparatus features the first chamber 100 disposed symmetrically about the channel axis 80. The first thermal brake 130 is positioned on the bottom of the second heat source 30 between the first chamber 100 and the first insulator 50.

The thickness of the first thermal brake 130 along the channel axis 80 shown in FIGS. 14A-B is defined by distance from the top end 131 to the bottom end 132 of the first thermal brake 130. Preferably that distance is between from about 0.1 mm to about 60% of the height of the second heat source 30 along the channel axis 80, more preferably about 0.5 mm to about 40% of the height of the second heat source 30.

In this embodiment, the apparatus features the first chamber positioned on the bottom part of the second heat source and the first chamber and the first insulator define the first thermal brake. The first thermal brake contacts the channel between the first chamber and the first insulator with an area and a thickness (or a volume) sufficient to reduce heat transfer from the first heat source. In this embodiment, the first thermal brake comprises a top surface and a bottom surface in which the bottom surface of the first thermal brake is located at about the same height as the bottom surface of the second heat source. This embodiment is particularly useful when using DNA polymerase that has optimum temperature closer to the annealing temperature of the second heat source than the denaturation temperature of the first heat source (e.g., Taq DNA polymerase).

Figure 14C:
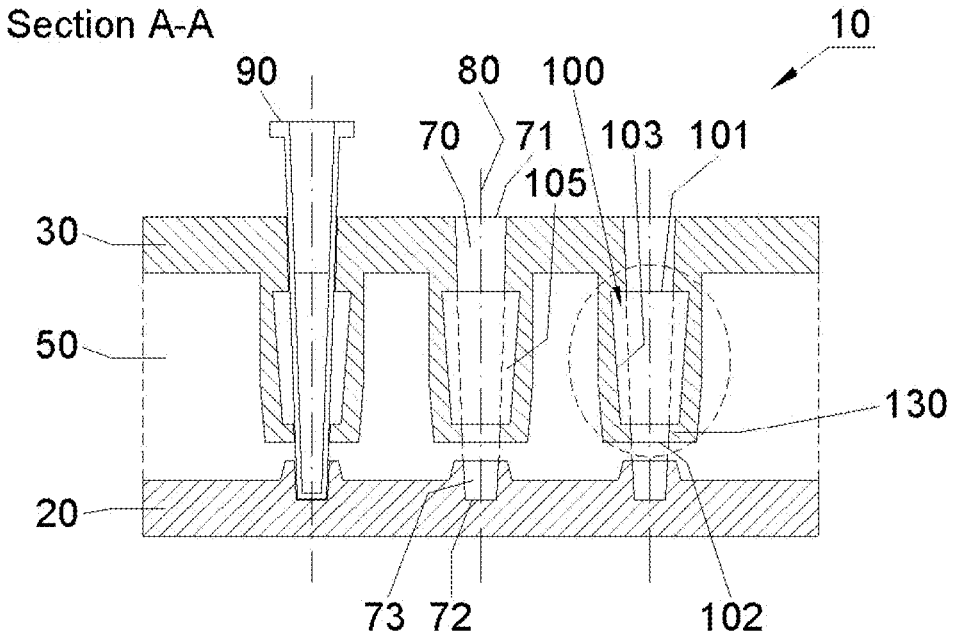
Figure 14D:
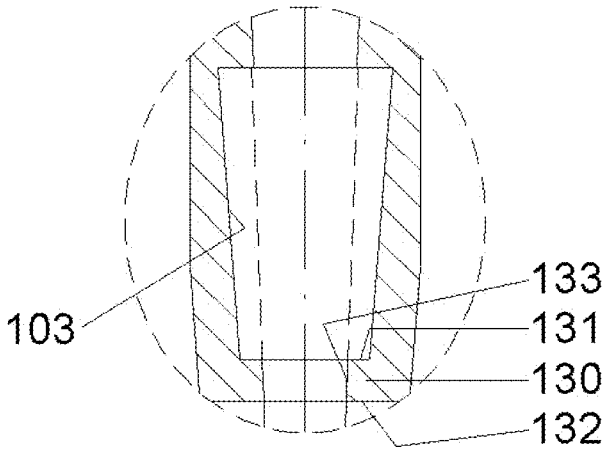

FIG. 14C is an example in which the chamber wall 103 of the first chamber 100 is tapered from the top end 101 to the bottom end 102 of the first chamber 100. An opposite arrangement with the chamber wall tapered from the bottom end 102 to the top end 101 of the first chamber 100 can also be used depending on the temperature property of DNA polymerase used. The first thermal brake 130 is positioned on the bottom of the second heat source 30 between the first chamber 100 and the first insulator 50. An expanded view of the first thermal brake 130 is shown in FIG. 14D.

D. Asymmetric Receptor Hole

As mentioned, it is an object of the invention to provide an apparatus with at least one temperature shaping element that has horizontal asymmetry. By "horizontal asymmetry" is meant asymmetry along a direction or plane perpendicular to the channel and/or channel axis. It will be apparent that many of the apparatus examples provided herein can be adapted to have a horizontal asymmetry. In one embodiment, the receptor hole is placed asymmetrically in the first heat source with respect to the channel axis sufficient to generate a horizontally asymmetric temperature distribution suitable for inducing a stable, directed convection flow. Without wishing to be bound to theory, it is believed that the region between the receptor hole and the bottom end of the chamber is a location where a major driving force for thermal convection flow can be generated. As will be readily apparent, this region is where initial heating to the highest temperature (i.e., the denaturation temperature) and transition toward a lower temperature (i.e., the polymerization temperature) take place, and thus the largest driving force can originate from this region.

It is thus an object of the invention to provide an apparatus with at least one horizontal asymmetry in which at least one of the receptor holes (for instance, all of them) in the first heat source has a width or diameter larger than the channel in the first heat source. Preferably, the width disparity allows the receptor hole to be off-centered from the channel axis. In this example of the invention, the receptor hole asymmetry produces a gap in which one side of the receptor hole is located closer to the channel compared to the opposite side. It is believed that in this embodiment, the apparatus will exhibit horizontally asymmetric heating from the first heat source to the channel.

An example of such an invention apparatus is shown in FIG. 15. As shown, the receptor hole 73 is disposed asymmetrically with respect to the channel axis 80 to form a receptor hole gap 74. That is, the receptor hole 73 is slightly off-centered with respect to the channel axis 80, for instance, by about 0.02 mm to about 0.5 mm. In this example, the receptor hole 73 has a width or diameter perpendicular to the channel axis 80 that is larger than the width or diameter of the channel 70. For example, the width or diameter of the receptor hole 73 can be about 0.04 mm to about 1 mm larger than the width or diameter of the channel 70.

Turning again to the embodiment shown in FIG. 15, one side (the left side) of the channel 70 is in contact with the first heat source 20 and the opposite side (the right side) is not in contact with the first heat source 20 to form a receptor hole gap 74. While the invention is compatible with several gap sizes, a typical receptor hole gap can be as small as about 0.04 mm, particularly if the other side is contacted to the channel. In other words, one side is formed as a channel and the opposite side as a small space. In this embodiment, it is believed that one side (the left side) is heated preferentially over the opposite side (the right side), providing a horizontally asymmetric heating directing the upward flow to the preferentially heated side (the left side). A similar effect can be obtained with a receptor hole having a gap from the wall of the receptor hole that is smaller on one side than the opposite side.

Figure 16A:
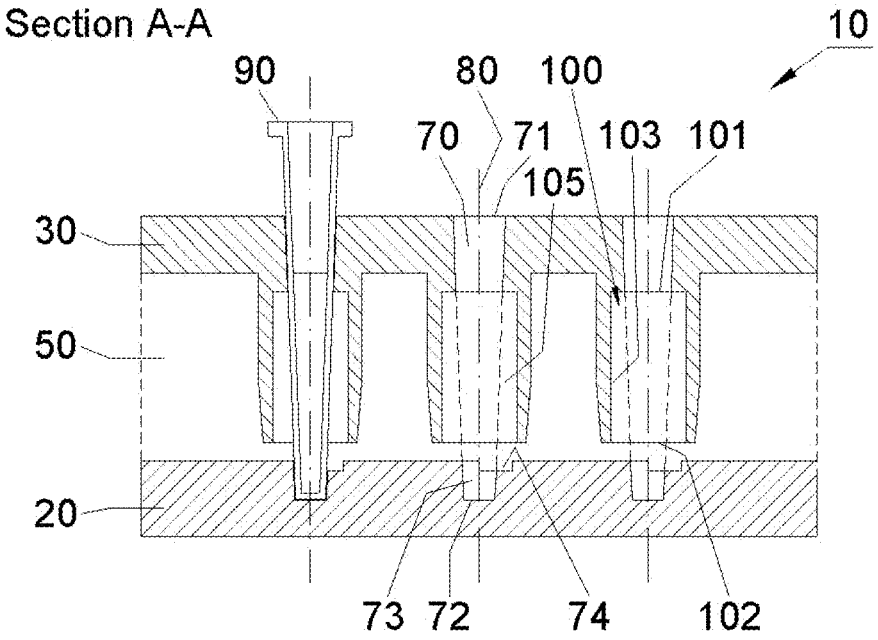
FIGS. 16A-B are schematic drawings showing sectional views of apparatus embodiments taken along the A-A plane. The first heat source 20 includes a receptor hole gap 74. In the embodiment shown by FIG. 16B, the receptor hole gap 74 includes a top surface that is inclined with respect to the channel axis 80.
Figure 16B:
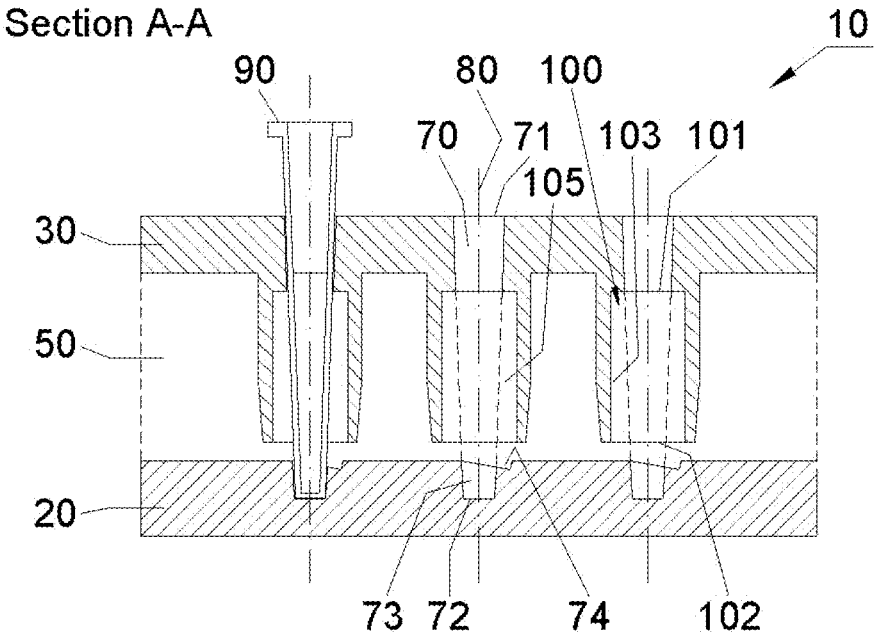

To enhance asymmetry, it is possible to make one side of the receptor hole deeper than the other with respect to the first heat source (and also closer to the chamber and the second heat source). Referring now to the apparatus shown in FIGS. 16A-B, the receptor hole 73 has a larger depth on one side of the hole (left side) compared to the side opposite to the channel 70 (right side). In this embodiment, both sides of the receptor hole 73 remain in contact with the channel 70. As shown in FIG. 16A, the top portion of the side wall of the receptor hole 73 is removed to form a receptor hole gap 74 defined roughly by the channel 70 and the first heat source 20. The bottom of the receptor hole gap 74 may be perpendicular to the channel axis 80 (FIG. 16A) or it may be disposed at an angle thereto (FIG. 16B). A side wall of the receptor hole gap 74 may be parallel to the channel axis 80 (FIG. 16A) or it may be at an angle thereto (FIG. 16B). In both the embodiments shown in FIGS. 16A-B, one side of the channel 70 has a larger depth with respect to the first heat source 20 than the other side with the receptor hole gap 74. Without wishing to be bound to theory, it is believed that the channel side with the larger depth in the embodiments shown in FIGS. 16A-B is heated preferentially due to more heat transfer from the first heat source, generating a larger buoyancy force on that side. It is further believed that by adding such an asymmetric receptor hole 73 and receptor hole gap 74 to the apparatus, there is an increase of the temperature gradient on one side of the channel 70 compared to the opposite side (the temperature gradient is typically inversely proportional to the distance). It is also believed that these features create a larger driving force on one side (e.g., the left side in FIGS. 16A and B) and support upward thermal convective flow along that side. It will be appreciated that one or a combination of different adaptations of the receptor hole 73 and receptor hole gap 74 are possible to achieve this goal. However, for many invention embodiments, it will be generally useful to make difference in the receptor hole depth on two opposing sides in the range of between from about 0.1 mm up to about 40 to 50% of the receptor hole depth.

FIGS. 17A-B show further examples of suitable apparatus embodiments in which the receptor hole 73 is disposed about the channel asymmetrically. Portions of the receptor hole are deeper in the first heat source and closer to the chamber or the second heat source than other portions, thereby providing uneven thermal flow toward the second heat source.

In the apparatus shown in FIG. 17A, the receptor hole 73 has two surfaces coincident with the top 21 of the first heat source 20. Each surface faces the second heat source 30 and one of the surfaces (the one on the right side in FIG. 17A) has a larger gap on one side of the channel 70 compared to the surface opposite the channel 70 (the one on the left side) with respect to the bottom surface 32 of the second heat source 30. That is, one of the surfaces is closer to the bottom 102 of the first chamber 100 or the bottom surface 32 of the second heat source 30 than the other. In this embodiment, both sides of the receptor hole 73 remain in contact with the channel 70. The difference of the receptor hole depth between the two surfaces is preferably in the range of between from about 0.1 mm up to about 40 to 50% of the receptor hole depth. The second heat source 30 features the first protrusion 33 that is disposed symmetrically about the channel axis 80. Also in this embodiment, the first heat source 20 includes the first protrusion 23 disposed asymmetrically about the channel axis 80.

Turning to FIG. 17B, the receptor hole 73 has a single inclined surface coincident with the top 21 of the first heat source 20. The incline angle is between about 2° to about 45° with respect to an axis perpendicular to the channel axis 80. In this embodiment, the apex of the inclined surface is relatively close to the bottom 102 of the first chamber 100. The second heat source 30 features the first protrusion 33 that is disposed symmetrically about the channel axis 80. Also in this embodiment, the first heat source 20 includes the first protrusion 23 disposed asymmetrically about the channel axis 80.

E. One Asymmetric Chamber, Asymmetric or Symmetric Receptor Hole

Figure 18A:
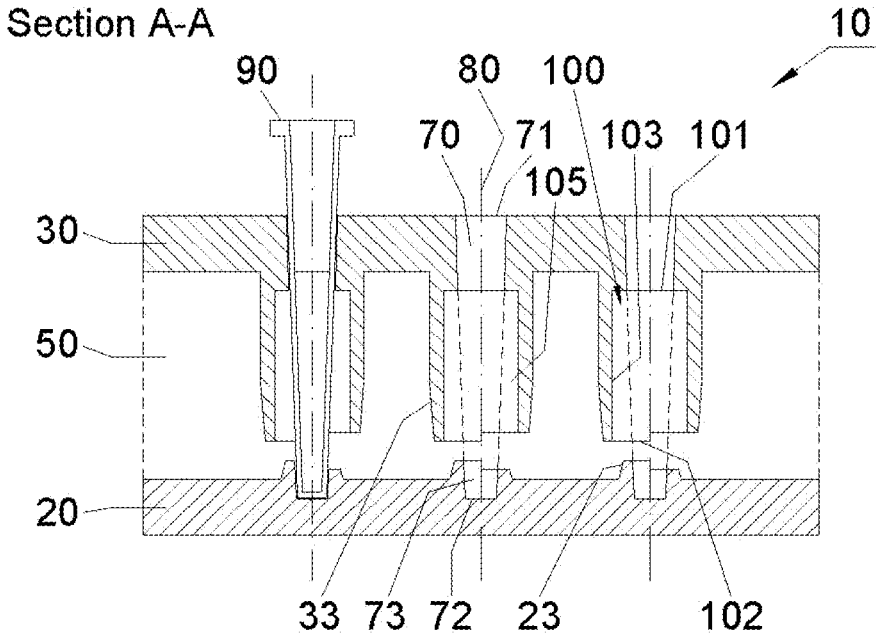
FIGS. 18A-D are schematic drawings showing sectional views of apparatus embodiments taken along the A-A plane. In these embodiments, the first 20 and second 30 heat sources feature protrusions 23 and 33 disposed asymmetrically about the channel axis 80. The protrusions 23 and 33 have a greater height on one side than another side opposite to the channel axis 80. The top end of the protrusion 23 and the bottom end of the protrusion 33 have multiple surfaces (FIGS. 18A and 18C) or are inclined with respect to the channel axis 80 (FIGS. 18B and 18D).
Figure 18B:
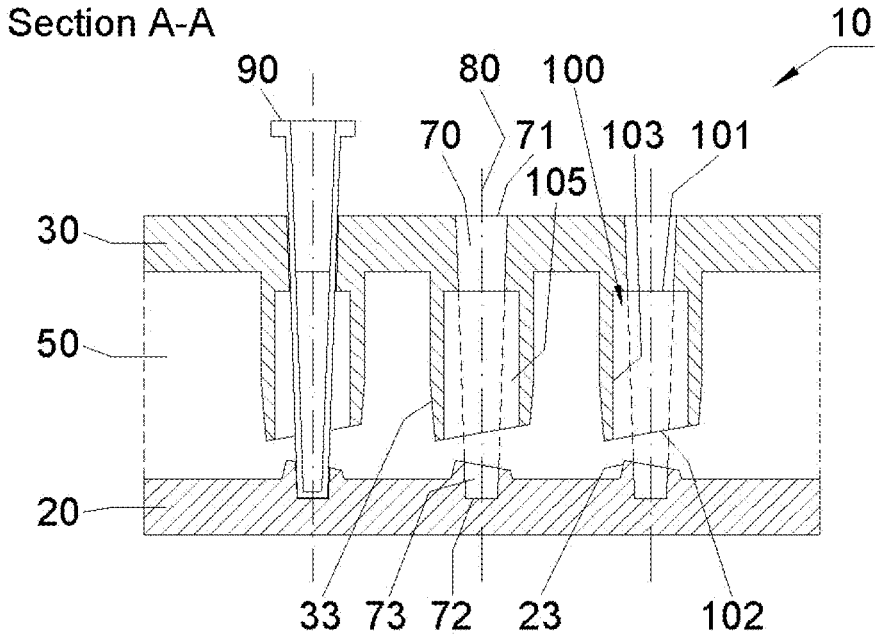

In the embodiment shown in FIG. 18A-B, the first chamber 100 is disposed asymmetrically about the channel axis 80 sufficient to cause horizontally uneven heat transfer from the second heat source 20 to the channel 70. The receptor hole 73 may also be disposed asymmetrically about the channel 70 as in FIGS. 18A-B. In the embodiment shown in FIG. 18A, the first chamber 100 is positioned within the second heat source 30 and has a greater height on one side of the chamber than the other side opposite the channel axis 80. That is, the length between one surface of the top end of the first chamber 101 and one surface of the bottom end of the first chamber 102 is greater (left side of FIG. 18A) along the channel axis 80 than the length between another surface of the top end of the first chamber 101 and another surface of the bottom end of the first chamber 102 (right side of FIG. 18A). The difference of the chamber height between the two opposing sides is preferably in the range of between from about 0.1 mm up to about 5 mm. There is gap between the bottom 101 of the first chamber 100 (or the bottom surface of the second heat source) and the top end of the receptor hole 73 that is smaller on the left side of the channel 70 than the other side.

Turning to FIG. 18B, the bottom end 102 of the first chamber 100 is inclined with respect to an axis perpendicular the channel axis 80 by from about 2° to about 45°. In the example, the apex of the incline is further closer to the receptor hole 73. The top of the receptor hole 73 coincident with the top surface 21 of the first heat source 20 is inclined with respect to the channel axis 80. In this embodiment, the apex of the receptor hole incline is closer to the bottom end of the first chamber 102. That is, there is gap between the bottom of the first chamber 100 (or the bottom surface of the second heat source) and the top end of the receptor hole 73 that is smaller on the left side of the channel 70 than the other side.

The configurations shown in FIGS. 18A-B provide preferential heating on one side of the channel 70 (i.e., the left side) in the receptor hole 73, and thus initial upward convective flow can start preferentially on that side. However, the second heat source 30 provides preferential cooling on the same side due to the longer chamber length on that side. Therefore, the upward flow can change its path to the other side depending on the extent of the first chamber asymmetry.

Figure 18C:
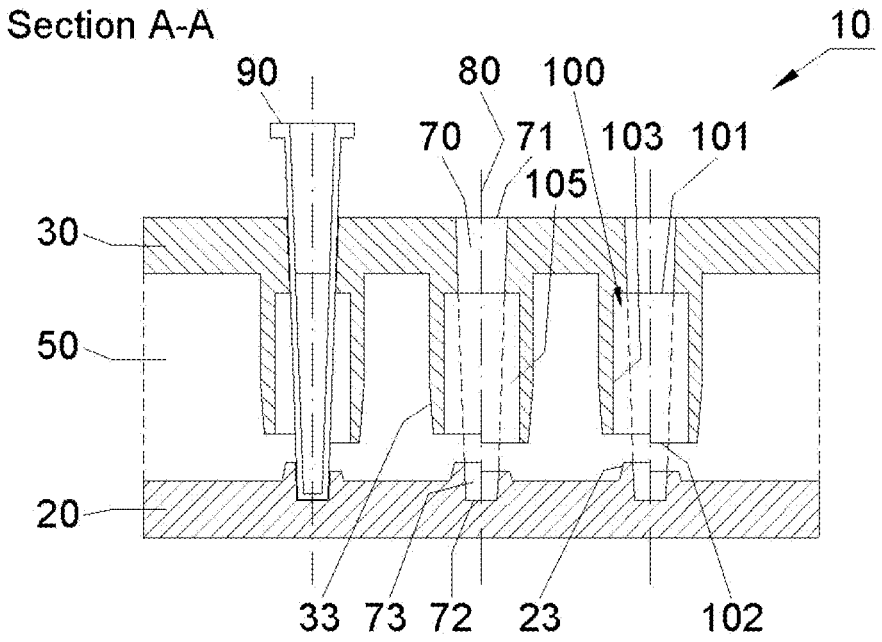
Figure 18D:
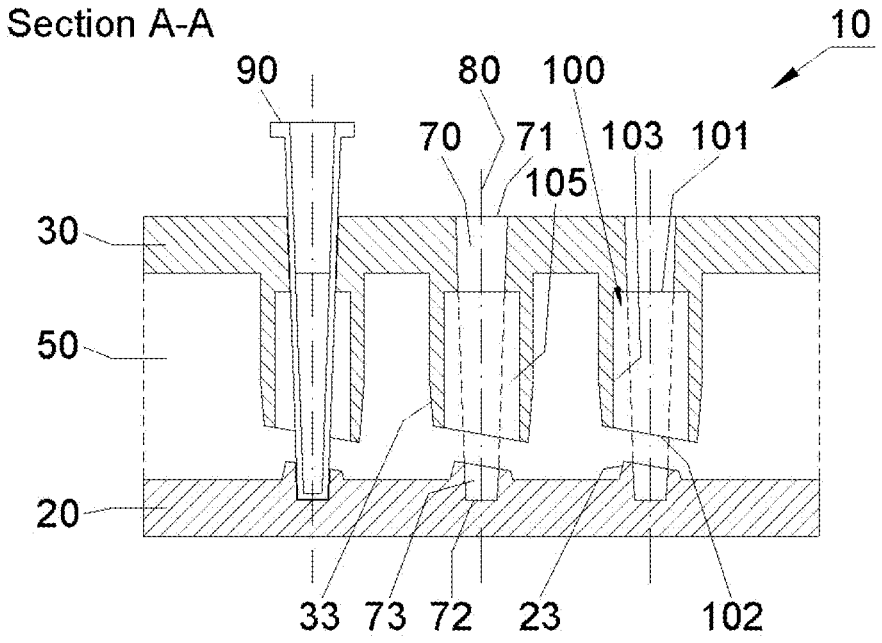

Turning to FIGS. 18C-D, the length between the top end 101 and the bottom end 102 is greater on one side of the first chamber 100 (the right side) than the other side with respect to the channel axis 80. Here, preferential cooling from the second heat source will be on the right side of the chamber shown in FIGS. 18C-D. Further asymmetry is provided by the larger depth of the receptor hole 73 on one side of the channel 70 (i.e., the left side of FIGS. 18C-D) than the other side. In the receptor hole 73, preferential heating will be on the left side of the channel 70. In this embodiment, a gap between the bottom 102 of the chamber 100 and the top of the receptor hole 73 is essentially constant around the channel 70.

The configurations shown in FIGS. 18C-D support preferential heating on one side of the channel 70 (i.e., the left side) in the receptor hole 73 and preferential cooling on the opposite side in the first chamber 100, and thus upward convective flow will stay preferentially on the left side.

In the embodiments shown in FIGS. 18A-D, asymmetry introduced by the chamber configurations is sufficient to cause horizontally uneven heat transfer from the second heat source to the channel. Also in these embodiments, the protrusions 23, 33 are disposed asymmetrically about the channel axis 80.

Other apparatus embodiments with at least one structural asymmetry are within the scope of the present invention.

Figure 19A:
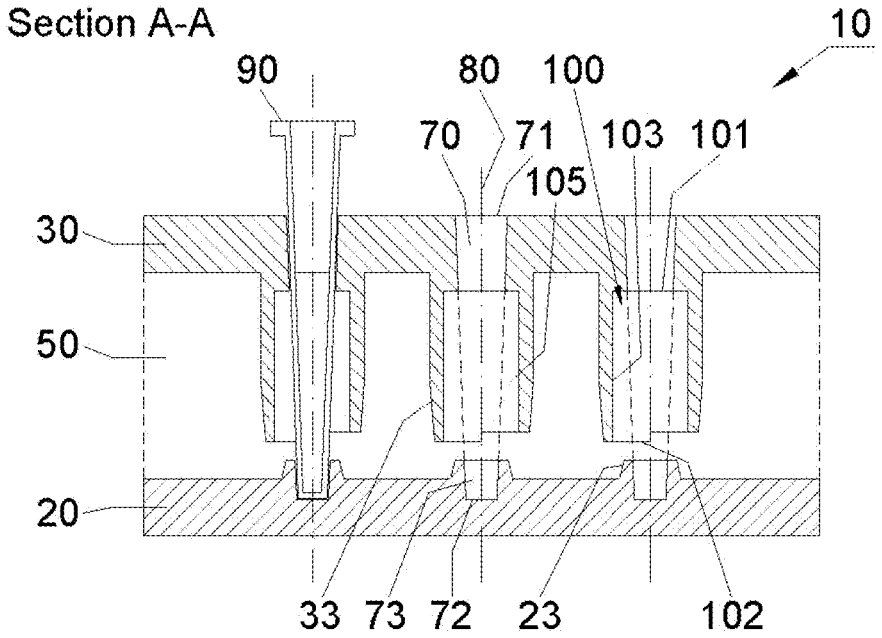
FIGS. 19A-B are schematic drawings showing sectional views of apparatus embodiments taken along the A-A plane. In these embodiments, the first heat source 20 features a protrusion 23 disposed symmetrically around the receptor hole 73 and the second heat source 30 features a protrusion 33 disposed asymmetrically about the channel axis 80.
Figure 19B:
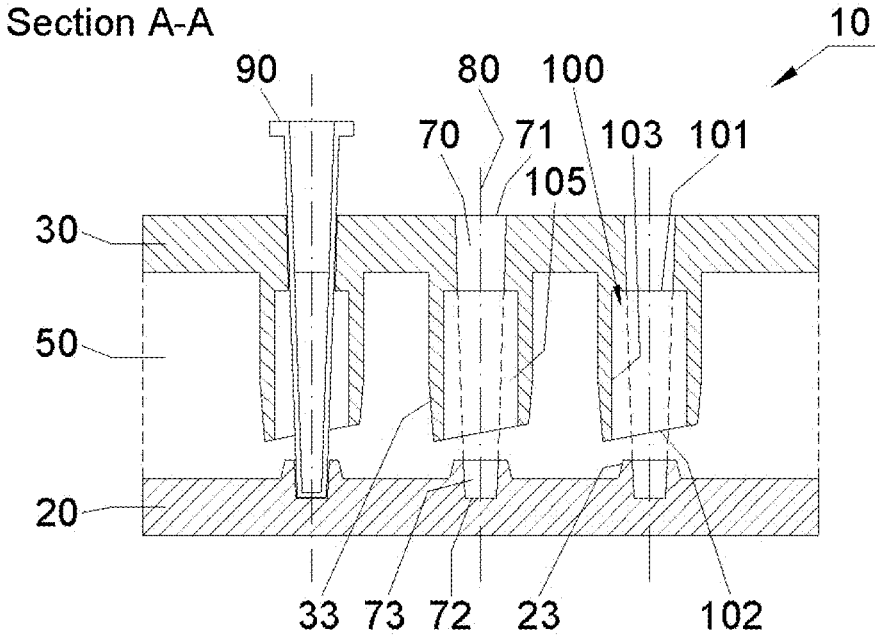

For example, and as shown in FIGS. 19A-B, the bottom end of the first chamber 102, is asymmetrically disposed with respect to the channel axis 80. The length between the top end 101 and the bottom end 102 is greater on one side of the first chamber 100 (the left side of the FIGS. 19A-B) than the other side with respect to the channel axis 80. A gap between the bottom of the first chamber 102 and the top of the receptor hole 73 is smaller on one side of the channel 70 (the left side of FIGS. 19A-B) than the other side. In these embodiments, the first protrusion 23 of the first heat source 20 is disposed symmetrically about the channel axis 80. Also in these embodiments, there is preferential heating on the right side of the receptor hole 73 (with respect to the channel axis 80) due to the larger gap on that side (since cooling by the second heat source is less significant on that side due to the larger gap) and thus a larger driving force is generated on the right side of the channel 70 and more pronounced upward flow on that side. In addition, the second heat source 30 features a first protrusion 33 disposed asymmetrically about the channel axis 80.

F. One Asymmetric Chamber with or without Thermal Brake

Figure 20B:
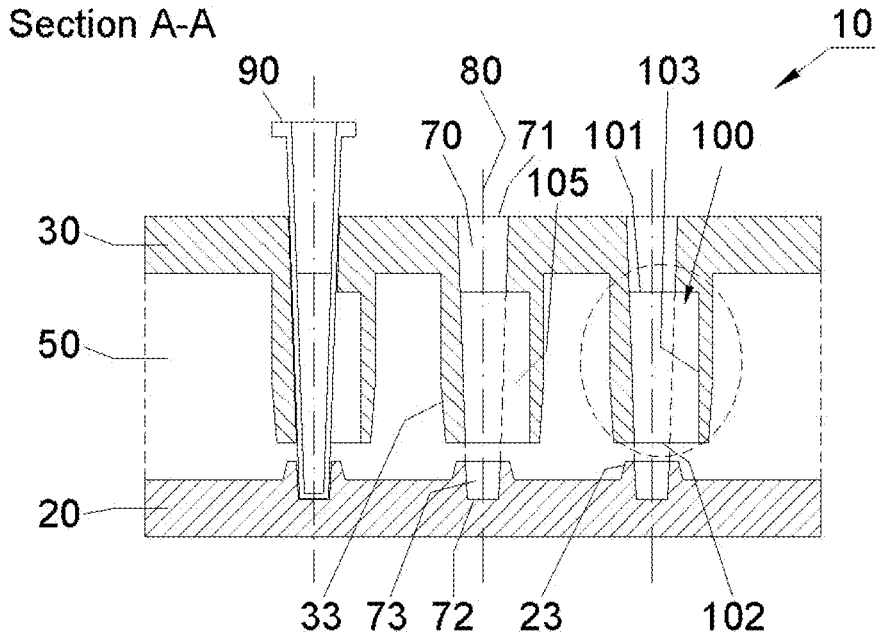
Figure 20C:
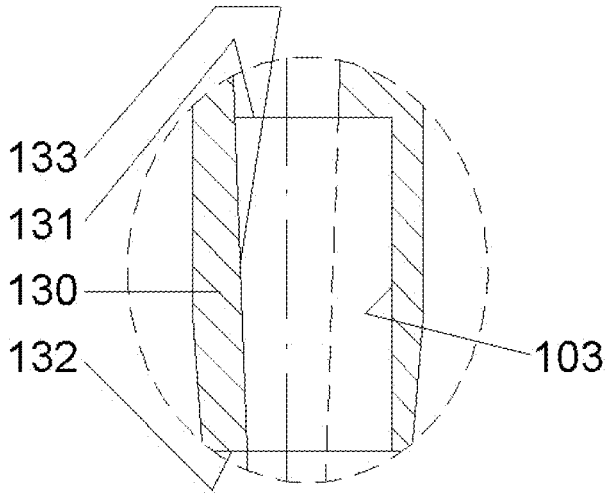

Referring to FIG. 20A, the first chamber 100 is off-centered with respect to the channel axis 80. In this embodiment, the receptor hole 73 is disposed symmetrically about the channel axis 80 and is of constant depth. The first chamber 100 is off-centered from the channel 70 so that the chamber gap 105 is smaller on one side compared to the opposite side. As shown in FIG. 20B, the chamber 100 can be further off-centered from the channel 70 so that one side or wall of the channel 70 makes contact with the chamber wall. In this embodiment, the channel-forming side (e.g., the left side in FIG. 29B) functions as a first thermal brake 130 having its top 131 and bottom 132 ends coincide with the top 101 and bottom 102 end of the first chamber 100. In such an embodiment, heat transfer between the second heat source 30 and the channel 70 is larger on the side where the chamber gap 105 is smaller or does not exist (i.e., the left side in FIGS. 20A and B), thus producing a horizontally asymmetric temperature distribution. FIG. 20C provides an expanded view of the first thermal brake 130. An acceptable difference between the chamber gaps on two opposite sides is preferably in the range between from about 0.2 mm to about 4 to 6 mm, and hence the chamber axis is off-centered from the channel axis by at least about 0.1 mm up to about 2 to 3 mm.

It will be appreciated that all or part of a chamber can be made asymmetric with respect to the channel axis 80, for example, all or part of the chamber may be off-centered. For most invention applications, it will be useful to off-center an entire chamber.

G. Asymmetric Chambers

As discussed, it is an object of the present invention to provide an apparatus within one, two or three chambers in the second heat source, for example. In one embodiment, at least one of the chambers has a horizontal asymmetry. The asymmetry helps create a horizontally asymmetric driving force within the apparatus. For example, and in the embodiment shown in FIG. 21, the first chamber 100 and the second chamber 110 are each off-centered from the channel axis 80 along opposite directions. In particular, the top end of the first chamber 101 is positioned at essentially at the same height as the bottom end of the second chamber 112. The first and second chambers may have different width or diameter. Difference of the chamber gap 105, 115 on two opposite sides may be at least about 0.2 mm up to about 4 to 6 mm.

Figure 21:
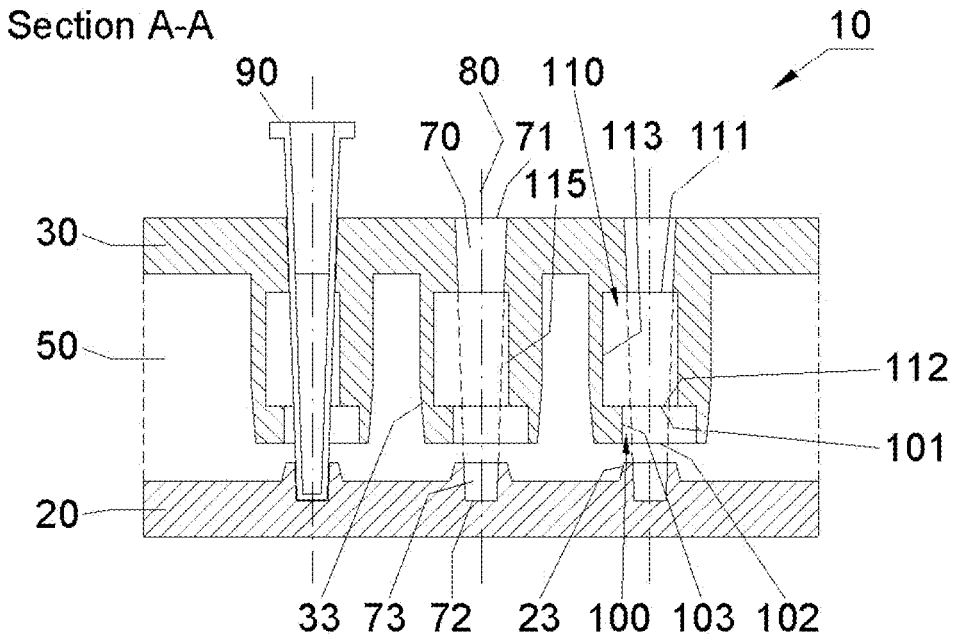
FIG. 21 is a schematic drawing showing a sectional view of an apparatus embodiment taken along the A-A plane showing the first 100 and second 110 chambers disposed asymmetrically about the channel axis 80 within the second heat source 30.
Figure 22:
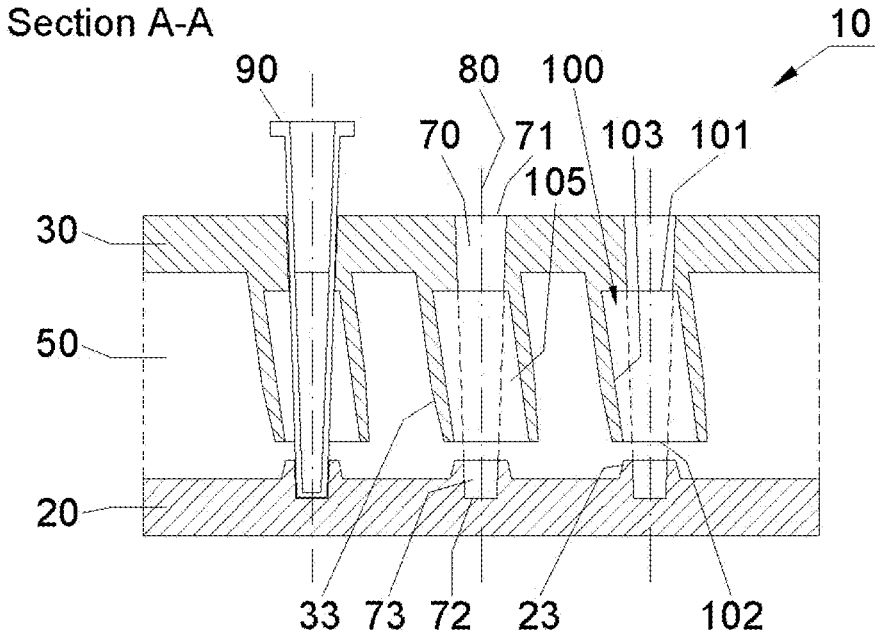
FIG. 22 is a schematic drawing showing a sectional view taken along the A-A plane of an apparatus embodiment in which the first chamber 100 includes a wall 103 disposed at an angle with respect to the channel axis 80.

In addition to the off-centered chamber structures exemplified in FIG. 21, one or more of the chambers may be made horizontally asymmetric by including structures that are tilted (skewed) with respect to the channel axis 80. For instance, and as shown in FIG. 22, the first chamber 100 may be tilted with respect to the channel axis 80. In this embodiment, the first wall of the first chamber 103 is tilted with respect to the channel axis 80 (e.g., at an angle less than about 30° with respect to the channel axis 80). Tilt angle as defined by an angle between the center axis of the chamber (or the chamber wall 103) and the channel axis may be between from about 2° to about 30°, more preferably between from about 5° to about 20°.

In the apparatus embodiments shown in FIGS. 21 and 22, upward convective flow from the bottom of the channel 70 is favored along the right side of the channel 70 as a result of preferential heating from the receptor hole 73 on that side (due to less significant cooling by the second heat source as a result of the larger chamber gap on that side).

H. One Chamber in Second Heat Source, Tilted

As mentioned, it is an object of the invention to provide an apparatus in which various temperature shaping elements such as one or more of the channel, receptor hole, protrusion (if present), gap such as a chamber, insulators or insulating gaps, and thermal brake are each disposed symmetrically about the channel axis. In use, the apparatus will often be placed on a flat, horizontal surface so that the channel axis will be substantially aligned with the direction of gravity. In such an orientation, it is believed that a buoyancy force is generated by the temperature gradient inside the channel and that the buoyancy force also becomes aligned parallel to the channel axis. It is also believed that the buoyancy force will have its direction opposite to the direction of gravity with a magnitude proportional to the temperature gradient (along the vertical direction). Since the channel and the one or more chambers are symmetrically disposed about the channel axis in this embodiment, it is believed that the temperature distribution (i.e., distribution of the temperature gradient) generated inside the channel should also be symmetric with respect to the channel axis. Therefore, distribution of the buoyancy force should also be symmetric with respect to the channel axis with its direction parallel to the channel axis.

It is possible to introduce a horizontal asymmetry into the apparatus by moving the channel axis away from the direction of gravity. In these embodiments, it is possible to further enhance the efficiency and speed of convection-based PCR within the apparatus. Thus it is an object of the invention to provide an apparatus featuring one or more horizontal asymmetries.

Examples of an invention apparatus with positional horizontal asymmetry are provided by FIGS. 11A-B.

In FIG. 11A, the channel axis 80 is offset with respect to the direction of gravity to give the apparatus a positional horizontal asymmetry. In particular, the channel and chamber are formed symmetrically with respect to the channel axis. However the whole apparatus is rotated (or tilted) by an angle $\theta_g$ with respect to the direction of gravity. In this tilted structure, the channel axis 80 is no longer parallel to the direction of gravity, and thus the buoyancy force generated by the temperature gradient on the bottom of the channel becomes tilted with respect to the channel axis 80 since it is supposed to have a direction opposite to the direction of gravity. Without wishing to be bound to theory, the direction of the buoyancy force makes an angle $\theta_g$ with the channel axis 80 even if the channel/chamber structure is symmetric with respect to the channel axis 80. In this structural arrangement, the upward convection flow will take a route on one side of the channel or the reaction vessel (the left side in the case of FIG. 11A) and the downward flow will take a route on the opposite side (i.e., the right side in the case of FIG. 11A). Hence, the route or pattern of the convection flow is believed to become substantially locked to one determined by such structural arrangement, therefore the convective flow becomes more stable and not sensitive to small perturbations from environment or small structural defects, leading to more stable convection flow and enhanced PCR amplification. It has been found that introduction of the gravity tilting angle helps enhancing the speed of the thermal convection, thereby supporting faster and more robust convection PCR amplification. The tilt angle $\theta_g$ can be varied between from about 2° to about 60°, preferably between about 5° to about 30°. This tilted structure can be used in combination with all the symmetric or asymmetric channel/chamber structures provided in the present invention.

The tilt angle $\theta_g$ shown in FIG. 11A can be introduced by one or a combination of different element. In one embodiment, the tilt is introduced manually. However it will often be more convenient to introduce the tilt angle $\theta_g$ by placing the apparatus 10 on an incline, for instance, by placing apparatus 10 on a wedge or similar shaped base.

However for some invention embodiments, it will not be useful to tilt the apparatus 10. FIG. 11B shows another approach for introducing the horizontal asymmetry. As shown, one or more of the channel and chambers is tilted with respect to the direction of gravity. That is, the channel axis 80 (and the chamber axis) are offset (by $\theta_g$) with respect to an axis perpendicular to the horizontal surface of the heat sources. In this invention embodiment, the channel axis 80 makes an angle $\theta_g$ with respect to the direction of gravity when the apparatus is placed on a flat, horizontal surface to have its bottom opposite from and parallel to that surface (as would be typical). According to this embodiment, and without wishing to be bound to theory, the buoyancy force generated by the temperature gradient on the bottom of the channel (that is supposed to have a direction opposite to the direction of gravity) will make an angle $\theta_g$ with respect to the channel axis as in the case of the embodiments described above. Such a structural arrangement will make the convection flow going upward on one side (i.e., the left side in the case of FIG. 11B) and going downward on the opposite side (i.e., the right side in the case of FIG. 11B). The tilt angle $\theta_g$ can be varied preferably between from about 2° to about 60°, more preferably between about 5° to about 30°. This tilted structure can also be used in combination with all the structural features of the channel and the chamber provided in the present invention.

Nearly any of the apparatus embodiment disclosed herein can be tilted by placing it on a structure capable of offsetting the channel axis 80 between from about 2° to about 60° with respect to the direction of gravity. As mentioned, an example of an acceptable structure is a surface capable of producing an incline such as a wedge or related shape.

L. Two Chambers and Thermal Brake(s) with Structural Asymmetry

Figure 23A:
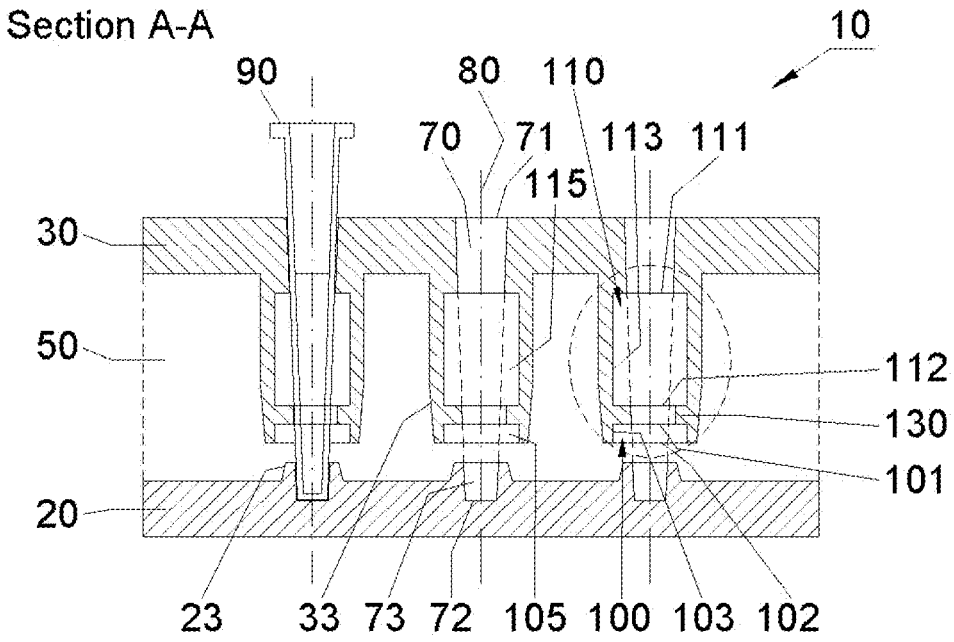
FIGS. 23A-B are schematic drawings showing a sectional view of an apparatus embodiment taken alone the A-A plane with the first chamber 100 and the second chamber 110 within the second heat source 30.

It is an object of the invention to provide an apparatus with one or more thermal brakes, e.g., one, two or three thermal brakes in which one or more of them have horizontal asymmetry. Referring to the apparatus shown in FIGS. 23A-B, the first thermal brake 130 has horizontal asymmetry. In this embodiment, the through hole formed in the first thermal brake 130 (that typically is made to fit with the channel) is larger than the channel 70 and off-centered from the channel axis 80 to provide a smaller (or no) gap on one side and a larger gap on the opposite side. Temperature distribution is found to be more sensitive to the asymmetry in the thermal brake compared to the asymmetry in the chamber (i.e., asymmetry in the first chamber wall 103). Preferably, the through hole in the thermal brake may be made at least about 0.1 mm up to about 2 mm larger, and off-centered from the channel axis by at least about 0.05 mm up to about 1 mm.

Figure 23B:
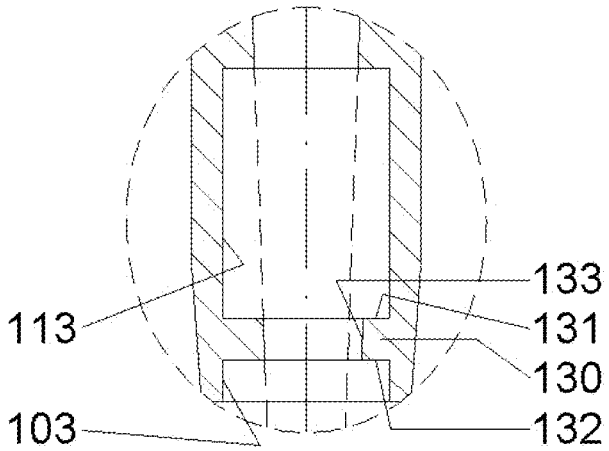

In embodiments in which the structural asymmetry resides in the first thermal brake 130 or the second thermal brake 140 (or both the first 130 and second 140 thermal brakes), the apparatus can include at least one chamber that is disposed symmetrically or asymmetrically about the channel axis 80. In the embodiment shown in FIG. 23A, the first chamber 100 and the second chamber 110 are positioned within the second heat source 30 and disposed symmetrically about the channel axis 80. In this embodiment, the first chamber 100 is spaced from the second chamber 110 by a length l along the channel axis 80. A portion of the second heat source 30 contacts the channel 70 to form the first thermal brake 130 sufficient to reduce heat transfer from the first heat source 20. The first thermal brake 130 is disposed asymmetrically about the channel 70. The first thermal brake 130 contacts one side of the channel 70 between the first 100 and second 110 chambers, the other side of the channel 70 being spaced from the second heat source 30. FIG. 23B shows an expanded view of the first thermal brake 130 showing wall 133 contacting the channel 70 on the left side. When the structural asymmetry is associated with one or more of the thermal brakes, the upward and downward convective flow can be favored on one side of the channel or the opposite side with respect to the channel axis depending on the position and thickness of the thermal brakes along the channel axis.

It will sometimes be useful to have an invention apparatus with one, two, or three chambers disposed in the second heat source either symmetrically or asymmetrically about the channel axis 80. In one embodiment, the apparatus has a first, second, and third chamber in which one or two of the chambers is disposed asymmetrically about the channel axis 80 and the other chamber is disposed symmetrically about the same axis. In an embodiment in which the apparatus includes a first chamber and second chamber that are each disposed asymmetrically about the channel axis 80, those chambers can reside completely or partially within the second heat source.

Particular examples of this invention embodiment are shown in FIGS. 24A-D.

Figure 24A:
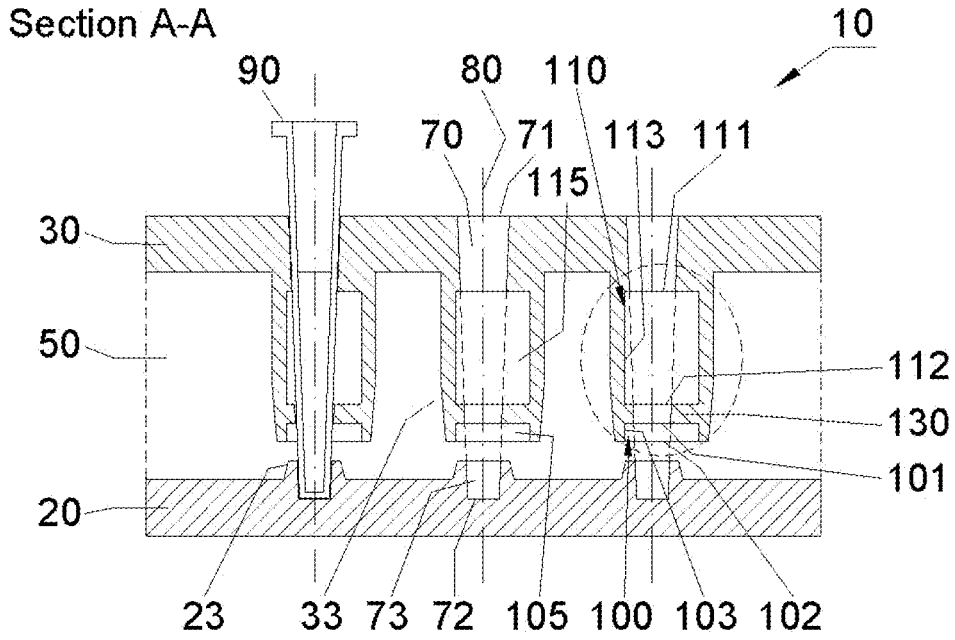
FIGS. 24A-B are schematic drawings showing a sectional view of an apparatus embodiment along the A-A plane in which the first 100 and second 110 chambers are within the second heat source 30. The first 100 and second 110 chambers are disposed asymmetrically about the channel axis 80. In an expanded view shown in FIG. 24B, the thermal brake 130 is shown disposed symmetrically about the channel 70 between the first 100 and second 110 chambers. The wall 133 of the thermal brake 130 contacts the channel 70.
Figure 24B:
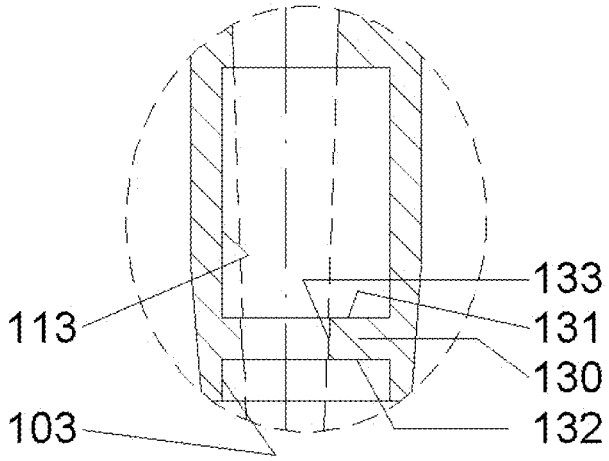

In FIG. 24A, the first thermal brake 130 contacts part of the height of the channel 70 within the second heat source 30. The first chamber 100 and the second chamber 110 are each positioned in the second heat source 30 and the first chamber 100 is spaced from the second chamber 110 by a length (l) along the channel axis 80. In this embodiment, the thermal brake 130 contacts the whole circumference of the channel 70 on the length (l) between the first 100 and second 110 chambers. The first chamber 100 and the second chamber 110 are each off-centered from the channel axis 80 in the same horizontal direction. FIG. 24B provides an expanded view of the first thermal brake 130 in which wall 133 contacts the channel 70.

Figure 24C:
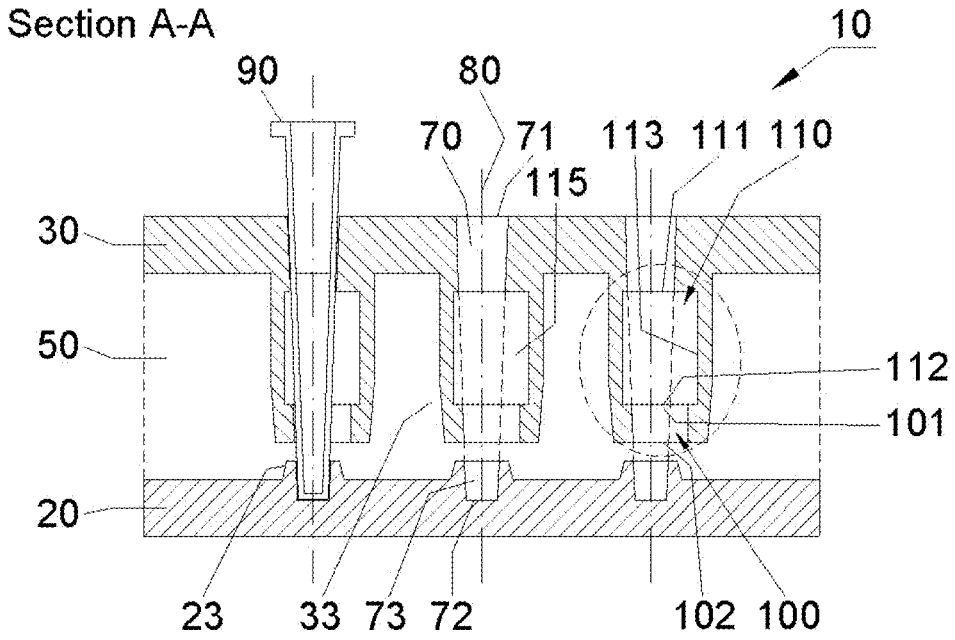
FIGS. 24C-D are schematic drawings showing a sectional view of an apparatus embodiment along the A-A plane in which the first 100 and second 110 chambers are within the second heat source 30. The first 100 and second 110 chambers are disposed asymmetrically about the channel axis 80. The width of the first chamber 100 perpendicular to the channel axis 80 is smaller than the width of the second chamber 110 along the channel axis 80. In an expanded view shown in FIG. 24D, the first thermal brake 130 is shown disposed asymmetrically about the channel 70 with the wall 133 contacting the channel 70 on one side.
Figure 24D:
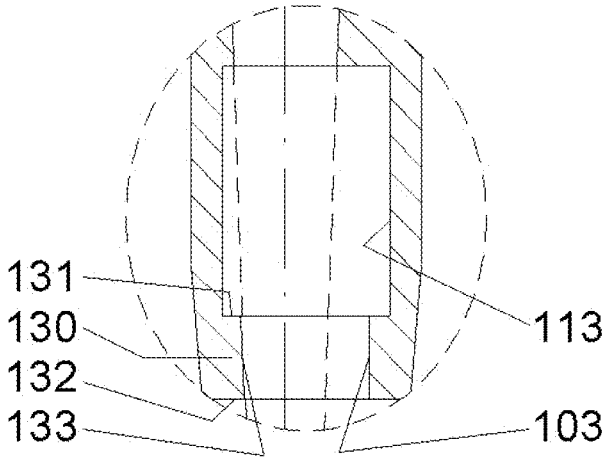

Turning to FIG. 24C, the first chamber 100 and the second chamber 110 are each off-centered from the channel axis in the same horizontal direction. The first 100 and second 110 chambers can have the same or different width or diameter. In this embodiment, the first thermal brake 130 contacts one side of the channel 70 (i.e., the left side) within the first chamber 100 on a length from the bottom end 132 to the top end 131 of the first thermal brake 130 that is the same as the length of the first chamber 100 along the channel axis 80 in the embodiment shown in FIG. 24C. FIG. 24D provides an expanded view of the first thermal brake 130 showing wall 133 contacting the channel 70.

In each of the embodiments shown in FIGS. 24A-D, the receptor hole 73 is disposed symmetrically about the channel 70.

Figure 25A:
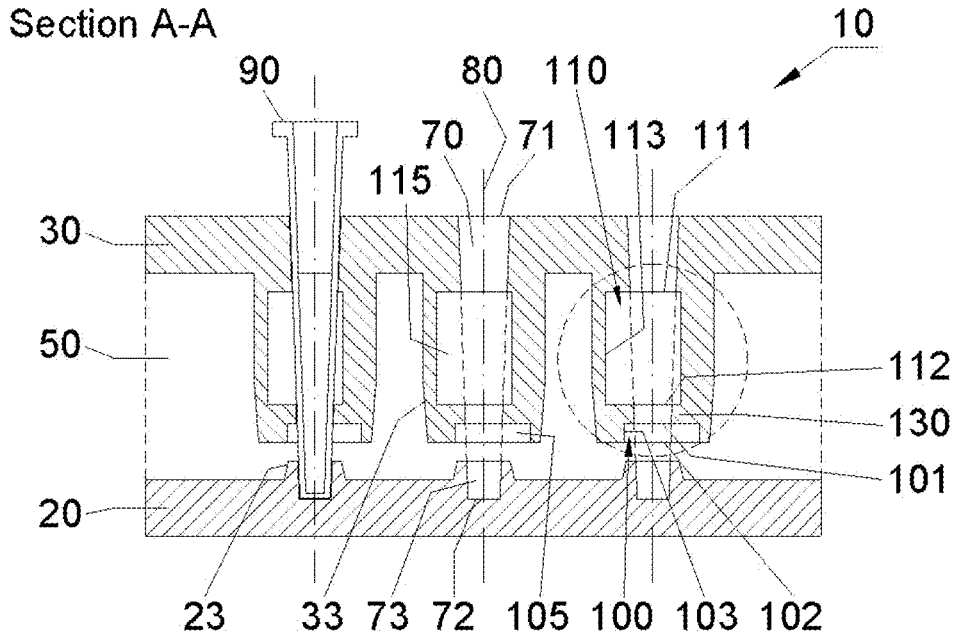
FIGS. 25A-B are schematic drawings showing a sectional view of an apparatus embodiment along the A-A plane in which the first 100 and second 110 chambers are within the second heat source 30. The first 100 and second 110 chambers are disposed asymmetrically about the channel axis 80 in opposite directions along the A-A plane. The thermal brake 130 is shown disposed symmetrically about the channel 70 with the wall 133 contacting the channel 70.
Figure 25B:
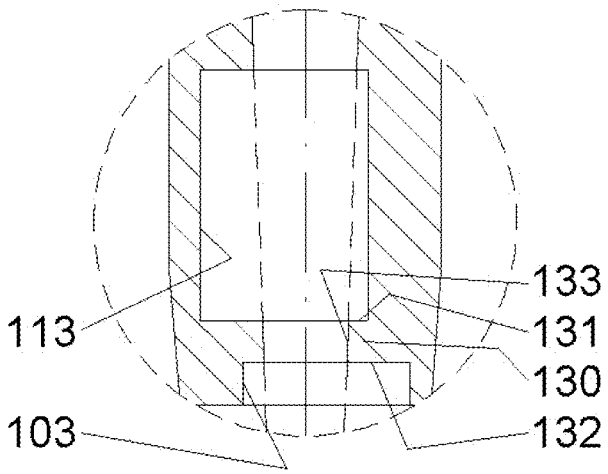

FIG. 25A shows an invention embodiment in which the first chamber 100 and the second chamber 110 are each off-centered in opposite directions with respect to the channel axis 80 by about 0.1 mm up to about 2 to 3 mm. The first thermal brake 130 is symmetrically disposed with respect to the channel axis 80. In this embodiment, a portion of the second heat source 30 contacts the channel 70 to form a first thermal brake 130 sufficient to reduce heat transfer from the first heat source 20. In this example of the invention, the first thermal brake 130 contacts the whole circumference of the channel 70 on a length (l) between the first 100 and second 110 chambers. In other embodiments, the first thermal brake 130 can contact the channel 70 on one side, the other side being spaced from the second heat source 30. FIG. 25B provides an expanded view of the first thermal brake 130 showing wall 133 contacting the channel 70.

Figure 26A:
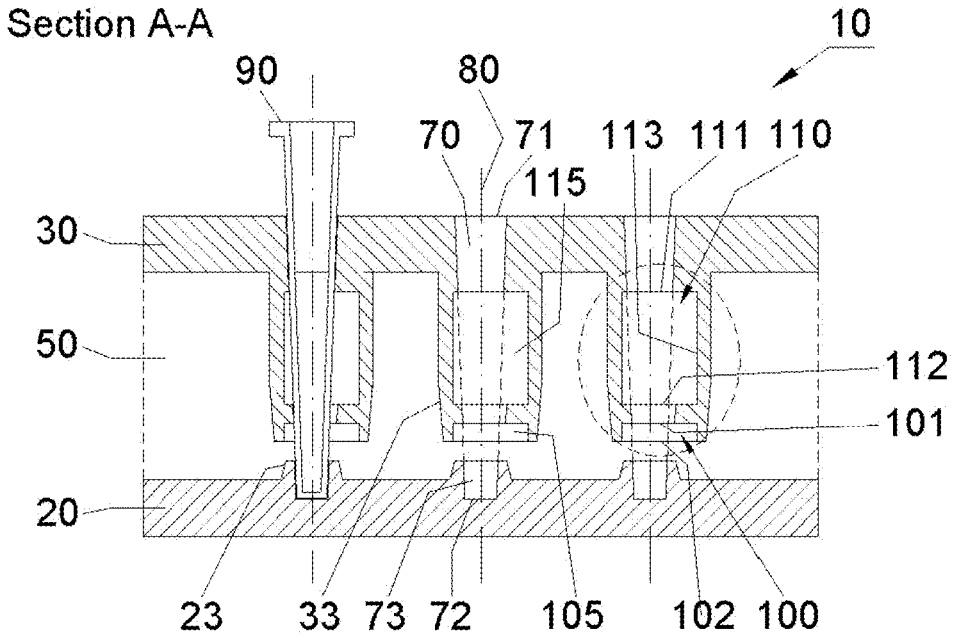
FIGS. 26A-B are schematic drawings showing a sectional view of an apparatus embodiment along the A-A plane in which the first 100 and second 110 chambers are within the second heat source 30. The first 100 and second 110 chambers are disposed asymmetrically about the channel axis 80.
Figure 26B:
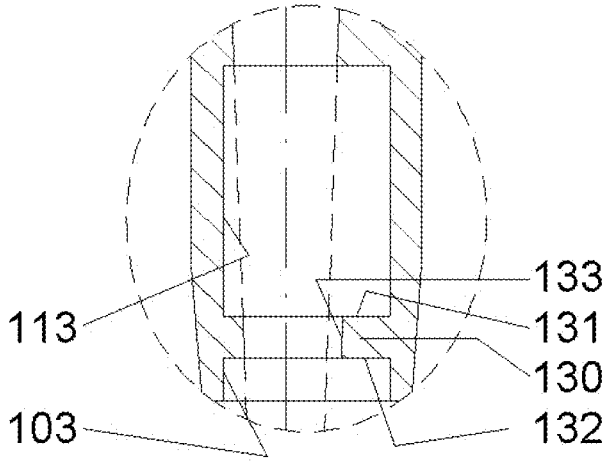

Referring to the embodiment shown in FIG. 26A, the first chamber 100 and second chamber 110 are each off-centered with respect to the channel axis 80 in the same horizontal direction (e.g., by about 0.1 mm up to about 2 to 3 mm). In this embodiment, the first thermal brake 130 is asymmetrically disposed with respect to the channel axis 80. The first thermal brake 130 and the chamber wall 103 are off-centered to the same direction. In this embodiment, the first thermal brake 130 contacts the channel 70 on one side (i.e., the left side), the other side being spaced from the second heat source 30. FIG. 26B shows an expanded view of the first thermal brake 130.

Figure 26C:
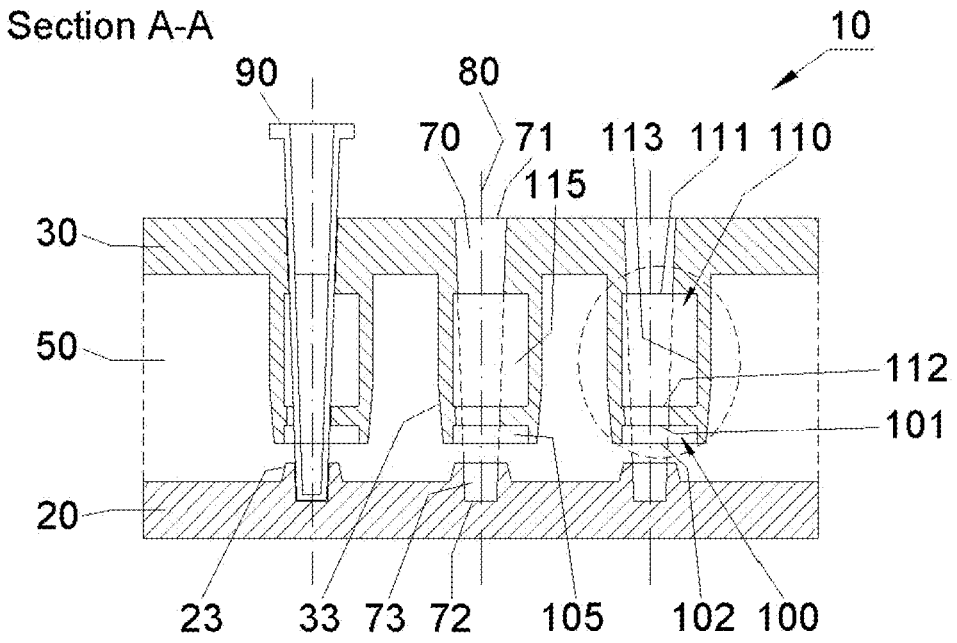
FIGS. 26C-D are schematic drawings showing a sectional view of an apparatus embodiment along the A-A plane in which the first 100 and second 110 chambers are within the second heat source 30 and are disposed asymmetrically about the channel axis 80.
Figure 26D:
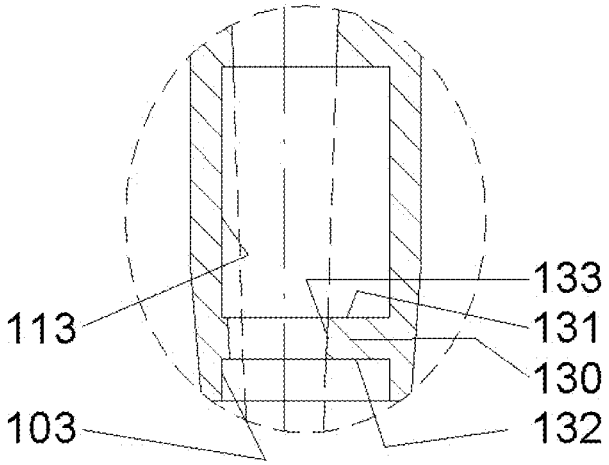

In FIG. 26C, the first chamber 100 and the second chamber 110 are each off-centered with respect to the channel axis 80 in the same horizontal direction and the first thermal brake 130 is off-centered to the opposite direction. In this embodiment, the first thermal brake 130 contacts the channel 70 on one side (i.e., the right side), the other side being spaced from the second heat source 30. FIG. 26D shows an expanded view of the first thermal brake 130.

Figure 27A:
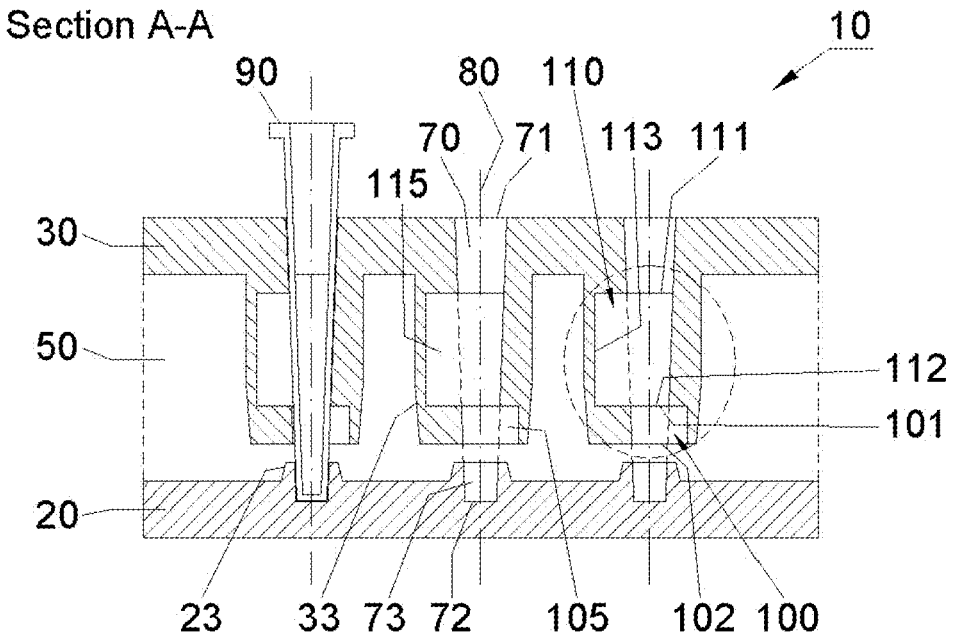
FIGS. 27A-B are schematic drawings showing a sectional view of an apparatus embodiment along the A-A plane in which the first 100 and second 110 chambers are within the second heat source 30 and are disposed asymmetrically about the channel axis 80 in opposite directions along the A-A plane. In an expanded view shown in FIG. 27B, the first thermal brake 130 is shown disposed asymmetrically with the wall 133 contacting the channel 70 on one side within the first chamber 100. The second thermal brake 140 is also shown disposed asymmetrically with the wall 143 contacting the channel 70 on one side within the second chamber 110. The top end 131 of the first thermal brake 130 is positioned essentially at the same height as the bottom end 142 of the second thermal brake 140.
Figure 27B:
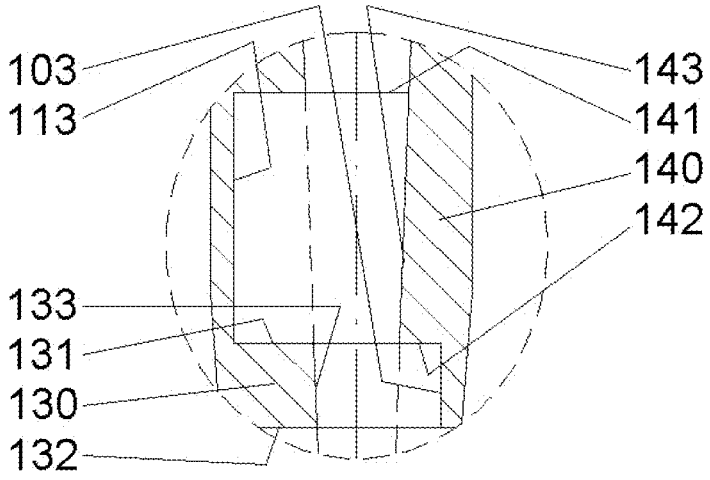

In another invention embodiment, the apparatus has two chambers in the second heat source 30 in which each chamber is off-set from the other in different horizontal directions. FIG. 27A shows an example. Here, the first chamber 100 and second chamber 110 within the second heat source 30 are each off-set with respect to the channel axis 80 in opposite horizontal directions (e.g., by about 0.5 mm to about 2 to 2.5 mm). The wall of the first chamber 103 is disposed lower along the channel axis 80 than the wall of the second chamber 113. The wall of the first thermal brake 133 contacts one side of the channel 70 (i.e., the left side) on the lower part of the channel 70 within the first chamber 100, and the wall of the second thermal brake 143 contacts the other side of the channel (i.e., the right side) on the upper part of the channel 70 within the second chamber 110. The top end of the first thermal brake 131 is positioned essentially at the same height as the bottom end of the second thermal brake 142. This arrangement is generally sufficient to cause horizontally uneven heat transfer between the second heat source 30 and the channel 70. FIG. 27B shows an expanded view of the first thermal brake 130 and the second thermal brake 140.

Figure 27C:
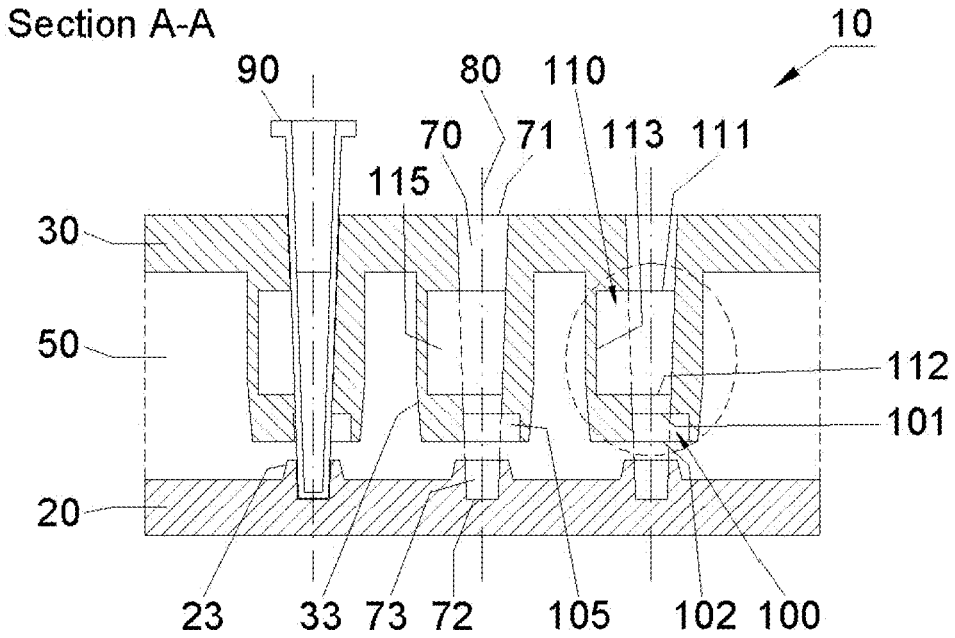
FIGS. 27C-D are schematic drawings showing a sectional view of an apparatus embodiment along the A-A plane in which the first 100 and second 110 chambers are within the second heat source 30 and are disposed asymmetrically about the channel axis 80 in opposite directions along the A-A plane. In an expanded view shown in FIG. 27D, the first 130 and second 140 thermal brakes are shown disposed asymmetrically with the walls (133, 143) each contacting the channel 70 on one side. The top end 131 of the first thermal brake 130 is positioned higher than the bottom end 142 of the second thermal brake 140.
Figure 27D:
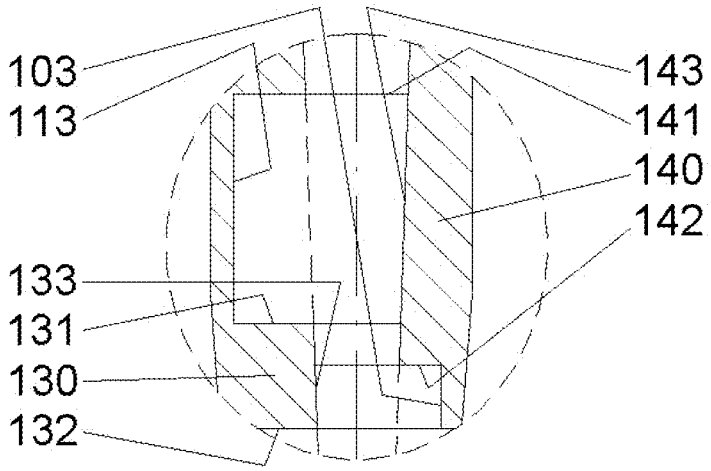

FIG. 27C shows an invention embodiment in which the top end of the first thermal brake 131 is positioned higher than the bottom end of the second thermal brake 142. The wall of the first thermal brake 133 and the wall of the second thermal brake 143 each contact the channel 70 on one side. FIG. 27D shows an expanded view of the first thermal brake 130 and the second thermal brake 140.

Figure 27E:
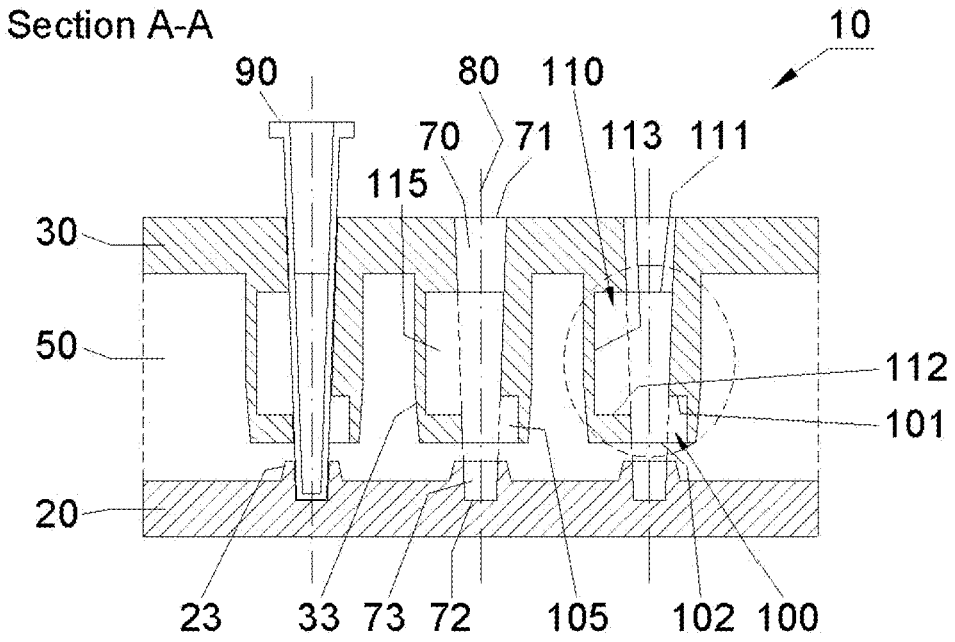
FIGS. 27E-F are schematic drawings showing a sectional view of an apparatus embodiment along the A-A plane in which the first 100 and second 110 chambers are within the second heat source 30 and are disposed asymmetrically about the channel axis 80 in opposite directions along the A-A plane. In an expanded view shown in FIG. 27F, the first 130 and second 140 thermal brakes are shown disposed asymmetrically with the walls (133, 143) each contacting the channel 70 on one side. The top end 131 of a first thermal brake 130 is shown positioned lower than the bottom end 142 of the second thermal brake 140.
Figure 27F:
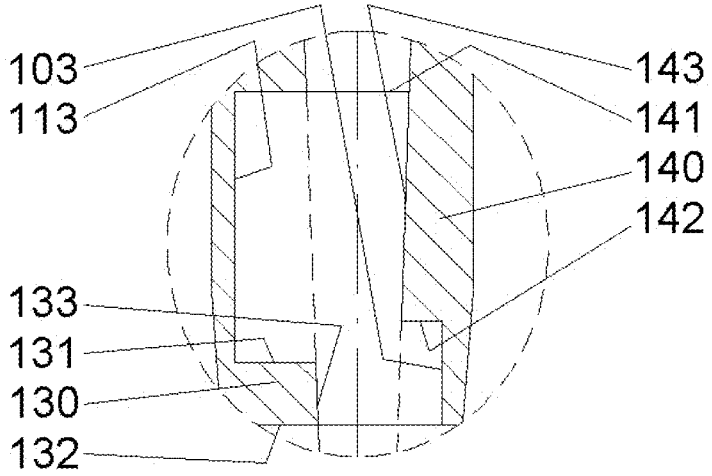

FIG. 27E shows an embodiment in which the top end of the first thermal brake 131 is positioned lower than the bottom end of the second thermal brake 142. The wall of the first thermal brake 133 and the wall of the second thermal brake 143 each contact the channel 70 on one side. FIG. 27F shows an expanded view of the first thermal brake 130 and the second thermal brake 140.

Figure 28A:
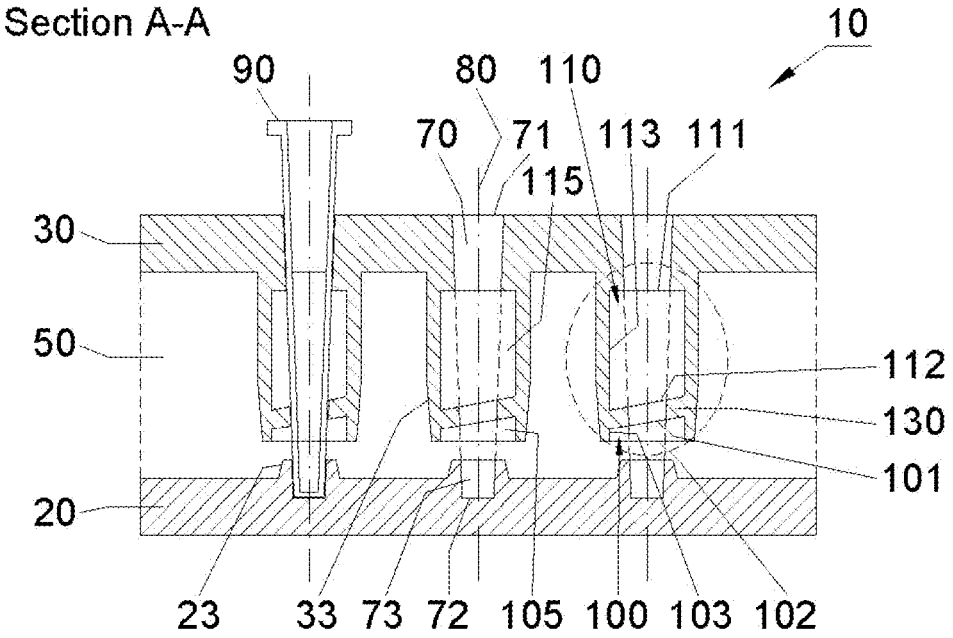
FIGS. 28A-B are schematic drawings showing a sectional view of an apparatus embodiment along the A-A plane in which the first 100 and second 110 chambers are within the second heat source 30 and are disposed asymmetrically about the channel axis 80. The top end 101 of the first chamber 100 and the bottom end 112 of the second chamber 110 are inclined (tilted) with respect to the channel axis 80.
Figure 28B:
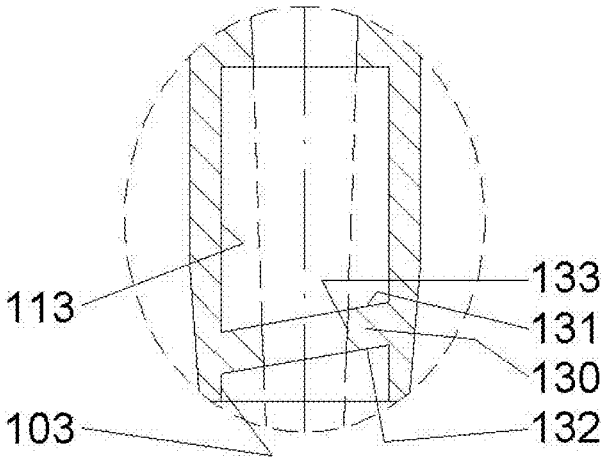

The invention provides other embodiments in which an asymmetry is introduced into the apparatus by tilting (skewing) one or more of the thermal brakes or the chamber with respect to the channel axis. Referring now to FIG. 28A, the top end of the first chamber 101 and the bottom end of the second chamber 112 are each inclined between about 2° to about 45° with respect to an axis perpendicular to the channel axis 80. In this embodiment, the distance between the top end of the first heat source 21 and the bottom end of the first thermal brake 132 is smaller on one side (i.e., the left side) with respect to the channel axis 80, resulting in a temperature gradient that is biased to be larger on that side of the first chamber 100. The thermal brake 130 contacts the whole circumference of the channel 70 between the first chamber 100 and the second chamber 110 and at a higher location on one side than the other side. FIG. 28B shows an expanded view of the first chamber 100, first thermal brake 130 and the second chamber 110 in which wall 133 contacts the channel 70.

In some invention embodiments, it will be useful to tilt at least one of the chambers with respect to the channel axis (e.g., one, two, or three of the chambers). Indeed, different combinations of the tilted or skewed structures may be adopted to achieve the intended horizontally asymmetric temperature distribution. A few examples are shown in FIGS. 29A-D.

Figure 29A:
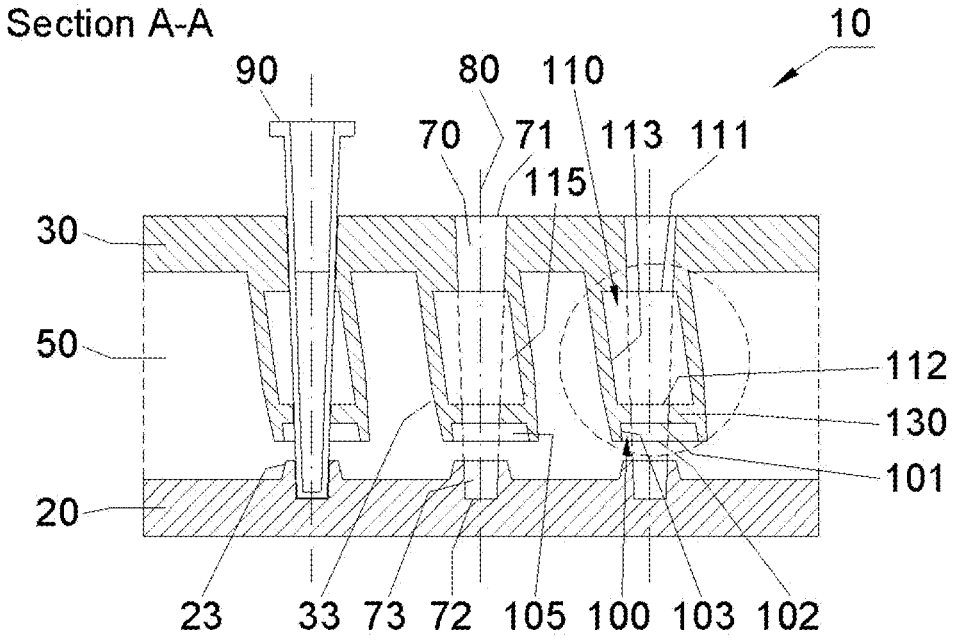
Figure 29B:
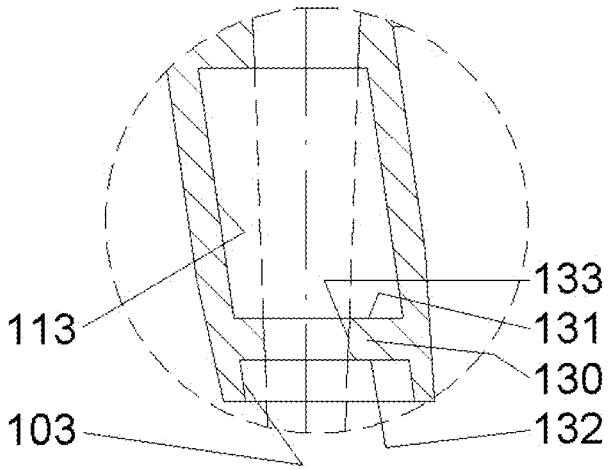

In particular, FIG. 29A shows a case in which the first chamber 100 and the second chamber 110 are each tilted or skewed with respect to the channel axis 80 between about 2° to about 30°. In this embodiment, the first thermal brake 130 is not tilted. FIG. 29B shows an expanded view of the first chamber 100, the first thermal brake 130 and the second chamber 110 in which wall 133 contacts the channel 70.

Figure 29C:
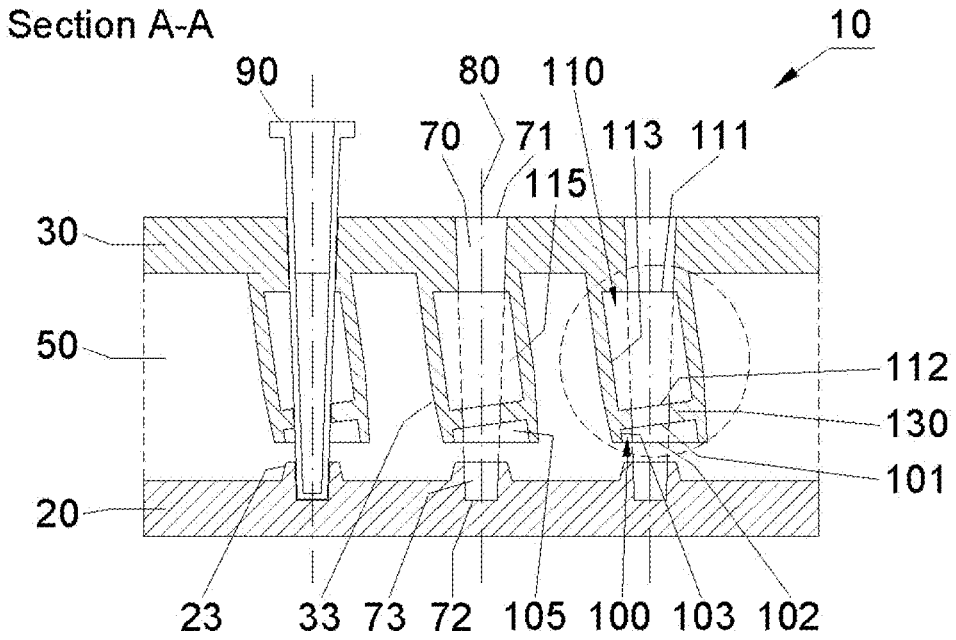
Figure 29D:
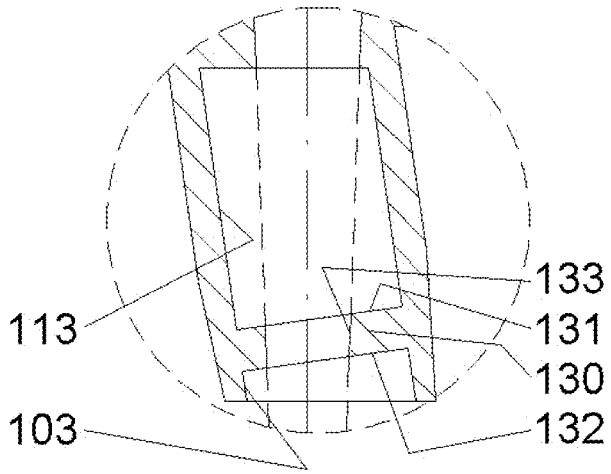

FIG. 29C shows an example in which both of the first chamber 100, the second chamber 110, and the first thermal brake 130 are each tilted with respect to the channel axis 80. Each of the first chamber 100 and the second chamber 110 can be tilted or skewed with respect to the channel axis 80 by between about 2° to about 30°. The top end 131 and bottom end 132 of the first thermal brake 130 can be each inclined or tilted by between about 2° to about 45° with respect to an axis perpendicular to the channel axis 80. In this embodiment, the first thermal brake 130 contacts the whole circumference of the channel between the first chamber and the second chamber and at a higher location on one side than the other side.

In the embodiments shown in FIGS. 25A-B, 26A-D, 27A-F, 28A-B, and 29A-D, the receptor hole 73 is disposed symmetrically about the channel axis 80.

Manufacture, Use and Temperature Shaping Element Selection

A. Heat Sources

For most invention embodiments, one or more of the heat sources can be made with materials having a relatively low thermal conductivity as compared to materials used for other thermal cycling type apparatuses. Rapid temperature changing process can be usually avoided in the present invention. Therefore, a high temperature uniformity across each of the heat sources (e.g., with a temperature variation smaller than about 0.1° C.) can be readily achieved using a material having a relatively low thermal conductivity. The heat sources can be made of any solid material that has a thermal conductivity sufficiently larger than that of the sample or the reaction vessel, for instance, preferably at least about 10 times larger, more preferably at least about 100 times larger. The sample to be heated is mostly water that has a thermal conductivity of 0.58 $W \cdot m^{-1} \cdot K^{-1}$ at room temperature, and the reaction vessel is typically made of a plastic that has a thermal conductivity typically about a few tenths of $W \cdot m^{-1} \cdot K^{-1}$. Therefore, the thermal conductivity of a suitable material is at least about 5 $W \cdot m^{-1} \cdot K^{-1}$ or larger, more preferably at least about 50 $W \cdot m^{-1} \cdot K^{-1}$ or larger. If the reaction vessel is made of a glass or ceramic that has a thermal conductivity larger than that of a plastic, it is preferred to use a material having somewhat larger thermal conductivity, for instance one having a thermal conductivity larger than about 80 or about 100 $W \cdot m^{-1} \cdot K^{-1}$. Most metals and metal alloys as well as some high thermal conductivity ceramics fulfill such requirement. Although materials having a higher thermal conductivity will generally provide better temperature uniformity across each of the heat sources, aluminum alloys and copper alloys are typically useful materials since they are relatively cheap and easy to fabricate while possessing high thermal conductivity.

The following specifications will be generally useful for making and using apparatus embodiments described herein. The width and length dimensions of the first and second heat sources along an axis perpendicular to the channel axis can be selected as any values depending on intended use, for instance, depending on spacing between adjacent channel/ chamber structures. The spacing between the adjacent channel/chamber structures can be at least about 2 to 3 mm, preferably between about 4 mm to about 15 mm. It will be generally preferred to use the industry standards, i.e., 4.5 mm or 9 mm spacing. In typical embodiments, the channel/chamber structures are arranged in equally spaced rows and/or columns. In such embodiments, it is preferred to make the width or length (along an axis perpendicular to the channel axis) of each of the heat sources that is at least about the value corresponding to the spacing times the number of rows or columns up to about one to about three spacing larger than this value. In other embodiments, the channel/chamber structures may be arranged in a circular pattern and preferably equally spaced. The spacing in such embodiments is also at least about 2 to 3 mm, preferably about 4 mm to about 15 mm with the industry standards of 4.5 mm or 9 mm spacing more preferred. In these embodiments, it is preferred to have the shape of the heat sources as a donut-like shape typically having a hole in the center. The channel/chamber structures may be positioned on one, two, three, up to about ten concentric circles. Diameter of each concentric circle can be determined by a geometric requirement for intended use, e.g., depending on number of the channel/chamber structures, spacing between adjacent channel/chamber structures in that circle, etc. Outer diameter of the heat sources is preferably at least about one spacing larger than diameter of the largest concentric circle, and inner diameter of the heat sources is preferably at least about one spacing smaller than diameter of the smallest concentric circle.

Length or thickness of the first and second heat sources along the channel axis has been already discussed. In the embodiments comprising at least one chamber in the second heat source, the thickness of the first heat source is larger than about 1 mm along the channel axis, preferably from about 2 mm to about 10 mm. Thickness of the second heat source along the channel axis is between about 2 mm to about 25 mm, preferably between 3 mm to about 15 mm.

The channel dimensions can be defined by a few parameters as denoted in FIGS. 7A-D and 8A-J. The height (h) of the channel along the channel axis is at least about 5 mm to about 25 mm, preferably 8 mm to about 16 mm for a sample volume of about 20 microliters. The taper angle (θ) is between from about 0° to about 15°, preferably from about 2° to about 10°. The width (w1) or diameter of the channel (or its average) along an axis perpendicular to the channel axis is at least about 1 mm to about 5 mm. The vertical aspect ratio as defined by the ratio of the height (h) to the width (w1) is between about 4 to about 15, preferably from about 5 to about 10. The horizontal aspect ratio as defined by the ratio of the first width (w1) to the second width (w2) along first and second directions, respectively, that are mutually perpendicular to each other and aligned perpendicular to the channel axis, is typically between about 1 to about 4.

The receptor hole has a width or diameter that is in the same range as the channel, i.e., at least about 1 mm to about 5 mm. When the channel is tapered, the width or diameter of the receptor hole is smaller or larger than that of the channel depending on the tapering direction. Depth of the receptor hole is typically at least about 0.5 mm up to about 8 mm, preferably between about 1 mm to about 5 mm.

The chamber typically has a width or diameter along an axis perpendicular to the channel axis that is at least about 1 mm to about 10 or 12 mm, preferably between about 2 mm to about 8 mm. Presence of the chamber structure provide the chamber gap between the channel and the chamber wall that is typically between about 0.1 mm to about 6 mm, more preferably about 0.2 mm to about 4 mm. Length or height of the chamber along the channel axis can vary depending on different embodiments. For instance, if the apparatus comprises one chamber in the second heat source, that chamber can have a height along the channel axis between about 1 mm to about 25 mm, preferably between about 2 mm to about 15 mm. In the embodiments having two or more chambers in the second heat source, the height of each chamber is between about 0.2 mm to about 80% or 90% of the thickness of the second heat source along the channel axis.

Dimensions of the thermal brake and the insulators (or insulating gaps) are also very important. Please refer to the general specifications as already provided above.

Although not generally required for optimal use of the invention, it is within the scope of the present invention to provide an apparatus with protrusions 24, 34, or both. See FIG. 6A, for example.

It will be appreciated that there usually exists certain tolerance in machining or fabricating mechanical structures. Therefore, in actual practice, the physically contacting holes (e.g., the through hole in the second heat source or the receptor hole in the first heat source in particular embodiments) must be designed to have a positive tolerance with respect to the size of the reaction vessel. Otherwise, the through hole or the channel could be made smaller or equal to the size of the reaction vessel, not allowing proper installation of the reaction vessel to the channel. Practically reliable tolerance for the physically contacting hole is about +0.05 mm in standard fabrication process. Therefore, if two objects are said to be "in physical contact", it should be interpreted as having a gap between the two contacting objects that is smaller than or equal to about 0.05 mm. If two objects are said to be "not in physical contact", or "spaced", it should be interpreted as having a gap between the two objects that is larger than about 0.05 or 0.1 mm.

B. Use

Nearly any thermal convection PCR apparatus described herein can be used to perform one or a combination of different PCR amplification techniques. One suitable method includes at least one of and preferably all of the following steps:

(a) maintaining a first heat source comprising a receptor hole at a temperature range suitable for denaturing a double-stranded nucleic acid molecule and forming a single-stranded template, (b) maintaining a second heat source at a temperature range suitable for annealing at least one oligonucleotide primer to the single-stranded template; and (c) producing thermal convection between the receptor hole and second heat source under conditions sufficient to produce the primer extension product.

In one embodiment, the method further includes the step of providing a reaction vessel comprising the double-stranded nucleic acid and the oligonucleotide primer(s) in aqueous buffer solution. Typically, the reaction vessel further includes one or more DNA polymerases. If desired, the enzyme may be immobilized. In a more particular embodiment of the reaction method, the method includes a step of contacting (either directly or indirectly) the reaction vessel to the receptor hole, the through hole, and at least one temperature shaping element (typically at least one chamber) disposed within at least one of the second or first heat sources. In this embodiment, the contacting is sufficient to support the thermal convection within the reaction vessel. Preferably, the method further includes a step of contacting the reaction vessel to a first insulator between the first and second heat sources. In one embodiment, the first and second heat sources have a thermal conductivity at least about tenfold, preferably about one hundred fold greater than the reaction vessel or aqueous solution therein. The first insulator may have a thermal conductivity at least about five fold smaller than the reaction vessel or aqueous solution therein in which the thermal conductivity of the first insulator is sufficient to reduce heat transfer between the first and second heat sources.

In the step (c) of the foregoing method, the thermal convection fluid flow is produced essentially symmetrically or asymmetrically about the channel axis within the reaction vessel. Preferably, the steps (a)-(c) of the method described above consume less than about 1 W, preferably less than about 0.5 W of power per reaction vessel to produce the primer extension product. If desired, the power for performing the method is supplied by a battery. In typical embodiments, the PCR extension product is produced in about 15 to about 30 minutes or shorter and the reaction vessel can have a volume of less than about 50 or 100 microliters, for example, less than or equal to about 20 microliters.

In embodiments in which the method is used with a thermal convection PCR centrifuge of the invention, the method further includes the step of applying or impressing a centrifugal force to the reaction vessel conducive to performing the PCR.

In a more specific embodiment of the method for performing PCR by thermal convection, the method includes the steps of adding an oligonucleotide primer, nucleic acid template, and buffer to a reaction vessel received by any of the apparatuses disclosed herein under conditions sufficient to produce a primer extension product. In one embodiment, the method further comprises a step of adding a DNA polymerase to the reaction vessel.

In another embodiment of a method for performing PCR by thermal convection, the method comprising the steps of adding an oligonucleotide primer, nucleic acid template, and buffer to a reaction vessel received by any PCR centrifuge disclosed herein and applying a centrifugal force to the reaction vessel under conditions sufficient to produce a primer extension product. In one embodiment, the method includes the step of adding a DNA polymerase to the reaction vessel.

Practice of the invention is compatible with one or a combination of PCR techniques including quantitative PCR (qPCR), multiplex PCR, ligation-mediated PCR, hot-start PCR, allele-specific PCR among other variations of the amplification technique. The following particular use of the invention is with reference to the embodiment shown in FIGS. 1 and 2A. As will be appreciated however, the methodology is generally applicable to other embodiments referred to herein.

Referring to FIGS. 1 and 2A, the first heat source 20 generates a temperature distribution suitable for the denaturation process on the bottom or lower portion of the channel (sometimes referred herein to as a denaturation region). The first heat source 20 is typically maintained at a temperature useful to melt the nucleic acid template of interest (e.g., about 1 fg to about 100 ng of a DNA-based template). In this embodiment, the first heat source 20 should be maintained at between about 92° C. to about 106° C., preferably between about 94° C. to about 104° C., and more preferably between about 96° C. to about 102° C. As will be appreciated, other temperature profiles may be better suited for optimal practice of the invention depending on recognized parameters such as the nucleic acid of interest, the sensitivity desired, and the speed of which the PCR process should be conducted.

The second heat source 30 generates a temperature distribution suitable for the annealing process on the top or upper portion of the channel (sometimes referred herein to as an annealing region). The second heat source is typically maintained at a temperature between about 45° C. to about 65° C., depending, for instance, on the melting temperatures of the oligonucleotide primers used and other parameters known to those with experience in PCR reactions.

A temperature distribution suitable for the polymerization process is generated in the intermediate region (i.e., transition region) of the channel 70 (sometimes referred herein to as a polymerization region) in between the denaturation region on the bottom of the channel and the annealing region on the top or upper part of the channel. For some instances (in which the temperature of the second heat source is maintained at a temperature equal to or higher than about 60° C.), the annealing region on the top part of the channel can also function as part of the polymerization region. For many invention applications, the polymerization region is typically maintained at a temperature between about 60° C. to about 80° C., more preferably between about 65° C. to about 75° C., in cases in which Taq DNA polymerase or a relatively heat stable derivative thereof is used. If a DNA polymerase that has a different temperature profile of its activity is used, the temperature range of the polymerization region can be changed (by changing the annealing temperature of the second heat source or the structure of the temperature shaping elements) to match with the temperature profile of the polymerase used. See U.S. Pat. No. 7,238,505 and references disclosed therein regarding use of heat sensitive and heat stable polymerases in the PCR process.

See the Examples section for information about use of additional apparatus embodiments.

C. Selection of Temperature Shaping Elements

The following section is intended to provide further guidance on the selection and use of temperature shaping elements. It is not intended to limit the invention to a particular apparatus design or use.

Choice of one or a combination of temperature shaping elements for use with an invention apparatus will be guided by the particular PCR application of interest. For instance, properties of the target template are important for selecting temperature shaping element(s) that is/are best suited for a particular PCR application. For instance, the target sequence may be relatively short or long; and/or the target sequence may have a relatively simple structure (such as in plasmid or bacterial DNA, viral DNA, phage DNA, or cDNA) or a complex structure (such as in genomic or chromosomal DNA). In general, target sequences having longer sequences and/or complex structures are more difficult to amplify and typically require a longer polymerization time. Additionally, longer times for annealing and denaturation are often required. Moreover, the target sequence may be available in a large or small amount. Target sequences in smaller amounts are more difficult to amplify and generally require more PCR reaction time (i.e., more PCR cycles). Other considerations may also be important depending on particular uses. For instance, the PCR apparatus may be used to produce a certain amount of a target sequence for subsequent applications, experiments, or analyses, or else to detect or identify a target sequence from a sample. In further considerations, the PCR apparatus may be used in the laboratory or in the field, or in certain extraordinary environments, for instance, inside a car, a ship, a submarine, or a spaceship; under severe weather conditions, etc.

As discussed, the thermal convection PCR apparatus of the present invention generally provides faster and more efficient PCR amplification than prior PCR apparatuses. Moreover, the invention apparatus has a substantially lower power requirement and a much smaller size than prior PCR apparatuses. For instance, the thermal convection PCR apparatus is typically at least about 1.5 to 2 times faster (preferably about 3 to 4 times faster) and requires at least about 5 times (preferably about ten times to several tens of times) less power for operation with its size or weight at least about 5 to 10 times smaller. Hence, if a suitable design can be selected, users can have an apparatus that can cost much less time, energy, and space.

In order to select a suitable apparatus design, it is important to appreciate the key functions of an intended temperature shaping element. As summarized in Table 1 below, each temperature shaping element has specific functions with regard to the performance of the thermal convection PCR apparatus. For instance, the chamber structure generally increases the speed of the thermal convection within a heat source in which a chamber resides as compared to the structures without the chamber, and the thermal brake generally decreases the speed of the thermal convection as compared to the structures having the chamber structure without the thermal brake. Importantly, however, incorporation of the thermal brake structure in addition to the chamber structure within the second heat source makes the time length or volume of the sample available for the polymerization step larger so that efficiency of the PCR amplification can be increased for target sequences that require a longer polymerization time. Hence, the chamber structure can be used with or without the thermal brake depending on particular applications as discussed below. As also summarized in Table 1, any one or a combination of the convection accelerating elements (e.g., the positional asymmetry, the structural asymmetry, and the centrifugal acceleration) can be used to increase the speed of the thermal convection regardless of other heat source structures including the channel alone structure (i.e., a structure without the chamber). Hence, at least one or a combination of these convection accelerating elements can be combined with nearly all of the heat source structures in order to enhance the thermal convection speed as needed. As discussed, the invention apparatus requires much less power than prior PCR apparatuses, mainly as a result of eliminating necessity for the thermal cycling process (i.e., the process that changes the temperature of the heat source). As also discussed, a suitable choice of the first insulator (i.e., the thickness of the insulating gap as well as use of a proper thermal insulator) can make the power consumption of the invention apparatus further reduced. Moreover, use of the protrusion structure(s) can still further reduce the power consumption of the invention apparatus substantially (see Example 1, for instance) and also to increase the chamber length and thus to increase the polymerization time. Other parameters such as the receptor hole depth and the temperatures of the first and second heat sources can also be used to modulate the thermal convection speed and also the time period available for each of the polymerization, annealing and denaturation steps. As discussed below, each of these temperature shaping elements can be used alone or in combination with one or more other elements to construct a particular thermal convection PCR apparatus that is suitable for a particular application.

TABLE 1

Key Functions of Temperature Shaping Elements

| Temperature Shaping Element | Key Functions |
|---|---|
| Chamber | Increases the thermal convection speed within the heat source in which the chamber resides as compared to the channel alone structure. The smaller the chamber diameter or the chamber gap, the slower is the thermal convection speed. |
| Thermal Brake | Decreases the thermal convection speed when combined with the chamber structure. Typically positioned within the second heat source in combination with at least one chamber and make the time length and volume of the sample available for the polymerization step increase as compared to the chamber only structure. The larger the length of the thermal brake along the channel axis, the slower is the thermal convection speed and the larger time and sample volume becomes available for the polymerization step. |
| Insulator/Insulating gap | Generally required for the multi-stage thermal convection apparatus. Useful to control the thermal convection speed and to reduce power consumption. The smaller the length of the insulator along the channel axis, the larger are the power consumption and the driving force for the thermal convection. |
| Protrusion | Useful to reduce power consumption substantially and also to lengthen the chamber length along the channel axis (and thus to increase the time and sample volume available for the polymerization step). |
| Positional Asymmetry | Increases the thermal convection speed and can be incorporated into the invention apparatus as an adjustable structural element so as to provide freedom to control the thermal convection speed within a given design. When used with a structural asymmetry, an adjustable positional asymmetry element can be used as both an accelerating and a decelerating element. |
| Structural Asymmetry | Increases the thermal convection speed. |
| Centrifugal Acceleration | Increases the thermal convection speed while providing freedom to control the thermal convection speed within a given design. Typically used with the positional asymmetry. |

Although many useful apparatus embodiments are provided by the invention, the following combinations are particularly useful and easy to predict the performance of the invention apparatus.

An acceptable thermal convection PCR apparatus for many applications typically includes the channel and the first insulator (or the first insulating gap) as basic elements. One or more other temperature shaping elements can be combined to use with these basic elements. An apparatus that uses the channel and the insulator only may not be optimal for some PCR applications. With the channel structure alone, the temperature gradient inside the sample within each heat source may be too small due to efficient heat transfer from the heat sources, and thus thermal convection becomes either too slow or not properly occurring. Use of the chamber structure can remedy this deficiency. As discussed, the speed of the thermal convection within each heat source can be increased by incorporating a chamber structure in that heat source. Thermal convection PCR apparatuses that use the chamber as an additional temperature shaping element are generally suited for most applications including fast amplification of relatively short target sequences (e.g., shorter than about 1 kbp) having simple structures as well as longer target sequences (e.g., longer than about 1 kbp up to about 2 or 3 kbp) or target sequences having complex structures (e.g., genomic or chromosomal DNAs). For instance, an apparatus design having a straight chamber in the second heat source with its width or diameter larger than about 3 or 4 mm can deliver PCR amplification of relatively short sequences within less than about 20 or 25 min, preferably within less than about 10 to 15 min depending on the amount and size of the target sequence (see Example 1, for instance). Amplification of target sequences having complex structures (e.g., see Example 1 for amplification of human genome targets) typically takes about 25 or 30 min. Longer target sequences typically takes more time, for instance, about 30 min to up to about 1 hour depending on the size and structure of the target sequence. Further increase of the speed of the thermal convection PCR could be achieved by incorporating at least one of the convection accelerating elements (e.g., see Examples 2 and 3).

Further enhancement of the dynamic range of the thermal convection PCR apparatus can be achieved by incorporating a thermal brake and/or a narrower chamber (e.g., smaller than about 3 mm of the chamber width or diameter) within the second heat source. Use of a thermal brake or a chamber having a reduced width or diameter (either partially or completely) within the second heat source leads to enhanced heat transfer from the second heat source to the channel, and hence the thermal convection becomes decelerated. In such decelerated heat source structures, the polymerization time period can be further increased so as to amplify longer sequences, for instance, up to about 5 or 6 kbp. However, the total PCR reaction time could be inevitably increased due to a slow thermal convection speed, for instance, about 35 min to up to about 1 hour or longer depending on the size and structure of the target sequence. Any one or more of the convection accelerating elements can be combined with this type of apparatus designs to increase the speed of the thermal convection PCR as desired. In this type of embodiments, it is typically recommended to use primers having relatively high melting points (e.g., higher than about 60° C.) in order to make the temperature of the sample within the second heat source near or close to the optimum temperature of typical DNA polymerases.

The convection accelerating elements mentioned above (i.e., the positional asymmetry, the structural asymmetry, and the centrifugal acceleration) can affect the speed of the thermal convection in different degrees. The positional or structural asymmetry can typically enhance the thermal convection speed from about 10% or 20% up to about 3 to 4 times. In the case of the centrifugal acceleration, the enhancement can be made as large as possible, for instance, about 11,200 times at 10,000 rpm when R=10 cm as discussed. A practically useful range would be up to about 10 to about 20 times enhancement. When any one of these convection accelerating elements is used, the speed of the thermal convection can be increased. Hence, whenever a further increase of the thermal convection speed is needed for the user's applications, such feature can be conveniently incorporated. One particular design that includes at least one of the convection accelerating elements is a heat source structure that does not include the chamber (i.e., the channel only). Use of a convection accelerating element can make the channel alone design operable. In such channel alone embodiment, use of primers having relatively high melting points (e.g., higher than about 60° C.) is typically recommended in order to make the temperature of the sample within the second heat source near or close to the optimum temperature of typical DNA polymerases. Such channel alone design when used with high melting point primers is advantageous since it can provide the time period and volume of the sample available for the polymerization step that is as largest as possible. However, as discussed, such design delivers a thermal convection speed that is typically too slow. Use of any one or more of the convection accelerating elements can remedy such deficiency by increasing the thermal convection speed as user's demand.

All of the apparatus examples discussed above require much less power than prior PCR apparatuses and can be made as portable devices, i.e., operable with a battery, even without the protrusion structure. As discussed, use of the protrusion structure can reduce the power consumption substantially and thus more recommended if a portable PCR apparatus is essential for the user's applications.

Also, the apparatus designs discussed above can amplify from very low copy number samples (when optimized). For instance, as demonstrated in Examples 1 and 2, target sequences even much less than about 100 copies can be amplified in about 25 min or about 30 min.

Moreover, the apparatus designs discussed above can be used in the laboratory or in the field, or in certain extraordinary conditions, not like many prior PCR apparatuses that can be used only under controlled conditions such as inside a laboratory. For instance, we have tested a few invention apparatuses inside a car while driving and confirmed that fast and efficient PCR amplification can be achieved as inside a laboratory. Furthermore, we also tested a few invention apparatuses under extraordinary temperature conditions (from below about −20° C. to above about 40° C.) and confirmed fast and efficient PCR amplification regardless of the outside temperatures.

Finally, as exemplified throughout the Examples, the thermal convection PCR apparatuses of the present invention can deliver PCR amplification that is not only fast but also very efficient. Hence, it is demonstrated that the invention apparatuses are generally suitable for nearly all of the diverse different applications of the PCR apparatus while providing enhanced performance with a new feature of a palm-size portable PCR device.

Apparatus with Housing and Temperature Control Elements

The invention apparatus referred to above can be used alone or in combination with suitable housing, temperature sensing, and heating and/or cooling elements. In one embodiment shown in FIG. 30, the first heat source 20 and second heat source 30 features at least one first securing element 200 (typically a screw hole) and a second securing element 210 in which each of the elements are adapted to secure the heat sources and the first insulator 50 together as a single operable unit. The second securing element 210 is preferably "wing-shaped" to help provide a boundary for additional insulating spaces (see below). Heating and/or cooling elements 160*a* and 160*b* are each positioned in the first 20 and second 30 heat sources, respectively. Each of the heat sources is typically equipped with at least one heating element. Typically useful heating elements are of resistive heating or inductive heating types. Depending on intended use, one or more of the heat sources can be further equipped with one or more of cooling elements and/or one or more of heating elements. Typically preferred cooling elements are a fan or a Peltier cooler. As well known, the Peltier cooler can function as both a heating and cooling element. It is particularly preferred to use more than one heating elements or both heating and cooling elements in different locations of one or more of the heat sources when a temperature gradient operation is required to provide different temperatures across that heat source. The first 20 and second 30 heat sources further include temperature sensors 170*a* and 170*b* disposed in each of the heat sources, respectively. For most of the embodiments, each of the heat sources is typically equipped with one temperature sensor. However, in some embodiments such as those with a temperature gradient operation capability in one or more of the heat sources, two or more temperature sensors can be located at different positions of that heat source.

FIGS. 31A-B provide cross-sectional views of the embodiment shown in FIG. 30. In addition to the cross sectional views of the channel and chamber structures, locations of the heating and/or cooling elements are shown as one example. As shown in this example, it is preferred to position the heating and/or cooling elements evenly to each of the heat sources to provide a uniform heating and/or cooling across each of the heat sources. For instance as depicted in FIG. 31B, the heating and/or cooling elements are positioned in between each of the channel and chamber structures and equally spaced from each other (see also FIG. 33 for instance). The cross-sectional view depicted in FIG. 31A, for instance, shows connections (i.e., the circles) between the heating and/or cooling elements from one position in between each of the channel and chamber structures to another. In other types of embodiments such as those with a temperature gradient operation option, two or more of the heating or cooling elements can be used in one or more of the heat sources and positioned to different locations of that heat source to provide a biased heating and/or cooling across that heat source.

In FIG. 32, the plane of section is through one of the second securing elements 210 and a first securing element 200. As shown, the first securing element 200 includes a screw 201, washer 202*a*, securing element of the first heat source 203*a*, spacer 202*b*, and securing element of the second heat source 203*b*. Preferably, at least one of and more preferably all of the screw 201, the washer 202*a* and the spacer 202*b* are made from a thermal insulator material. Examples include plastics, ceramics, and plastic composites (such as those with carbon or glass fiber). Materials having a high mechanical strength, high melting and/or deflection temperature (e.g., about 100° C. or higher, more preferably about 120° C. or higher), and low thermal conductivity (e.g., plastics with thermal conductivity smaller than about a few tenths of $W \cdot m^{-1} \cdot l^{-1}$ or ceramics with thermal conductivity smaller than about a few $W \cdot m^{-1} \cdot K^{-1}$) are more preferred. More specific examples include plastics such as PPS (polyphenylene sulfide), PEEK (polyetherehterketone), Vesper (polyimide), RENY (polyamide), etc. or their carbon or glass composites, and low thermal conductivity ceramics such as Macor, fused silica, zirconium oxide, Mullite, Accuflect, etc.

FIG. 33 provides an expanded view of an apparatus embodiment with various securing element and temperature control elements. It will be apparent that in addition to the particular securing structures shown in FIG. 33, others are possible. Thus in one embodiment, at least one of the first and/or second securing elements (200, 210) is located in other region(s) of at least one, and preferably all of the first heat source 20 and second heat source 30, and first insulator 50. That is, although the second heat source 30 is shown to include the second securing element 210, any other or all of the heat sources and/or the first insulator could include the second securing element 210. In another embodiment, at least one of the first and/or second securing elements (200, 210) is located in an inner region of at least one, and preferably all of the first heat source 20, second heat source 30, and first insulator 50.

Although the forgoing invention embodiments will be generally useful for many PCR applications, it will often be desirable to add protective housing. One embodiment is shown in FIGS. 34A-B. As shown, the apparatus 10 features a first housing element 300 that surrounds the first heat source 20, the second heat source 30, and the first insulator 50. In this embodiment, each of the second securing elements 210 has a wing-shaped structure that cooperates with other structural elements of the apparatus 10 to form at least one insulating gap, for example, one, two, three, four, five, six, seven or eight of such gaps. Each of the gaps can be filled with a suitable insulating material such as those disclosed herein such as a gas or solid insulator. Air will be a preferred insulating material for many applications. Presence of the insulating gap(s) provides advantages such as reducing heat loss from the apparatus 10, thereby lowering power consumption.

Thus in the embodiment shown in FIG. 34A-B, the second heat source 30 comprises four second securing elements 210 in which each pair of second securing elements defines a second insulating gap 310. In particular, FIG. 34A shows four parts of the second insulating gaps 310 each defined by a first housing element 300 and a pair of the second securing element 210. FIG. 34A also shows a third insulating gap 320 located between the bottom of the first heat source 20 and the first housing element 300. Also shown is a support 330 for suspending the secured heat sources inside the first housing element 300, thereby helping form the second insulating gap 310 and the third insulating gap 320.

It will often be desirable to further house the invention apparatus, for example to provide further protection and insulating gaps. Referring now to FIG. 35A-B, the apparatus further includes a second housing element 400 that surrounds the first housing element 300. In this embodiment, the apparatus 10 further includes a fourth insulating gap 410 defined by the first housing element 300 and the second housing element 400. The apparatus 10 can also include a fifth insulating gap 420 located between the bottom of the first housing element 300 and the bottom of the second housing element 400.

If desired, the invention apparatus may further include at least one fan unit to remove heat from the apparatus. In one embodiment, the apparatus comprises a first fan unit positioned above the second heat source 30 to remove heat from the second heat source 30. If desired, the apparatus may further include a second fan unit positioned below the first heat source 20 to remove heat from the first heat source 20.

Convection PCR Apparatus Incorporating Centrifugal Acceleration

It is an object of the invention to provide "centrifugal acceleration" as an optional additional feature of the apparatus embodiments described herein. As discussed above, it is believed that thermal convection can be made optimal when a vertical temperature gradient (and optionally or in addition, a horizontally asymmetric temperature distribution when the positional or structural asymmetry is used) is generated inside a fluid. Proportional to the magnitude of vertical temperature gradient, a buoyancy force is generated that drives a convection flow inside the fluid. Thermal convection generated by an invention apparatus must typically fulfill various conditions for inducing a PCR reaction. For instance, the thermal convection must flow through a plurality of spatial regions sequentially and repeatedly, while maintaining each of the spatial regions at a temperature range suitable for each step of the PCR reaction (i.e., the denaturation, annealing, and polymerization steps). Moreover, the thermal convection must be controlled to have a suitable speed so as to allow suitable time period for each of the three PCR reaction steps.

Without wishing to be bound to any theory, it is believed that thermal convection can be controlled by controlling the temperature gradient, more precisely distribution of the temperature gradient inside the fluid. The temperature gradient (dT/dS) depends on temperature difference (dT) and distance (dS) between two reference positions. Therefore, the temperature difference or distance may be changed to control the temperature gradient. However, in the convection PCR apparatus, neither the temperature (or its difference) nor the distance may be changed easily. The temperature of different spatial regions inside the sample fluid is subject to a specific range as defined by the temperature suitable for each of the three PCR reaction steps. There are not many opportunities to change the temperature of different (typically at least vertically different) spatial regions inside the sample. Furthermore, vertical positions of the different spatial regions (in order to generate a vertical temperature gradient for inducing a buoyant driving force) are usually restricted due to a small volume of the sample fluid. For instance, a typical volume of PCR sample is only about 20 to 50 microliters and sometimes smaller. Such small volumes and space limitations do not allow much freedom to change the vertical positions of the different spatial regions for the PCR reaction.

As discussed, the buoyancy force is proportional to the vertical temperature gradient that in turn depends on temperature difference and distance between two reference points. Further to such dependence, however, the buoyancy force is also proportional to the gravitational acceleration ($g$=9.8 m/sec$^2$ on Earth). This force field parameter is a constant, a variable that cannot be controlled or changed, but can be only defined by the law of universal gravitation. Therefore, nearly all of the thermal convection based PCR apparatuses rely upon highly restricted special structures, inevitably adapted to gravitational forces.

Use of centrifugal acceleration in accord with the present invention provides a solution for this problem. By making a convection based PCR apparatus subject to a centrifugal acceleration force field, one can control the magnitude of the buoyant driving force regardless of the structure that defines the magnitude of the temperature gradient, thereby controlling the convection speed without much limitation.

FIGS. 36A-B shows one embodiment of a PCR centrifuge 500 according to the invention. In this example, the apparatus 10 is attached to a rotation arm 520 rotatably attached to motor 501. In this embodiment, the rotation arm 520 includes a tilt shaft 530 for providing freedom of changing the angle between the axis of rotation 510 and the channel axis 80. The PCR centrifuge may include any number of the apparatus 10 provided intended results are achieved, for example, 2, 4, 6, 8, 10 or even 12. The apparatus 10 may or may not include protective housing as discussed above, although having some protective housing will be generally useful.

The tilt shaft 530 is preferably configured to be an angle inducing element capable of tilting the angle of the heat source (more particularly the angle of the channel axis 80) with respect to the rotation axis. Tilt angle can be adjusted depending on the rotation speed (i.e., depending on the magnitude of the centrifugal acceleration) so that the tilt angle between the channel axis 80 and the net acceleration vector depicted in FIG. 37 can be adjusted in the range between from about 0° to about 60°. In one embodiment, the angle inducing element in FIG. 36A is a rotation shaft (depicted as a circle) in the center of the joint region between the horizontal arm and an arm on which the heat source assembly is located.

In the embodiment shown in FIGS. 36A-B, the sample fluid inside the reaction vessel placed inside the apparatus 10 is subject to a centrifugal acceleration force in addition to the gravitational acceleration force. See FIG. 37. As will be appreciated, the direction of the centrifugal acceleration $g_c$ is perpendicular to (and outward from) the axis of the centrifugal rotation, and its magnitude is given by an equation $g_c = R\,\omega^2$, where R is the distance from the axis of the centrifugal rotation to the sample fluid and $\omega$ is angular velocity in radian/sec. For instance, when R=10 cm and speed of the centrifugal rotation is 100 rpm (corresponding to $\omega$=about 10.5 radian/sec), magnitude of the centrifugal acceleration is about 11 m/sec$^2$, similar to the gravitational acceleration on Earth. Since the centrifugal acceleration is proportional to square of the rotation speed (or square of the angular velocity), the centrifugal acceleration increases quadratically with increase of the rotation speed, for instance, about 4.5 times of the gravitational acceleration at 200 rpm, about 112 times at 1,000 rpm, and about 11,200 times at 10,000 rpm when R=10 cm. The magnitude of the net force field that acts on the sample fluid can be controlled freely by adopting such centrifugal acceleration. Therefore, the buoyancy force can be controlled (typically increased) as needed so as to make the convection speed as fast as needed. Practically, there are few limitations for inducing the thermal convection to very high flow speed sufficient for very high speed PCR reaction, provided a small vertical temperature gradient can be generated in the sample fluid. Therefore, prior limitations regarding heat source assembly and use can be minimized or avoided when combined with centrifugal acceleration in accord with the invention.

As depicted in FIG. 37, the sample fluid is subject to the net force field generated by addition of the centrifugal acceleration and the gravitational acceleration. In a typical embodiment, the channel axis 80 is aligned parallel to the net force field or made to have a tilt angle $\theta_c$ with respect to the net force field. As discussed, presence of the tilt angle is generally preferred in order to make the convection flow stay in a stable route. The tilt angle $\theta_c$ ranges from about 2° to about 60°, more preferably about 5° to about 30°.

It will be appreciated that the apparatus embodiment used to exemplify the PCR centrifuge 500 is shown in FIGS. 1 and 2A-C. However, the PCR centrifuge 500 is compatible with use of one or a combination of different invention apparatuses as described herein. In particular, the PCR centrifuge 500 can also be used with nearly any type of heat source structure and reaction vessel described herein provided that a small vertical temperature gradient can be generated inside the sample. For example, nearly any of the heat source structures described above and elsewhere (e.g., WO02/072267 to Benett et al. and U.S. Pat. No. 6,783,993 to Malmquist et al.) may be combined with the centrifugal element of the present invention so as to enhance the amplification speed and performance of the apparatus. Moreover, other heat source structures that cannot be made operable (or that cannot be made to provide a high PCR amplification speed) in typical gravitationally driven mode can be made operable when combined with the centrifugal acceleration structure. For instance, a heat source structure that does not include a chamber as described herein but only comprises the channel structure may also be made operable. See PCT/KR02/01900, PCT/KR02/01728 and U.S. Pat. No. 7,238,505, for example. In this embodiment, the prior heat source structures without the chamber provides a temperature distribution inside the second heat source that changes slowly, presumably due to a high heat transfer from the second heat source. A result is a small temperature gradient within the second heat source. With only gravity, thermal convection will be unsatisfactory or too slow for many PCR applications. However, introduction of centrifugal acceleration in accord with the invention can make thermal convection sufficiently fast and stable so as to induce the PCR reaction successfully and efficiently.

In typical operation of the thermal convection PCR centrifuge 500, the axis of rotation 510 is essentially parallel to the direction of gravity. See FIG. 37. In this embodiment, the channel axis 80 is essentially parallel to, or tilted with respect to the direction of net force generated by the gravitational force and the centrifugal force. That is, the channel axis 80 can be tilted with respect to the direction of net force generated by the gravitational force and the centrifugal force. For most embodiments, the tilt angle $\theta_c$ between the channel axis 80 and the direction of the net force is between about 2° to about 60°. The tilt shaft 530 is adapted to control the angle between the channel axis 80 and the net force. In operation, the axis of rotation 510 is usually located outside of the first 20 and second 30 heat sources. Alternatively, the axis of rotation 510 is located essentially at or near the center of the first 20 and second 30 heat sources. In these embodiments, the apparatus 10 includes a plurality of channels 70 that are located concentrically with respect to the axis of rotation 510.

Circular-Shaped Heat Sources

In another embodiment of the thermal convection PCR centrifuge, one or more of the heat sources has a circular or semi-circular shape. FIGS. 38A-B and 39A-B show particular embodiments of such a heat source structure.

FIGS. 38A-B show vertical sections of a particular embodiment of a centrifugally accelerated convection PCR apparatus. In particular, FIGS. 38A and 38B show cross-sections along the channel and securing element regions, respectively. The two sections are defined in FIGS. 39A-B which depict horizontal top view of the first 20 and second 30 heat sources, respectively. As depicted in FIGS. 38A-B, the two circular shape heat sources are assembled to form an apparatus embodiment rotatably attached to the rotation axis 510 of a PCR centrifuge 500 through a rotation arm 520. The center of the heat source assembly is positioned concentric with respect to the rotation axis 510 so that the radius of centrifugal rotation is defined by the horizontal length of the rotation arm from the rotation axis to the center of the channel 70. The two heat sources 20 and 30 are assembled essentially parallel to each other with the top of one heat source facing the bottom of another heat source. As also depicted, the heat source assembly is oriented with respect to the rotation axis such that the channel axis 80 is aligned either parallel to, or tilted from the net acceleration vector depicted in FIG. 37.

The two heat sources depicted in FIGS. 39A-B are assembled using a set of first securing element comprising a screw 201, spacers or washers 202*a-b*, and securing apertures 203*a-b* formed in the heat sources as depicted in FIG. 38B. A second securing element 210 formed in the second heat source 30 shown in FIGS. 38B and 39B is used to install the apparatus within the first housing element 300.

Nearly any of the apparatus embodiments disclosed in the present application (including various channel and chamber structures) can be used with the centrifugally accelerated thermal convection PCR apparatus described herein. However, an apparatus without any chamber structure can also be used.

In one embodiment of the forgoing thermal convection PCR centrifuge, the device is made portable and preferably operated with a battery. The embodiment shown in FIGS. 36A-B can be used for high throughput large scale PCR amplification, for example. In this embodiment, the apparatus can be used as a separable module and thus can be easily loaded and unloaded to the centrifuge unit.

Reaction Vessels

A suitable channel of the apparatus is adapted to hold a reaction vessel within the apparatus so that intended results can be achieved. In most cases, the channel will have a configuration that is essentially the same as that of a lower part of the reaction vessel. In this embodiment, the outer profile of the reaction vessel, particularly the lower part, will be essentially identical to the vertical and horizontal profiles of the channel. The upper part of the reaction vessel (i.e., toward the top end) may have nearly any shape depending on intended use. For instance, the reaction vessel may have a larger width or diameter on the upper part to facilitate introduction of a sample and may include a cap to seal the reaction vessel after introduction of a sample to be subjected to thermal convection PCR.

In one embodiment of a suitable reaction vessel, and referring again to FIG. 7A-D, the outer profile of the reaction vessel can be identical to the profile of the channel 70 up to the top end 71 of the channel 70. The shape or profile of inside of the reaction vessel may have a shape different from that of outside of the reaction vessel (if wall thickness of the reaction vessel is made to vary). For instance, the outer profile of the horizontal section may be circular while the inner profile is ellipsoidal, or vice versa. Different combinations of outer and inner profiles are possible as far as the outer profile is suitably selected to provide proper thermal contact with the heat sources, and the inner profile is suitably selected for an intended thermal convection pattern. In typical embodiments, however, the reaction vessel has a wall thickness that is about constant or does not vary much, i.e., the inner profile is typically identical or similar to the outer profile of the reaction vessel. Typical wall thickness ranges between from about 0.1 mm to about 0.5 mm, more preferably between from about 0.2 mm to about 0.4 mm, although it can vary depending on the material used.

If desired, the vertical profile of the reaction vessel may also be shaped to form a linear or tapered tube to fit with the channel as shown in FIGS. 7A-D. When tapered, the reaction vessel may be tapered either from the top to the bottom or from the bottom to the top, although a reaction vessel that is (linearly) tapered from the top to the bottom is generally preferred as in the case of the channel. Typical taper angle θ of the reaction vessel is in the range between from about 0° to about 15°, more preferably from about 2° to about 10°.

The bottom end of the reaction vessel may also be made flat, rounded, or curved as for the bottom end of the channel depicted in FIGS. 7A-D. When the bottom end is rounded or curved, it can have a convex or concave shape with its radius of curvature equal to or larger than the radius or half width of the horizontal profile of the bottom end. Flat or near flat bottom end is more preferred over other shapes since it can provide an enhanced heat transfer so as to facilitate the denaturation process. In such preferred embodiments, the flat or near flat bottom end has a radius of curvature that is at least two times larger than the radius or half width of the horizontal profile of the bottom end.

Also if desired, horizontal profile of the reaction vessel may also be made into various different shapes although a shape having certain symmetry is generally preferred. FIGS. 8A-J shows a few examples of the horizontal profile of the channel having certain symmetry. An acceptable reaction vessel may be made to fit these shapes. For instance, the reaction vessel may have its horizontal shape that is circular (top, left), square (middle, left), or rounded square (bottom, left) generally the same as that shown for the channel 70 in FIGS. 8A, D, G, and J. Thus, the reaction vessel may have a horizontal shape that has its width larger than its length (or vice versa), for instance, an ellipsoid (top, middle), rectangular (middle, middle), or rounded rectangular (bottom, middle) that is generally the same as that depicted in the middle column of FIGS. 8B, E, and H for the channel 70. This type of horizontal shape for the reaction vessel is useful when incorporating a convection flow pattern going upward on one side (e.g., on the left hand side) and going downward on the opposite side (e.g., on the right hand side). Due to the relatively larger width profile incorporated compared to the length, interference between the upward and downward convection flows can be reduced, leading to more smooth circulative flow. The reaction vessel may have a horizontal shape that has its one side narrower than the opposite side. A few examples are shown on the right column of FIGS. 8A-J for the shape of the channel. In particular, the reaction vessel may be made so that the left side of the reaction vessel is narrower than the right side for instance, as shown in FIGS. 8C, F and I for the channel 70. This type of horizontal shape is also useful when incorporating a convection flow pattern going upward on one side (e.g., on the left hand side) and going downward on the opposite side (e.g., on the right hand side). Moreover, when this type of shape is incorporated, speed of the downward flow (e.g., on the right hand side) can be controlled (typically reduced) with respect to the upward flow. Since the convective flow must be continuous within the continuous medium of the sample, the flow speed should be reduced when cross-sectional area becomes larger (or vice versa). This feature is particularly important with regard to enhancing the polymerization efficiency. The polymerization step typically takes place during the downward flow (i.e., after the annealing step), and therefore time period for the polymerization step can be lengthened by making the downward flow slower as compared to that of the upward flow, leading to more efficient PCR amplification.

Further examples of suitable reaction vessels are provided in FIGS. 40A-D. As shown, the reaction vessel 90 includes a top end 91 and a bottom end 92 which ends include center points that define a central reaction vessel axis 95. The reaction vessel 90 is further defined by an outer wall 93 and an inner wall 94 which surround a region for holding a PCR reaction mixture. In FIGS. 40A-B, the reaction vessel 90 is tapered from the top end 91 to the bottom end 92. A generally useful taper angle (θ) is in the range between from about 0° to about 15°, preferably from about 2° to about 10°. In the embodiment shown in FIG. 40A, the reaction vessel 90 has a flat or near flat bottom end 92 while in the example shown in FIG. 40B, the bottom end is curved or rounded. The top 71 and bottom 72 ends of the channel are marked in FIGS. 40A-D.

FIGS. 40C-D provide examples of suitable reaction vessels with straight walls from the top end 91 to the bottom end 92. The reaction vessel 90 shown in FIG. 40C has a flat or near flat bottom end 92 while in the example shown in FIG. 40D, the bottom end is curved or rounded.

Preferably, the vertical aspect ratio of the outer wall 93 of the reaction vessel 90 shown in FIGS. 40A-D is at least about 4 to about 15, preferably from about 5 to about 10. The horizontal aspect ratio of the reaction vessel is defined by the ratio of the height (h) to the width (w1) up to the position corresponding to the top end 71 of the channel 70 as in the case of the channel. The horizontal aspect ratio of the outer wall 93 is typically about 1 to about 4. The horizontal aspect ratio is defined by the ratio of the first width (w1) to the second width (w2) of the reaction vessel along first and second directions, respectively, that are mutually perpendicular to each other and aligned perpendicular to the channel axis. Preferably, the height of the reaction vessel 90 along the reaction vessel axis 95 is at least between about 6 mm to about 35 mm. In this embodiment, the average of the width of the outer wall is between about 1 mm to about 5 mm, and that of the inner wall of the reaction vessel is between about 0.5 mm to about 4.5 mm.

FIGS. 41A-J show horizontal cross-sectional views of suitable reaction vessels for use with the invention. The invention is compatible with other reaction vessel configurations provided intended results are achieved. Accordingly, the horizontal shape of an acceptable reaction vessel can be one or a combination of circle, semi-circle, rhombus, square, rounded square, ellipsoidal, rhomboid, rectangular, rounded rectangular, oval, triangular, rounded triangular, trapezoidal, rounded trapezoidal or oblong shape. In many embodiments, the inner wall is disposed essentially symmetrically with respect to the reaction vessel axis. For example, the thickness of the reaction vessel wall can be between about 0.1 mm to about 0.5 mm. Preferably, the thickness of the reaction vessel wall is essentially unchanged along the reaction vessel axis 95.

In one embodiment of the reaction vessel 90, the inner wall 94 is disposed off-centered with respect to the reaction vessel axis 95. For instance, the thickness of the reaction vessel wall is between about 0.1 mm to about 1 mm. Preferably, the thickness of the reaction vessel wall is thinner on one side than the other side by at least about 0.05 or 0.1 mm.

As discussed, bottom end of a suitable reaction vessel can be flat, curved or rounded. In one embodiment, the bottom end is disposed essentially symmetrically with respect to the reaction vessel axis. In another embodiment, the bottom end is disposed asymmetrically with respect to the reaction vessel axis. The bottom end may be closed and can include or consist of a plastic, ceramic or a glass. For some reactions, the reaction vessel may further include an immobilized DNA polymerase. Nearly any reaction vessel described herein can include a cap in sealing contact with the reaction vessel.

In embodiments where a reaction vessel is used with a thermal convection PCR centrifuge of the invention, relatively large forces will be generated by centrifugal rotation. Preferably, the channel and the reaction vessel will have a smaller diameter or width thus having a large vertical profile can be used. The diameter or width of the channel and the outer wall of the reaction vessel is at least about 0.4 mm to up to about 4 to 5 mm, and that of the inner wall of the reaction vessel is at least about 0.1 mm to up to about 3.5 to 4.5 mm.

Convection PCR Apparatus Comprising an Optical Detection Unit

It is objective of the invention to provide "optical detection" as an additional feature of the apparatus embodiments described herein. It is important to detect progress or results of the polymerase chain reaction (PCR) during or after the PCR reaction with speed and accuracy. The optical detection feature can be useful for such needs by providing apparatuses and methods for simultaneous amplification and detection of the PCR reaction.

In typical embodiments, a detectable probe that can generates an optical signal as a function of the amount of the amplified PCR product is introduced to the sample, and the optical signal from the detectable probe is monitored or detected during or after the PCR reaction without opening the reaction vessel. The detectable probe is typically a detectable DNA binding agent that changes its optical property depending on its binding or non-binding to DNA molecules or interaction with the PCR reaction and/or the PCR product. Useful examples of the detectable probe include, but not limited to, intercalating dyes having a property of binding to double-stranded DNA and various oligonucleotide probes having detectable label(s).

The detectable probe that can be used with the invention typically changes its fluorescence property such as its fluorescence intensity, wavelength or polarization, depending on the PCR amplification. For instance, intercalating dyes such as SYBR green 1, YO-PRO 1, ethidium bromide, and similar dyes generate fluorescence signal that is enhanced or activated when the dye binds to double-stranded DNA. Hence, fluorescence signal from such intercalating dyes can be detected to monitor the amount of the amplified PCR product. Detection using the intercalating dye is non-specific with regard to the sequence of the double-stranded DNA. Various oligonucleotide probes that can be used with the invention are known in the field. Such oligonucleotide probes typically have at least one detectable label and a nucleic acid sequence that can specifically hybridize to the amplified PCR product or the template. Hence, sequence-specific detection of the amplified PCR product, including allelic discrimination, is possible. The oligonucleotide probes are typically labeled with an interactive label pair such as a pair of two fluorescers or a pair of a fluorescer and a quencher whose interaction (such as "fluorescent resonance energy transfer" or "non-fluorescent energy transfer") is enhanced as the distance between the two labels becomes shorter. Most of the oligonucleotide probes are designed such that the distance between the two interactive labels is modulated depending on its binding (typically a longer distance) or non-binding (typically a shorter distance) to a target DNA sequence. Such hybridization-dependent distance modulation results in change of the fluorescence intensity or change (increase or decrease) of the fluorescence wavelength depending on the amount of the amplified PCR product. In other types of the oligonucleotide probes, the probes are designed to undergo certain chemical reactions during the extension step of the PCR reaction, such as hydrolysis of the fluorescer label due to the 5'-3' nuclease activity of a DNA polymerase or extension of the probe sequence. Such PCR reaction dependent changes of the probes lead to activation or enhancement of a fluorescence signal from the fluorescer so as to signal the change of the amount of the PCR product.

A variety of suitable detectable probes and devices for detecting such probes are described in the following U.S. Pat. Nos. 5,210,015; 5,487,972; 5,538,838; 5,716,784; 5,804,375; 5,925,517; 5,994,056; 5,475,610; 5,602,756; 6,028,190; 6,030,787; 6,103,476; 6,150,097; 6,171,785; 6,174,670; 6,258,569; 6,326,145; 6,365,729; 6,703,236; 6,814,934; 7,238,517, 7,504,241; 7,537,377; as well as non-US counterpart applications and patents.

As used herein, the phrase "optical detection unit" including plural forms means a device(s) for detecting PCR amplification that is compatible with one or more of the PCR thermal convection apparatuses and PCR methods disclosed herein. A preferred optical detection unit is configured to detect a fluorescence optical signal such as when a PCR amplification reaction is in progress. Typically, the device will provide for detection of the signal and preferably quantification thereof without opening at least one reaction vessel of the apparatus to which it is operably attached. If desired, the optical detection unit and one or more of the PCR thermal convection apparatuses of the invention can be configured to relate the amount of amplified nucleic acid in the reaction vessel (i.e., real-time or quantitative PCR amplification). A typical optical detection unit for use with the invention includes one or more of the following components in an operable combination: an appropriate light source(s), lenses, filters, mirrors, and beam-splitter(s) for detecting fluorescence typically in the visible region between from about 400 to about 750 nm. A preferred optical detection unit is positioned below, above and/or to the side of a reaction vessel sufficient to receive and output light for detecting PCR amplification within the reaction vessel.

An optical detection unit is compatible with a thermal convection PCR apparatus of the invention if it supports robust, sensitive and rapid detection of the PCR amplification for which the apparatus is intended. In one embodiment, the thermal convection PCR apparatus includes an optical detection unit that enables detection of an optical property of the sample in the reaction vessel. The optical property to be detected is preferably fluorescence at one or more wavelengths depending on the detectable probe used, although absorbance of the sample is sometimes useful to detect. When fluorescence from the sample is detected, the optical detection unit irradiates the sample (either a portion of, or entire sample) with an excitation light and detects a fluorescence signal from the sample. The wavelength of the excitation light is typically shorter than the fluorescence light. In the case of detecting absorbance, the optical detection unit irradiates the sample with a light (typically at a selected wavelength or with scanning the wavelength) and the intensity of the light before and after passing through the sample is measured. Fluorescence detection is generally preferred because it is more sensitive and specific to the target molecule to be detected.

Reference to the following figures and descriptions is intended to provide greater understanding of the thermal convection PCR apparatus comprising an optical detection unit for fluorescence detection. It is not intended and should not be read as limiting the scope of the present invention.

Referring to FIGS. 59A-B, the apparatus embodiments feature one or more optical detection units 600-603 operable to detect a fluorescence signal from the sample in the reaction vessel 90 from the bottom end 92 of the reaction vessel 90 or the bottom end 72 of the channel 70. Shown in FIG. 59A is an embodiment in which single optical detection unit 600 is used to detect fluorescence from multiple reaction vessels 90. In this embodiment, a broad excitation beam (shown as upward arrows) is generated to irradiate multiple reaction vessels and a fluorescence signal (shown as downward arrows) from multiple reaction vessels 90 is detected. In this embodiment, a detector 650 (see FIG. 62, for instance) to be used for the fluorescence detection is preferably one that has an imaging capability so that the fluorescence signal from different reaction vessels can be distinguished from the fluorescence image. Alternatively, multiple detectors 650 each of which detects the fluorescence signal from each reaction vessel can be incorporated.

In the embodiment shown in FIG. 59B, multiple optical detection units 601-603 are incorporated. In this embodiment, each optical detection unit irradiates the sample in each reaction vessel 90 with an excitation light and detects a fluorescence signal from each sample. This embodiment is advantageous in controlling the profile of the excitation beam for each reaction vessel more precisely and also measuring different fluorescence signal from different reaction vessels independently and simultaneously. This type of embodiment is also advantageous in constructing miniaturized apparatuses since larger optical elements and greater optical paths required for generating a broad excitation beam in the single optical detection unit embodiment can be avoided.

Again referring to FIGS. 59A-B, when the optical detection unit 600-603 is located on the bottom end 92 of the reaction vessel 90, the first heat source 20 comprises an optical port 610 for each channel 70 to provide a path for the excitation and emission light to the reaction vessel 70. The optical port 610 may be a through hole or an optical element made of (partially or entirely) an optically transparent or semitransparent material such as glass, quartz or polymer materials having such optical property. If the optical port 610 is made as a though hole, the diameter or width of the optical port is typically smaller than that of the bottom end 72 of the channel 70 or the bottom end 92 of the reaction vessel 90. In the embodiments shown in FIGS. 59A-B, the bottom end 92 of the reaction vessel 90 also works as an optical port. Therefore, it is generally desirable to have all or at least the bottom end 92 of the reaction vessel 90 made of an optically transparent or semitransparent material.

Turning now to FIGS. 60A-B, the apparatus embodiments feature single optical detection unit 600 (FIG. 60A) or multiple optical detection units 601-603 (FIG. 60B) that are located above the top end 91 of the reaction vessel 90. Again, when a single optical detection unit 600 is incorporated (FIG. 60A), a broad excitation beam (shown as downward arrows) is generated to irradiate the multiple reaction vessels and a fluorescence signal (shown as upward arrows) from the multiple reaction vessels 90 is detected. When multiple optical detection units 601-603 (FIG. 60B) are incorporated, each optical detection unit irradiates the sample in each reaction vessel 90 with an excitation light and detects a fluorescence signal from each sample.

In the embodiments shown in FIGS. 60A-B, a center part of a reaction vessel cap (not shown) that typically fits to the top end (opening) 91 of the reaction vessel 90 functions as an optical port for the excitation and emission light. Therefore, all or at least the center part of the reaction vessel cap is made of an optically transparent or semitransparent material.

FIG. 61 shows an apparatus embodiment that features optical detection units 600 that are located on the side of the reaction vessel 90. In this particular embodiment, the optical port 610 is formed on the side of the second heat source 30 (shown as gray rectangular boxes) and the side of the first insulator 50 (shown as dashed lines). Alternatively, the optical port 610 can be formed any one or more of the first 20 and second 30 heat sources, and the first insulator 50 depending on the position of the fluorescence detection as required by particular application purposes. In this embodiment, a side part of the reaction vessel 90 and a portion of the first chamber 100 along the light path also function as optical port, and thus all or at least the parts of the reaction vessel 90 and the first chamber 100 are made of an optically transparent or semitransparent material. When the optical detection unit 600 is located on the side of the reaction vessel 90, the channels 90 are typically formed in one or two arrays that are linearly or circularly arranged. Such arrangement of the channels 70 enables to detect a fluorescence signal from every channel 70 or reaction vessel 90 without interference by other channels.

In the embodiments described above, both excitation and fluorescence detection are performed from the same side with respect to the reaction vessel 90, and thus both an excitation part and a fluorescence detection part are located on the same side, typically within a same compartment of an optical detection unit 600-603. For instance, in the embodiments shown in FIGS. 59A-B, the optical detection unit 600-603 that contains both parts is located on the bottom end 92 of the reaction vessel 90. Similarly, entire optical detection unit is located above the top end 91 of the reaction vessel 90 in the embodiments shown in FIGS. 60A-B, and on the side part of the reaction vessel 90 in the embodiment shown in FIG. 61. Alternatively, the optical detection unit 600-603 may be modified so that the excitation part and the fluorescence detection part are located separately. For instance, the excitation part is located on the bottom (or top) of the reaction vessel 90 and the fluorescence detection part is located on the top (bottom) or side part of the reaction vessel 90. In other embodiments, the excitation part may be located on one side (e.g., left side) of the reaction vessel 90 and the fluorescence detection part may be located another side (e.g., top, bottom, right, front or back side; or a side part other than the excitation side).

The optical detection unit 600-603 typically comprises an excitation part that generates an excitation light with a selected wavelength and a fluorescence detection part that detects a fluorescence signal from the sample in the reaction vessel 90. The excitation part typically comprises a combination of light sources, wavelength selection elements, and/or beam shaping elements. Examples of the light source include, but not limited to, arc lamps such as mercury arc lamps, xenon arc lamps, and metal-halide arc lamps, lasers, and light-emitting diodes (LED). The arc lamps typically generate multiple bands or broad bands of light, and the lasers and LEDs typically generate a monochromatic light or a narrow band light. The wavelength selection element is used to select an excitation wavelength from the light generated by the light source. Examples of the wavelength selection element includes a grating or a prism (for dispersing the light) combined with a slit or an aperture (for selecting a wavelength), and an optical filter (for transmitting a selected wavelength). The optical filter is generally preferred because it can effectively select specific wavelength with compact size and it is relatively cheap. Preferred optical filter is an interference filter having a thin-film coating that can transmit certain band of light (band-pass filter) or light having wavelength longer (long-pass filter) or shorter (short-pass filter) than certain cut-on value. Acoustic optical filters and liquid crystal tunable filters can be an excellent wavelength selection element since these types of filters can be electronically controlled to change the transmission wavelength with speed and accuracy in a compact size although relatively expensive. A colored filter glass can also be used as a wavelength selection element as a cheap replacement of, or in combination with other types of the wavelength selection element to enhance rejection of undesired light (e.g., IR, UV, or other stray light). Choice of the optical filter depends on the characteristics of the light generated by the light source and the wavelength of the excitation light as well as other geometric requirement of the apparatus such as the size. The beam shaping element is used to shape and guide the excitation beam. The beam shaping element can be any one or combination of lenses (convex or concave), mirrors (convex, concave, or elliptical), and prisms.

The fluorescence detection part typically comprises a combination of detectors, wavelength selection elements, and/or beam shaping elements. Examples of the detector include, but not limited to, photomultiplier tubes (PMT), photodiodes, charge-coupled devices (CCD), and video camera. The photomultiplier tubes are typically most sensitive. Therefore, when the sensitivity is the key issue due to very weak fluorescence signal, the photomultiplier tube can be a suitable choice. However, the photomultiplier tubes are not suitable if a compact size or an imaging capability is required (due to its large size). CCDs, silicon photodiodes, or video cameras intensified with, for example, a microchannel plate can have sensitivity similar to the photomultiplier tubes. If imaging of the fluorescence signal is not required and miniaturization is important as in the embodiments having an optical detection unit for each reaction vessel, photodiodes or CCDs with or without an intensifier can be a good choice since these elements are compact and relatively cheap. If imaging is required as in the embodiments having single optical detection unit for multiple reaction vessels, CCD arrays, photodiode arrays, or video cameras (also with or without an intensifier) can be incorporated. Similar to the excitation part, the wavelength selection element is used to select an emission wavelength from the light collected from the sample and the beam shaping element is used to shape and guide the emission light for efficient detection. Examples of the wavelength selection element and the beam shaping element are the same as those described for the excitation part.

In addition to the optical elements described above, the optical detection unit can comprise a beam-splitter. The beam-splitter is particularly useful if the excitation part and the fluorescence detection part are located on the same side with respect to the reaction vessel 90. In such embodiments, the paths of the excitation and emission beams (along opposite directions) coincide with each other and thus it becomes necessary to separate the beam paths using a beam-splitter. Typically useful beam-splitters are dichroic beam-splitters or dichroic mirrors that have a thin-film interference coating similar to the thin-film optical filters. Typical beam-splitters reflect the excitation light and transmit the fluorescence light (a long-pass type), or vice versa (a short-pass type).

Referring now to FIGS. 62-63, 64A-B, and 65, a few design examples of structure of the optical detection unit 600 are described.

In FIG. 62, one embodiment of the optical detection unit 600 is illustrated. In this embodiment, excitation optical elements (620, 630, and 640) are located along a direction at a right angle with respect to the channel axis 80, and fluorescence detection optical elements (650, 655, 660, and 670) are located along the channel axis 80. A dichrocic beam-splitter 680 that transmits the fluorescence emission and reflects the excitation light (i.e., a long-pass type) is located around the middle. As typical, a light generated by the light source 620 is collected by an excitation lens 630 and filtered with an excitation filter 640 to select an excitation light with a desired wavelength. The selected excitation light is then reflected by a dichroic beam-splitter and irradiated to the sample. Fluorescence emission from the sample is collected by an emission lens 660 after passing through the dichroic beam-splitter 680 and an emission filter 670 to select an emission light with a desired wavelength. The fluorescence light thus collected is then focused to an aperture or slit 655 or to a detector 650 to measure the fluorescence signal. The function of the aperture or slit 655 is "spatial filtering" of the emission. Typically, the fluorescence light is focused on or near the aperture or slit 655 and thus a fluorescence image from certain (vertical) location of the sample is formed on the aperture or slit 655. Such optical arrangement enables to collect a fluorescence signal efficiently from a certain limited location inside the sample (e.g., the annealing, extension or denaturation region) while rejecting light from other locations. Use of the aperture or slit 655 is optional depending on the type of the detectable probe used. If the fluorescence signal is subject to be generated from a specific region inside the sample, use of one or more of the aperture or slit 655 is preferred. If the fluorescence signal is subject to be generated regardless of the location inside the sample, use of the aperture or slit 655 may not be necessary or one having a larger opening may be used.

As shown in the embodiment depicted in FIG. 63, the optical detection unit 600 may be modified to position the excitation optical elements (620, 630, 640) along the channel axis 80 and the fluorescence detection optical elements (650, 655, 660, and 670) along a direction at a right angle to the channel axis 80. A dichrocic beam-splitter 680 useful for this type of embodiment is a short-pass type that transmits the excitation light and reflects the emission light.

The excitation lens 630 used in the embodiments shown in FIGS. 62-63 can be replaced with a combination of more than one lenses or a combination of lenses and mirrors. When a combination of such optical elements is used, the first lens (typically a convex lens) is preferably located close to and in front of the light source in order to collect the excitation light efficiently. To further enhance the collection efficiency of the excitation light, a mirror (typically concave or elliptic) may be placed on the back side of the light source. When it is required to make the excitation beam large as in the embodiments having a single optical detection unit 600 for irradiating multiple reaction vessels 90, a concave lens or a convex mirror may be used additionally to expand the excitation beam. In some embodiments, one or more of the optical elements (e.g., one or more of lenses or mirrors) may be placed other locations, e.g., between the reaction vessel 90 and the dichroic beam-splitter 680 or the excitation filter 640. In other aspect, the excitation light is typically shaped to an essentially collinear beam so as to irradiate a larger volume of the sample(s). In some special applications such as when using a multi-photon excitation scheme, the excitation light may be tightly focused to a certain position inside the sample.

The emission lens 660 used in the embodiments shown in FIGS. 62-63 can also be replaced with a combination of more than one lenses or a combination of lenses and mirrors. When a combination of such optical elements is used, the first lens (typically a convex lens) is preferably located close to the reaction vessel 90 (for instance, between the reaction vessel 90 and the dichroic beam-splitter 680 or the emission filter 670) in order to collect the fluorescence light more efficiently. In some embodiments, one or more of the optical elements (e.g., a lens or a mirror) may be placed other locations, e.g., between the reaction vessel 90 and the dichroic beam-splitter 680 or the emission filter 670.

FIGS. 64A-B show embodiments in which one lens 635 is used to shape both the excitation beam and the emission beam. Two examples of arranging the excitation optical elements (620 and 640) and the fluorescence detection optical elements (650, 655, and 670) are shown. The excitation optical elements (620 and 640) are located along a direction at a right angle to the channel axis 80 in FIG. 64A and along the channel axis 80 in FIG. 64B. This type of embodiments using a single lens is useful in miniaturizing the optical detection unit 600 such as in the embodiments of incorporating multiple optical detection units shown in FIGS. 59B, 60B and 61.

FIG. 65 shows one apparatus embodiment in which the optical detection unit 600 is located on the top side of the reaction vessel 90. The arrangement of the optical elements depicted is the same as the embodiment shown in FIG. 62. Other types of the optical arrangements (e.g., those shown FIGS. 63 and 64A-B) can also be incorporated. When the optical detection unit 600 (or the excitation or fluorescence detection part) is located on the top side of the reaction vessel 90, the center part of the reaction vessel cap 690 functions as an optical port 610. Therefore, as discussed, the reaction vessel cap 690 or at least the center part is preferably made of an optically transparent or semitransparent material in this type of embodiments.

Again referring to FIG. 65, the reaction vessel 90 and the reaction vessel cap 690 typically has a sealing relationship with each other in order to avoid an evaporative loss of the sample during the PCR reaction. In the reaction vessel embodiment shown in FIG. 65, the sealing relationship is made between an inner wall of the reaction vessel 90 and an outer wall of the reaction vessel cap 690. Alternatively, the sealing relationship may be made between an outer wall of the reaction vessel 90 and an inner wall of the reaction vessel cap 690 or between a top surface of the reaction vessel 90 and a bottom surface of the reaction vessel cap 690. In some embodiments, the reaction vessel cap 690 may be a thin-film adhesive tape that is optically transparent or semitransparent. In such embodiments, the sealing relationship is made between a top surface of the reaction vessel 90 and a bottom surface of the reaction vessel cap 690.

The reaction vessel embodiments described above may not be optimal for all uses of the invention. For instance, and as shown in FIG. 65, it is typical that the sample meniscus (i.e., a water-air interface) is formed between the sample and the reaction vessel cap 690 (or an optical port part of the reaction vessel cap 690). In operation, water in the sample evaporates and condenses to the inner surface of the reaction vessel cap 690 (or an optical port part of the reaction vessel cap 690) due to the PCR reaction that involves a high temperature process. Such condensed water may, for some applications, interfere somewhat with the excitation beam and the fluorescence beam, particularly when the optical detection unit is positioned on the top side of the reaction vessel 90.

The reaction vessel embodiments exemplified in FIGS. 66A-B provide another approach. As shown, a reaction vessel 90 and a reaction vessel cap 690 are designed to have an optical port 695 to contact the sample. A sample meniscus is formed higher than, or about the same height as the bottom surface 696 of the optical port 695. Unlike the typical reaction vessel embodiments described above, the excitation beam and the fluorescence beam are transmitted directly from the optical port 695 to the sample or vice versa without passing through the air or any condensed water inside the reaction vessel 90. Structural requirements for such embodiments are as follows:

Firstly, as shown FIGS. 66A-B, the reaction vessel cap 690 has a sealing relationship with the upper part of the reaction vessel 90 and also with the optical port 695. As discussed, the sealing between the reaction vessel 90 and the reaction vessel cap 690 can be made at an inner wall of the reaction vessel (as in FIGS. 66A-B) or at an outer wall or a top end 91 of the reaction vessel 90. The sealing between the reaction vessel cap 690 and the optical port 695 can be made at a top surface 697 (FIG. 66A) or a side wall 699 (FIG. 66B) of the optical port 695. Alternatively the reaction vessel cap 690 and the optical port 695 may be made as one body, preferably using a same or similar optically transparent or semitransparent material.

Additionally, the diameter or width of the optical port 695 (and also that of a wall of the reaction vessel cap 690 if that wall is located near or about the same height as the bottom surface 696 of the optical port 695) is made smaller than the diameter or width of a portion of the inner wall of the reaction vessel 90 that is located near or about the same height as the bottom surface 696 of the optical port 695. Moreover, the bottom surface 696 of the optical port 695 is located lower than, or about the same height as the bottom of the inner part of the reaction vessel cap 690. When these structural requirements are met, an open space 698 is provided between the inner wall of the reaction vessel 90 and the side part of the optical port 695. Therefore, the sample can fill up a portion of the open space to form a sample meniscus above the bottom part 696 of the optical port 695 when the reaction vessel 90 is sealed with the reaction vessel cap 690 to make the bottom of the optical port contact the sample.

In FIG. 67, use of the optically non-interfering reaction vessel discussed above is exemplified. As discussed, the bottom 696 of the optical port 695 contacts the sample and the sample meniscus is formed above the bottom 696 of the optical port 695. With an optical detection unit 600 located on the top end 91 of the reaction vessel 90, the excitation beam and the fluorescence beam are transmitted directly from the optical port 695 to the sample or vice versa without passing through the air or any condensed water inside the reaction vessel 90. Such optical structure can greatly facilitate the optical detection feature of the invention.

Convection PCR Apparatus Comprising a Nucleic Acid Separation Unit

It is a further object of the invention to provide at least one "nucleic acid separation" unit operably linked to the multi-stage thermal convection apparatus invention described herein (e.g., one, two, three or more of such units). As will be appreciated, it will often be important to separate the PCR amplified product(s) produced by the apparatus during or after the PCR reaction. In such embodiments, the additional feature of having the operably linked nucleic acid separation unit will assist identification, analysis and/or utilization of the amplified PCR product. Preferably, the nucleic acid separation can be performed as a function of size or size to charge ratio and/or in combination with optional optical detection of the separated product(s). The nucleic acid separation feature can be useful in embodiments that require simultaneous amplification and separation as well as identification of the PCR product(s).

In one embodiment, the multi-stage thermal convection PCR apparatus is a two-stage apparatus as described herein that includes an operably linked nucleic acid separation unit that can separate the amplified PCR product(s). Preferably, the nucleic acid separation unit separates the PCR product(s) as a function of size or size to charge ratio. Examples of the size-dependent nucleic acid separation unit include, but not limited to, a capillary electrophoresis unit, a gel electrophoresis unit, and other types of electrophoresis or chromatography units known in the field.

In another embodiment, the multi-stage thermal convection PCR apparatus is a two-stage apparatus as described herein that further comprises at least one operably linked optical detection unit for detecting the separated PCR product (e.g., one, two, three or more of such units). For most applications, the optical detection unit typically detects fluorescence, absorbance, or chemiluminescence from the PCR product as a function of elution time and/or as a function of position within the separation unit.

Examples of suitable nucleic acid separation units and/or optical detection units include, but not limited to those described in the following references: U.S. Pat. Nos. 4,865,707; 5,147,517; 5,384,024; 5,582,705; 5,597,468; 5,790,727; 6,017,434; and 7,361,259; as well as non-US counterpart applications and patents. See also Felhofer, J. L., et al., Electrophoresis, 31(15), pp. 2469-2486 (2010); Terabe, S., et al., Analytical Chemistry, 56, pp. 111-113 (1984); Jorgenson, J. W. and Lukacs, K. D., Science, 222, pp. 266-272 (1983); Hjerten, S., Journal of Chromatography 270, pp. 1-6 (1983); and Jorgenson, J. W. and Lukacs, K. D., Analytical Chemistry, 53(8), pp. 1298-1302 (1981).

In one embodiment in which the two-stage apparatus includes an operably linked optical detection unit, at least one detectable probe (e.g., one, two, three or more of such probes) that can generate an optical signal as a function of the amount of the PCR product is introduced to the sample during or after the PCR reaction, and the optical signal from the detectable probe is monitored or detected during or after the nucleic acid separation. The detectable probe is typically a detectable label that generates a fluorescence, absorbance or chemiluminescence signal, or a detectable DNA binding agent that generates an optical signal or changes its optical property depending on its binding or non-binding to, or interaction with the PCR product. Useful examples of the detectable probe include, but not limited to, detectable labels that can be incorporated into the primers or PCR products, intercalating dyes having a property of binding to double-stranded DNA, and various oligonucleotide probes having detectable label(s). Suitable detectable probes include, but are not limited to the following U.S. Pat. Nos. 5,210,015; 5,487,972; 5,538,838; 5,716,784; 5,804,375; 5,925,517; 5,994,056; 5,475,610; 5,602,756; 6,028,190; 6,030,787; 6,103,476; 6,150,097; 6,171,785; 6,174,670; 6,258,569; 6,326,145; 6,365,729; 6,703,236; 6,814,934; 7,238,517; 7,504,241; and 7,537,377; as well as non-US counterpart applications and patents.

The optical detection unit may be used to determine the size of one or more of the PCR products or in some embodiments to determine a partial or whole nucleic acid sequence of the PCR product. When the sequence of the PCR product is to be determined, the PCR reaction may be terminated by adding a termination agent such as dideoxynucleotide triphosphates (ddNTPs).

Thus in a particular invention embodiment, the multi-stage thermal convention apparatus is a two-stage apparatus as described herein that further includes as operably linked components, a suitable nucleic acid separation unit and an optical detection unit. In use, the two-stage apparatus with the operably linked nucleic acid separation and optical detection units may be used in conjunction with an appropriate detectable probe for monitoring or detecting amplification during or after the PCR reaction.

Convection PCR Apparatus Comprising a Sequence-Specific Detection Unit

It is a further object of the invention to provide "sequence-specific detection" as an additional feature of the multi-stage thermal convection apparatus embodiments described herein such as the two-stage apparatus. For some applications, it will be important to detect the PCR product(s) in a sequence-specific manner, for instance, in embodiments in which a user wishes to have accurate identification of target amplicon(s) and/or elimination of false amplicon(s) during or after a PCR reaction. The sequence-specific detection feature can be useful for such needs by providing apparatuses and methods for simultaneous amplification and sequence-specific detection of the PCR product(s) during or after the PCR reaction.

In one embodiment, the multi-stage thermal convection PCR apparatus is a two-stage apparatus as described herein that includes at least one operably linked sequence-specific detection unit (e.g., one, two, three or more of such units). The sequence-specific detection unit typically comprises one or more hybridization chips such as DNA chip, for example, one, two, three, four or more of such hybridization chips. The hybridization chip typically comprises at least one oligonucleotide probe that is immobilized on a solid substrate (e.g., less than several hundreds of such oligonucleotide probes such as one, two, three, four or more of such oligonucleotide probes). In preferred embodiments, the hybridization chip comprises two or more oligonucleotide probes with each probe immobilized at a different location on a suitable solid substrate. The oligonucleotide probe typically has a nucleic acid sequence that can specifically hybridize to at least one of the PCR products. Hence, sequence-specific detection of the amplified PCR product, including allelic discrimination, is possible.

In some embodiments, the hybridization chip may be located inside of the reaction vessel described above, preferably in contact with the PCR reaction mixture. In such embodiments, the hybridization chip may be a separate unit that can be introduced into the reaction vessel, or it can be a part of the reaction vessel. The hybridization chip may be located anywhere inside of the reaction vessel, for instance, the side, bottom or top part of the reaction vessel. In preferred embodiments, the hybridization chip is located at the bottom of the inside of the reaction vessel or at the bottom side of the reaction vessel cap 690, e.g., the bottom end 696 of the optical port 695 as shown in FIGS. 66A-B and 67.

In other embodiments, the sequence-specific detection unit including the hybridization chip may be located outside the reaction vessel as a separate unit.

In other embodiments, the multi-stage thermal convection PCR apparatus is a two-stage apparatus that further includes the operably linked optical detection unit for detecting hybridization of the PCR product on the hybridization chip. The optical detection unit typically detects a fluorescence, absorbance or chemiluminescence signal from the hybridized PCR product as a function of position within the hybridization chip. In a particular embodiment, the optical detection unit has a capability of capturing an image of the hybridization chip.

Examples of suitable hybridization chips and/or optical detection units include, but not limited to those described in the following references: U.S. Pat. Nos. 5,445,934; 5,545,531; 5,744,305; 5,837,832; 5,861,242; 6,579,680; and 7,879,541; as well as non-US counterpart applications and patents. See also PCT Publication Nos. WO 2006/082035; and WO 2012/080339; and Maskos, U. and Southern, E. M., Nucleic Acids Research, 20(7), pp. 1679-1684 (1992).

In one embodiment, a detectable probe that can generate an optical signal as a function of the amount of the hybridized PCR product is introduced to the sample during or after the PCR reaction, and the optical signal from the detectable probe is monitored or detected after hybridization to the hybridization chip. The detectable probe is typically a detectable label that generates a fluorescence, absorbance or chemiluminescence signal, or a detectable DNA binding agent that generates an optical signal or changes its optical property depending on its binding or non-binding to, or interaction with the hybridized PCR product. Useful examples of the detectable probe include, but not limited to, detectable labels that can be incorporated into the primers or PCR products, intercalating dyes having a property of binding to double-stranded DNA, and various oligonucleotide probes having detectable label(s). Suitable detectable probes and labels have been described above.

In a particular embodiment, the structure of the optical detection unit can be the same as or operably similar to any one of the structures depicted in FIGS. 59A-B, 60A-B, 61-63, 64A-B, and 67. In another particular embodiment, the detector 650 has an imaging capability.

The following examples are given for purposes of illustration only in order that the present invention may be more fully understood. These examples are not intended to limit in any way the scope of the invention unless otherwise specifically indicated.

EXAMPLES

Materials and Methods

Three different DNA polymerases purchased from Takara Bio (Japan), Finnzymes (Finland), and Kapa Biosystems (South Africa) were used to test PCR amplification performance of various invention apparatuses. Plasmid DNAs comprising various insert sequences, human genome DNA, and cDNA were used as template DNAs. The plasmid DNAs were prepared by cloning insert sequences with different size into pcDNA3.1 vector. The human genome DNA was prepared from a human embryonic kidney cell (293, ATCC CRL-1573). The cDNA was prepared by reverse transcription of mRNA extracts from HOS or SV-OV-3 cells.

Composition of the PCR mixture was as follows: a template DNA with different amount depending on experiments, about 0.4 μM each of a forward and reverse primer, about 0.2 mM each of dNTPs, about 0.5 to 1 units of DNA polymerase depending on DNA polymerase used, about 1.5 mM to 2 mM of $MgCl_2$ mixed in a total volume of 20 μL using a buffer solution supplied by each manufacturer.

The reaction vessel was made of polypropylene and had structural features as depicted in FIG. 40A. The reaction vessel had a tapered cylindrical shape with its bottom end closed and comprised a cap that fits with the inner diameter of the top end of the reaction vessel so as to seal the reaction vessel after introduction of a PCR mixture. The reaction vessel was (linearly) tapered from the top to the bottom end so that the upper part had a larger diameter. The taper angle as defined in FIG. 40A was about 4°. The bottom end of the reaction vessel was made flat in order to facilitate heat transfer from the receptor hole in the first heat source. The reaction vessel had a length from the top end to the bottom end of about 22 mm to about 24 mm, an outer diameter at the bottom end of about 1.5 mm, an inner diameter at the bottom end of about 1 mm, and a wall thickness of about 0.25 mm to about 0.3 mm.

Volume of the PCR mixture used for each reaction was 20 μL. The PCR mixture with 20 μL volume produced a height of about 12 to 13 mm inside the reaction vessel.

All the apparatuses used in the examples below were made operable with a DC power. A rechargeable $Li^+$ polymer battery (12.6 V) or a DC power supply was used to operate the apparatus. The apparatuses used in the examples had 12 (3×4), 24 (4×6), or 48 (6×8) channels that were arranged in an array format with multiple rows and columns as exemplified in FIG. 30. The spacing between adjacent channels was made as 9 mm. In the experiments, the reaction vessel(s) containing the PCR mixture sample was introduced into the channel(s) after the three heat sources of the apparatus were heated to desired temperatures. The PCR mixture sample was removed from the apparatus after a desired PCR reaction time and analyzed with agarose gel electrophoresis using ethidium bromide (EtBr) as a fluorescent dye for visualizing amplified DNA bands.

Example 1. Thermal Convection PCR Using the Apparatus of FIG. 5A

The apparatus used in this example had the structure shown in FIG. 5A comprising a channel 70, a first chamber 100, a receptor hole 73, a through hole 71, a first protrusion 33 of the second heat source 30, and a first protrusion 23 of the first heat source 20. The length of the first and second heat sources along the channel axis 80 were about 4 mm and about 9.5 mm, respectively. The first insulator (or first insulating gap) had a length along the channel axis 80 near the channel region (i.e., within the protrusion region) of about 1.5 mm. The length of the first insulator along the channel axis 80 outside the channel region (i.e., outside the protrusion region) was about 9.5 mm to about 8 mm depending on position. The first chamber 100 was located on the lower part of the second heat source 30 and had a cylindrical shape with a length along the channel axis 80 of about 6.5 mm and a diameter of about 4 mm. The depth of the receptor hole 73 along the channel axis 80 was about 2.5 mm for the data presented in this example although it was varied between from about 1.5 mm to about 3 mm. In this apparatus, the channel 70 was defined by the through hole 71 in the second heat source 30 and the receptor hole 73 in the first heat source 20. The channel 70 had a tapered cylinder shape. Average diameter of the channel was about 2 mm with the diameter at the bottom end (in the receptor hole) being about 1.5 mm. In this apparatus, all the temperature shaping elements including the first chamber, the receptor hole, the first insulator, and the protrusions were disposed symmetrically with respect to the channel axis.

As presented below, the apparatus used in this example having the structure shown in FIG. 5A was found to be efficient enough to amplify from a 10 ng human genome sample (about 3,000 copies) in about 25 min without the gravity tilting angle. For a 1 ng plasmid sample, PCR amplification resulted in a detectable amplification in as little as about 6 or 8 min. Hence, this is a good demonstrating example of a symmetric heating structure that can provide an efficient PCR amplification without using the gravity tilting angle. As presented in Example 2, this structure also works better (i.e., faster and more efficient) when the gravity tilting angle is introduced. However, a small tilting angle (about 10° to 20° or smaller) can be sufficient for most applications.

1.1. PCR Amplification from Plasmid Samples

FIGS. 42A-C show PCR amplification results obtained from a 1 ng plasmid DNA template using the three different DNA polymerases (from Takara Bio, Finnzymes, and Kapa Biosystems, respectively) described above. The expected size of the amplicon was 349 bp. The forward and reverse primers used were 5'-GGGAGACCCAAGCTGGCTAGC-3' (SEQ ID NO: 1) and 5'-CACAGTCGAGGCTGATCA-GCGG-3' (SEQ ID NO: 2), respectively. In FIGS. 42A-C, the left most lane shows DNA size marker (2-Log DNA Ladder (0.1-10.0 kb) from New England BioLabs) and lanes 1 to 4 are results obtained with the thermal convection PCR apparatus at PCR reaction time of 10, 15, 20, and 25 min, respectively, as denoted on the bottom of each Figure. The temperatures of the first and second heat sources of the invention apparatus were set to 98° C. and 62° C., respectively. Depth of the receptor hole along the channel axis was about 2.5 mm. As shown in FIGS. 42A-C, the thermal convection apparatus yielded an amplified product at the expected size in very shorter reaction time. PCR amplification reached a detectable level at about 10 min and became saturated in about 20 or 25 min. As manifested, the three DNA polymerases were found to be nearly equivalent to use with the thermal convection PCR apparatus. A control experiment was also performed using T1 Biometra Thermocycler from Biometra for the same PCR mixture containing the same amount of the plasmid template (data not shown). The control experiment yielded a product band at the expected size with its intensity similar to that observed at about 20 or 25 min PCR reaction time with the invention apparatus; however it took about 3 to 4 times longer time to complete the PCR reaction (about 1 hour 30 min including 5 min pre-heating and 10 min final extension).

FIG. 43 shows another result of thermal convection PCR obtained using a plasmid template that can yield a 936 bp amplicon. Amount of the template plasmid used was 1 ng. The forward and reverse primers used had the sequences as set forth in SEQ ID NOs: 1 and 2, respectively. The temperatures of the first and second heat sources were set to 98° C. and 62° C., respectively. Depth of the receptor hole along the channel axis was about 2.5 mm. As shown, even a larger amplicon (about 1 kbp) was successfully amplified in very short reaction time (about 20 to 25 min), demonstrating a wide dynamic range of the invention apparatus.

1.2. Acceleration of PCR Amplification at Elevated Denaturation Temperature

The results shown in FIGS. 44A-D demonstrate acceleration of the thermal convection PCR at elevated denaturation temperatures. The template used was a 1 ng plasmid that can yield a 349 bp amplicon. Except for the denaturation temperature, all other experimental conditions including the template and primers used were the same as those used for the experiments presented in FIGS. 42A-C and 43. While the temperature of the second heat source was set to 62° C., the temperature of the first heat source was increased from 98° C. (FIG. 44A) to 100° C. (FIG. 44B), 102° C. (FIG. 44C), and 104° C. (FIG. 44D). As shown, increase of the denaturation temperature (i.e., the temperature of the first heat source) resulted in acceleration of PCR amplification. The 349 bp product was barely observable at 10 min reaction time when the denaturation temperature was 98° C. (FIG. 44A). However, the product band became stronger even at 8 min reaction time when the denaturation temperature was increased to 100° C. (FIG. 44B). When the denaturation temperature was further increased to 102° C. (FIG. 44C) and 104° C. (FIG. 44D), the product band became observable in as short as 6 min reaction time.

1.3. PCR Amplification from Human Genome Sample

FIGS. 45A-B show two examples of thermal convection PCR for amplification from a human genome sample. Depth of the receptor hole along the channel axis was about 2.5 mm. Amount of the human genome template used for each reaction was 10 ng corresponding to about 3,000 copies only. FIG. 45A shows results for amplification of a 479 bp segment of GAPDH gene. The forward and reverse primers used in this experiment were 5'-GGTGGGCTTGCCCT-GTCCAGTTAA-3' (SEQ ID NO: 3) and 5'-CCTGGTGAC-CAGGCGCC-3' (SEQ ID NO: 4), respectively. In this experiment, the temperatures of the first and second heat sources were set to 98° C. and 62° C., respectively. FIG. 45B shows results for amplification of a 363 bp segment of β-globin gene. The forward and reverse primers used in this experiment were 5'-GCATCAGGAGTGGACAGAT-3' (SEQ ID NO: 5) and 5'-AGGGCAGAGCCATCTATTG-3' (SEQ ID NO: 6), respectively. In this experiment, the temperatures of the first and second heat sources were changed to 98° C. and 54° C., respectively, to match for the lower annealing temperatures of the primers used.

As shown in FIGS. 45A-B, the thermal convection PCR from about 3,000 copies of human genome samples yielded amplicons with correct size in very short reaction time. The PCR amplification was completed in about 25 or 30 min. These results demonstrate that the thermal convection PCR is fast and very efficient for amplifying from low copy number samples.

1.4. PCR Amplification from Very Low Copies of Human Genome Sample

FIG. 46 shows PCR amplification from very low copy number samples using the invention apparatus. Template sample used was human genome DNA extracted from 293 cells. The forward and reverse primers used in this experiment were 5'-ACAGGAAGTCCCTTGCCATC-CTAAAAGC-3' (SEQ ID NO: 7) and 5'-CCAAAAGCCT-TCATACATCTCAAGTTGGGGG-3' (SEQ ID NO: 8), respectively. The temperatures of the first and second heat sources were set to 98° C. and 62° C., respectively. Depth of the receptor hole along the channel axis was about 2.5 mm. Target sequence was a 241 bp segment of β-actin. PCR reaction time was 25 min. As denoted on the bottom of FIG. 46, amount of the human genome sample used for each reaction was decreased consecutively, starting from 10 ng (about 3,000 copies) to 1 ng (about 300 copies), 0.3 ng (about 100 copies), and 0.1 ng (about 30 copies). As manifested, the thermal convection PCR yielded successful PCR amplification from as little as a 30 copy sample (a weak band was observed as shown).

1.5. Temperature Stability and Power Consumption of the Invention Apparatus

Temperature stability and power consumption of the invention apparatus having the structure shown in FIG. 5A were tested. The apparatus used in this experiment had 12 channels (3×4) disposed 9 mm apart from each other as shown in FIGS. 30 and 33. The first and second heat sources were each equipped with a NiCr heating wire (160*a-b*) that was disposed in between the channels as shown in FIG. 33. The apparatus also comprised a fan above the second heat source to provide cooling to the second heat source when needed. DC power from a rechargeable $Li^+$ polymer battery (12.6 V) was supplied to each heating wire and controlled by PID (proportional-integral-derivative) control algorism so as to maintain the temperature of each of the two heat sources at a pre-set target value.

FIG. 47 shows temperature variations of the first and second heat sources when target temperatures were set to 98° C. and 64° C., respectively. The ambient temperature was about 25° C. As shown, the two heat sources reached the target temperatures within less than about 2 min. During about 40 min time span after reaching the target temperatures, the temperatures of the two heat sources were maintained stably and accurately at the target temperatures. Average of the temperature of each heat source during the 40 min time span was within about ±0.05° C. with respect to each target temperature. Temperature fluctuations were also very small, i.e., standard deviation of the temperature of each heat source was within about ±0.06° C.

FIG. 48 shows power consumption of the invention apparatus having 12 channels. As shown, the power consumption was high in the initial time period (i.e., up to about 2 min) in which rapid heating to the target temperatures took place. After the two heat sources reached the target temperatures (i.e., after about 2 min), the power consumption was reduced to lower values. The large fluctuations observed after about 2 min are result of active control of the power supply to each heat source. Due to such active power control, the temperatures of the two heat sources can be maintained stably and accurately at the target temperatures as shown in FIG. 47. Average of the power consumption in the temperature maintaining region (i.e., after about 2 min) was about 4.6 W as denoted in FIG. 48. Therefore, power consumption per each channel or each reaction was less than about 0.4 W. Since about 25 min to 30 min or less time is sufficient for PCR amplification in the invention apparatus, energy cost for completion of one PCR reaction is only about 600 J to 700 J or less as is equivalent to energy needed to heat up about 2 mL water from room temperature to about 100° C. one time.

Invention apparatuses having 24 and 48 channels were also tested (data not shown). Average power consumption was about 6 to 8 W for the 24 channel apparatus and about 9 to 12 W for the 48 channel apparatus. Hence, power consumption per each PCR reaction was found to be even less for lager apparatuses, i.e., about 0.3 W for the 24 channel apparatus and about 0.2 W for the 48 channel apparatus.

Example 2. Thermal Convection PCR Using the Apparatus of FIG. 11A

In this example, effect of the gravity tilting angle $\theta_g$ to the thermal convection PCR was examined. The apparatus used in this example had the same structure and dimensions as that used in Example 1 except for incorporation of the gravity tilting angle $\theta_g$ as defined in FIG. 11A. The apparatus was equipped with an inclined wedge on the bottom so that the channel axis was tilted by $\theta_g$ with respect to the direction of gravity.

As presented below, introduction of the gravity tilting angle caused the convective flow faster and thus accelerated the thermal convection PCR. It was therefore confirmed that a structural element such as a wedge or leg, or an inclined or tilted channel that can impose a gravity tilting angle to the apparatus or the channel is a useful structural element in constructing an efficient and fast thermal convection PCR apparatus.

2.1. PCR Amplification from Plasmid Sample

Figure 49:
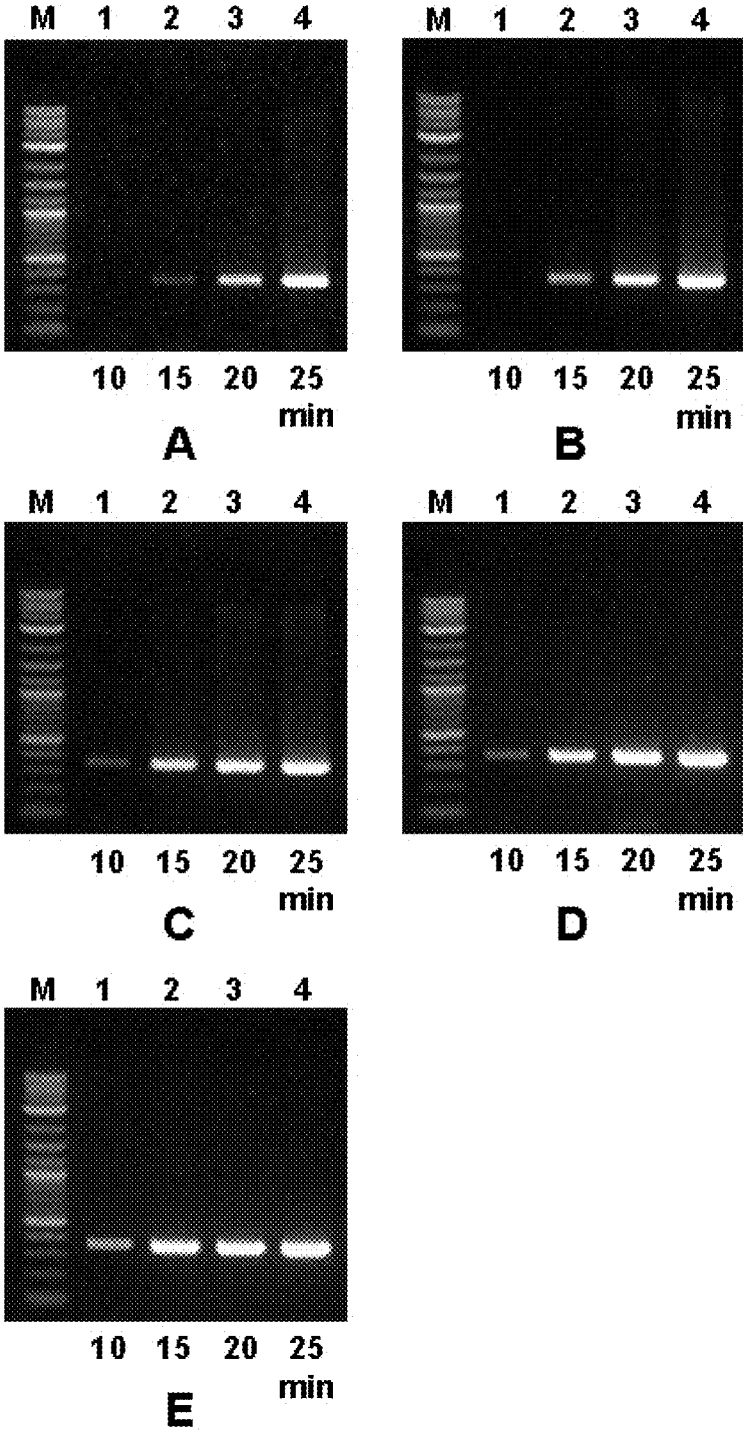

FIGS. 49A-E show results of thermal convection PCR as a function of the gravity tilting angle for amplification from a plasmid sample. The temperatures of the first and second heat sources were set to 98° C. and 64° C., respectively. Depth of the receptor hole along the channel axis was about 2.5 mm. Amount of the template plasmid used for each reaction was 1 ng. The primers used had the sequences as set forth in SEQ ID NOs: 1 and 2. The expected size of the amplicon was 349 bp. FIG. 49A shows results obtained at zero gravity tilting angle. FIGS. 49B-E show results obtained at $\theta_g$ equal to 10°, 20°, 30°, and 45°, respectively. At zero gravity tilting angle (FIG. 49A), the amplified product was barely observable at 15 min reaction time and became strong at 20 min. In contrast, the amplified product was observable with a significant intensity at 15 min reaction time when the gravity tilting angle of 10° was introduced (FIG. 49B). Further increase of the product band intensity at 15 min reaction time and appearance of a weak product band at a shorter time (i.e., 10 min) were evident as the gravity tilting angle was increased to 20° (FIG. 49C). Above 20° tilting angle (FIGS. 49D-E), amplification speed was observed to be similar to that observed at 20° (i.e., only slightly increased).

Figure 50:
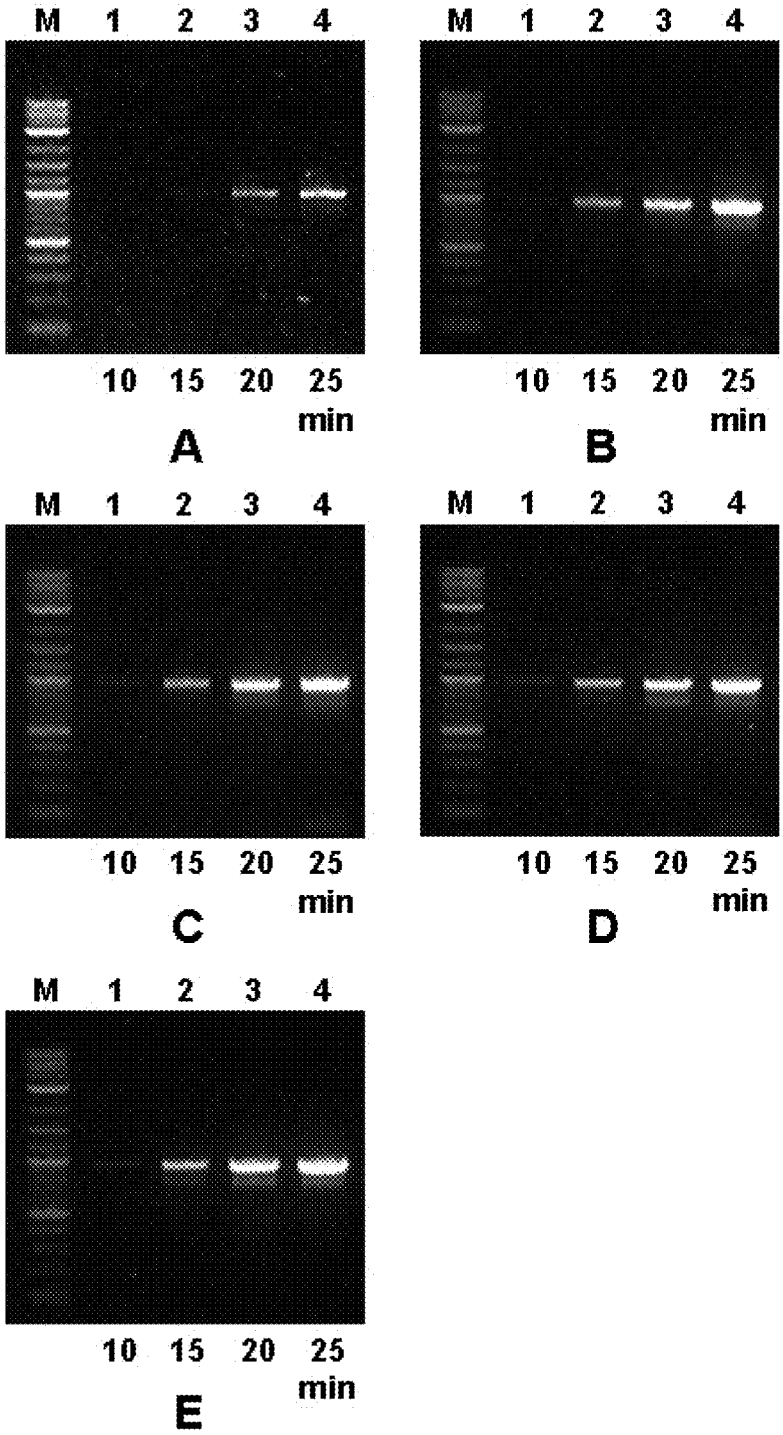

FIGS. 50A-E show another example for amplification of an about 1 kbp amplicon from a plasmid sample. All the experimental conditions including the primers used (except for the template plasmid) are the same as the experiments shown in FIGS. 49A-E. The expected size of the amplicon was 936 bp. FIG. 50A shows results obtained at zero gravity tilting angle. FIGS. 50B-E show results obtained at $\theta_g$ equal to 10°, 20°, 30°, and 45°, respectively. At zero gravity tilting angle (FIG. 50A), a weak product band was observed at 20 min reaction time. In contrast, the amplified product was observable at 15 min reaction time when the gravity tilting angle of 10° was introduced (FIG. 50B). Further increase of the product band intensity at 15 min reaction time and appearance of a very weak product band at a shorter time (i.e., 10 min) were observed as the gravity tilting angle was increased to 20° (FIG. 50C). Above 20° tilting angle (FIGS. 50D-E), only a slight increase of the amplification speed was observed as compared to the 20° tilting angle. The effect of the gravity tilting angle observed for a longer amplicon in this example was found to be similar to the results obtained for a shorter amplicon shown in FIGS. 49A-E.

2.2. PCR Amplification from Various Plasmid Sample

FIG. 51 shows results of thermal convection PCR amplification obtained from various plasmid templates with amplicon size between about 150 bp to about 2 kbp when the gravity tilting angle of 10° was introduced. The temperatures of the first and second heat sources were set to 98° C. and 64° C., respectively. Depth of the receptor hole along the channel axis was about 2.5 mm. Amount of the template plasmid used for each reaction was 1 ng. The forward and reverse primers used had the sequences as set forth in SEQ ID NOs: 1 and 2, respectively. The expected size of the amplicon was 153 bp for lane 1; 349 bp for lane 2; 577 bp for lane 3; 709 bp for lane 4; 936 bp for lane 5; 1,584 bp for lane 6; and 1,942 bp for lane 7. PCR reaction time was 25 min for lanes 1-6 and 30 min for lane 7. As shown, nearly saturated product bands were observed for all amplicons in a short reaction time. This result demonstrates that thermal convection PCR is not only fast and efficient, but also has a wide dynamic range.

2.3. PCR Amplification from Human Genome Sample

FIGS. 52A-E show an example that demonstrates the effect of the gravity tilting angle for amplification from a human genome sample. In this experiment, a 10 ng human genome sample (about 3,000 copies) was used as a template DNA. The forward and reverse primers used in this experiment were 5'-GCTTCTAGGCGGACTATGACTTAGTTGCG-3' (SEQ ID NO: 9) and 5'-CCAAAAGCCTTCATACATCTCAAGTTGGGGG-3' (SEQ ID NO: 8), respectively. A 521 bp segment of β-actin gene was the target. Other experimental conditions were the same as those used for the experiment presented in FIGS. 49A-E and 50A-E above. FIGS. 52A-E show results obtained when $\theta_g$ was set to 0°, 10°, 20°, 30°, and 45°, respectively. As shown in FIG. 52A, no product band was observed even after 30 min reaction time when no gravity tilting angle was used. In contrast, the product band was observed in as little as 20 min reaction time when the gravity tilting angle was introduced (FIGS. 52B-E). Increase of the PCR amplification speed as compared to the zero tilting angle was observed to be similar for the different gravity tilting angles examined (i.e., between about 10° to 45°). Only a slight increase of the PCR speed was observed above 10°.

2.4. PCR Amplification from Various Target Genes of Human Genome

FIGS. 53A-B show further examples of thermal convection PCR amplification from a human genome sample when the gravity tilting angle of 10° was introduced. In these examples, a 10 ng human genome (about 3,000 copies) was used as a template DNA and primers having relatively low melting temperatures (about 54° C.) as compared to the primers used in other examples were used. The temperatures of the first and second heat sources were set to 98° C. and 54° C., respectively. Depth of the receptor hole along the channel axis was about 2.5 mm. FIG. 53A shows amplification results for a 200 bp segment of β-globin gene. The forward and reverse primers used had sequences 5'-CCCATCACTTTGGCAAAGAATTCA-3' (SEQ ID NO: 10) and 5'-GAATCCAGATGCTCAAGGCC-3' (SEQ ID NO: 11), respectively. FIG. 53B shows amplification results for a 514 bp segment of β-actin gene. The forward and reverse primers used had sequences 5'-TTCTAGGCGGACTATGACTTAGTTGCG-3' (SEQ ID NO: 12) and 5'-AGCCTTCATACATCTCAAGTTGGGGG-3' (SEQ ID NO: 13), respectively. As shown in FIGS. 53A-B, the thermal convection PCR yielded very fast amplification for both genes, delivering significant product band intensity in as short as 20 min. In the case of the β-actin sequence, a weak band was observed even at 15 min reaction time.

FIG. 54 shows further examples of thermal convection PCR amplification from 10 ng human genome or cDNA samples when the gravity tilting angle was 10°. The temperatures of the first and second heat sources were set to 98° C. and 64° C., respectively. Depth of the receptor hole along the channel axis was about 2.5 mm. PCR reaction time was 25 min for lanes 10, 11, and 13 and 30 min for other lanes. As shown, all fourteen gene segments with their size ranging from about 100 bp to about 500 bp were successfully amplified in 25 or 30 min reaction time. Target genes and corresponding primer sequences are summarized in Table 2 below. Templates used were human genome DNA (10 ng) for lanes 2, 4-7, and 10-14; and cDNA (10 ng) for lanes 1, 3, 8, and 9. The cDNA samples were prepared by reverse transcription of mRNA extracts from HOS (lanes 1 and 8) or SK-OV-3 (lanes 3 and 9) cells.

TABLE 2

Primer Sequences and Target Genes Used for the Experiments in FIG. 54

| Lane No. | Target Gene | Amplicon Size | SEQ ID NO | Primer Sequence |
|---|---|---|---|---|
| 1 | p53 | 123 bp | 14 | 5'-TGCCCAACAACACCAGCTCCTCT-3' |
| | | | 15 | 5'-CCAAGGCCTCATTCAGCTCTCGGAAC-3' |
| 2 | HER2 | 144 bp | 16 | 5'-CCCCAGCCCTCTGACGTCC-3' |
| | | | 17 | 5'-TCCGTTTCCTGCAGCAGTCTCCG-3' |
| 3 | HER2 | 192 bp | 18 | 5'-AGCACTGGGGAGTCTTTGTGGATTCTGAG-3' |
| | | | 19 | 5'-GGGACAGTCTCTGAATGGGTCGCTTTTGT-3' |
| 4 | MTHFR | 198 bp | 20 | 5'-TGAAGGAGAAGGTGTCTGCGGG-3' |
| | | | 21 | 5'-AGGACGGTGCGGTGAGAGTG-3' |
| 5 | PIGR | 216 bp | 22 | 5'-GGGTCCCGCGATGTCAGCCTAG-3' |
| | | | 23 | 5'-TTCTCCGAGTGGGGAGCCTT-3' |
| 6 | β-actin | 236 bp | 24 | 5'-ACAGGAAGTCCCTTGCCATCC-3' |
| | | | 13 | 5'-AGCCTTCATACATCTCAAGTTGGGGG-3' |
| 7 | GNB3 | 268 bp | 25 | 5'-TGACCCACTTGCCACCCGTGC-3' |
| | | | 26 | 5'-GCAGCAGCCAGGGCTGGC-3' |
| 8 | CDK4 | 284 bp | 27 | 5'- GGTGTTTGAGCATGTAGACCAGGACCTAAGGA-3' |
| | | | 28 | 5'- GAACTTCGGGAGCTCGGTACCAGAGTG-3' |
| 9 | CD24 | 330 bp | 29 | 5'-TCCAAGCACCCAGCATCCTGCTAG-3' |
| | | | 30 | 5'-TGGGGAAATTTAGAAGACGTTTCTTGGCCTGA-3' |
| 10 | CR2 | 405 bp | 31 | 5'-GGGAGGTTGGGGTCTTGCCTTTCTG-3' |
| | | | 32 | 5'-CACCTGTGCTAGACGGTGTTAGCAGC-3' |

TABLE 2-continued

Primer Sequences and Target Genes Used for the Experiments in FIG. 54

| Lane No. | Target Gene | Amplicon Size | SEQ ID NO | Primer Sequence |
|---|---|---|---|---|
| 11 | PIGR | 433 bp | 33 | 5'-GCCACCTACTACCCAGAGGCATTGTG-3' |
| | | | 34 | 5'-TGATGGTCACCGTTCTGCCCAGG-3' |
| 12 | GAPDH | 479 bp | 3 | 5'-GGTGGGCTTGCCCTGTCCAGTTAA-3' |
| | | | 4 | 5'-CCTGGTGACCAGGCGCC-3' |
| 13 | β-globin | 500 bp | 35 | 5'-CTAAGCCAGTGCCAGAAGAGCCAAGGAC-3' |
| | | | 36 | 5'-GCATCAGGAGTGGACAGATCCCCAAAGG-3' |
| 14 | β-actin | 514 bp | 12 | 5'-TTCTAGGCGGACTATGACTTAGTTGCG-3' |
| | | | 13 | 5'-AGCCTTCATACATCTCAAGTTGGGGG-3' |

Abbreviations used in Table 2 are as follows. HER2: ERBB2, v-erb-b2 erythroblastic leukemia viral oncogene homolog 2; MTHFR: 5,10-methylenetetrahydrofolate reductase (NADPH); PIGR: polymeric immunoglobulin receptor; GNB3: guanine nucleotide binding protein, beta polypeptide 3; CDK4: cyclin-dependent kinase 4; CR2: complement receptor 2; GAPDH: glyceraldehydes 3-phosphate dehydrogenase.

2.5. PCR Amplification from Very Low Copies of Human Genome Sample

FIG. 55 shows results of thermal convection PCR amplification from very low copy human genome samples when the gravity tilting angle was used. The primers used had the sequences as set forth in SEQ ID NOs: 7 and 8. The amplification target was a 241 bp segment of β-actin gene. The temperatures of the first and second heat sources were set to 98° C. and 64° C., respectively. Depth of the receptor hole along the channel axis was about 2.5 mm. The gravity tilting angle was set to 10° and the PCR reaction time was set to 25 min. As denoted on the bottom of FIG. 55, amount of the human genome sample used for each reaction was decreased consecutively, starting from 10 ng (about 3,000 copies) to 1 ng (about 300 copies), 0.3 ng (about 100 copies), and 0.1 ng (about 30 copies). As manifested, the thermal convection PCR yielded successful PCR amplification from as little as a 30 copy sample The results presented in this example demonstrate that the gravity tilting angle is an important structural element that can be used to increase the speed of the thermal convection PCR. Moreover, the results suggest that there may be certain limitations (other than the apparatus itself) in speeding up the thermal convection PCR. For instance, the speed of the thermal convection PCR was observed to be about the same when the gravity tilting angle was larger than about 10° or 20° (e.g., see FIGS. 49B-E, 50B-E, and 52B-E). These results demonstrate that the ultimate speed of the thermal convection PCR can be limited by other factors such as the polymerization speed of the DNA polymerase and the property of the target template although the convection speed of the invention apparatus can be increased as fast as desired.

Example 3. Thermal Convection PCR Using Apparatuses Having Structural Asymmetry Two types of apparatuses were used in this example. The first apparatus used in this example had the same structure as that used in Example 1 (i.e., the structure shown in FIG. 5A), but with slightly different dimensions. The first insulator had a smaller length along the channel axis 80 near the channel region as compared to the apparatus used in Example 1. The length along the channel axis 80 near the channel region (i.e., within the protrusion region) was about 0.5 mm that was smaller than the about 1.5 mm length of the apparatus used in Example 1. The length of the first insulator along the channel axis 80 outside the channel region (i.e., outside the protrusion region) was the same (i.e., about 9.5 mm to about 8 mm depending on position). The length of the first and second heat sources along the channel axis 80 were about 4 mm and about 11.5 mm, respectively. The first chamber 100 was located on the lower part of the second heat source 30 as shown in FIG. 5A and had a cylindrical shape with a length along the channel axis 80 of about 7.5 mm and a diameter of about 4 mm. The depth of the receptor hole 73 along the channel axis 80 was about 2.5 mm for the data presented in this example although it was varied between from about 1.5 mm to about 3 mm. The channel 70 had a tapered cylinder shape with an average diameter of about 2 mm and the diameter at the bottom end (in the receptor hole) of about 1.5 mm. In this apparatus, all the temperature shaping elements including the first chamber, the receptor hole, the first insulator, and the protrusions of the first and second heat sources were disposed symmetrically with respect to the channel axis.

The second apparatus used had an asymmetric chamber having a structure shown in FIG. 20A. The first chamber 100 located on the lower part of the second heat source was off-centered with respect to the channel axis by about 0.8 mm as shown in FIG. 20A. Hence, the first protrusion 33 of the second heat source was also off-centered with respect to the channel axis by 0.8 mm. Other structures and dimensions of the second apparatus were identical to those of the first apparatus described above. In the second apparatus, the first chamber 100 and the first protrusion 33 of the second heat source were disposed asymmetrically (i.e., off-centered) with respect to the channel axis, while the receptor hole in the first heat source and the through hole in the second heat source were disposed symmetrically with respect to the channel axis.

As presented below, presence of the structural asymmetry was found to increase the speed of the thermal convection PCR substantially. Hence, it is demonstrated that the asymmetric structural elements such as asymmetric chamber, asymmetric receptor hole, asymmetric thermal brake, asymmetric insulator, asymmetric protrusions, etc. are useful structural elements. Such asymmetric structural elements can be used alone or in combination with other temperature shaping elements and/or the gravity tilting angle to modulate (typically to increase) the speed of the thermal convection PCR as desired.

3.1. PCR Amplification from Plasmid Sample

Template DNA used in this example was a 1 ng plasmid DNA. Two primers having the sequences as set forth in SEQ ID NOs: 1 and 2 were used. The expected size of the amplicon was 349 bp. The temperatures of the first and second heat sources were set to 98° C. and 64° C., respectively. No gravity tilting angle was introduced.

FIG. 56A shows the results obtained with the first apparatus having all the temperature shaping elements that are disposed symmetrically with respect to the channel axis. As shown, a very weak product band was observed at 15 min reaction time and strong bands were observed after 20 min.

FIG. 56B show the results obtained with the second apparatus that had the asymmetric chamber structure. As described above, the first chamber was off-centered by about 0.8 mm with respect to the channel axis. As shown in FIG. 56B, the PCR amplification became faster and more efficient as compared to the results obtained with the symmetric apparatus (FIG. 56A). A weak product band was observed even at 10 min reaction time, demonstrating reduction of the PCR reaction time by about 5 to 10 min. As manifested, the small horizontal asymmetry in the first chamber was sufficient to accelerate the thermal convection PCR dramatically.

3.2. PCR Amplification from Human Genome Sample

FIGS. 57A-B and 58A-B show the results obtained for two human genome targets, a 241 bp segment of β-actin and a 216 bp segment of PIGR, respectively. Primers used for the results shown in FIGS. 57A-B had the sequences as set forth in SEQ ID NOs: 7 and 8. Primers used for the results shown in FIGS. 58A-B had the sequences as set forth in SEQ ID NOs: 22 and 23. Amount of the human genome sample used for each reaction was 10 ng corresponding to about 3,000 copies.

As shown in FIGS. 57A-B for amplification of the β-actine sequence, the second apparatus comprising the asymmetric heating structure (i.e., having the off-centered first chamber) delivered faster and more efficient PCR amplification (FIG. 57B) as compared to the first apparatus having the symmetric heating structure (FIG. 57A). A weak product band was observed at 25 min reaction time when the symmetric heating structure was used (FIG. 57A). However, when the asymmetric chamber structure was used (FIG. 57B), the product band became much stronger at the same 25 min reaction time and it became observable at 20 min.

As shown in FIGS. 58A-B, similar results were obtained when the target was changed to the PIGR sequence. With the symmetric heating structure (FIG. 58A), the product was observed as a weak band at 25 min. However, with the asymmetric chamber structure (FIG. 58B), the product band became saturated at the same 25 min reaction time and it became observable as a weak band at 20 min.

The disclosures of all references mentioned herein (including all patent and scientific documents) are incorporated herein by reference. The invention has been described in detail with reference to particular embodiments thereof. However, it will be appreciated that those skilled in the art, upon consideration of this disclosure, may make modifications and improvements within the spirit and scope of the invention.

SEQUENCE LISTING

```
<160> NUMBER OF SEQ ID NOS: 36

<210> SEQ ID NO 1
<211> LENGTH: 21
<212> TYPE: DNA
<213> ORGANISM: Artificial Sequence
<220> FEATURE:
<223> OTHER INFORMATION: plasmid forward primer

<400> SEQUENCE: 1

gggagaccca agctggctag c                                                21


<210> SEQ ID NO 2
<211> LENGTH: 22
<212> TYPE: DNA
<213> ORGANISM: Artificial Sequence
<220> FEATURE:
<223> OTHER INFORMATION: plasmid reverse primer

<400> SEQUENCE: 2

cacagtcgag gctgatcagc gg                                               22


<210> SEQ ID NO 3
<211> LENGTH: 24
<212> TYPE: DNA
<213> ORGANISM: Artificial Sequence
<220> FEATURE:
<223> OTHER INFORMATION: GAPDH forward primer

<400> SEQUENCE: 3

ggtgggcttg ccctgtccag ttaa                                             24


<210> SEQ ID NO 4
<211> LENGTH: 17
<212> TYPE: DNA
<213> ORGANISM: Artificial Sequence
```

<220> FEATURE:
<223> OTHER INFORMATION: GAPDH reverse primer

<400> SEQUENCE: 4 cctggtgacc aggcgcc 17

<210> SEQ ID NO 5
<211> LENGTH: 19
<212> TYPE: DNA
<213> ORGANISM: Artificial Sequence
<220> FEATURE:
<223> OTHER INFORMATION: beta-globin forward primer

<400> SEQUENCE: 5 gcatcaggag tggacagat 19

<210> SEQ ID NO 6
<211> LENGTH: 19
<212> TYPE: DNA
<213> ORGANISM: Artificial Sequence
<220> FEATURE:
<223> OTHER INFORMATION: beta-globin reverse primer

<400> SEQUENCE: 6 agggcagagc catctattg 19

<210> SEQ ID NO 7
<211> LENGTH: 28
<212> TYPE: DNA
<213> ORGANISM: Artificial Sequence
<220> FEATURE:
<223> OTHER INFORMATION: beta-actin forward primer

<400> SEQUENCE: 7 acaggaagtc ccttgccatc ctaaaagc 28

<210> SEQ ID NO 8
<211> LENGTH: 31
<212> TYPE: DNA
<213> ORGANISM: Artificial Sequence
<220> FEATURE:
<223> OTHER INFORMATION: beta-actin reverse primer

<400> SEQUENCE: 8 ccaaaagcct tcatacatct caagttgggg g 31

<210> SEQ ID NO 9
<211> LENGTH: 29
<212> TYPE: DNA
<213> ORGANISM: Artificial Sequence
<220> FEATURE:
<223> OTHER INFORMATION: beta-actin forward primer

<400> SEQUENCE: 9 gcttctaggc ggactatgac ttagttgcg 29

<210> SEQ ID NO 10
<211> LENGTH: 24
<212> TYPE: DNA
<213> ORGANISM: Artificial Sequence
<220> FEATURE:
<223> OTHER INFORMATION: beta-globin forward primer

<400> SEQUENCE: 10 cccatcactt tggcaaagaa ttca 24

<210> SEQ ID NO 11
<211> LENGTH: 20
<212> TYPE: DNA
<213> ORGANISM: Artificial Sequence
<220> FEATURE:
<223> OTHER INFORMATION: beta-globin reverse primer

<400> SEQUENCE: 11 gaatccagat gctcaaggcc 20

<210> SEQ ID NO 12
<211> LENGTH: 27
<212> TYPE: DNA
<213> ORGANISM: Artificial Sequence
<220> FEATURE:
<223> OTHER INFORMATION: beta-actin forward primer

<400> SEQUENCE: 12 ttctaggcgg actatgactt agttgcg 27

<210> SEQ ID NO 13
<211> LENGTH: 26
<212> TYPE: DNA
<213> ORGANISM: Artificial Sequence
<220> FEATURE:
<223> OTHER INFORMATION: beta-actin reverse primer

<400> SEQUENCE: 13 agccttcata catctcaagt tggggg 26

<210> SEQ ID NO 14
<211> LENGTH: 23
<212> TYPE: DNA
<213> ORGANISM: Artificial Sequence
<220> FEATURE:
<223> OTHER INFORMATION: p53 forward primer

<400> SEQUENCE: 14 tgcccaacaa caccagctcc tct 23

<210> SEQ ID NO 15
<211> LENGTH: 26
<212> TYPE: DNA
<213> ORGANISM: Artificial Sequence
<220> FEATURE:
<223> OTHER INFORMATION: p53 reverse primer

<400> SEQUENCE: 15 ccaaggcctc attcagctct cggaac 26

<210> SEQ ID NO 16
<211> LENGTH: 19
<212> TYPE: DNA
<213> ORGANISM: Artificial Sequence
<220> FEATURE:
<223> OTHER INFORMATION: HER2 forward primer

<400> SEQUENCE: 16 ccccagccct ctgacgtcc 19

<210> SEQ ID NO 17
<211> LENGTH: 23
<212> TYPE: DNA
<213> ORGANISM: Artificial Sequence
<220> FEATURE:
<223> OTHER INFORMATION: HER2 reverse primer

<400> SEQUENCE: 17 tccgtttcct gcagcagtct ccg 23

<210> SEQ ID NO 18
<211> LENGTH: 29
<212> TYPE: DNA
<213> ORGANISM: Artificial Sequence
<220> FEATURE:
<223> OTHER INFORMATION: HER2 forward primer

<400> SEQUENCE: 18 agcactgggg agtctttgtg gattctgag 29

<210> SEQ ID NO 19
<211> LENGTH: 29
<212> TYPE: DNA
<213> ORGANISM: Artificial Sequence
<220> FEATURE:
<223> OTHER INFORMATION: HER2 reverse primer

<400> SEQUENCE: 19 gggacagtct ctgaatgggt cgcttttgt 29

<210> SEQ ID NO 20
<211> LENGTH: 22
<212> TYPE: DNA
<213> ORGANISM: Artificial Sequence
<220> FEATURE:
<223> OTHER INFORMATION: MTHFR forward primer

<400> SEQUENCE: 20 tgaaggagaa ggtgtctgcg gg 22

<210> SEQ ID NO 21
<211> LENGTH: 20
<212> TYPE: DNA
<213> ORGANISM: Artificial Sequence
<220> FEATURE:
<223> OTHER INFORMATION: MTHFR reverse primer

<400> SEQUENCE: 21 aggacggtgc ggtgagagtg 20

<210> SEQ ID NO 22
<211> LENGTH: 22
<212> TYPE: DNA
<213> ORGANISM: Artificial Sequence
<220> FEATURE:
<223> OTHER INFORMATION: PIGR forward primer

<400> SEQUENCE: 22 gggtcccgcg atgtcagcct ag 22

<210> SEQ ID NO 23
<211> LENGTH: 20
<212> TYPE: DNA
<213> ORGANISM: Artificial Sequence
<220> FEATURE:
<223> OTHER INFORMATION: PIGR reverse primer

<400> SEQUENCE: 23 ttctccgagt ggggagcctt 20

<210> SEQ ID NO 24
<211> LENGTH: 21
<212> TYPE: DNA
<213> ORGANISM: Artificial Sequence
<220> FEATURE:
<223> OTHER INFORMATION: beta-actin forward primer

<400> SEQUENCE: 24 acaggaagtc ccttgccatc c 21

<210> SEQ ID NO 25
<211> LENGTH: 21
<212> TYPE: DNA
<213> ORGANISM: Artificial Sequence
<220> FEATURE:
<223> OTHER INFORMATION: GNB3 forward primer

<400> SEQUENCE: 25 tgacccactt gccacccgtg c 21

<210> SEQ ID NO 26
<211> LENGTH: 18
<212> TYPE: DNA
<213> ORGANISM: Artificial Sequence
<220> FEATURE:
<223> OTHER INFORMATION: GNB3 reverse primer

<400> SEQUENCE: 26 gcagcagcca gggctggc 18

<210> SEQ ID NO 27
<211> LENGTH: 32
<212> TYPE: DNA
<213> ORGANISM: Artificial Sequence
<220> FEATURE:
<223> OTHER INFORMATION: CDK4 forward primer

<400> SEQUENCE: 27 ggtgtttgag catgtagacc aggacctaag ga 32

<210> SEQ ID NO 28
<211> LENGTH: 27
<212> TYPE: DNA
<213> ORGANISM: Artificial Sequence
<220> FEATURE:
<223> OTHER INFORMATION: CDK4 reverse primer

<400> SEQUENCE: 28 gaacttcggg agctcggtac cagagtg 27

<210> SEQ ID NO 29
<211> LENGTH: 24
<212> TYPE: DNA
<213> ORGANISM: Artificial Sequence
<220> FEATURE:
<223> OTHER INFORMATION: CD24 forward primer

<400> SEQUENCE: 29 tccaagcacc cagcatcctg ctag 24

<210> SEQ ID NO 30
<211> LENGTH: 32
<212> TYPE: DNA
<213> ORGANISM: Artificial Sequence
<220> FEATURE:
<223> OTHER INFORMATION: CD24 reverse primer

<400> SEQUENCE: 30 tggggaaatt tagaagacgt ttcttggcct ga 32

<210> SEQ ID NO 31
<211> LENGTH: 25
<212> TYPE: DNA
<213> ORGANISM: Artificial Sequence
<220> FEATURE:
<223> OTHER INFORMATION: CR2 forward primer

<400> SEQUENCE: 31 gggaggttgg ggtcttgcct ttctg 25

<210> SEQ ID NO 32
<211> LENGTH: 26
<212> TYPE: DNA
<213> ORGANISM: Artificial Sequence
<220> FEATURE:
<223> OTHER INFORMATION: CR2 reverse primer

<400> SEQUENCE: 32 cacctgtgct agacggtgtt agcagc 26

<210> SEQ ID NO 33
<211> LENGTH: 26
<212> TYPE: DNA
<213> ORGANISM: Artificial Sequence
<220> FEATURE:
<223> OTHER INFORMATION: PIGR forward primer

<400> SEQUENCE: 33 gccacctact acccagaggc attgtg 26

<210> SEQ ID NO 34
<211> LENGTH: 23
<212> TYPE: DNA
<213> ORGANISM: Artificial Sequence
<220> FEATURE:
<223> OTHER INFORMATION: PIGR reverse primer

<400> SEQUENCE: 34 tgatggtcac cgttctgccc agg 23

<210> SEQ ID NO 35
<211> LENGTH: 28
<212> TYPE: DNA
<213> ORGANISM: Artificial Sequence
<220> FEATURE:
<223> OTHER INFORMATION: beta-globin forward primer

<400> SEQUENCE: 35 ctaagccagt gccagaagag ccaaggac 28

<210> SEQ ID NO 36
<211> LENGTH: 28
<212> TYPE: DNA
<213> ORGANISM: Artificial Sequence
<220> FEATURE:
<223> OTHER INFORMATION: beta-globin reverse primer

<400> SEQUENCE: 36 gcatcaggag tggacagatc cccaaagg 28

What is claimed is:

1. An apparatus adapted to perform thermal convection PCR comprising:

(a) a first heat source for heating or cooling a channel and comprising a top surface and a bottom surface, the channel being adapted to receive a reaction vessel for performing PCR, (b) a second heat source for heating or cooling the channel and comprising a top surface and a bottom surface, the bottom surface facing the top surface of the first heat source, wherein the channel is defined by a bottom end contacting the first heat source and a through hole contiguous with the top surface of the second heat source, and further wherein center points between the bottom end and the through hole form a channel axis about which the channel is disposed, (c) at least one chamber positioned exclusively within the second heat source and disposed around at least part of the channel, the chamber comprising a permanent chamber gap between the second heat source and the channel sufficient to reduce heat transfer between the second heat source and the channel, (d) a receptor hole adapted to receive the channel within the first heat source, wherein the receptor hole, the through hole and the chamber contact the channel during the thermal convection PCR, the contacting being sufficient to support PCR amplification by thermal convection within the reaction vessel; and (e) wherein the apparatus further comprises at least one chamber disposed around the channel within the first heat source.

2. The apparatus of claim 1, wherein the apparatus comprises a first insulator positioned between the top surface of the first heat source and the bottom surface of the second heat source.

3. The apparatus of claim 1, wherein a first chamber is positioned in the second heat source and comprises a first chamber top end facing a first chamber bottom end along the channel axis and at least one chamber wall disposed around the channel axis.

4. The apparatus of claim 3, wherein the first chamber wall is disposed essentially parallel to the channel axis.

5. The apparatus of claim 2, wherein the first insulator comprises a solid or a gas.

6. The apparatus of claim 3, wherein the first chamber comprises a solid or a gas.

7. The apparatus of claim 6, wherein the apparatus further comprises a first insulator positioned between the top surface of the first heat source and the bottom surface of the second heat source and the first insulator comprises a solid or a gas.

8. The apparatus of any of claims 5-7, wherein the gas is air.

9. The apparatus of claim 1, wherein the bottom end of the channel is rounded, flat or curved.

10. The apparatus of claim 3, wherein the first chamber is disposed essentially symmetrically about the channel along a plane perpendicular to the channel axis.

11. The apparatus of claim 3, wherein at least part of the first chamber is disposed asymmetrically about the channel along a plane perpendicular to the channel axis.

12. The apparatus of any of claims 10-11, wherein at least part of the first chamber is tapered along the channel axis.

13. The apparatus of any of claims 10-11, wherein the apparatus further comprises a second chamber exclusively positioned within the second heat source and the first chamber has a width (w) perpendicular to the channel axis that is different from the width (w) of the second chamber.

14. The apparatus of claim 1, wherein the second heat source comprises at least one protrusion extending toward the first heat source or away from the top surface of the second heat source.

15. The apparatus of claim 1, wherein the first heat source comprises at least one protrusion extending toward the second heat source or away from the bottom surface of the first heat source.

16. The apparatus of claim 1, wherein the apparatus is adapted so that the channel axis is tilted with respect to the direction of gravity.

17. The apparatus of claim 16, wherein the channel axis is perpendicular to the top or bottom surface of any of the first and second heat sources, and the apparatus is tilted.

18. The apparatus of claim 16, wherein the channel axis is tilted from a direction perpendicular to the top or bottom surface of any of the first and second heat sources.

19. The apparatus of claim 1, wherein the apparatus is adapted to generate a centrifugal force inside the channel so as to modulate the convection PCR; and the apparatus further comprises means for generating the centrifugal force.

20. The apparatus of claim 1 further comprising at least one optical detection unit.

21. The apparatus of claim 3, wherein the first chamber bottom end is located at about the same height as the bottom surface of the second heat source.

22. The apparatus of claim 21 further comprising at least one optical detection unit.

23. The apparatus of claim 1 wherein at least part of each of the first and second heat sources is in physical contact with the channel and the chamber is in thermal contact with the channel during the thermal convection PCR, the contacts being sufficient to support the PCR amplification by thermal convection within the reaction vessel.

24. A method for performing a polymerase chain reaction (PCR) by thermal convection using the apparatus of claim 1, the method comprising at least one of the following steps:

(a) maintaining the first heat source comprising the receptor hole at a temperature range suitable for denaturing a double-stranded nucleic acid molecule and forming a single-stranded template, (b) maintaining the second heat source at a temperature range suitable for annealing at least one oligonucleotide primer to the single-stranded template; and (c) producing the thermal convection PCR between the receptor hole and the second heat source under conditions sufficient to produce the primer extension product.

* * * * *